US009861850B1

(12) United States Patent
Webber et al.

(10) Patent No.: US 9,861,850 B1
(45) **Date of Patent: *Jan. 9, 2018**

(54) EXERCISE MACHINE WITH LIFTING ARM

(71) Applicant: Hoist Fitness Systems, Inc., Poway, CA (US)

(72) Inventors: Randall T. Webber, La Jolla, CA (US); Bruce Hockridge, San Diego, CA (US); Jeffrey O. Meredith, San Diego, CA (US)

(73) Assignee: HOIST FITNESS SYSTEMS, INC., Poway, CA (US)

( * ) Notice: Subject to any disclaimer, the term of this patent is extended or adjusted under 35 U.S.C. 154(b) by 464 days.

This patent is subject to a terminal disclaimer.

(21) Appl. No.: 14/506,676

(22) Filed: Oct. 5, 2014

Related U.S. Application Data

(63) Continuation of application No. 13/078,627, filed on Apr. 1, 2011, now Pat. No. 8,870,720, which is a continuation of application No. 12/253,392, filed on Oct. 17, 2008, now Pat. No. 7,938,760.

(51) Int. Cl.
*A63B 21/06* (2006.01)
*A63B 21/00* (2006.01)
*A63B 23/12* (2006.01)

(52) U.S. Cl.
CPC ..... *A63B 21/0615* (2013.01); *A63B 21/159* (2013.01); *A63B 21/4047* (2015.10); *A63B 21/4031* (2015.10); *A63B 23/12* (2013.01)

(58) Field of Classification Search
CPC ..... A63B 21/0615; A63B 21/159; A63B 21/4047; A63B 23/12; A63B 21/4031
See application file for complete search history.

(56) References Cited

U.S. PATENT DOCUMENTS

| | | | |
|---|---|---|---|
| 248,121 | A | 10/1881 | Tuttle |
| 2,145,940 | A | 2/1939 | Marlowe |
| 2,252,156 | A | 8/1941 | Bell |
| 3,116,062 | A | 12/1963 | Zinkin |
| 3,207,464 | A | 9/1965 | Hrach |
| 3,367,613 | A | 2/1968 | Christensen |

(Continued)

FOREIGN PATENT DOCUMENTS

| | | |
|---|---|---|
| CA | 2075331 | 2/1994 |
| GB | 2162075 | 1/1986 |
| SU | 1674874 A1 | 9/1991 |

OTHER PUBLICATIONS

Body Masters brochure, 2002, 1 page.

(Continued)

*Primary Examiner* — Sundhara Ganesan
(74) *Attorney, Agent, or Firm* — Gordon Rees Scully Mansukhani LLP; David R. Heckadon

(57) ABSTRACT

An exercise machine has a main frame and a user support movably mounted relative to the main frame for movement between a start position and an end position during an exercise. At least one user engagement device is movably mounted relative to the main frame for engagement and actuation by a user during an exercise, and a connecting linkage translates movement of the user engagement device to movement of the user support. A lifting arm is movably mounted relative to the main frame and associated with at least one of the user support, user engagement device, and connecting linkage so as to move during an exercise. A load associated with the lifting arm provides exercise resistance.

19 Claims, 121 Drawing Sheets

(56) References Cited

U.S. PATENT DOCUMENTS 3,446,503 A 5/1969 Lawton
3,592,465 A 7/1971 Fulkerson, Jr.
3,640,528 A 2/1972 Proctor
3,707,285 A 12/1972 Martin
3,917,262 A 11/1975 Salkeld
3,999,702 A 12/1976 Conroy
4,004,801 A 1/1977 Campanaro et al.
4,111,414 A 9/1978 Roberts
4,149,714 A 4/1979 Lambert, Jr.
4,231,568 A 11/1980 Riley et al.
4,300,760 A 11/1981 Bobroff
4,336,934 A 6/1982 Hanagan et al.
4,387,893 A 6/1983 Baldwin
4,390,179 A 6/1983 Szkalak
4,441,708 A 4/1984 Brentham
4,448,412 A 5/1984 Brentham
4,468,025 A 8/1984 Sferle
4,478,411 A 10/1984 Baldwin
4,500,089 A 2/1985 Jones
4,511,137 A 4/1985 Jones
4,577,861 A 3/1986 Bangerter et al.
4,598,907 A 7/1986 Ross
4,623,144 A 11/1986 Rockwell
4,627,619 A 12/1986 Rockwell et al.
4,632,390 A 12/1986 Richey
4,641,833 A 2/1987 Threthewey
4,666,152 A 5/1987 Jones
4,678,185 A 7/1987 Mahnke
4,684,126 A 8/1987 Dalebout et al.
4,700,946 A 10/1987 Breunig
4,743,010 A 5/1988 Geraci
4,790,530 A 12/1988 Maag
4,793,608 A 12/1988 Mahnke et al.
4,822,038 A 4/1989 Maag
D301,597 S 6/1989 Lehtonen
4,836,536 A 6/1989 Jones
4,844,456 A 7/1989 Habing et al.
4,858,915 A 8/1989 Szabo
D303,558 S 9/1989 Alessandri
D306,052 S 2/1990 Brentham
4,911,438 A 3/1990 Van Straaten
4,915,377 A 4/1990 Malnke et al.
4,917,379 A 4/1990 Maag
4,943,051 A 7/1990 Haskins et al.
4,949,951 A 8/1990 Deola
4,949,958 A 8/1990 Richey
5,007,675 A 4/1991 Musto et al.
5,011,139 A 4/1991 Towley
5,050,873 A 9/1991 Jones
5,052,684 A 10/1991 Kosuge et al.
5,056,779 A 10/1991 Webb
5,066,003 A 11/1991 Jones
5,066,004 A 11/1991 Jones
5,094,449 A 3/1992 Stearns
5,100,128 A 3/1992 Mabry
5,106,081 A 4/1992 Webb
5,108,095 A 4/1992 Nichols
5,167,364 A 12/1992 Wenning
5,217,422 A 6/1993 Domzalski
5,221,245 A 6/1993 Yeh
5,236,406 A 8/1993 Webber
5,250,013 A 10/1993 Brangi
5,254,067 A 10/1993 Habing et al.
5,263,914 A 11/1993 Simonson et al.
5,267,930 A 12/1993 Henes
5,299,997 A 4/1994 Chen
5,304,107 A 4/1994 Jones
5,322,489 A 6/1994 Webb
5,330,404 A 7/1994 Lopeteguy et al.
5,330,405 A 7/1994 Habing et al.
5,334,120 A 8/1994 Rasmussen
5,342,269 A 8/1994 Huang et al.
5,342,270 A 8/1994 Jones
5,346,447 A 9/1994 Stearns
5,356,357 A 10/1994 Wang et al.
5,356,358 A 10/1994 Chen
5,360,383 A 11/1994 Boren
5,366,432 A 11/1994 Habing et al.
5,387,171 A 2/1995 Casey et al.
5,401,227 A 3/1995 Webber
D357,041 S 4/1995 McBride et al.
5,409,440 A 4/1995 Yang
5,417,633 A 5/1995 Habing
5,417,634 A 5/1995 Habing
5,419,751 A 5/1995 Byrd et al.
5,421,796 A 6/1995 Jones et al.
5,437,589 A 8/1995 Habing
5,447,480 A 9/1995 Fulks
5,453,066 A 9/1995 Richter, Jr.
5,458,553 A 10/1995 Wu
5,478,298 A 12/1995 Chen
5,484,365 A 1/1996 Jones et al.
5,486,150 A 1/1996 Randolph
5,498,222 A 3/1996 Hur
5,499,959 A 3/1996 Holmes et al.
5,503,608 A 4/1996 Chang
5,505,679 A 4/1996 McBride et al.
5,507,710 A 4/1996 Chen
5,518,477 A 5/1996 Simonson
5,520,599 A 5/1996 Chen
5,527,243 A 6/1996 Chen
5,527,249 A 6/1996 Harris
5,527,250 A 6/1996 Chen
5,533,953 A 7/1996 Lui et al.
5,540,639 A 7/1996 Potts et al.
D372,509 S 8/1996 Yang
5,547,443 A 8/1996 Chen
5,547,444 A 8/1996 Huang
5,549,530 A 8/1996 Fulks
5,549,533 A 8/1996 Olson et al.
5,554,086 A 9/1996 Habing et al.
5,554,090 A 9/1996 Jones
5,562,577 A 10/1996 Nichols et al.
5,573,482 A 11/1996 Wang et al.
5,575,743 A 11/1996 Jones et al.
5,575,744 A 11/1996 Jones et al.
5,577,987 A 11/1996 Brown
5,580,340 A 12/1996 Yu
5,580,341 A 12/1996 Simonson
5,582,563 A 12/1996 Fan
5,595,558 A 1/1997 Moon
5,597,375 A 1/1997 Simonson
5,603,678 A 2/1997 Wilson
5,616,105 A 4/1997 Wang et al.
5,616,107 A 4/1997 Simonson
5,620,402 A 4/1997 Simonson
5,626,542 A 5/1997 Dalebout et al.
5,628,715 A 5/1997 Simonson
5,643,147 A 7/1997 Huang
5,643,152 A 7/1997 Simonson
5,658,227 A 8/1997 Stearns
D383,814 S 9/1997 Ward
D384,118 S 9/1997 Deblauw
5,669,865 A 9/1997 Gordon
5,672,142 A 9/1997 Wu
5,674,161 A 10/1997 Lin
5,676,626 A 10/1997 Huang
5,681,247 A 10/1997 Webber
5,681,250 A 10/1997 Hoover et al.
5,683,334 A 11/1997 Webber
5,690,593 A 11/1997 Huang
5,692,997 A 12/1997 Stearns
5,695,434 A 12/1997 Dalebout et al.
5,695,435 A 12/1997 Dalebout et al.
5,702,328 A 12/1997 Mansvelt
5,711,749 A 1/1998 Miller
5,720,695 A 2/1998 Eckmann
5,722,918 A 3/1998 Lee
5,733,229 A 3/1998 Dalebout et al.
5,733,232 A 3/1998 Hsu
5,749,813 A 5/1998 Domzalski
5,800,321 A 9/1998 Webber
5,803,882 A 9/1998 Habing et al.
5,810,698 A 9/1998 Hullett et al.

(56) References Cited

U.S. PATENT DOCUMENTS

| | | | |
|---|---|---|---|
| 5,810,701 | A | 9/1998 | Ellis et al. |
| 5,827,158 | A | 10/1998 | Drecksel |
| 5,833,585 | A | 11/1998 | Jones et al. |
| 5,876,095 | A | 3/1999 | Johnston |
| 5,885,193 | A | 3/1999 | Habing et al. |
| D408,875 | S | 4/1999 | Anderson |
| 5,897,467 | A | 4/1999 | Habing et al. |
| 5,897,473 | A | 4/1999 | Koenig |
| 5,899,836 | A | 5/1999 | Chen |
| 5,906,564 | A | 5/1999 | Jacobsen |
| 5,916,072 | A | 6/1999 | Webber |
| 5,938,570 | A | 8/1999 | Maresh |
| 5,938,571 | A | 8/1999 | Stevens |
| 5,938,575 | A | 8/1999 | Stearns |
| 5,944,641 | A | 8/1999 | Habing |
| 5,961,427 | A | 10/1999 | Habing et al. |
| 5,961,428 | A | 10/1999 | Webber |
| 5,967,954 | A | 10/1999 | Habing |
| 5,971,895 | A | 10/1999 | Habing |
| 5,971,901 | A | 10/1999 | Shaw |
| 5,989,165 | A | 11/1999 | Gianelli et al. |
| 5,997,446 | A | 12/1999 | Stearns |
| 5,997,447 | A | 12/1999 | Gianelli et al. |
| 6,004,247 | A | 12/1999 | Webber |
| 6,015,370 | A | 1/2000 | Pandozy |
| 6,024,677 | A | 2/2000 | Siwertz |
| 6,030,322 | A | 2/2000 | Webber |
| 6,056,675 | A | 5/2000 | Aruin et al. |
| 6,056,678 | A | 5/2000 | Giannelli |
| 6,071,216 | A | 6/2000 | Gianelli et al. |
| 6,074,328 | A | 6/2000 | Johnson |
| 6,080,091 | A | 6/2000 | Habing et al. |
| 6,086,521 | A | 7/2000 | Solland |
| 6,090,020 | A | 7/2000 | Webber |
| 6,120,419 | A | 9/2000 | Huang |
| 6,135,930 | A | 10/2000 | Kuo |
| 6,142,914 | A | 11/2000 | Crawford et al. |
| 6,142,917 | A | 11/2000 | Gianelli et al. |
| 6,152,864 | A | 11/2000 | Gianelli et al. |
| 6,162,153 | A | 12/2000 | Perez et al. |
| 6,168,557 | B1 | 1/2001 | Liao |
| 6,171,219 | B1 | 1/2001 | Simonson |
| 6,186,926 | B1 | 2/2001 | Ellis |
| 6,220,993 | B1 | 4/2001 | Sencil |
| 6,244,995 | B1 | 6/2001 | Prsala |
| 6,244,996 | B1 | 6/2001 | Sencil |
| 6,248,047 | B1 | 6/2001 | Abdo |
| 6,251,047 | B1 | 6/2001 | Stearns et al. |
| 6,254,516 | B1 | 7/2001 | Giannelli et al. |
| 6,264,588 | B1 | 7/2001 | Ellis |
| 6,287,241 | B1 | 9/2001 | Ellis |
| 6,302,832 | B1 | 10/2001 | Stearns |
| 6,302,833 | B1 | 10/2001 | Ellis et al. |
| 6,312,366 | B1 | 11/2001 | Prusick |
| 6,319,178 | B1 | 11/2001 | Webber |
| 6,340,342 | B1 | 1/2002 | Lee |
| 6,350,219 | B1 | 2/2002 | Hobson |
| 6,387,020 | B1 | 5/2002 | Simonson |
| 6,394,937 | B1 | 5/2002 | Voris |
| 6,468,191 | B1 | 10/2002 | Cameron |
| 6,475,120 | B2 | 11/2002 | Johnston |
| 6,475,123 | B1 | 11/2002 | Evans |
| 6,478,721 | B1 | 11/2002 | Hunter |
| 6,491,609 | B2 | 12/2002 | Webber |
| 6,491,611 | B1 | 12/2002 | Stearns |
| 6,517,468 | B1 | 2/2003 | Lapcevic |
| RE38,057 | E | 4/2003 | Pandozy |
| 6,544,154 | B2 | 4/2003 | Forcillo |
| 6,561,960 | B2 | 5/2003 | Webber |
| 6,579,213 | B1 | 6/2003 | Webber et al. |
| 6,605,022 | B2 | 8/2003 | Webber |
| 6,605,024 | B2 | 8/2003 | Stearns |
| D481,428 | S | 10/2003 | Giannelli et al. |
| 6,659,919 | B2 | 12/2003 | Deola |
| 6,676,573 | B2 | 1/2004 | Abelbeck et al. |
| 6,676,577 | B2 | 1/2004 | Stearns |
| D490,128 | S | 5/2004 | Giannelli et al. |
| 6,743,158 | B2 | 6/2004 | Giannelli et al. |
| 6,752,748 | B1 | 6/2004 | Scotti |
| 6,770,017 | B1 | 8/2004 | Leipheimer |
| 6,811,522 | B1 | 11/2004 | McQuinn |
| 6,855,098 | B2 | 2/2005 | Reitz et al. |
| 6,913,565 | B2 | 7/2005 | Mitchell et al. |
| 6,916,278 | B2 | 7/2005 | Webber |
| 6,966,872 | B2 | 11/2005 | Eschenbach |
| D513,293 | S | 12/2005 | Panatta |
| 6,971,978 | B2 | 12/2005 | Hyder |
| 6,988,977 | B2 | 1/2006 | Webber et al. |
| D520,084 | S | 5/2006 | McVay et al. |
| 7,052,444 | B2 | 5/2006 | Webber |
| 7,052,446 | B2 | 5/2006 | Morris et al. |
| 7,070,545 | B2 | 7/2006 | Lull et al. |
| 7,108,641 | B2 | 9/2006 | Pertegaz-Esteban |
| 7,141,003 | B2 | 11/2006 | Wu |
| 7,141,008 | B2 | 11/2006 | Krull et al. |
| 7,150,702 | B2 | 12/2006 | Webb et al. |
| 7,166,066 | B2 | 1/2007 | Webber |
| 7,220,221 | B2 | 5/2007 | Mosimann et al. |
| 7,223,213 | B2 | 5/2007 | Golesh |
| 7,229,389 | B2 | 6/2007 | Hong |
| 7,322,906 | B2 | 1/2008 | Webber |
| 7,331,911 | B2 | 2/2008 | Webber et al. |
| 7,335,140 | B2 | 2/2008 | Webber et al. |
| 7,357,761 | B2 | 4/2008 | Mattox |
| 7,357,768 | B2 | 4/2008 | Marshall |
| 7,361,125 | B2 | 4/2008 | Webber et al. |
| 7,384,381 | B2 | 6/2008 | Webber et al. |
| 7,468,024 | B2 | 12/2008 | Webber et al. |
| 7,553,263 | B2 | 6/2009 | Webb et al. |
| 7,563,209 | B2 | 7/2009 | Webber et al. |
| 7,594,880 | B2 | 9/2009 | Webber et al. |
| 7,938,760 | B1 | 5/2011 | Webber et al. |
| 8,425,384 | B2 | 4/2013 | Garner |
| 2002/0013199 | A1 | 1/2002 | Giannelli et al. |
| 2002/0103058 | A1 | 8/2002 | Webber |
| 2002/0183173 | A1 | 12/2002 | Abelbeck et al. |
| 2002/0187879 | A1 | 12/2002 | Ball et al. |
| 2003/0199362 | A1 | 10/2003 | Chamberlin |
| 2004/0005966 | A1 | 1/2004 | Chen |
| 2005/0032611 | A1 | 2/2005 | Webber et al. |
| 2005/0096196 | A1 | 5/2005 | Webber et al. |
| 2005/0096197 | A1 | 5/2005 | Webber et al. |
| 2005/0096198 | A1 | 5/2005 | Webber et al. |
| 2005/0168017 | A1 | 8/2005 | Pernicka et al. |
| 2006/0116253 | A1 | 6/2006 | Nizram |
| 2006/0148625 | A1 | 7/2006 | Garner |
| 2006/0166799 | A1 | 7/2006 | Boland et al. |
| 2006/0211549 | A1 | 9/2006 | Nohejl |
| 2006/0247107 | A1 | 11/2006 | Carter |
| 2006/0276313 | A1 | 12/2006 | Hong |
| 2007/0037673 | A1 | 2/2007 | Giannelli et al. |
| 2007/0232462 | A1 | 10/2007 | Webber et al. |
| 2007/0232467 | A1 | 10/2007 | Puzey |
| 2007/0270290 | A1 | 11/2007 | Mosimann et al. |
| 2007/0293377 | A1 | 12/2007 | Webber et al. |
| 2007/0293378 | A1 | 12/2007 | Webber et al. |
| 2008/0058176 | A1 | 3/2008 | Webber et al. |
| 2008/0058181 | A1 | 3/2008 | Webber et al. |
| 2008/0085822 | A1 | 4/2008 | Webb et al. |
| 2008/0132389 | A1 | 6/2008 | Webber et al. |
| 2008/0153677 | A1 | 6/2008 | Webber et al. |
| 2008/0182732 | A1 | 7/2008 | Webber et al. |
| 2008/0214365 | A1 | 9/2008 | Webber et al. |
| 2008/0214367 | A1 | 9/2008 | Webber et al. |
| 2008/0220950 | A1 | 9/2008 | Webber et al. |
| 2008/0234110 | A1 | 9/2008 | Webber et al. |
| 2008/0242517 | A1 | 10/2008 | Webber et al. |
| 2008/0248929 | A1 | 10/2008 | Webber et al. |

OTHER PUBLICATIONS

Body Masters CS210 Back Extension, (date unknown), is admitted prior art for this application, 1 page.

(56) References Cited

OTHER PUBLICATIONS

Cybex Back Extension, 1990, 1 page.
Flex FB-306 Low Back Machine, (date unknown), is admitted prior art for this application, 1 page.
Flex Fitness, FL-105 Abductor, 2002, 1 page.
Flex FL-106 Adductor and FL-105 Abductor, date unknown is admitted prior art for this application, 1 page.
Flex FL-109 Standing Calf, 2002, p. 9 of product brochure.
Flex FL-115 45 Donkey Calf, 2002, 1 page.
Flex Product Sheet, (date unknown), is admitted prior art for this application, 1 page.
FreeMotion Calf, (date unknown), is admitted prior art for this application, 1 page.
Keiser brochure, 1999, 1 page.
Paramount AP-3300 Lower Back, 2001, 1 page.
Paramount AP-3800 and 3900 Hip and Abduction Adductor, 2001, 2 pages.
Paramount Calf Raise AP-3500, 2001, 1 page.
Paramount plate loaded unit, 2002, 1 page.
Paramount selectorized unit, 2000, 1 page.
Polaris Adductor, 1986, 1 page.
Schwinn Natural Strength, Schwinn magazine Ad, (date unknown), is admitted prior art for this application.
Seated Calf and Standing Calf/Squat, Polaris by Iron Co., 1986, 1 page.
Tuff Stuff KDX-1 Gym, date unknown, is admitted prior art for this application, 1 page.
Bicep Curl PL-2300 and Tricep Extension PL-2200, Paramount Brochure, 1997.
Boss Fitness Brochure, 1993.
CD 2400 Leg Extension/Leg Curl, Hoist Fitness Systems, Owner's Catalog, 2005.
U.S. Appl. No. 11/846,437, filed Aug. 2007, Webber, et al.
U.S. Appl. No. 11/849,028, filed Aug. 2007, Webber, et al.
U.S. Appl. No. 11/848,012, filed Aug. 2007, Webber, et al.
U.S. Appl. No. 11/846,472, filed Aug. 2007, Webber, et al.
Hammer Strength, Hammer Brochure, 1993.
FS-403 Shoulder Press, Flex Brochure, 1995.
Paramount Advanced Performance System—Legg Press AP—2800 (brochure dated 2000).
08003 Rower, Gym 80 Brochure, 2001.
Gym 80 Brochure, 2001.
Leg Press, Cybex International Brochure, 2002.
Flex Fitness Brochure, date unknown.
Pace, 318 Dip/Shrug, Hanley International Brochure, date unknown.
FA-508 Dip Machine, Flex Brochure, date unknown.
Sprint by Hogan Industries, date unknown.
Models 217 and 206-2, Polaris Brochure, date unknown.
Hoist Selectionized Duals HD Series, Hoist Brochure, 2002.
Gravity Gym Instruction Manual, Seated Bench Press, date unknown.
Seated Close Grip Bench Press, Gravity Gym Instruction Manual, date unknown.
Vertical Bench Press Machine, Hoist Brochure, 1993.
Sprint by Hogan Industries, Linear Motion Chest Press, date unknown.
Chest Press and Incline Press, plate-loaded, Cybex Brochure, 1996.
Leg Press Machine, Schwinn Natural Strength, European trade magazine, date unknown.
Low Back Machine, Hoist Brochure, HS1225, 2005.
How It Works Flyer, illustration of exercises performed on U.S. Pat. No. 5,527,249 of Harris, date unknown.
Sprint Circuit, Hogan Industries Brochure, date unknown.
Hoist Prime 8 Brochure, Hoist Fitness Systems, 2000.
Hoist Diamond Gym Brochure, Hoist Fitness Systems, 1993.
Leverage Gym Brochure, Home Gym Warehouse, 2000.
Tuff Stuff Brochure, undated.
U.S. Appl. No. 12/212,090 of Webber et al., filed Sep. 17, 2008.

EXERCISE MACHINE WITH LIFTING ARM

CROSS-REFERENCE TO RELATED APPLICATIONS

This application is a continuation of U.S. patent application Ser. No. 13/078,627, which was filed in the U.S. Patent and Trademark Office on Apr. 1, 2011. application Ser. No. 13/078,627 is a continuation of U.S. patent application Ser. No. 12/253,392, which was filed in the U.S. Patent and Trademark Office Oct. 17, 2008, and has issued as U.S. Pat. No. 7,938,760. This application claims priority to each of the aforementioned applications, which are incorporated herein by reference.

STATEMENT REGARDING FEDERALLY SPONSORED RESEARCH OR DEVELOPMENT

This application is not the subject of any federally sponsored research or development.

THE NAMES OF THE PARTIES TO A JOINT RESEARCH AGREEMENT

There have been no joint research agreements entered into with any third parties.

FIELD OF THE INVENTION

This invention relates generally to exercise machines with moving user supports, and is particularly concerned with an exercise machine which has a lifting arm associated with a moving part of the exercise machine.

BACKGROUND OF THE INVENTION

Various exercise machines have been developed for exercising different muscles and muscle groups. Some of these have a stationary user support, while others have a pivoting or movable user support, which may or may not be linked to an exercise arm or user engagement means.

Movable user supports linked to the movement of an exercise arm are known in exercise machines. U.S. Pat. No. 2,252,156 of Bell and U.S. Pat. No. 6,251,047 of Steams show bicycle and exercise bike designs in which a seat or user support is linked to an exercise arm or crank and pedal system to provide up and down movement to the seat. The most common application of movable user supports is found in rowing and horse riding type exercise machines, which use the weight of the user as the exercise resistance. In U.S. Pat. No. 3,446,503 of Lawton, U.S. Pat. No. 4,743,010 of Geraci, and U.S. Pat. No. 5,342,269 of Huang, a seat and exercise arm are pivotally mounted on the base frame, with the seat linked to the exercise arm for dependent movement U.S. Pat. No. 4,300,760 of Bobroff, U.S. Pat. No. 5,299,997 of Chen, U.S. Pat. No. 5,356,357 of Wang, U.S. Pat. No. 5,453,066 of Richter, U.S. Pat. No. 5,458,553 of Wu, U.S. Pat. No. 5,503,608 of Chang and U.S. Pat. No. 5,507,710 of Chen all show horse riding type exercise machines. They all consist of a user support pivotally attached to a base frame, and one or more exercise arms pivotally connected to the frame and pivotally linked to the user support.

U.S. Pat. No. 6,264,588 of Ellis shows a composite motion movement machine that has a moving exercise arm linked to a movable user support, and a pivoting truck system which is slidably connected to rails mounted both on the main frame and user support. The movable user support and exercise arm are both pivoted at the same point on the base frame, in front of the user support. A belt connects the exercise arm to the truck. When the exercise arm is pushed or pulled, the belt pulls the truck along the rails, forcing the user support to rotate about its pivotal connection to the frame. This design puts all of the user's weight on one side of the pivot, producing a high initial lifting resistance when the user starts the exercise, and also has no means for properly aligning the exercise arm and user support during the exercise movement.

Movable seats linked to exercise arms have also been used in other exercise machines, such as U.S. Pat. No. 5,330,405 of Habing, U.S. Pat. No. 5,334,120 of Rasmussen, U.S. Pat. No. 5,669,865 of Gordon, U.S. Pat. No. 5,733,232 of Hsu, and U.S. Pat. No. 6,244,995 of Prsala. In U.S. Pat. No. 5,330,405 of Habing, a lever arm is pivotally connected to the base frame and supports a movable sub-frame including a user support which is also pivotally connected to the stationary base frame. An exercise arm is pivotally mounted on the sub-frame and linked to the lever arm via cables and pulleys, so that movement of the exercise arm pulls the cables lifting the lever arm, and causing the sub-frame to pivot about its connection to the base frame and rise against the weight of the user. U.S. Pat. No. 5,733,232 of Hsu shows another exercise machine with a pivoting seat, but in this case the back pad is stationary and only the seat pad is pivoted. Thus, the seat travels in an arcuate path without any secondary stabilization for the user, forcing the user to try to maintain their balance on the seat as it arcs upward. Also, in this design, the pivot point for the seat is located at a spacing behind the user position, so that all of the user's weight will oppose the user when starting an exercise from rest. Neither of these machines has any capability for aligning the user and user support with a rigid exercise arm, thus do not maintain or support the user in the proper position throughout the exercise.

U.S. Pat. Nos. 7,361,125, 7,331,125, and 7,335,140, all of Webber, et al., describe exercise machines for performing pull down, shoulder press, and triceps dip exercises, respectively. Each machine has a pivotally mounted user support, a user engagement device or exercise arm assembly for engagement by the user in performing the exercise, and a connecting linkage which translates movement of the user engagement device into movement of the user support. The user support has a primary support portion and at least one secondary support portion which support different parts of the user's body and which travel together during an exercise movement. This helps to stabilize the user, so that the user can focus on the exercise without worrying about balancing on a moving platform or seat. A load or exercise resistance is associated with the user support, user engagement device, or connecting linkage in these machines.

SUMMARY OF THE INVENTION

Embodiments described herein provide for an exercise machine with a moving user support and a connecting linkage which translates movement of an exercise arm or user engagement device into movement of the user support, and a lifting arm associated with at least one of the moving parts.

An exercise machine in one embodiment comprises a main frame, a user support frame pivotally associated with the main frame, a user engagement device movably mounted on one of the frames for actuating by a user in order to perform a selected exercise, and a connecting linkage which translates movement of the user engagement device to movement of the user support. A load provides resistance to movement of the user support frame, user engagement device and/or connecting linkage. The connecting linkage, user support pivot, and user engagement device mount are arranged so that movement of the user engagement device results in self-aligning movement of the user support. In one embodiment, the connecting linkage comprises a multiple part linkage which includes a lifting arm. In another embodiment, the lifting arm is associated with the exercise arm and is lifted by actuation of the exercise arm. In another alternative, the lifting arm is associated with the user support and is moved as the user support is moved during an exercise. The lifting arm may be pushed or pulled during the exercise. The load is associated with the lifting arm, and may comprise weights directly loaded on one or more weight pegs on the arm, or other types of exercise resistance linked to the lifting arm.

The user support frame in an exemplary embodiment has both a primary user support, such as a seat pad or back pad, and one or more secondary user supports which travel with the primary user support during an exercise. One secondary user support may be a back pad, shoulder pad, thigh hold-down pads, chest pad, or the like. Another secondary or additional user support may be a foot rest, which may be mounted on, and travel with, the user support frame. Alternatively, a foot rest may be mounted on the main frame. In either case, the foot rest provides additional stabilization to the user, helping them to maintain a proper exercise position and providing additional comfort and support. The use of multiple supports on the user support frame helps to position the exerciser properly and safely. In one embodiment, these supports are in fixed alignment to each other and travel together, keeping the user in the same braced position throughout the entire exercise range of motion. This allows the user to focus on the exercise rather than worrying about their positioning on a moving platform or seat.

The exercise arm or user engagement device is movably mounted on the main frame, the user support frame, or the connecting linkage. The connecting linkage translates movement of the exercise arm to movement of the user support, and is movably engaged with at least two of the main frame, exercise arm, and user support. In one embodiment, the user engagement device is movably mounted on the main frame and associated with the connecting linkage. The user support and exercise arm may both be movably mounted on the main frame, with the connecting linkage connected between them. The exercise arm may be mounted for linear movement or may be pivotally mounted for rotational movement, or may travel in a user-defined path.

The user support frame may be pivotally mounted on a base of the main frame so that it is relatively low to the ground and readily accessible to the user in entering and exiting the machine, via a single pivot or a multiple pivot assembly. In one embodiment, the user engagement device is also movably mounted on the base of the main frame. In other embodiments, the user engagement device is movably mounted relative to an upright portion of the main frame, or may be movably mounted on the user support frame or connecting linkage. The user engagement device may comprise one or two completely rigid or partially rigid exercise arms with handles for gripping by the user which are movable between a start position and an end position. Alternatively, the user engagement device may be a flexible line or lines with handles for gripping by a user, or may comprise a leg engaging device for engagement by the user's legs or feet. The user's hands or feet may be at a different elevation in the end position in the start position.

A pivot assembly which pivotally supports the user support frame may be located beneath the user support frame. The connecting linkage may be rigid, flexible, or partially flexible, and may be adjustable in length or position. The user engagement device or exercise arm may have one or two handles. If handles are provided, they may be rigid or flexible, fixed or self-aligning, and may provide two dimensional or three dimensional movement.

Where the user engagement device comprises two exercise arms, the exercise arms may be movable independently or in unison. In one embodiment, the user engagement device and connecting linkage are both movably associated with the main frame. The user engagement device may be a bi-directional exercise arm.

The pivot mounting of the user support defines a vertical gravitational center line of the pivotal movement, and in one embodiment portions of the combined weight of the user and user support frame are positioned on both sides of the vertical gravitational center line in at least one of the start and end positions of the exercise. In one embodiment, a portion of the combined weight of the user and user support is positioned on the movement side (i.e. the side the user support is pivoting towards) of the gravitational center line in the start position. This reduces the initial lifting resistance. By finishing the exercise with a portion of the combined user and user support weight on the trailing side of the center line in the movement direction, resistance "dropoff" at the end of an exercise is reduced. This distribution reduces the effect of the user's body weight on the resistance felt during the exercise. This is the opposite of most exercise devices that have moving user supports, which tend to rely on the weight of the user for resistance. Whether it is the starting or the finishing position, most prior art pivoting user supports place the majority of the user's weight on one or the other side of the gravitational center line of the pivoting movement, resulting in either a high initial lifting resistance, or else a resistance "dropoff" at the end of the exercise.

The exercise resistance or load may comprise a weight stack, weight plates mounted on pegs, or other types of resistance such as hydraulic, pneumatic, electromagnetic, or elastic bands. Where the exercise resistance is a weight stack, multiple exercise stations may share the same weight stack or load for exercise resistance, or separate weight stacks may be provided for each station.

The exercise machine may have a single exercise station, or may be a multi-station exercise machine with one or more stations which have lifting arms and pivoting user supports as described above.

BRIEF DESCRIPTION OF THE DRAWINGS

The details of the present invention, both as to its structure and operation, may be gleaned in part by study of the accompanying drawings, in which like reference numerals refer to like parts, and in which:

FIG. 48 is a side elevation view similar to FIG. 46 but illustrating the end position when the load is attached as in FIG. 47;

DETAILED DESCRIPTION

Figure 1:
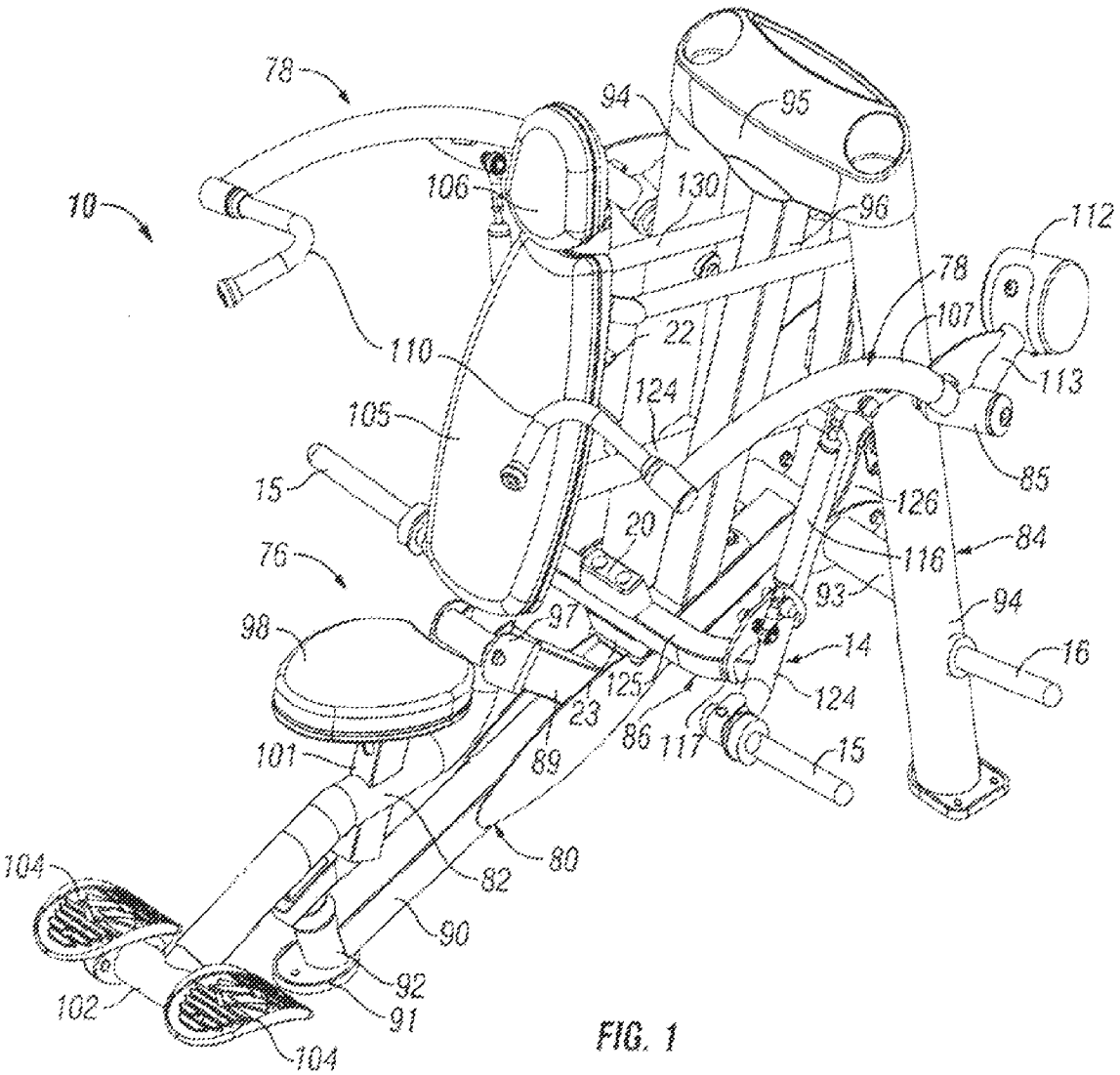
FIG. 1 is a front perspective view of a shoulder press exercise machine according to a first embodiment, with a lifting arm which is plate loaded, illustrating the user support and exercise arms in a first position corresponding to the start of a shoulder press exercise.

Certain embodiments as disclosed herein provide for an exercise machine having a moving user support and a user engagement device comprising one or more exercise arms, along with a connecting linkage which translates movement of the user engagement device into movement of the user support, and a lifting arm which is associated with at least one of the moving parts of the machine. In some embodiments, the lifting arm comprises part of the connecting linkage, while in others the lifting arm is associated with either the user engagement device or the user support so as to move in response to movement of those parts. A single lifting arm or more than one lifting arm may be provided, and the lifting arm may be designed to carry a load in the form of weight plates or may be linked to another form of exercise resistance.

After reading this description it will become apparent to one skilled in the art how to implement the invention in various alternative embodiments and alternative applications. However, although various embodiments of the present invention will be described herein, it is understood that these embodiments are presented by way of example only, and not limitation.

FIGS. 1 to 6B illustrate a shoulder press exercise machine 10 according to a first embodiment which has a stationary main frame 80 on which a user support 76 is pivotally mounted, and a user engagement device comprising exercise arms or main arm portions 78 pivotally mounted on opposite sides of a rear upright portion 84 of the main frame to extend on opposite sides of the user support. A multiple part connecting linkage 86 is provided between the exercise arms 78 and the user support 76 so that movement of the exercise arms is translated into movement of the user support. The connecting linkage 86 includes a generally L-shaped lifting arm 14, as described in more detail below.

The main frame 80 comprises base 90 and rear upright portion 84. The base has a ground engaging foot 91 at its forward end, and a short stand off post 92 projects upwards from foot 91. The base is inclined upwardly from the front to the rear end, and is secured to a horizontal cross bar 93 of the rear upright portion at its rear end. Rear upright portion 84 has a pair of upright struts 94 connected together by a cross member 95 at their upper ends, and by cross bar 93 at a location spaced below their upper ends, with the upright struts 94 inclined outward to form a generally A-frame structure. A central, rearwardly inclined upright strut 96 extends from base 90 at a location spaced forward from cross bar 93 to cross member 95. A forwardly inclined pivot support strut 89 extends upwardly from the base 90 at a location spaced forward from central upright strut 96.

Figure 3:
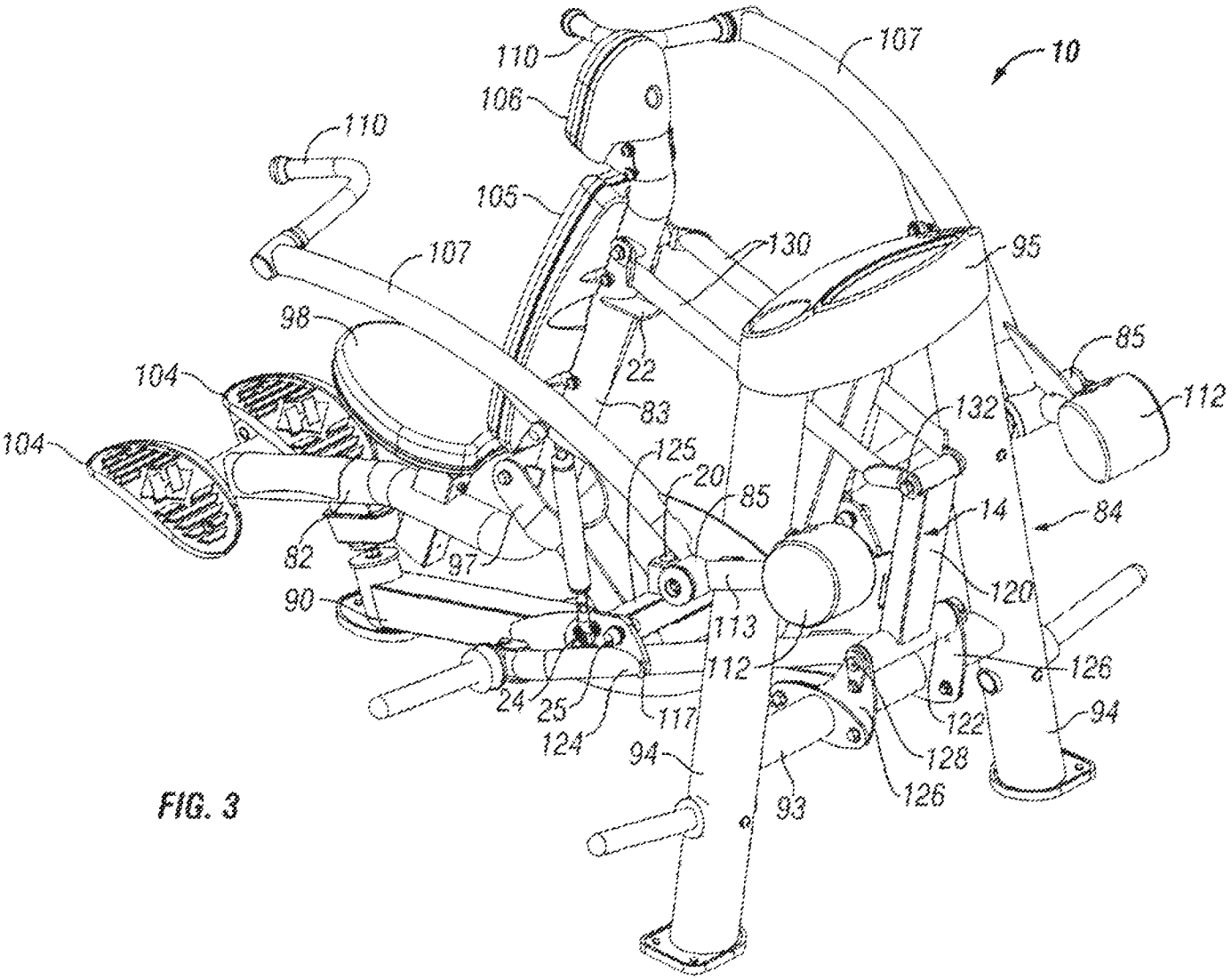
FIG. 3 is a rear perspective view of the shoulder press exercise machine in the start position of FIG. 1.
Figure 68:
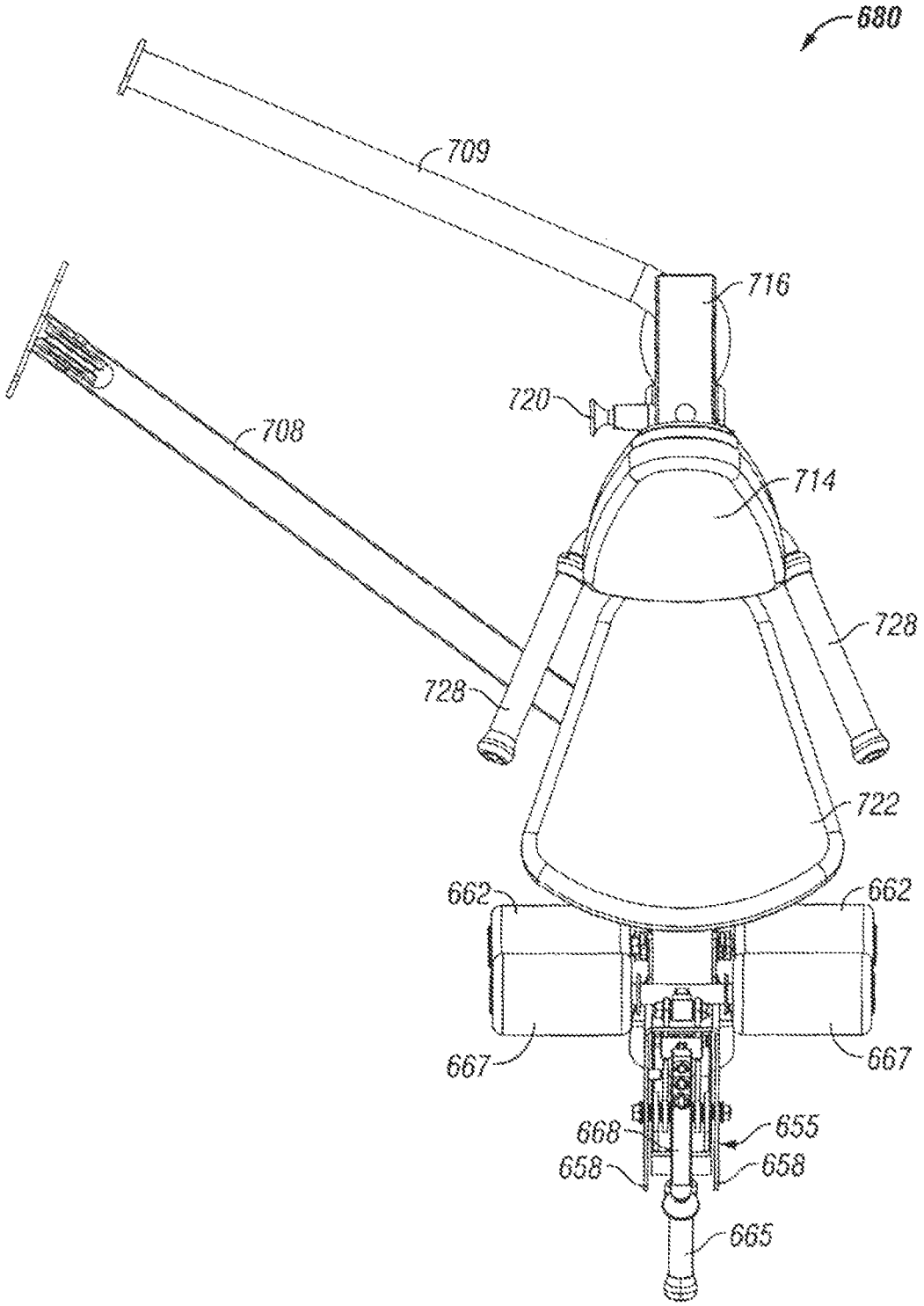
FIG. 68 is a top plan view of the machine in the same position as FIGS. 66 and 67.

User support frame 76 is generally L-shaped with a base portion 82 and an upright portion 83, and is pivotally supported at the upper end of pivot support 89 for rotation about pivot axis 99 (see FIGS. 6A and 68) via pivot bracket 97 located above the junction or bend between the base portion 82 and upright portion 83 of the frame. A seat pad 98 is adjustably mounted on the base portion 82 via seat support post 100 which is telescopically engaged in an open upper end of a seat support tube 101 on the base portion. Seat support post 100 has a series of openings for releasable engagement with pull pin 103 to adjust the seat pad height based on user size and preference. The base portion 82 of the user support frame extends forward from the seat support tube 101 and a foot support bar 102 is transversely mounted at the forward end of base portion 82, with a foot support or foot rest 104 mounted at each end of bar 102 for engagement by a user's feet. A back pad 105 and a head rest pad 106 are mounted on the upright portion 83 of the user support frame. The base portion 82 of the user support engages the upper end of post or stand-off 92 in a first position of the user support, as illustrated in FIGS. 1, 3 and 6A.

Figure 4:
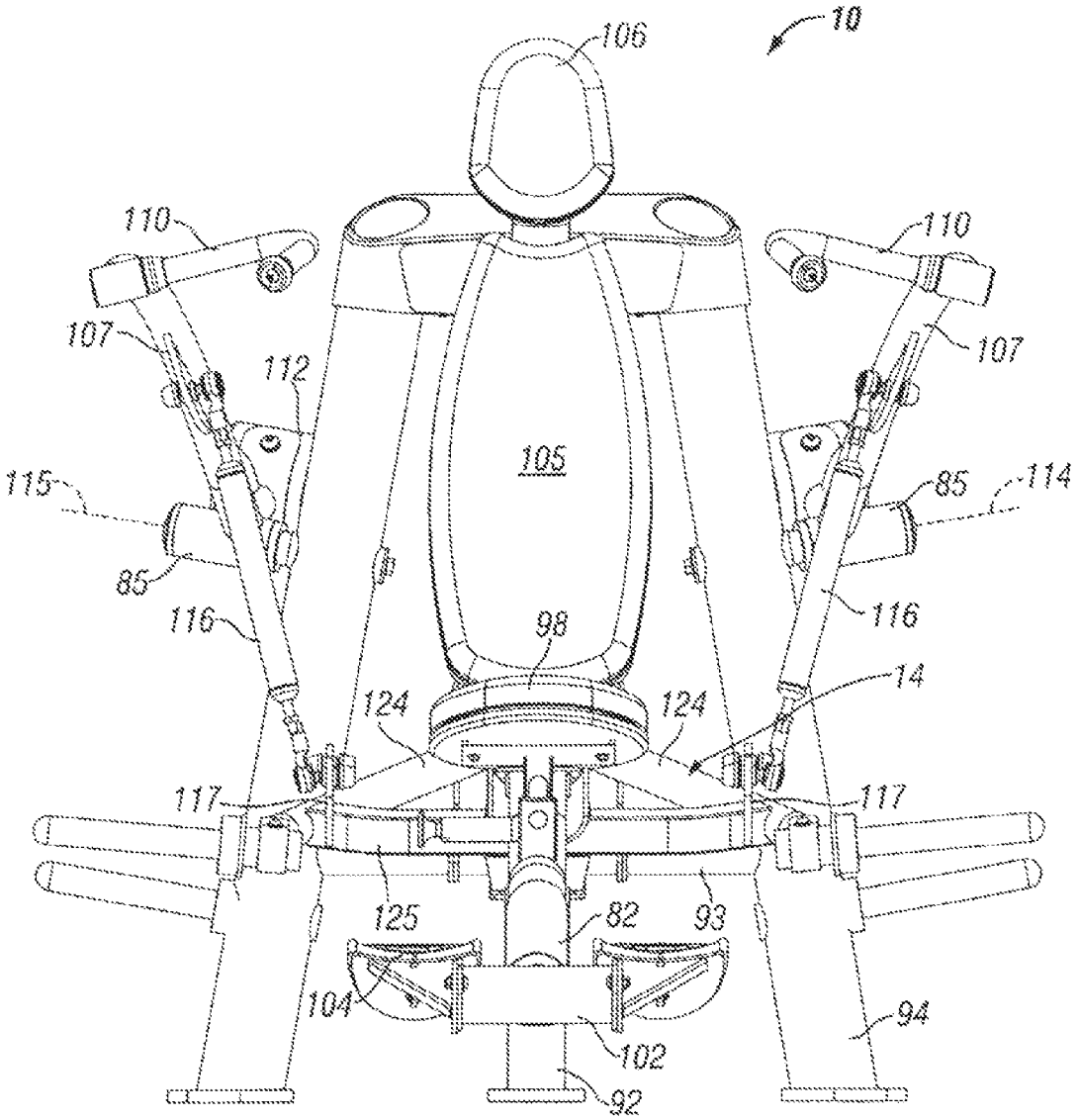
FIG. 4 is a front elevation view of the exercise machine in the start position of FIGS. 1 and 3.

Each exercise arm or main arm portion 78 comprises an arcuate member 107 having a first end secured to a respective pivot housing or sleeve 85. An inwardly directed angled user engaging portion such as a handle or grip 110 is secured to the end of each arcuate member. A counterweight 112 is secured to a rearward projection 113 of pivot sleeve 85 to offset or counterbalance the weight of the exercise arm. Pivot sleeves 85 are each pivotally secured via skewed pivot pins to the respective rear upright 94, defining skewed, non-parallel pivot axes 114, 115, as best illustrated in FIG. 4. Due to the skewed pivot mounts, each arm is rotated in an inward or converging path as it rotates from the lower, exercise start position of FIG. 1 to the upper, exercise end position of FIG. 2.

Figure 5:
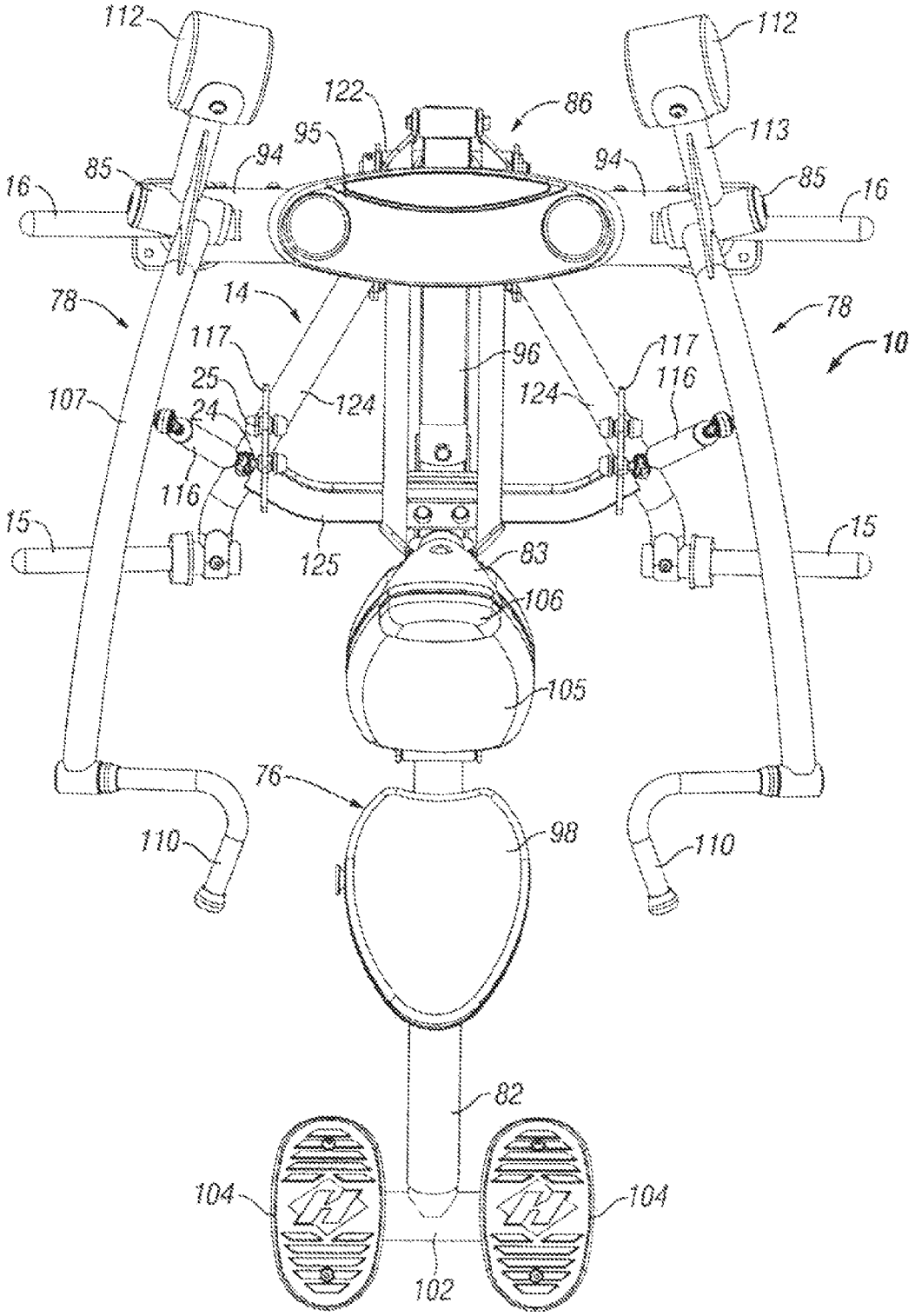
FIG. 5 is a top plan view of the exercise machine in the start position of FIGS. 1, 3 and 4.

The connecting linkage 86 comprises multiple links between each exercise arm and the user support, the links including lifting arm 14. A pair of first links or tie rods 116 each have a first end pivotally connected to the respective exercise arm member 107 at a location spaced between the pivot mount and handle, and a second end pivotally connected to forward end portions of the L-shaped lifting arm 14. Lifting arm 14 has a generally upwardly extending rear portion 120 secured to a pivot sleeve 122 at its lower end (FIG. 3), and a pair of outwardly diverging rods or bars 124 extending forward from pivot sleeve 122, as illustrated in FIGS. 1 to 3 and 5. Rods 124 are secured together by a cross bar 125 at a location close to their forward ends, and the lower ends of tie rods 116 are pivoted to respective brackets 117 adjacent the outer ends of cross bar 125, as best illustrated in FIGS. 1 and 5. A weight plate mounting peg 15 extends outwardly from the forward end of each rod 124. Storage pegs 16 for weight plates are also provided on the respective main frame uprights 94. Pivot sleeve 122 of the lifting arm 14 is rotatably mounted on a pivot pin extending between pivot brackets 126 mounted on the main frame cross bar 93 for rotation about pivot axis 128, as best illustrated in FIGS. 3, 6A and 6B. Two parallel second links 130 are each pivotally secured at their rear ends to the upper end of rear portion 120 of lifting arm 14 for rotation about pivot axis 132, and are pivotally secured at their forward ends to the rear upright 83 of the user support, for rotation about pivot axis 134 (see FIG. 6B). This multiple pivot link arrangement translates movement of the exercise arms into movement of the user support. At the same time, the lifting arm 14 of the connecting link is loaded by weight plates 18 on pegs 15 at the ends of the rods 124 of the lifting arm 14 to provide a selected amount of exercise resistance.

Figure 6A:
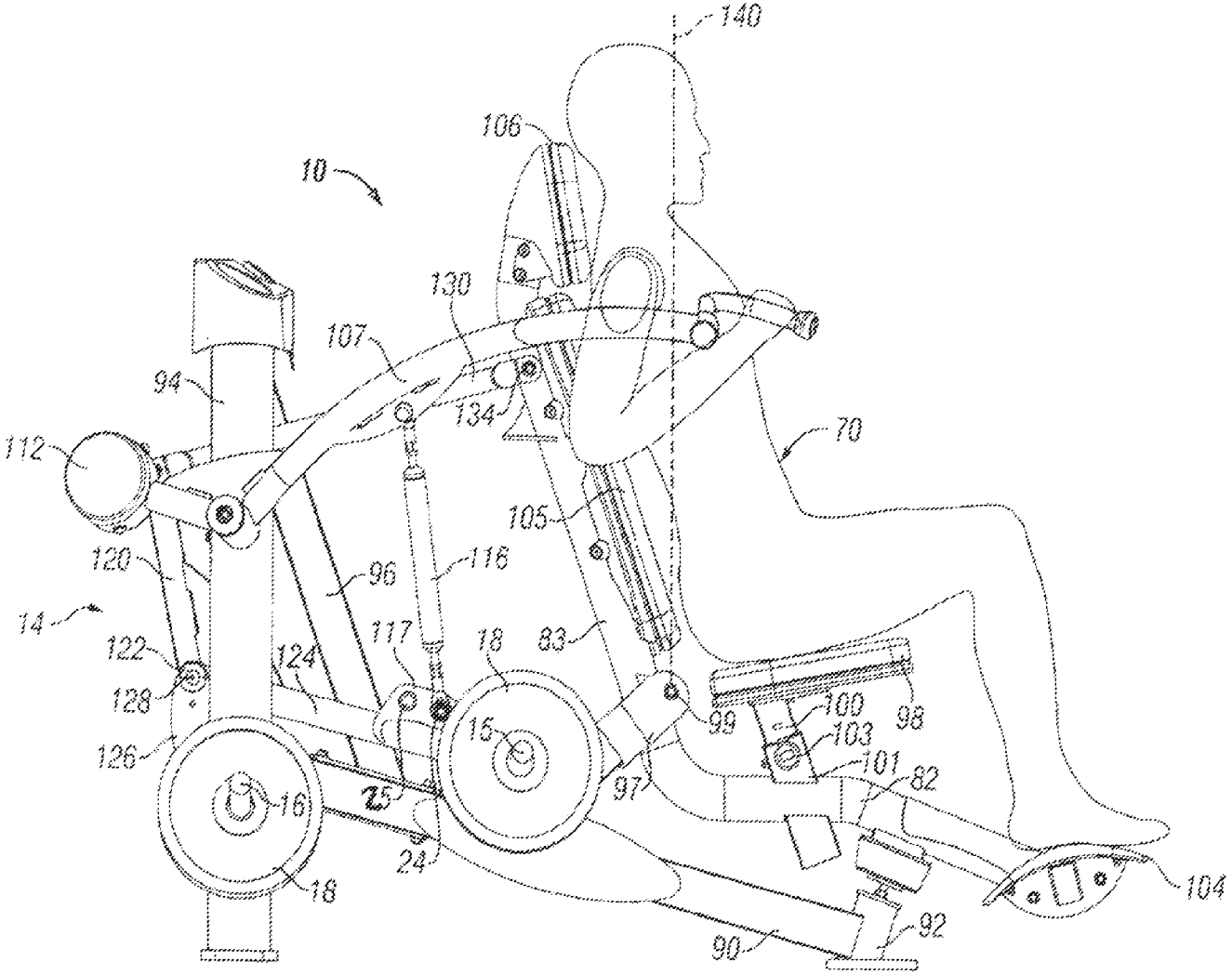
FIG. 6A is a side elevation view of the machine of FIGS. 1 to 5 in the position of FIGS. 1 and 3 to 5 and a user seated in an exercise position on the machine at the start of a shoulder press exercise.
Figure 6B:
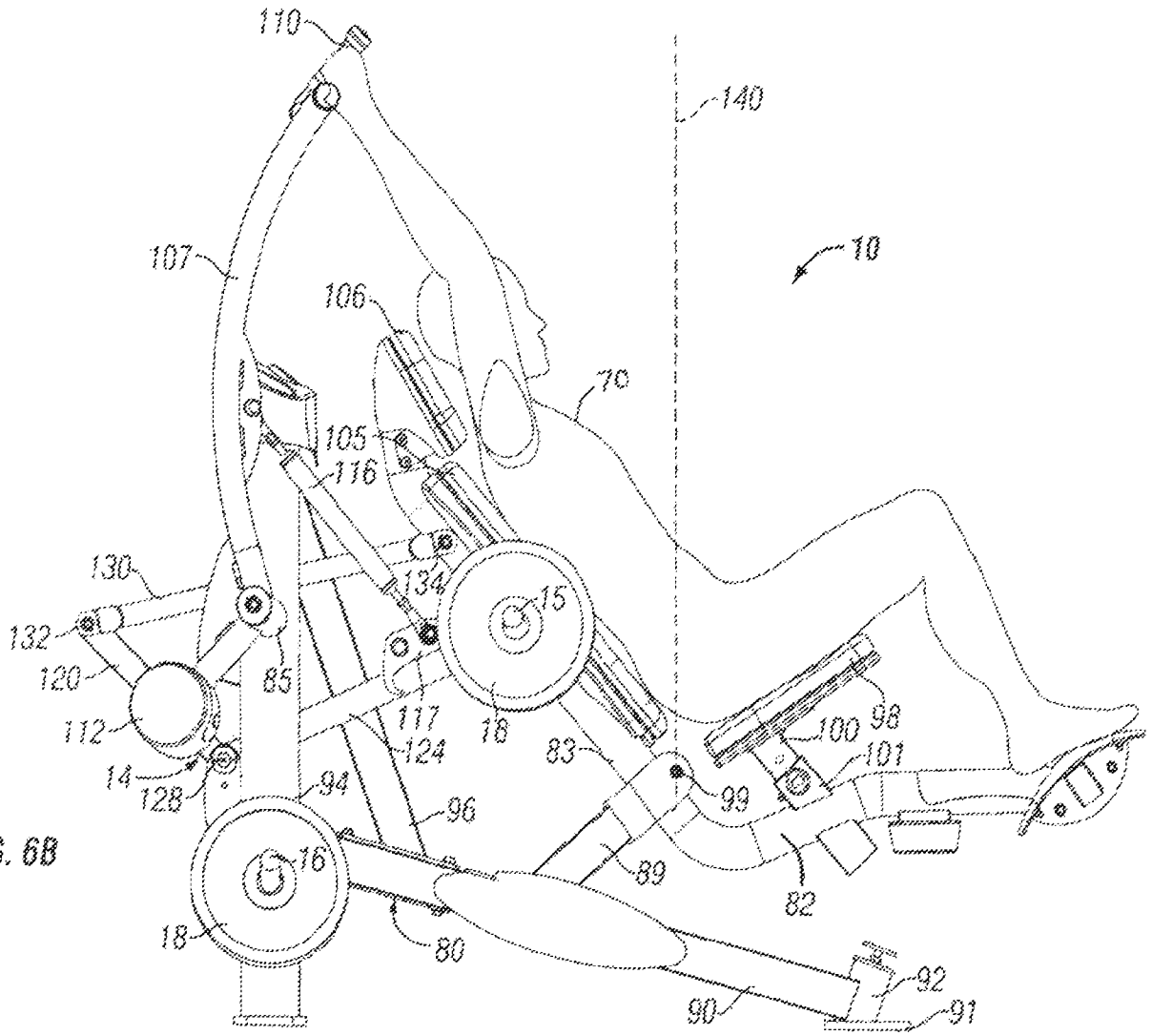
FIG. 6B is a side elevation view similar to FIG. 6A but illustrating the end position of a shoulder press exercise.

The exercise arms 78 may be used to perform a shoulder press exercise with the user support and exercise arms starting in the shoulder press start position of FIGS. 1, 3 to 5, and 6A. In this position, the user support is in a slightly reclined orientation, as best illustrated in FIG. 6A. FIG. 6A illustrates a user 70 seated on the user support in the start position for a shoulder press, with their hands gripping handles or grips 110 on opposite sides of the seat at chest height. From this position, the user pushes their hands upwards, which in turn rotates the handles upward and inward in a converging path, as can be seen by comparison of FIGS. 1 and 2, with the users hands following an equivalent path. The user ends the shoulder press exercise with their hands extending straight above their head, as illustrated in FIG. 6B.

Figure 2:
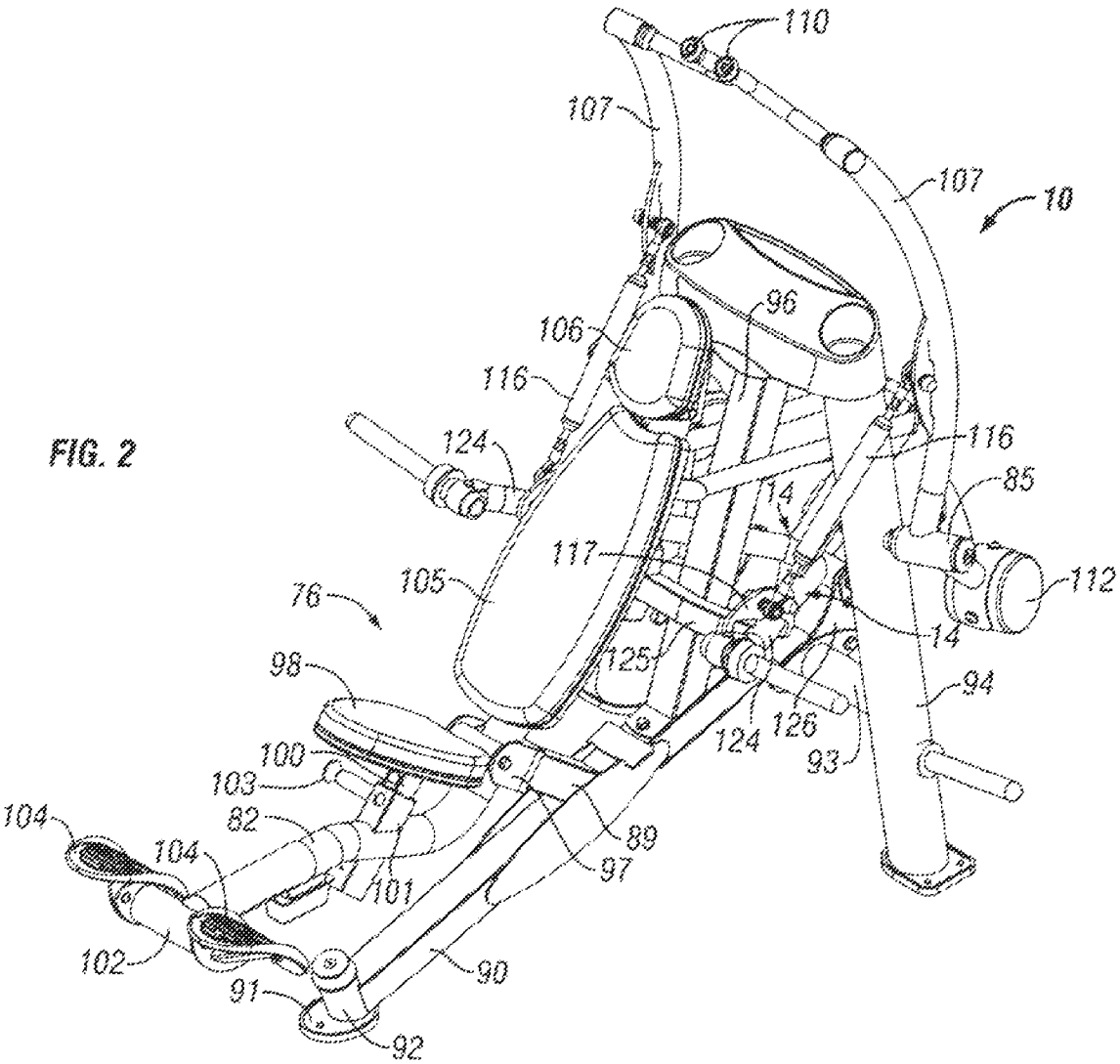
FIG. 2 is a front perspective view similar to FIG. 1, showing a second position corresponding to the end of a shoulder press exercise.

As the user presses or pushes the exercise arms upward between the position of FIG. 6A and the end position of FIG. 6B, the exercise arms pull tie rods 116 upwards, pulling both of the rods 124 of the lifting arm 14 upward adjacent their forward ends and lifting any weight plates mounted on pegs 15, providing the exercise resistance. This simultaneously rotates the rear upright portion 120 of the generally L-shaped lifting arm 14 rearward and downward about pivot axis 128, pulling the second links 130 rearward and causing the user support to rotate rearward about pivot axis 99, ending in a more rearwardly reclined position. A stop plate or stand-off 22 projecting from rear upright 83 engages a stop or stand-off 20 at the center of lifting arm cross bar 125 to limit upward movement of the exercise arms 107, with the end position for an individual user depending on their arm length. An oppositely directed stop or standoff 23 at the center cross bar 125 rests on the base 90 of the main frame in the rest or exercise start position, as seen in FIG. 1. The end position for the shoulder press exercise is illustrated in FIGS. 2 and 6B. FIGS. 6A and 6B also illustrate the vertical gravitational centerline 140 of the user support's pivotal motion, which extends vertically through the user support pivot 99.

In this embodiment, two possible anchor positions 24, 25 (see FIGS. 3, 5, 6A and 6B) are provided on brackets 117 for selectively anchoring the ends of the respective tie rods 116 to brackets 117. In the drawings, tie rods 116 are connected to the forward anchor position 24 on each bracket. The tie rods may be adjusted if desired to anchor to the rear anchor positions 25, which adjusts the handle starting position. This allows the handles to be adjusted in position for different users.

FIGS. 7 to 10B illustrate an exercise machine 75 which is similar to the machine 10 of FIGS. 1 to 6 except that the lifting arm 118 of this embodiment is associated with a bidirectional hydraulic ram or gas shock assembly 88 to provide the exercise resistance, instead of the weight plates 18 of the previous embodiment. In this embodiment, due to the bi-directional resistance, the user engagement device comprises multi-function exercise arms or main arm portions 78 which have two modes of operation to perform either a shoulder press exercise which exercises the shoulder muscles, or a lat pulldown exercise which exercises the lat muscles of the back. Other parts of the machine 75 are identical to corresponding parts of the previous exercise machine 10, and like reference numbers are provided for like parts as appropriate. Exercise resistance is provided by a bi-directional hydraulic ram or gas shock assembly 88 which is pivotally secured to the upper end of main frame upright portion 84 at one end, and to the cross bar 125 of lifting arm 118 at the opposite end.

As described above, the bi-directional hydraulic ram or gas shock assembly 88 provides exercise resistance to movement of the exercise arms. Assembly 88 comprises a cylinder 135 and a piston 136 telescopically engaged in cylinder 135 (see FIGS. 7A and 10A). Cylinder 135 is pivotally secured at the upper end between pivot brackets 137 close to the upper end of main frame upright 96, and piston 136 is pivotally secured at its lower end between pivot brackets 139 at or close to the center of the forward cross bar 125 of lifting arm 118. This arrangement provides resistance to both pulling of the piston out of cylinder 135 and pushing of the piston into cylinder 135.

Figure 9:
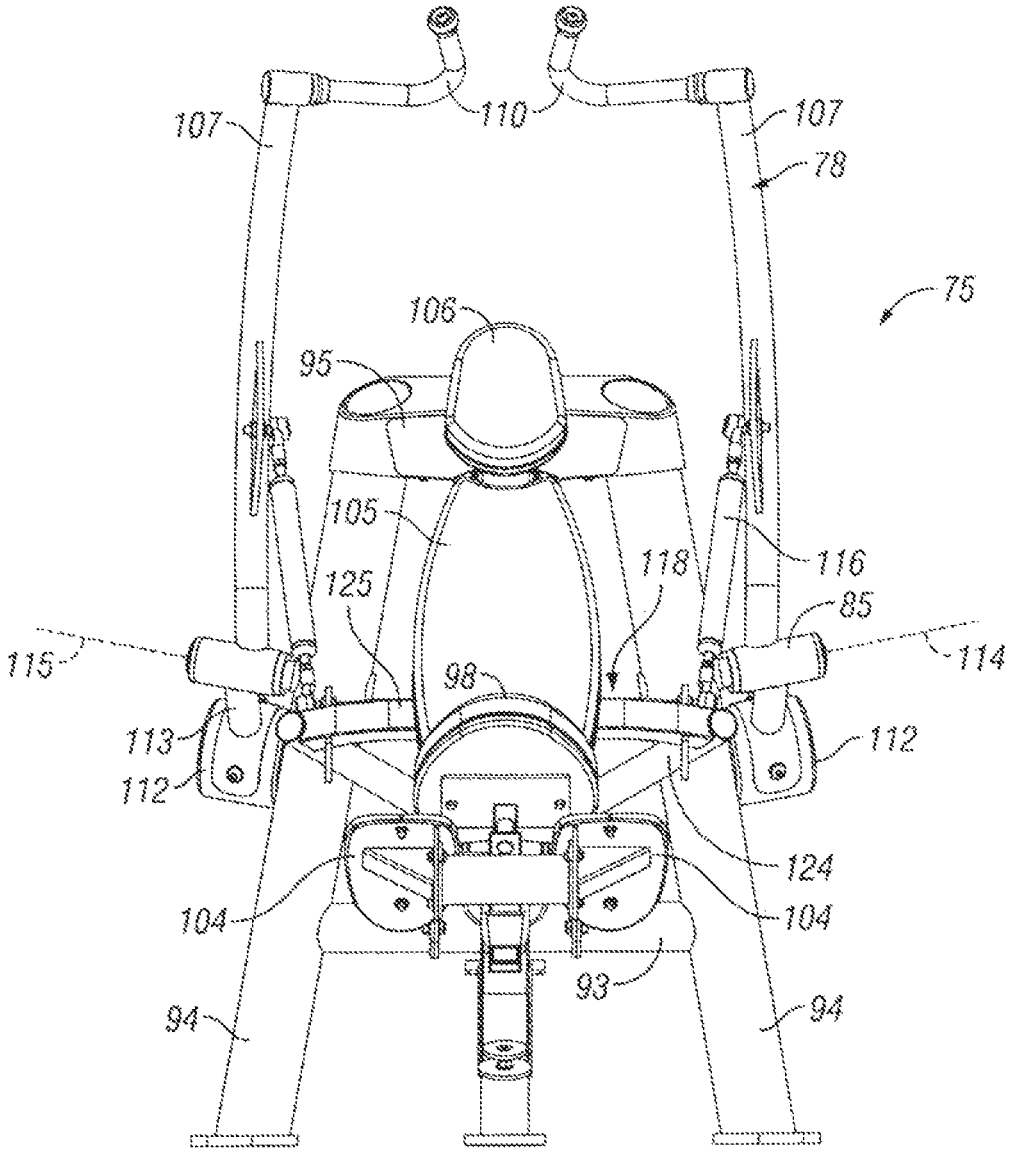
FIG. 9 is a front elevation view of the machine with the exercise arms in the higher position of FIG. 7B corresponding to the start of a lat pulldown exercise and the end of a shoulder press exercise.
Figure 10A:
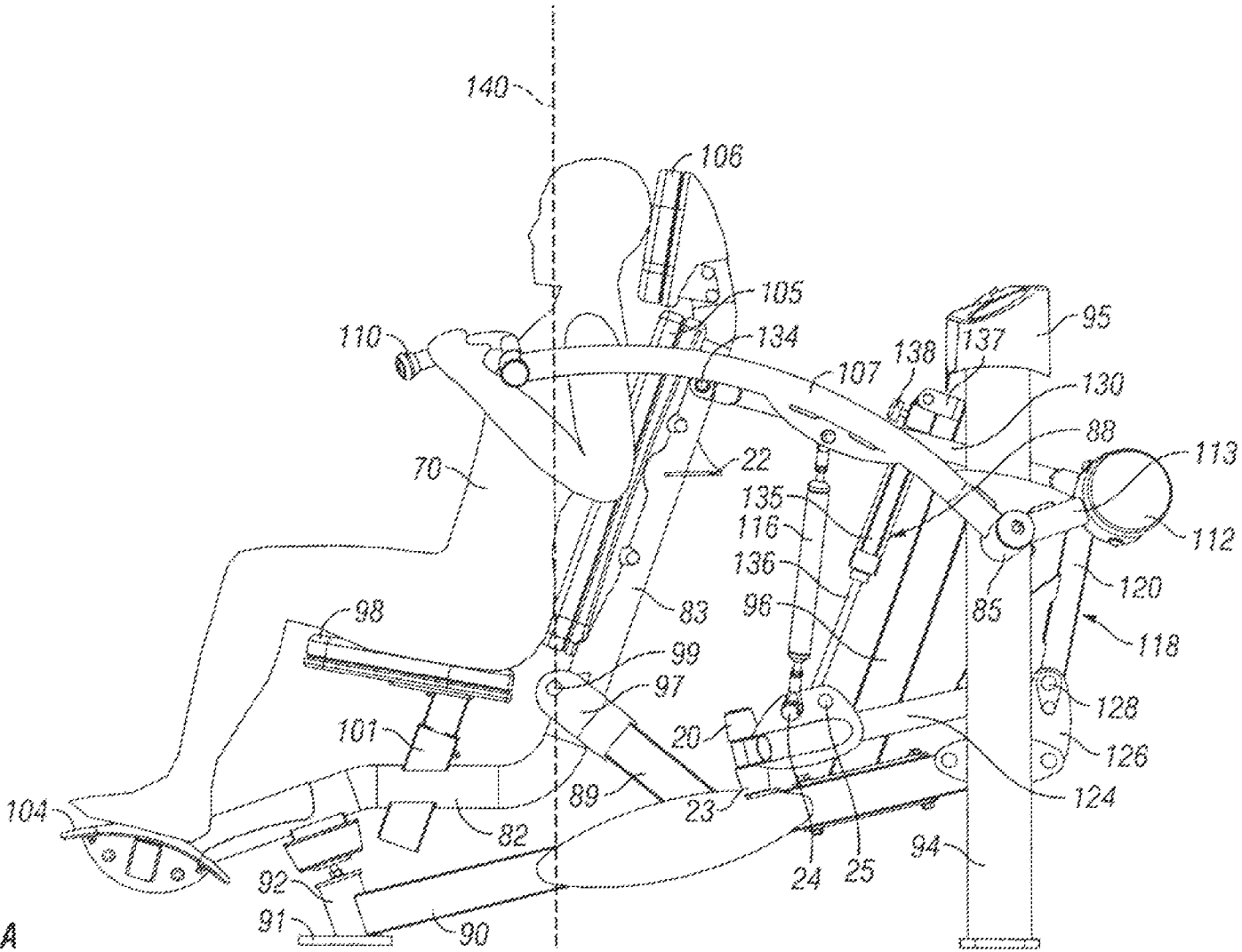
FIG. 10A is a side elevation view of the machine of FIGS. 7 to 9 with the arms in the position of FIGS. 7A and 8 and a user seated in an exercise position on the machine at the start of a shoulder press exercise or the end of a lat pulldown exercise.
Figure 10B:
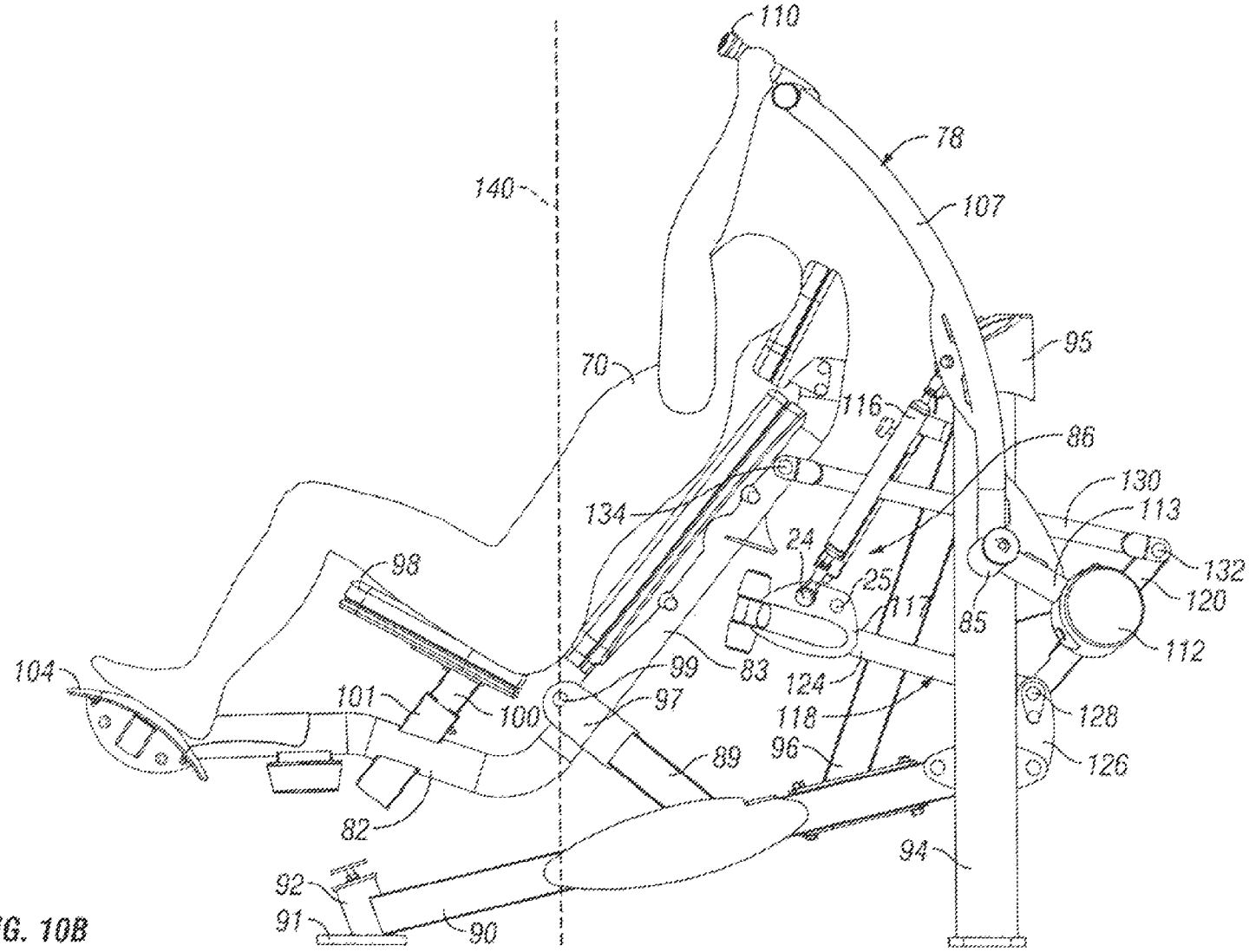
FIG. 10B is a side elevation view of the exercise machine similar to FIG. 10A but with the exercise arms and user support in the position of FIGS. 7B and 9, which is the end position of a shoulder press exercise or the start position of a lat pulldown exercise.
Figure 11:
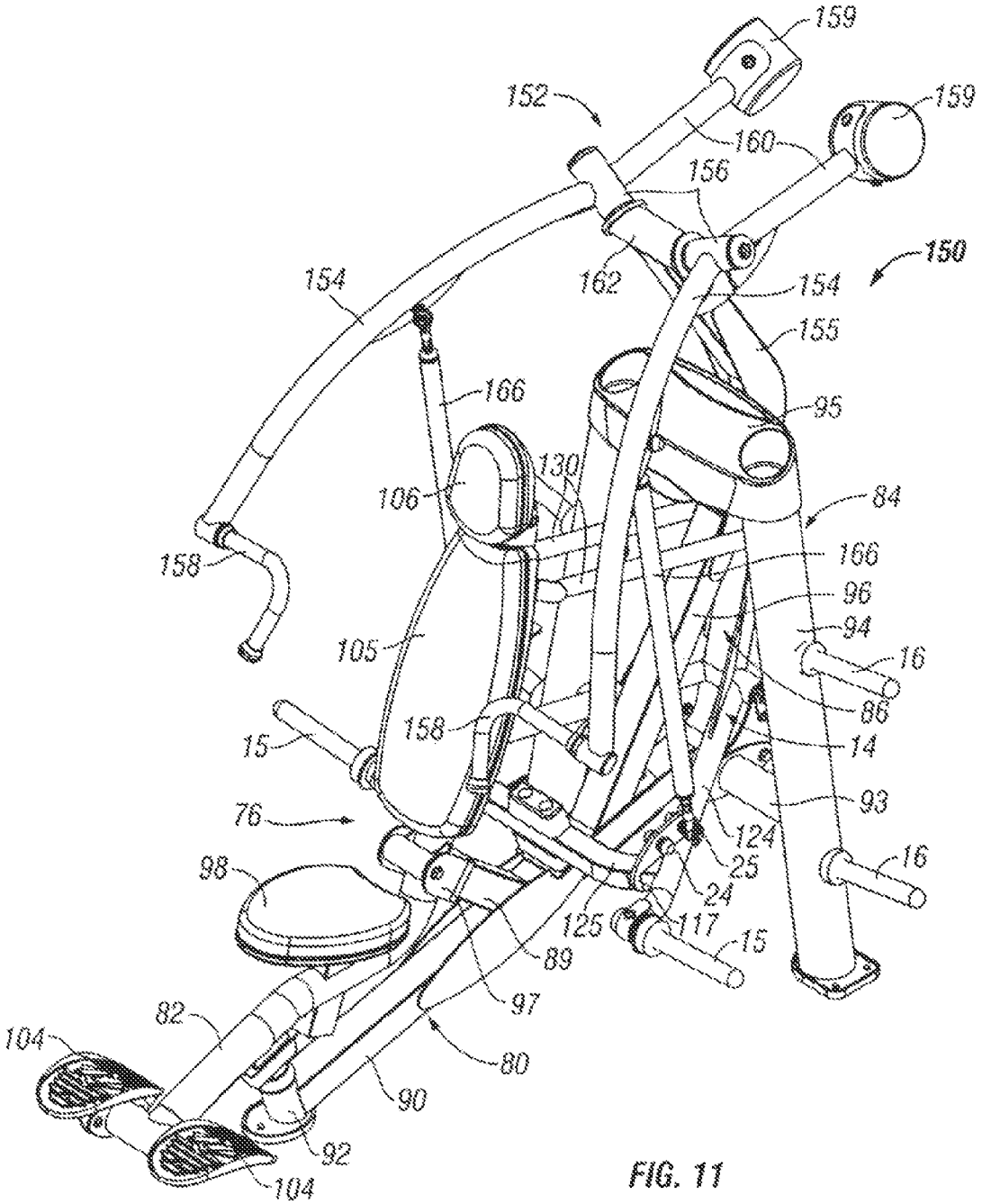
FIG. 11 is a front perspective view of a chest press exercise machine according to another embodiment, with the machine in an exercise start position.
Figure 12:
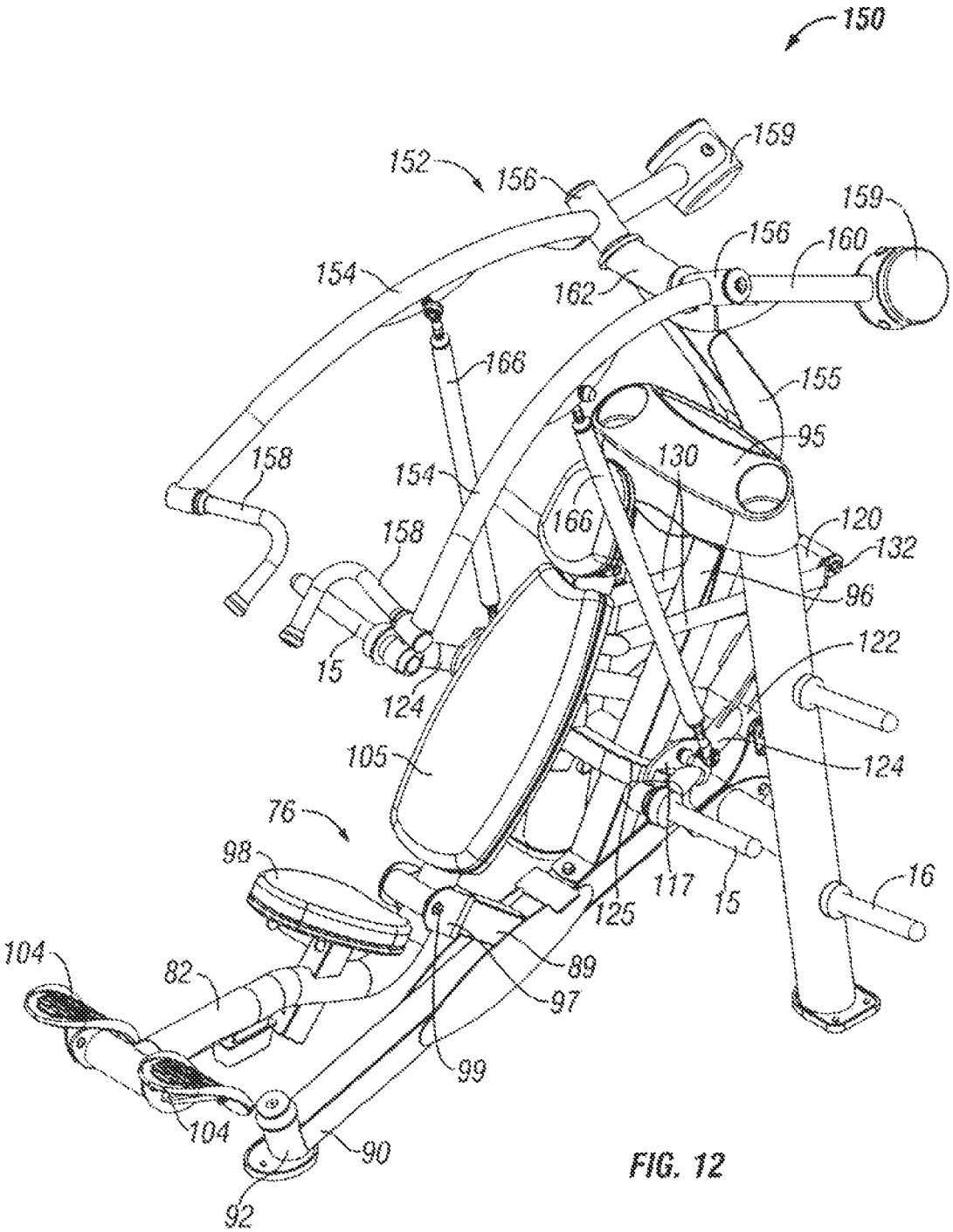
FIG. 12 is a front perspective view similar to FIG. 11 but illustrating the end position of a chest press exercise.
Figure 13:
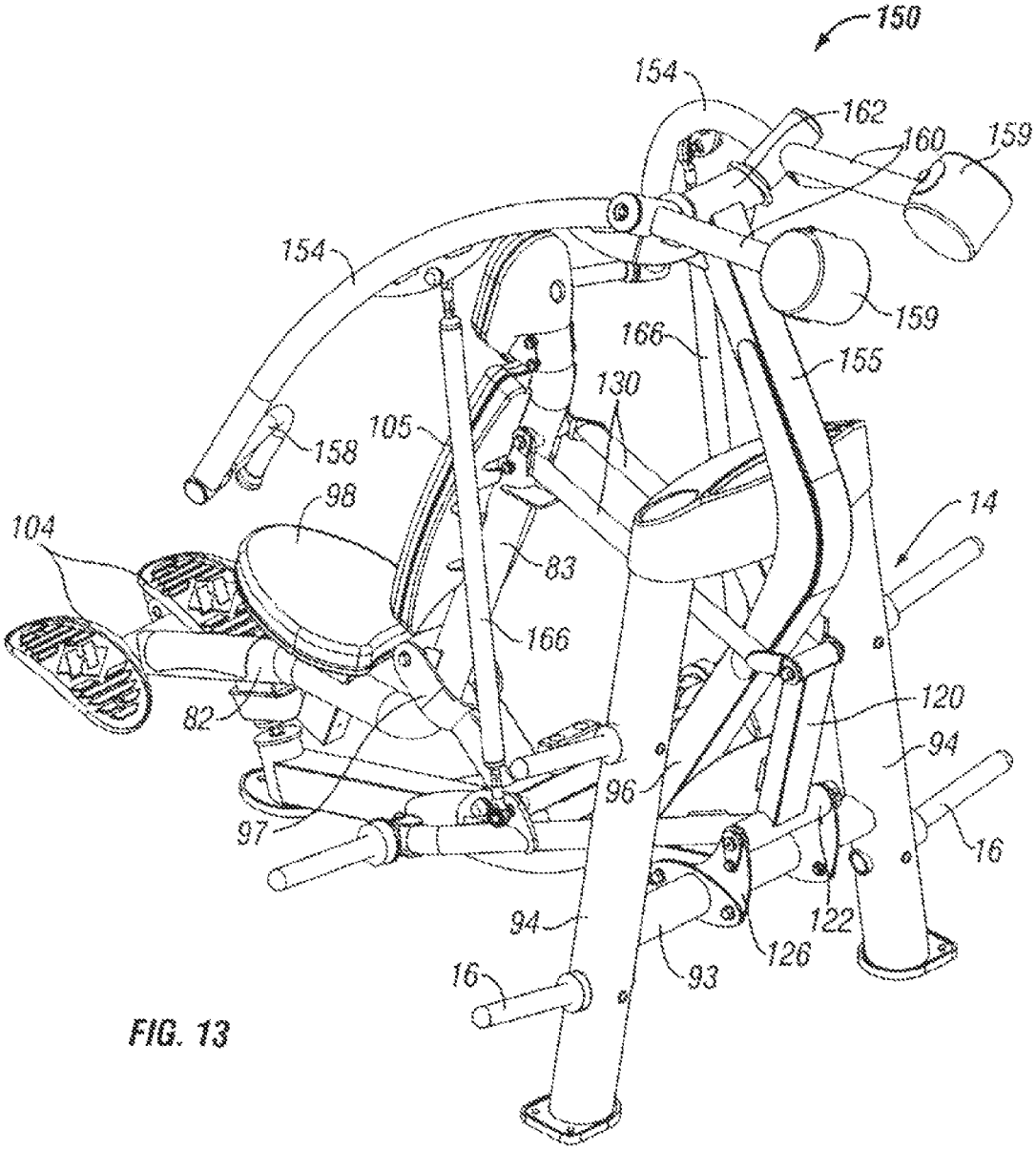
FIG. 13 is a rear perspective view of the machine of FIGS. 11 and 12 in the exercise start position.

When the exercise arms are in the upper position of FIGS. 9 and 10B, the gas shock or ram assembly 88 is at its shortest length with the piston 136 more or less completely retracted into cylinder 135. As the arms are pulled down from the upper position of FIG. 10B to the lower position of FIG. 10A, links 116 push down the forward end of lifting arm 118, simultaneously pulling piston 136 out of cylinder 135 into the extended position of FIGS. 7A and 10A against the resistance of the gas in cylinder 135. The resistance can be adjusted using an adjustment knob 138 (FIG. 7 A, 78) on the cylinder 135. When the exercise arms are pushed back up into the upper position, the link arm is raised at its forward end, pushing piston 136 back into the cylinder against the resistance of gas in the cylinder. Thus, exercise resistance is provided in both directions of exercise arm movement.

Figure 7A:
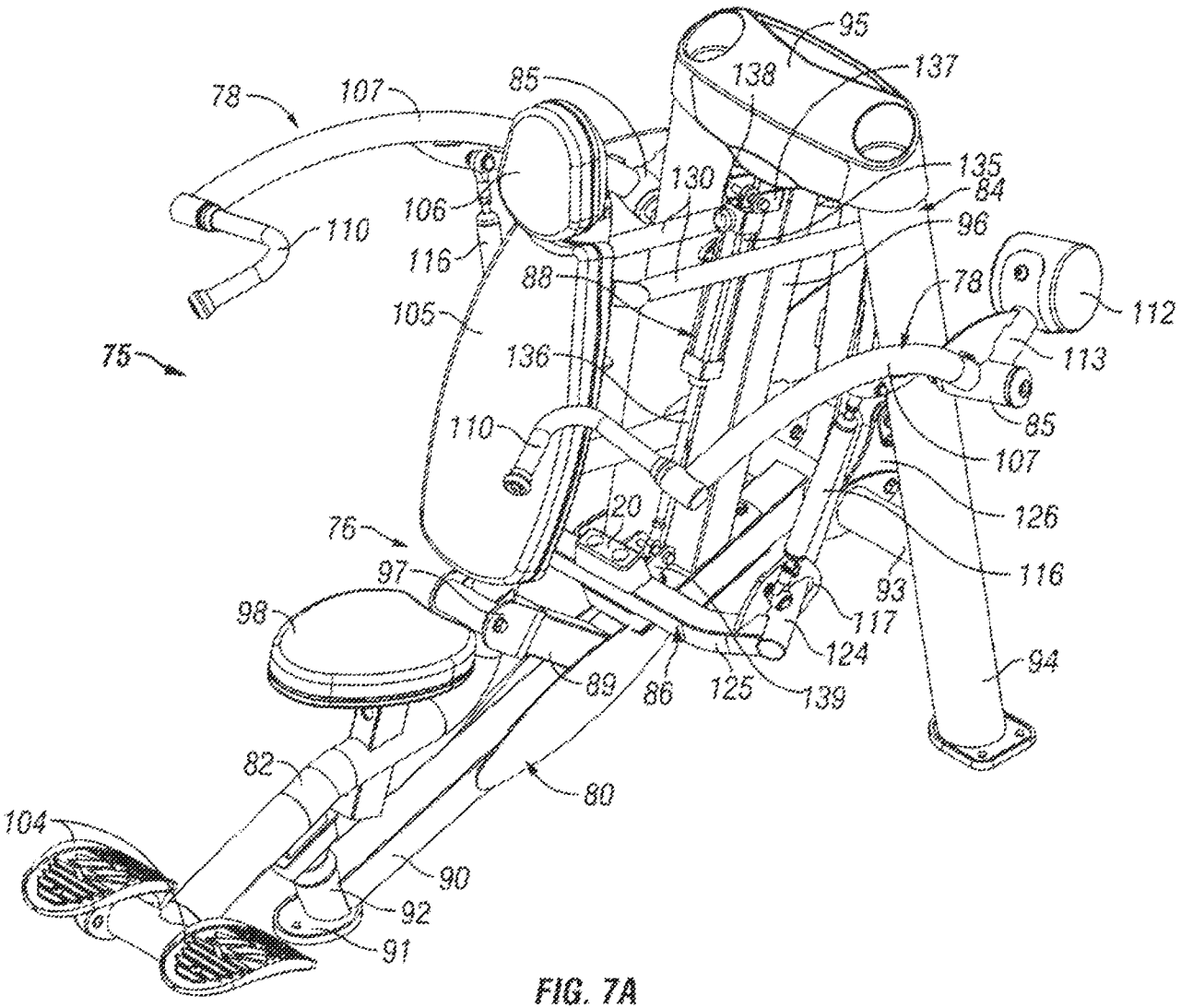
FIG. 7A is a front perspective view of a shoulder press/lat pulldown exercise machine which is similar to the machine of FIGS. 1 to 6 but with the load provided by a bi-directional hydraulic ram in place of the weight plates, with the exercise arms in the start position for a shoulder press exercise and the end position for a lat pulldown exercise.

In this embodiment, the exercise arms 78 may be selectively used in two different modes of operation, to perform either a lat pulldown exercise or a shoulder press exercise which exercise different muscles. The lower arm position of FIGS. 7A, 8 and 10A is the start position for a shoulder press exercise. The user 70 sits on the seat as illustrated in FIG. 10A, grabs the handles 110 with their hands in front of their chest, and pushes the arms upward. Due to the skewed pivot mounting of the two exercise arms, the arms converge inwardly in arcuate paths as they move to the uppermost position, so that the user's hands follow a similar converging path (see handle positions in FIGS. 8 and 9). As the arms 78 are pulled up, links or tie rods 116 pull up the forward end of the lifting arm 118, simultaneously pushing the upper end of upright 120 rearwards and moving the user support 76 back into the more reclined end position of FIGS. 7B and 10B.

Figure 7B:
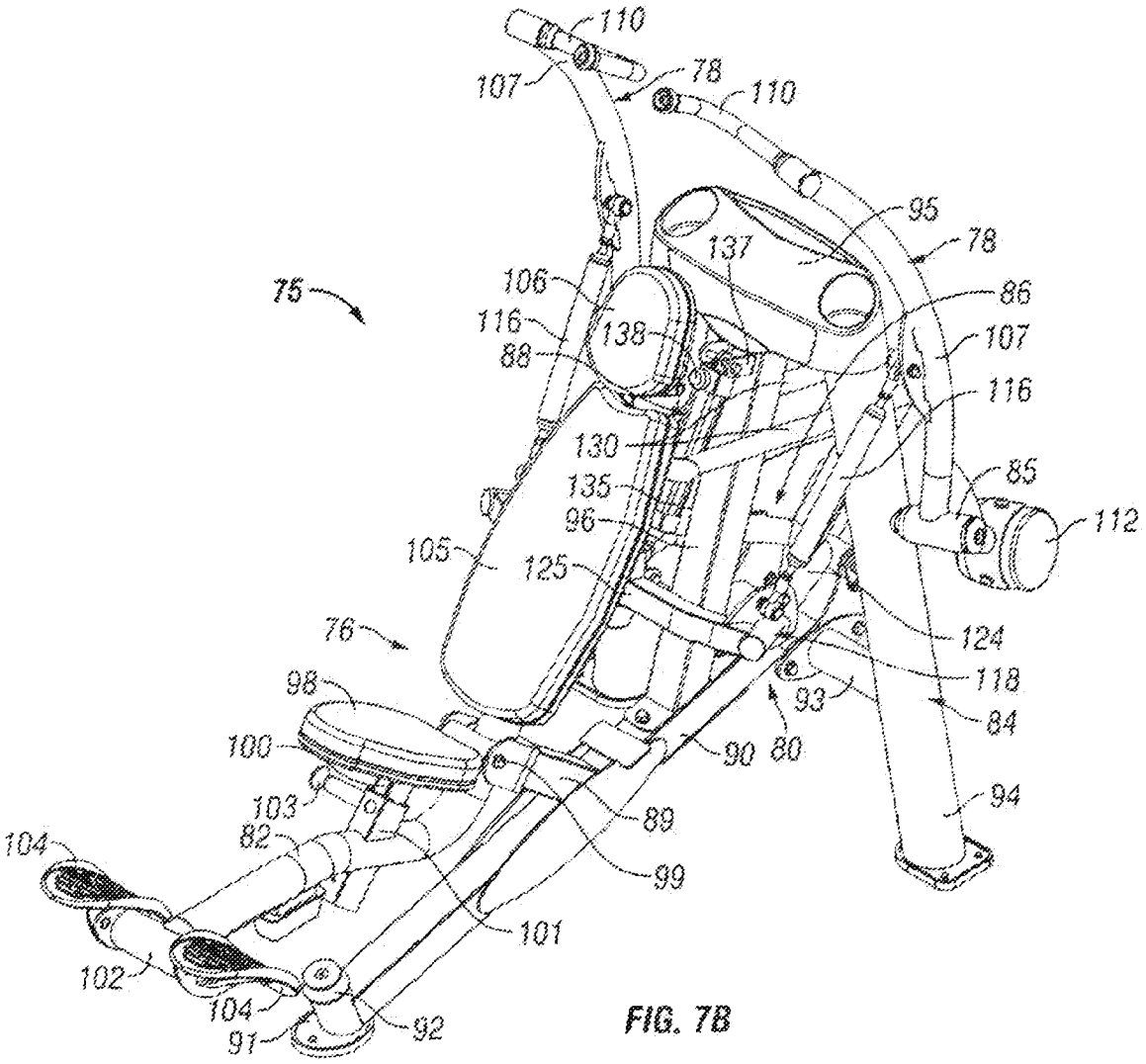
FIG. 7B is a front perspective view similar to FIG. 7A but illustrating the arms in the end position for a shoulder press exercise and the start position for a lat pulldown exercise.
Figure 8:
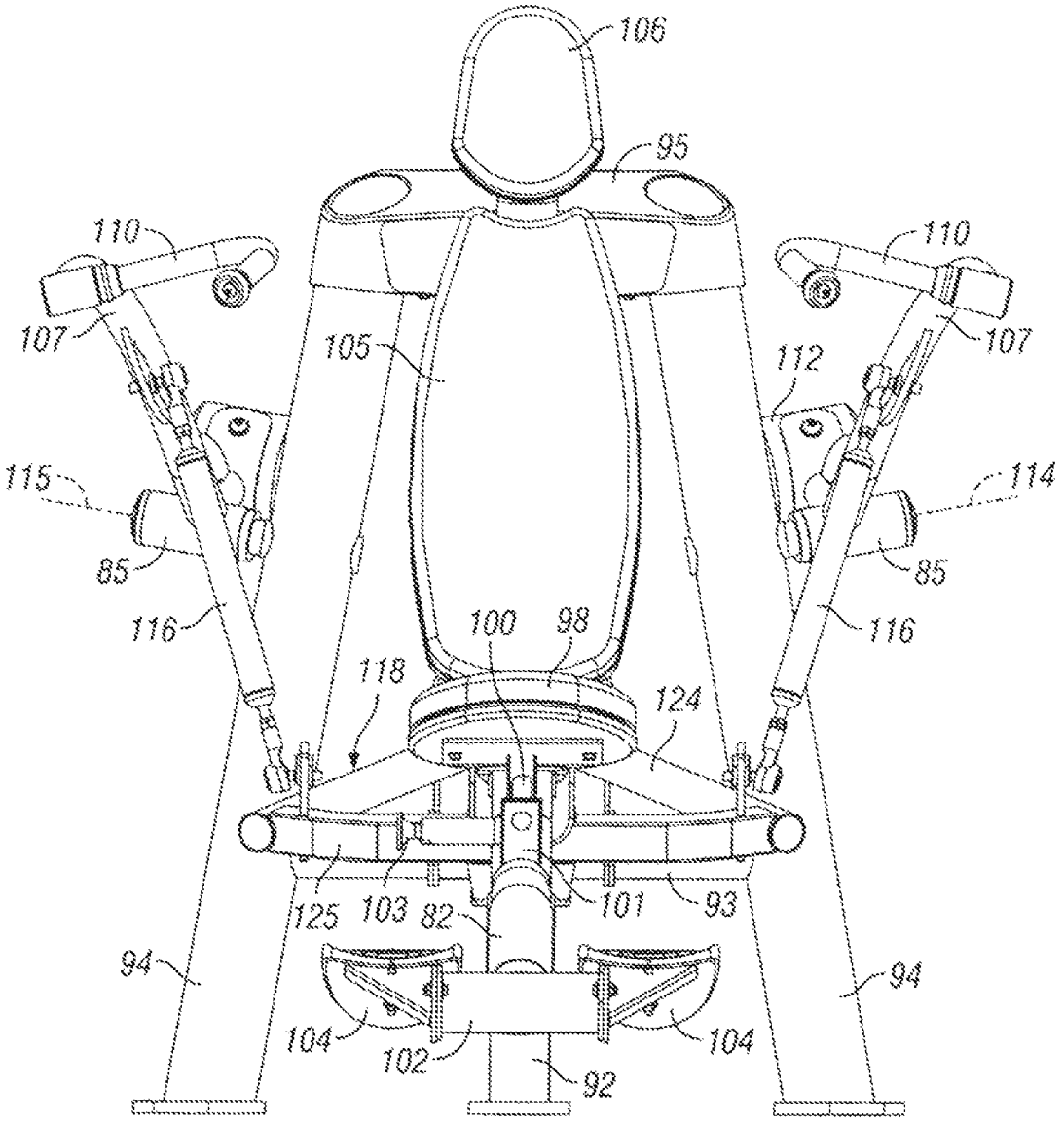
FIG. 8 is a front elevation view of the machine in the position of FIG. 7A.

In another mode of operation, the user support and exercise arms start in the position of FIGS. 7B, 9 and 10B, with the arms in the upper position and the user support inclined rearward, in order to perform a lat pulldown exercise. FIG. 10B illustrates a user 70 seated on the user support in this position with their arms raised above their head while gripping handles 110. From this position, the user pulls the handles downward, which in turn rotates the handles downward and outward in a diverging path, as can be seen by comparison of FIGS. 9 and 8, with the users hands following an equivalent path.

At the same time, the lifting arm 118 is pushed down by the tie rods 116 acting on the rods 124 at its forward end, rotating lifting arm 118 downward about pivot axis 128 to rotate the rear upright 120 forward, simultaneously urging the second links 130 forward and causing the user support to rotate forward about pivot axis 99, ending in a less reclined position with the base 82 resting on stop 92 at the forward end of the main frame. The end position for a lat pulldown exercise is illustrated in FIGS. 7A, 8, and 10A. In this position, the base portion 82 of the user support frame rests on stop post 92. This position is also the start position for a shoulder press exercise.

Resistance to both pushing and pulling of arms 78 is provided by the bi-directional gas shock or ram assembly 88, as described above. In this embodiment, as in the previous embodiment, the gravitational centerline or vertical centerline 140 of the user support pivot runs through the user support and the user in both the start and finish position of each exercise, as illustrated in FIGS. 10A and 10B. Regardless of whether the user performs a lat pull down or shoulder press exercise, there is a balanced distribution of weight on each side of the centerline 140 both at the start and end position, minimizing the effect that the weight of the exerciser and user support has on the exercise resistance. The amount of weight positioned on each side of centerline 140 varies only slightly from the start to the finish position. The combined weight of the user and user support has little effect on the amount of starting resistance because a substantially equal amount of weight is balanced rearward of the user support pivot. By the same token, because only a small portion of the user passes through the gravitational centerline during the exercise, there is no appreciable drop-off in resistance felt by the user.

FIGS. 11 to 15B illustrate a chest press exercise machine 150 according to another embodiment. The machine 150 is similar to the shoulder press machine 10 of the first embodiment, except that the user engagement device or exercise arm assembly 152 is pivoted to the main frame at an overhead location rather than behind the user, and like reference numbers are used for like parts as appropriate. As in the first embodiment, the machine has a stationary main frame 80 on which a user support 76 is pivotally mounted. Exercise arm assembly 152 in this embodiment comprises a pair of exercise arms or main arm portions 154 pivotally mounted on opposite sides of an upper end of upwardly and forwardly extending portion 155 of main frame upright 96, above the user support, to extend downwardly on opposite sides of the user support. A multiple part connecting linkage 86 similar or identical to the linkage of the first embodiment is provided between the exercise arms 154 and the user support 76 so that movement of the exercise arms is translated into movement of the user support. The connecting linkage 86 includes generally L-shaped lifting arm 14 which has oppositely directed weight plate receiving pegs 15 at its forward ends, as in the first embodiment.

Figure 14:
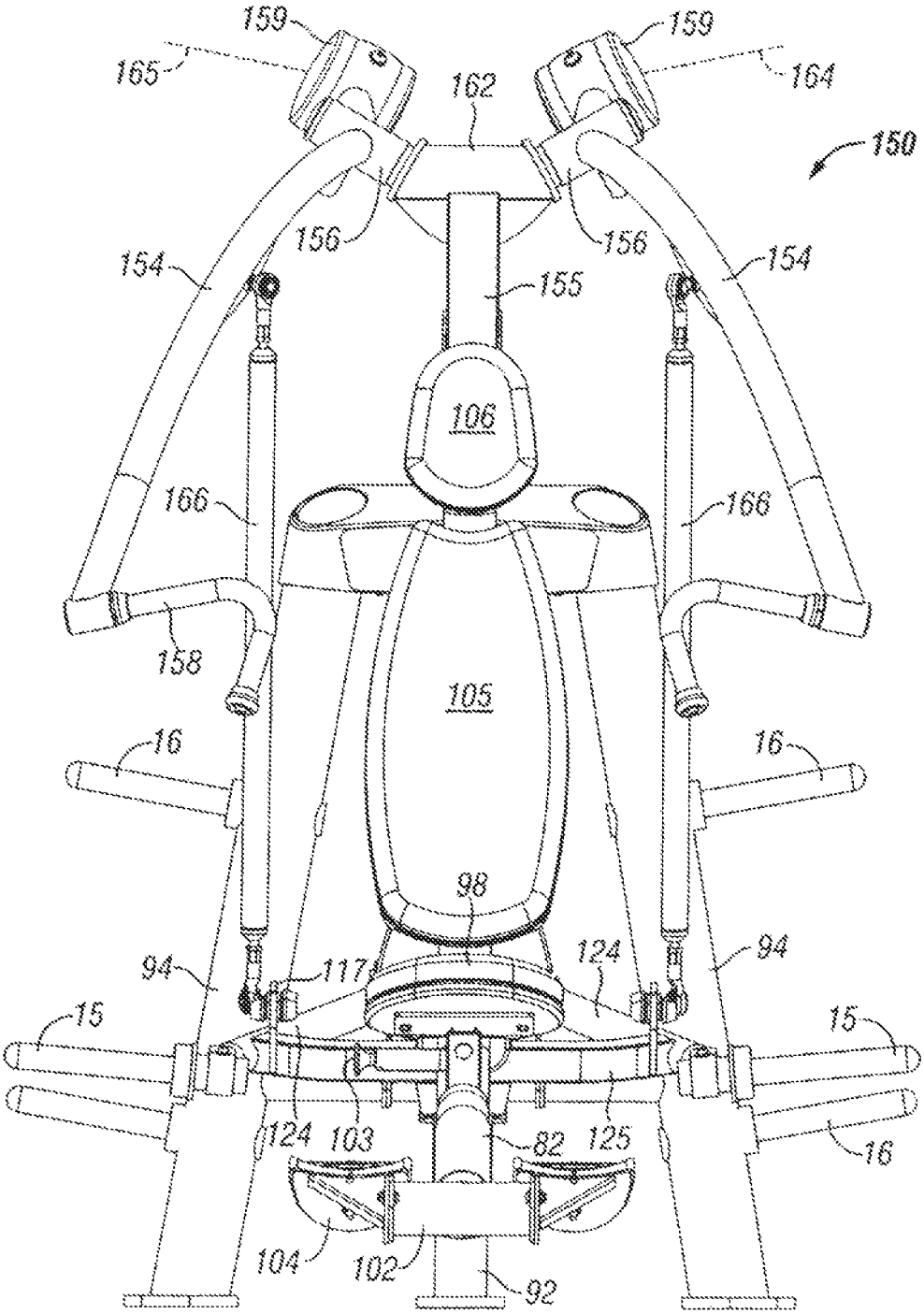
FIG. 14 is a front elevation view of the machine of FIGS. 11 to 13 in the exercise start position.

Each exercise arm 154 comprises an arcuate member having a first end secured to a respective pivot housing or sleeve 156. An inwardly directed angled user engaging portion comprising a handle or grip 158 is secured to the second end of each arcuate member. As in the previous embodiments, a counterweight 159 is secured to a rearward projection 160 of pivot sleeve 156 to offset or counterbalance the weight of the exercise arm. Pivot sleeves 156 are each pivotally secured to skewed pivot pins projecting from opposite ends of cross bar 162 at the upper end of rear upright extension 155, defining skewed, non-parallel pivot axes 164, 165, as best illustrated in FIG. 14. Due to the skewed pivot mounts, each arm is rotated in an inward or converging path as it rotates from the exercise start position of FIG. 11 to the exercise end position of FIG. 12.

As in the previous embodiments, the connecting linkage 86 comprises multiple links between each exercise arm and the user support, the links including lifting arm 14. A pair of first links or tie rods 166 (similar to the tie rods 116 of the previous embodiments but of increased length due to the higher mounting point of the exercise arms) each have a first end pivotally connected to the respective exercise arm 154 at a location spaced between the pivot mount and handle, and a second end pivotally connected to forward end portions of the L-shaped lifting arm 14. Lifting arm 14 has a generally upwardly extending rear portion 120 secured to a pivot sleeve 122 at its lower end (FIG. 3), and a pair of outwardly diverging rods or bars 124 extending forward from pivot sleeve 122, as illustrated in FIGS. 1 to 3 and 5. Rods 124 are secured together by a cross bar 125 at a location close to their forward ends, and the lower ends of tie rods 166 are pivoted to respective brackets 117 adjacent the outer ends of cross bar 125, as best illustrated in FIGS. 11 to 14. As in the previous embodiments, there are two possible anchor points 24, 25 for the lower ends of rods 166, and the tie rods are shown anchored to the rear anchor point 25 in the drawings. They may alternatively be anchored to the forward anchor point to adjust the handle start position. Respective weight plate mounting pegs 15 extend outwardly from the forward ends of the respective rods 124. Storage pegs 16 for weight plates are also provided on the respective main frame uprights 94. Pivot sleeve 122 of the lifting arm 14 is rotatably mounted on a pivot pin extending between pivot brackets 126 mounted on the main frame cross bar 93 for rotation about pivot axis 128, as in the previous embodiments. Two parallel second links 130 are each pivotally secured at their rear ends to the upper end of rear portion 120 of lifting arm 14 for rotation about pivot axis 132, and are pivotally secured at their forward ends to the rear upright 83 of the user support, for rotation about pivot axis 134. As in the previous embodiments, this multiple pivot link arrangement translates movement of the exercise arms into movement of the user support. At the same time, the lifting arm 14 of the connecting link is loaded by weight plates 18 on pegs 15 at the ends of the rods 124 of the lifting arm 14 to provide a selected amount of exercise resistance. In an alternative embodiment, the resistance may be provided by a bi-directional hydraulic ram or gas shock assembly, as in the embodiment of FIGS. 7 to 10, so that both pushing and pulling exercises can be carried out using arms 154.

Figure 15A:
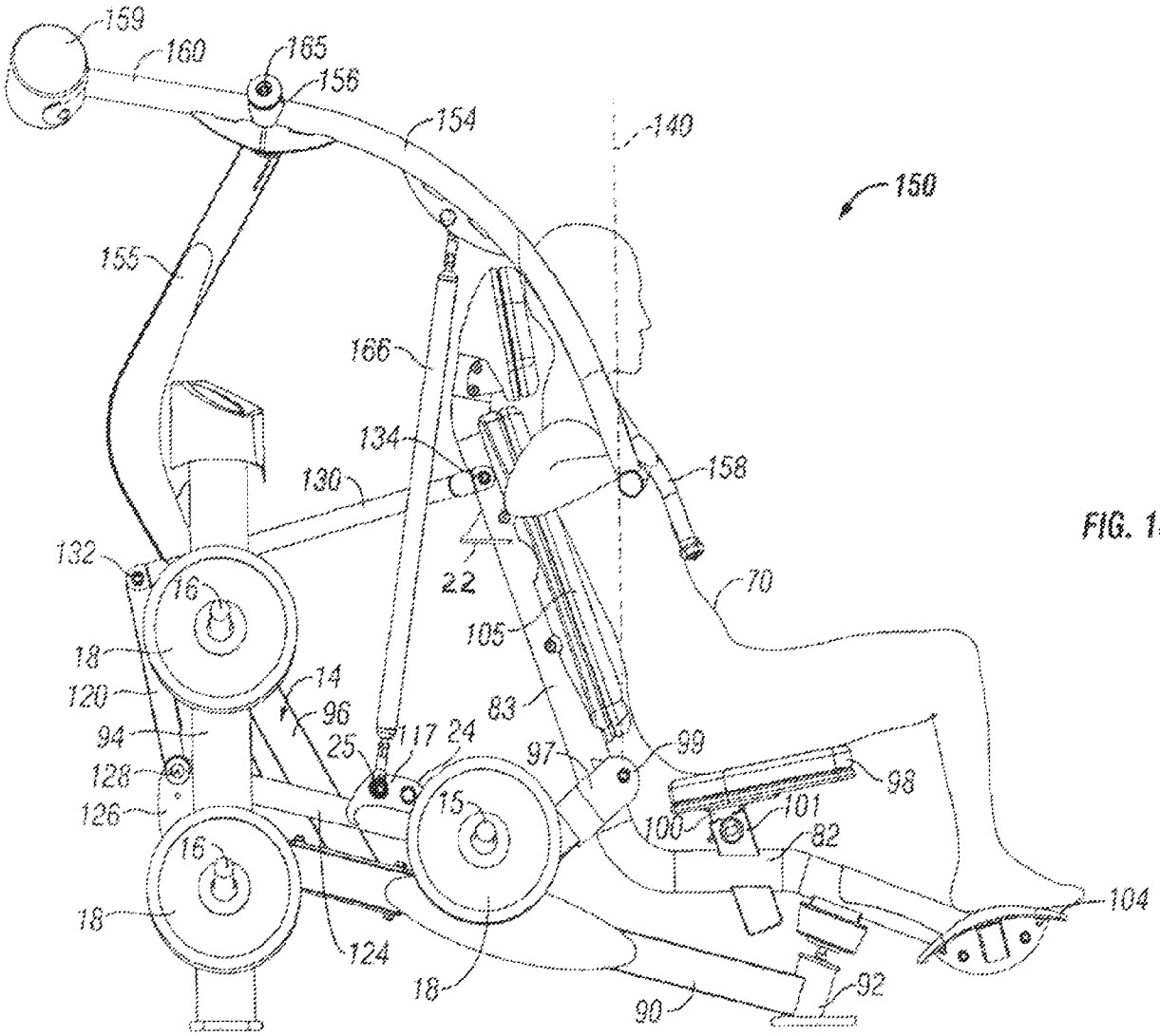
FIG. 15A is a side elevation view of the machine of FIGS. 11 to 14 with a user seated on the machine in the start position of a chest press exercise.

The exercise arms 154 may be used to perform a chest press exercise with the user support and exercise arms starting in the position of FIGS. 11, 13, 14, and 15A. In this position, the user support is in a slightly reclined orientation, and the handles 158 are located on opposite sides of the user support approximately at the chest height of a user 70 seated on the user support, as illustrated in FIG. 15A. FIG. 15A illustrates a user 70 seated on the user support in the start position for a chest press, with their hands gripping handles 158. From this position, the user pushes their hands forwards away from their body, which in turn rotates the handles upward and inward in a converging path, as can be seen by comparison of FIGS. 11 and 12. As the user presses or pushes the exercise arms upward between the position of FIG. 15A and the end position of FIG. 15B, the exercise arms pull tie rods 166 upwards, pulling both of the rods 124 of the lifting arm 14 upward adjacent their forward ends and lifting any weight plates 18 mounted on pegs 15, providing the exercise resistance. This simultaneously rotates the rear upright portion 120 of the generally L-shaped lifting arm 14 rearward and downward about pivot axis 128, pulling the second links 130 rearward and causing the user support to rotate rearward about pivot axis 99, ending in a more rearwardly reclined position. The user ends the chest press exercise with their arms extending straight outward in front of their chest, as seen in FIG. 15B.

Figure 15B:
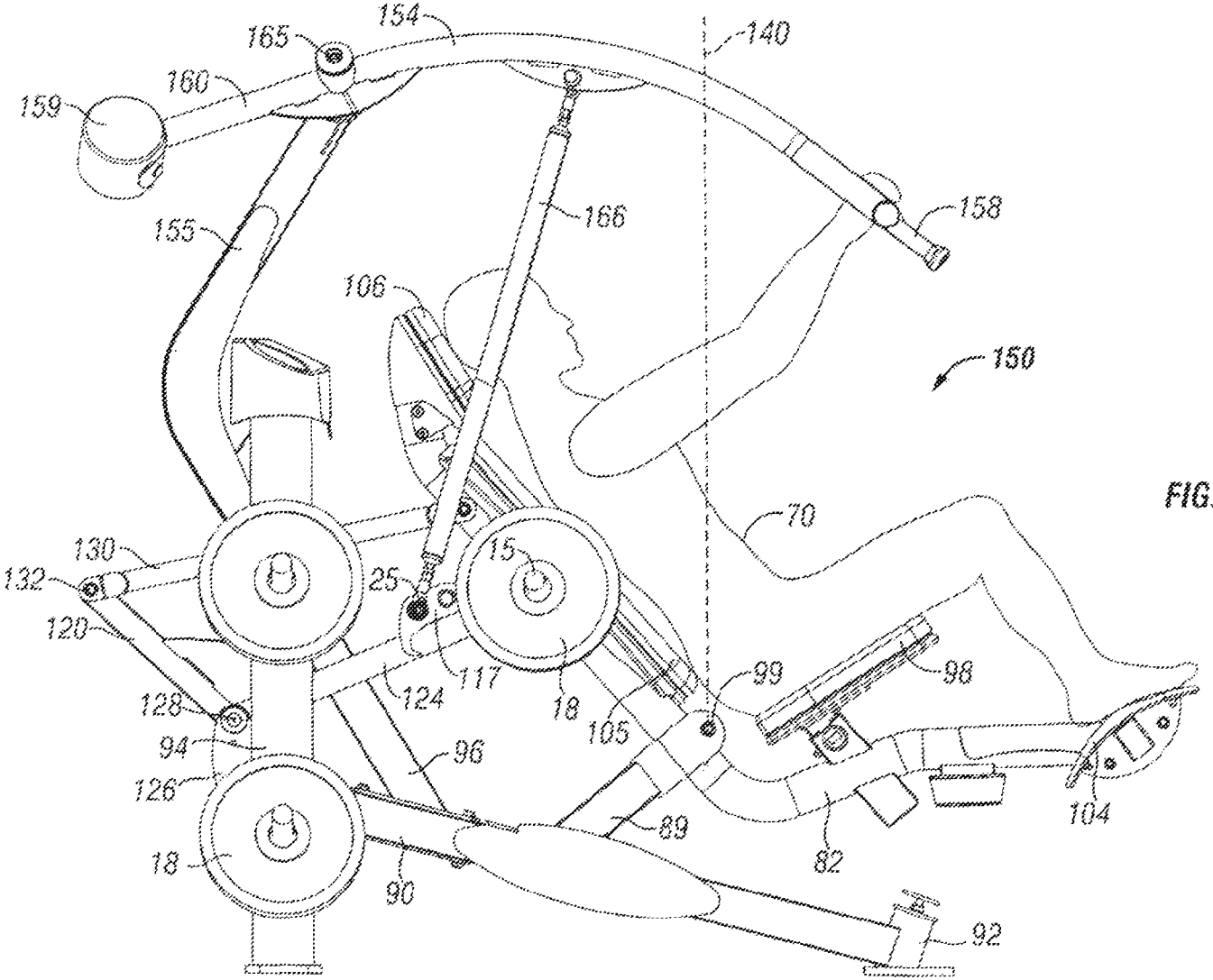
FIG. 15B is a side elevation view similar to FIG. 15A but illustrating the end position of the chest press exercise.
Figure 16:
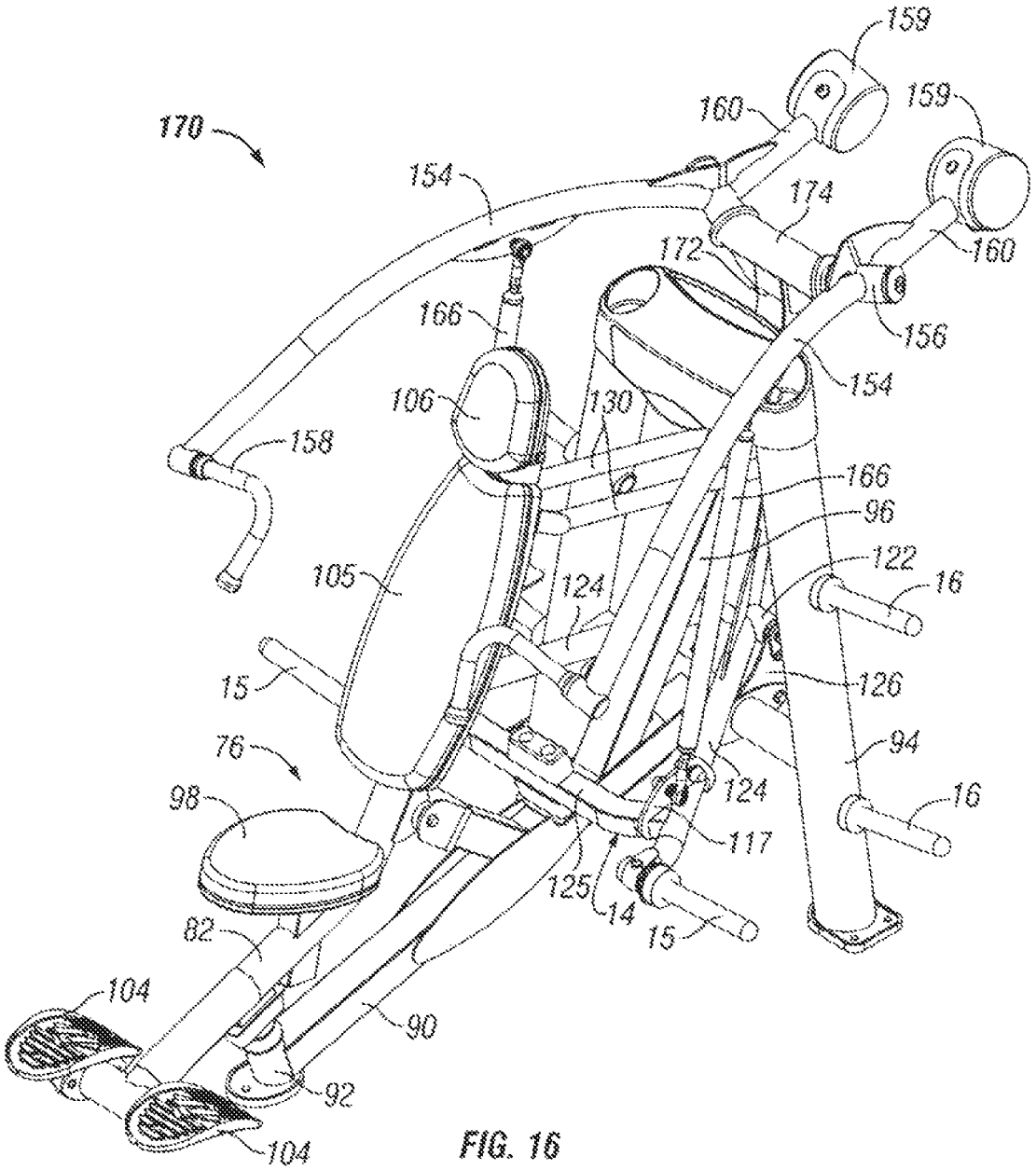
FIG. 16 is a front perspective view of an incline press exercise machine which is similar to the machine of FIGS. 11 to 15B but which has a lower pivot point for the exercise arms, with the machine shown in a start position for an incline press exercise.
Figure 17:
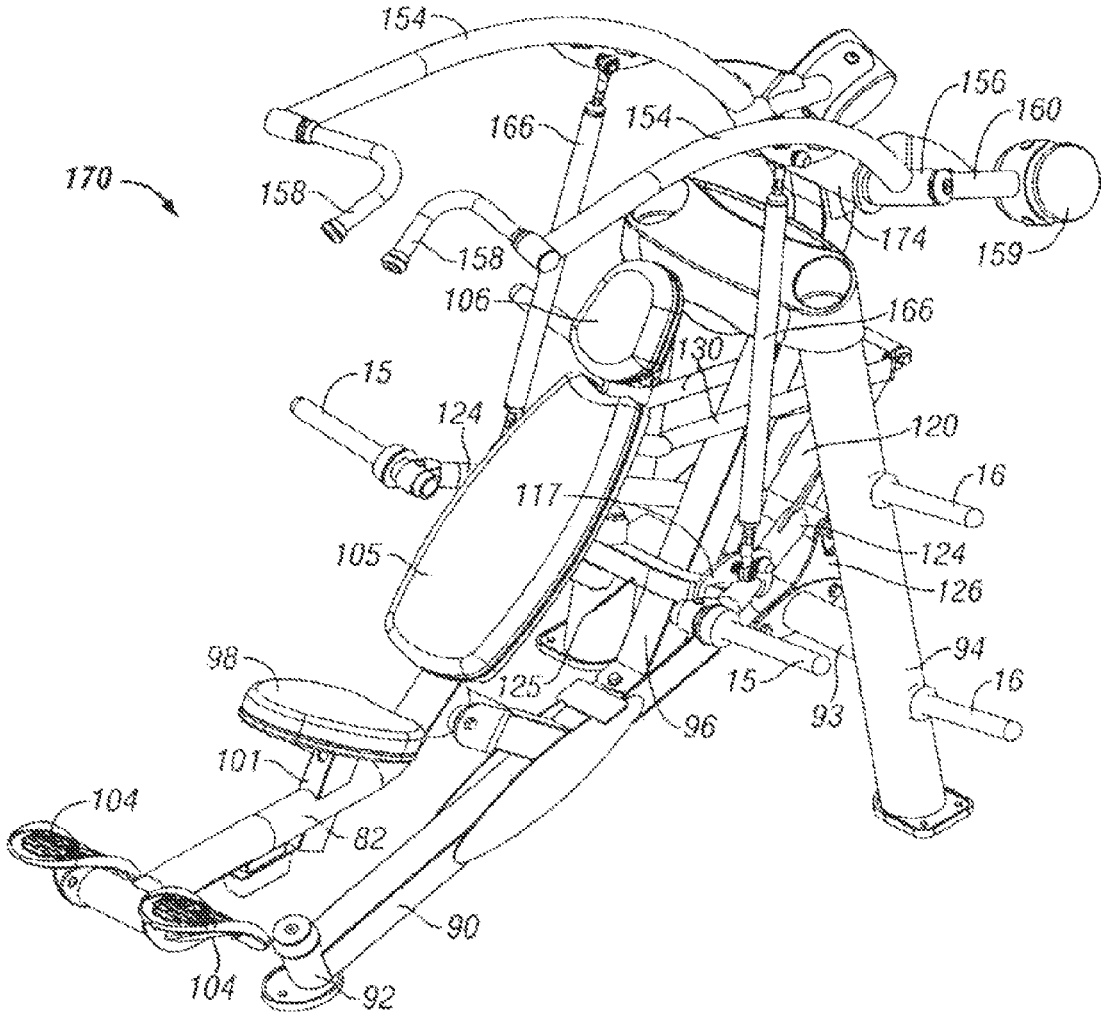
FIG. 17 is a front perspective view similar to FIG. 16 but illustrating the end position for an incline press exercise.
Figure 18:
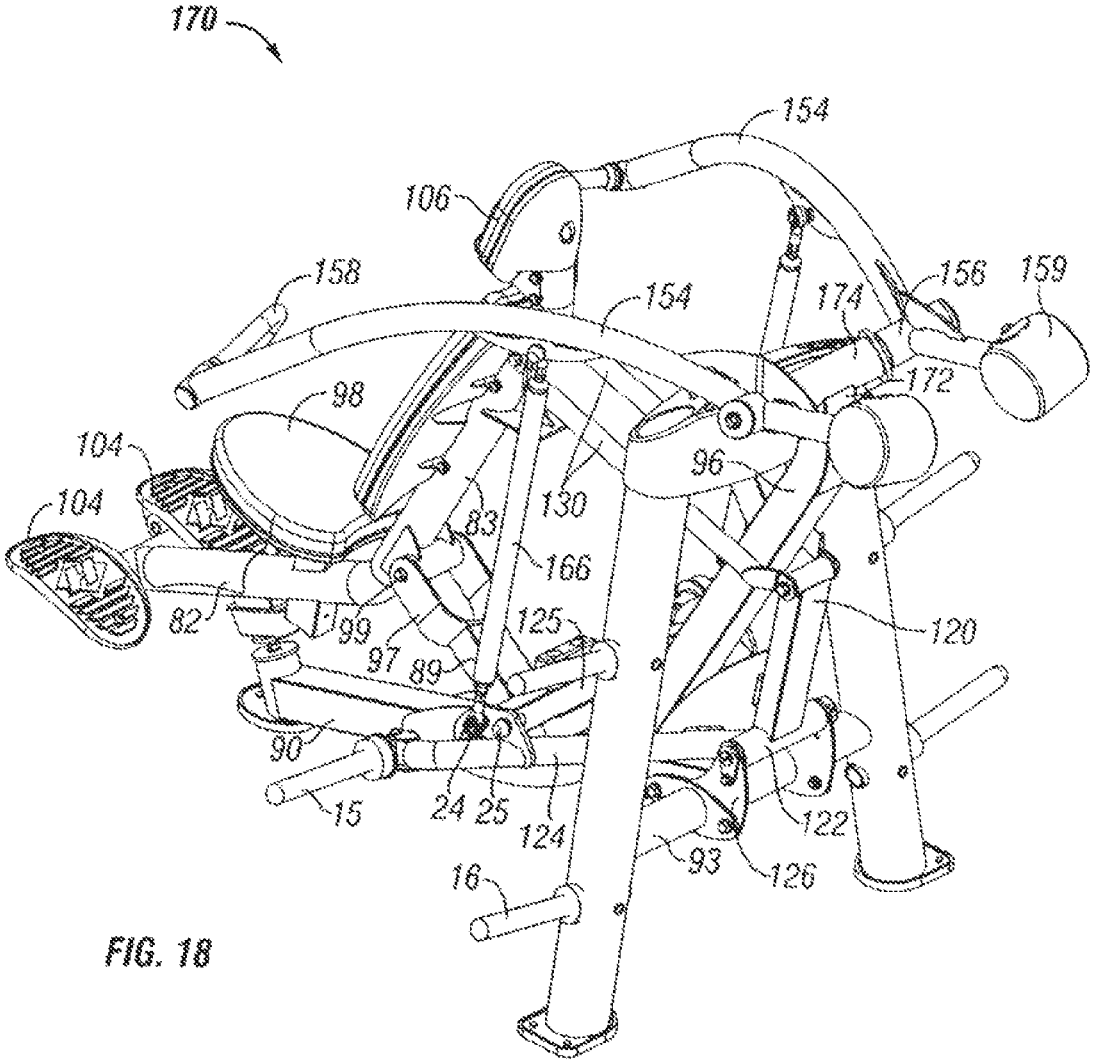
FIG. 18 is a rear perspective view of the incline press machine in the start position of FIG. 16.
Figure 19:
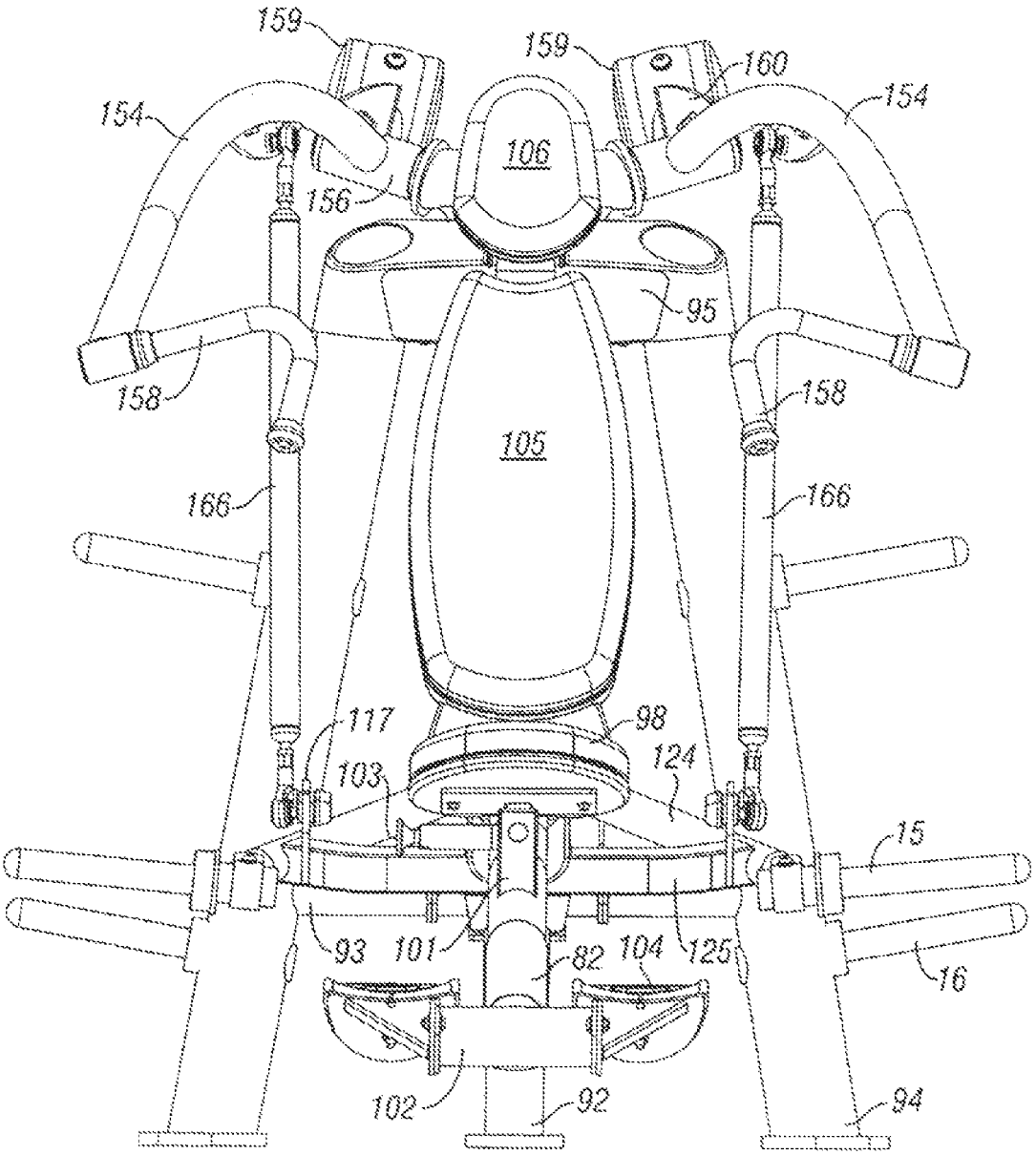
FIG. 19 is a front elevation view of the incline press machine in the start position of FIGS. 16 and 18.

FIGS. 15A and 15B also illustrate the vertical gravitational centerline 140 of the user support's pivotal motion, which extends vertically through the user support pivot 99. As in the previous embodiments, there is a balanced distribution of weight on each side of the centerline 140 both at the start and end position, minimizing the effect that the weight of the exerciser and user support has on the exercise resistance. The amount of weight positioned on each side of centerline 140 varies only slightly from the start to the finish position. The combined weight of the user and user support has little effect on the amount of starting resistance because a substantially equal amount of weight is balanced rearward of the user support pivot. By the same token, because only a small portion of the user passes through the gravitational centerline during the exercise, there is no appreciable drop-off in resistance felt by the user.

FIGS. 16 to 20B illustrate an incline press exercise machine 170 which is very similar to the chest press exercise machine 150 of the previous embodiment but has a lower pivot mount for the user engagement device or exercise arms in order to produce an incline press movement rather than a straight chest press movement, as explained in more detail below. All parts of the machine 170 are identical to the machine 150 apart from the exercise arm pivot mount, and like reference numbers are used for like parts as appropriate. Reference is made to the description of the previous embodiments for a detailed explanation of all like numbered parts.

The main frame upright 96 in this embodiment has only a short upward extension 172 which is shorter than the upward and forward extension of the previous embodiment, with a longer cross bar 174 across the upper end of extension 172. Pivot sleeves 156 on arcuate exercise arms 154 are pivotally secured at opposite ends of cross bar 174 via pivot pins for rotation about skewed pivot axes as illustrated in FIGS. 16 to 19. In this embodiment, the exercise arms 154 are pivoted to the main frame at a location in line with the upper end of head rest pad 106 of the user support 76, as seen in FIGS. 20A and 20B.

Figure 20A:
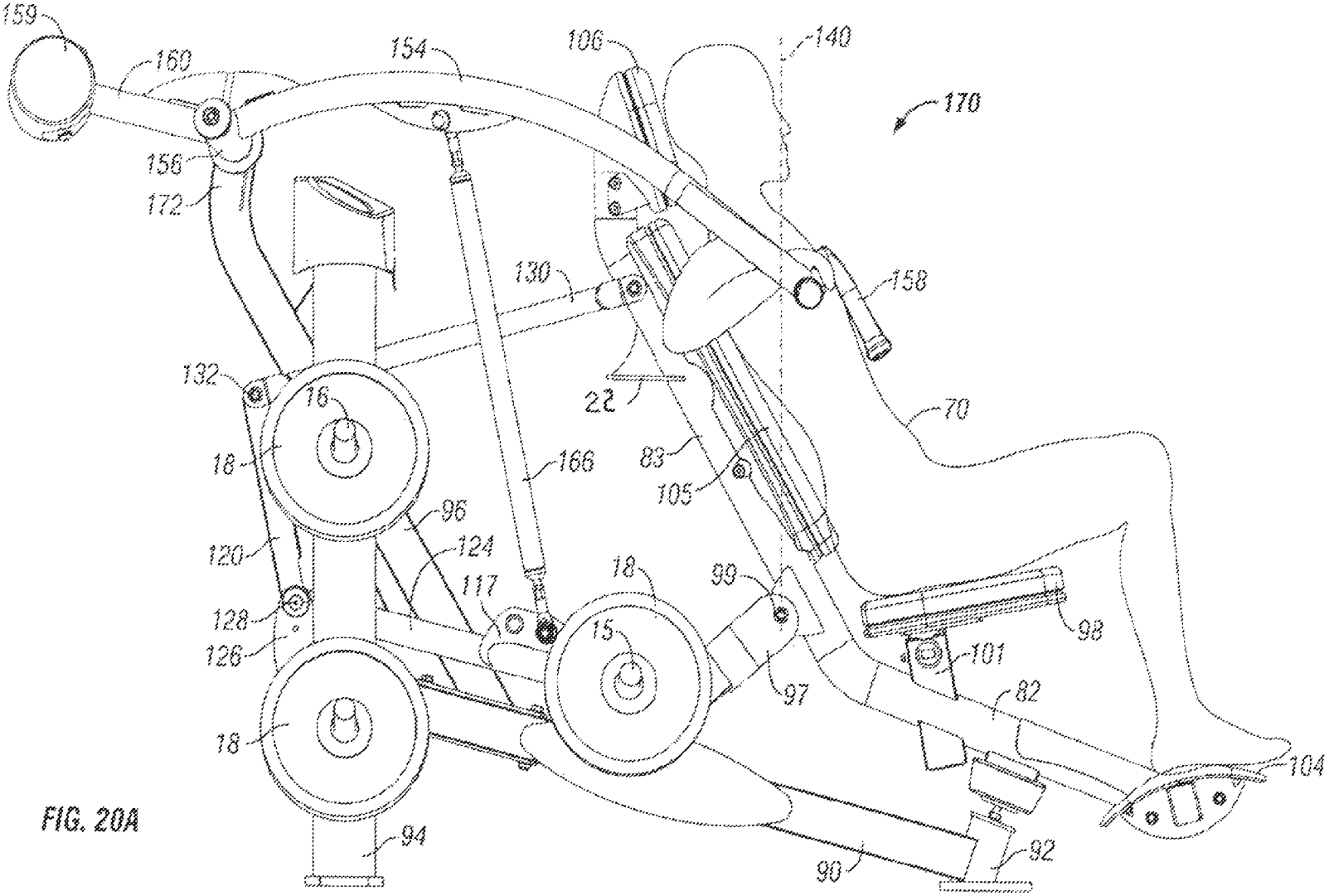
FIG. 20A is a side elevation view of the machine of FIGS. 16 to 19 with a user seated on the machine in the start position of an incline press exercise.

The exercise arms 154 may be used to perform an incline press exercise with the user support and exercise arms starting in the position of FIGS. 16, 18, 19, and 20A. In this position, the user support is in a slightly reclined orientation, and the handles 158 are located on opposite sides of the user support approximately at the chest height of a user 70 seated on the user support in the start position for an incline press, as illustrated in FIG. 20A, with their hands gripping handles 158. From this position, the user pushes their hands away from their body, which in turn rotates the handles upward and inward in a converging path, as can be seen by comparison of FIGS. 16 and 17. As the user presses or pushes the exercise arms upward between the position of FIG. 20A and the end position of FIG. 20B, the exercise arms pull first links or tie rods 166 upwards, pulling both of the rods 124 of the lifting arm 14 upward adjacent their forward ends and lifting any weight plates 18 mounted on pins 15, providing the exercise resistance. This simultaneously rotates the rear upright portion 120 of the generally L-shaped lifting arm 14 rearward and downward about pivot axis 128, pulling the second links 130 rearward and causing the user support to rotate rearward about pivot axis 99, ending in a more rearwardly reclined position. Due to the lower pivot mount for the exercise arms in this embodiment, as compared to the chest press pivot mount of the previous embodiment, the user ends the incline press exercise with their arms extending forward and upward at an angle from their chest, as seen in FIG. 20B. This results in an incline press exercise movement which exercises different chest muscles from the previous embodiment.

Figure 20B:
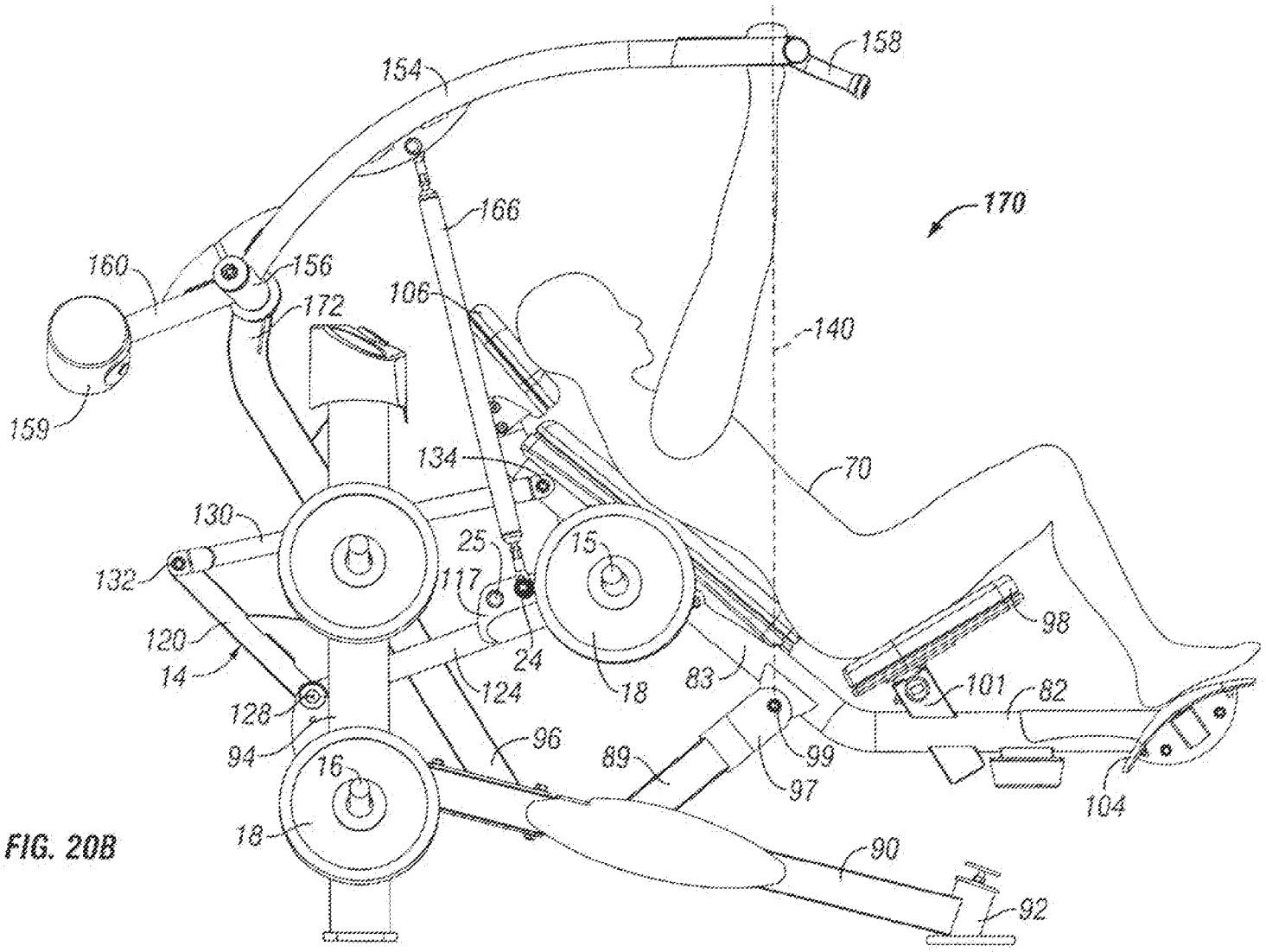
FIG. 20B is a side elevation view similar to FIG. 20A but illustrating the end position of the incline press exercise.
Figure 21:
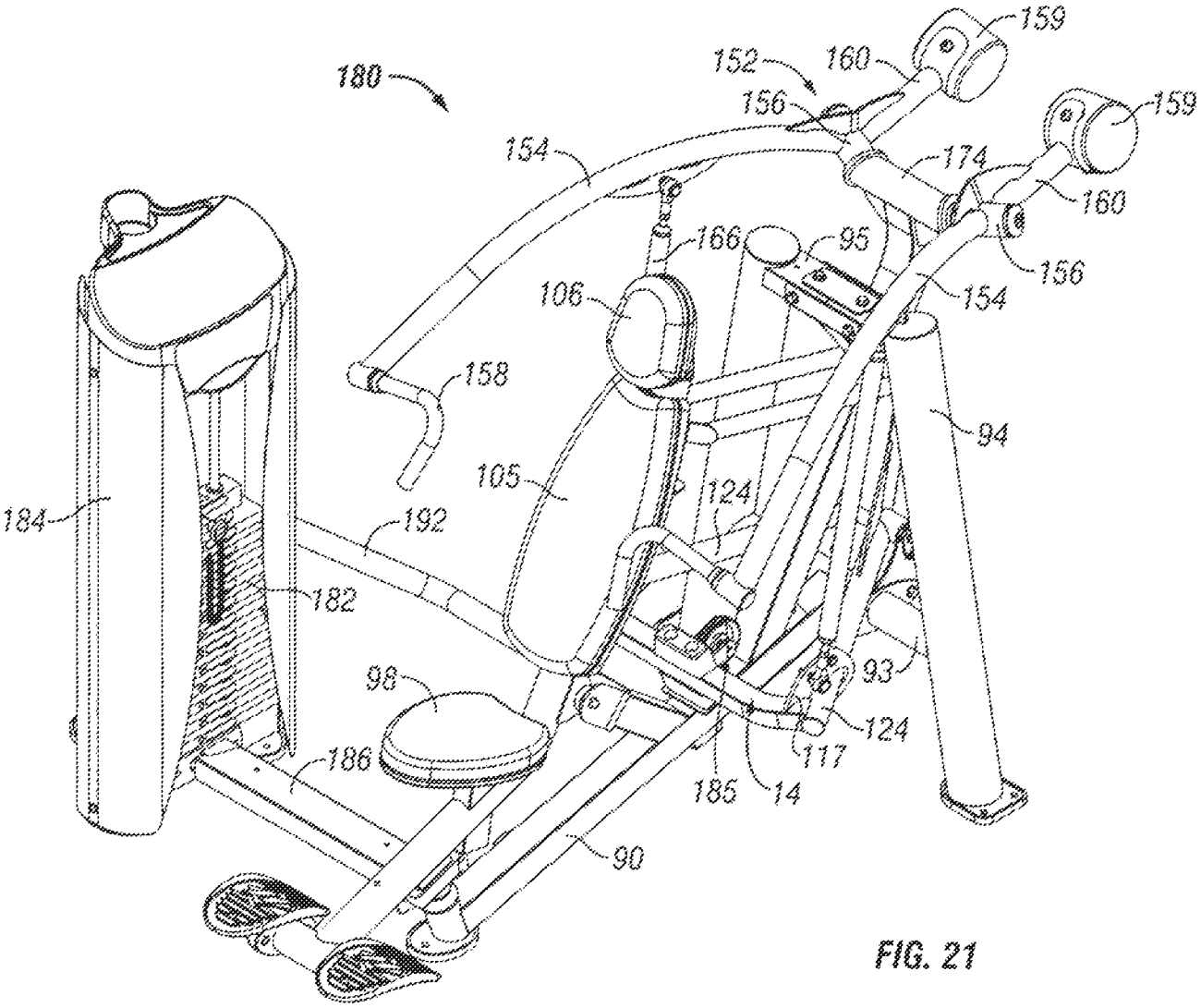
FIG. 21 is a front perspective view of an incline press machine similar to the machine of FIGS. 16 to 20B but with the load provided by a weight stack rather than weight plates, with the machine in a start position for an incline press exercise.
Figure 22:
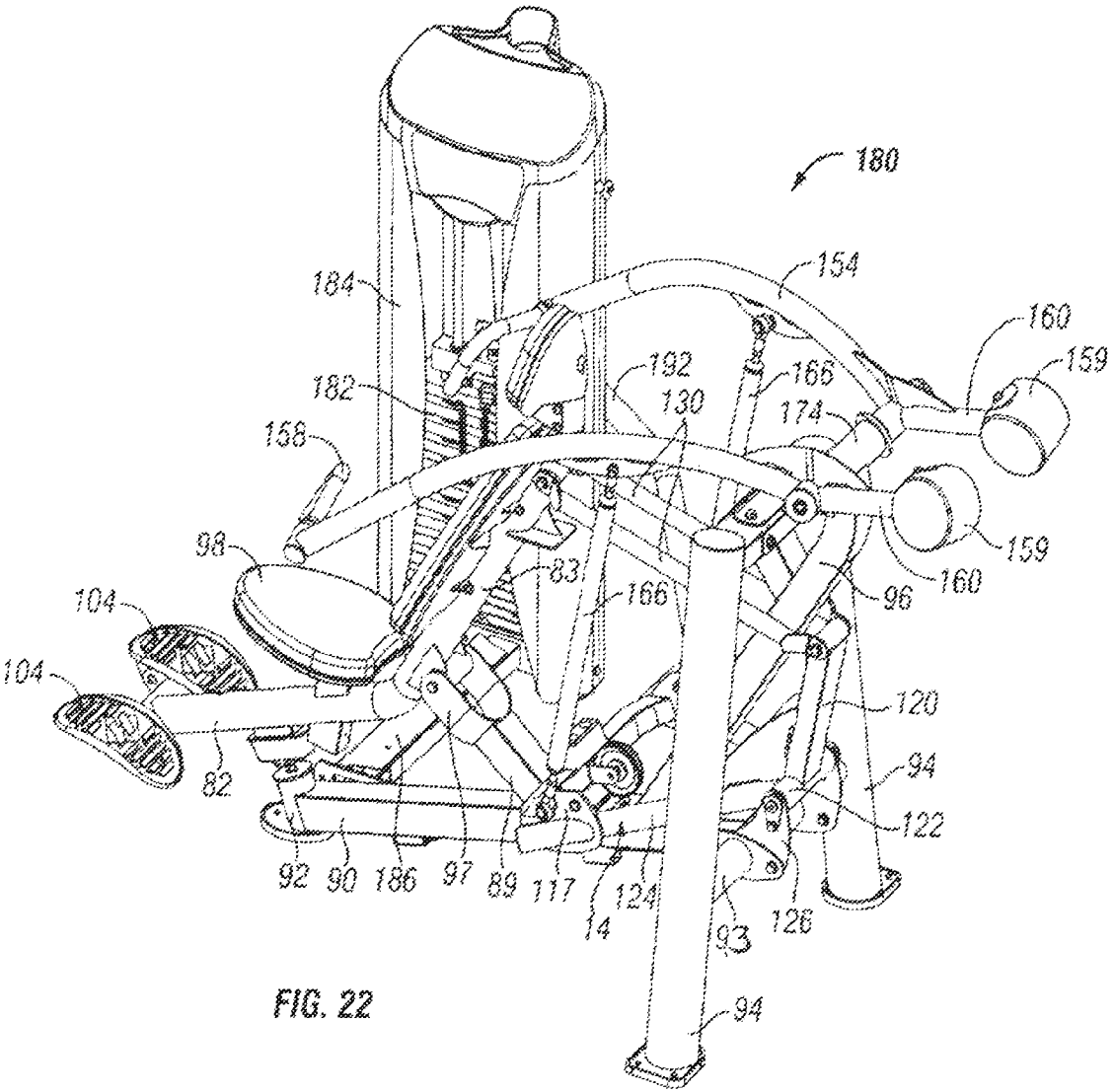
FIG. 22 is a rear perspective view of the incline press machine in the start position of FIG. 21.
Figure 23:
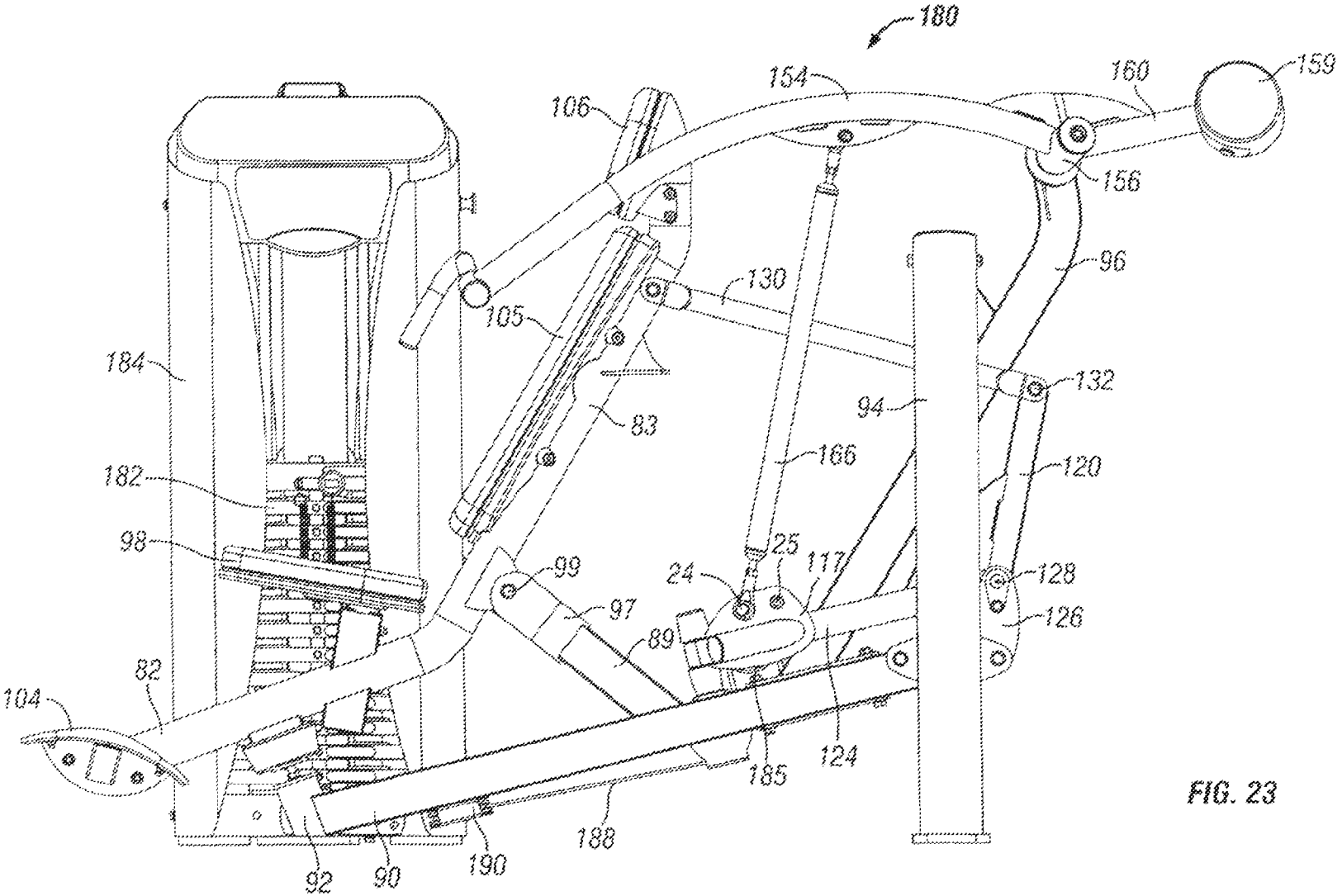
FIG. 23 is a side elevation view of the machine of FIGS. 21 and 22 in the start position of an incline press exercise.

FIGS. 20A and 20B also illustrate the vertical gravitational centerline 140 of the user support's pivotal motion, which extends vertically through the user support pivot 99. As in the previous embodiments, there is a balanced distribution of weight on each side of the centerline 140 both at the start and end position, minimizing the effect that the weight of the exerciser and user support has on the exercise resistance. The amount of weight positioned on each side of centerline 140 varies only slightly from the start to the finish position. The combined weight of the user and user support has little effect on the amount of starting resistance because a substantially equal amount of weight is balanced rearward of the user support pivot. By the same token, because only a small portion of the user passes through the gravitational centerline during the exercise, there is no appreciable drop-off in resistance felt by the user.

FIGS. 21 to 25 illustrate a modified incline press exercise machine 180 which is identical to the incline press exercise machine 170 in all respects apart from the exercise resistance, and like reference numbers are used for like parts as appropriate. Reference is made to the description of the previous embodiments for an explanation of these parts. In this embodiment, the exercise resistance is provided by a weight stack 182 secured to lifting arm 14 via a cable and pulley linkage, and this resistance replaces the weight plates 18 of the previous embodiment.

Figure 24:
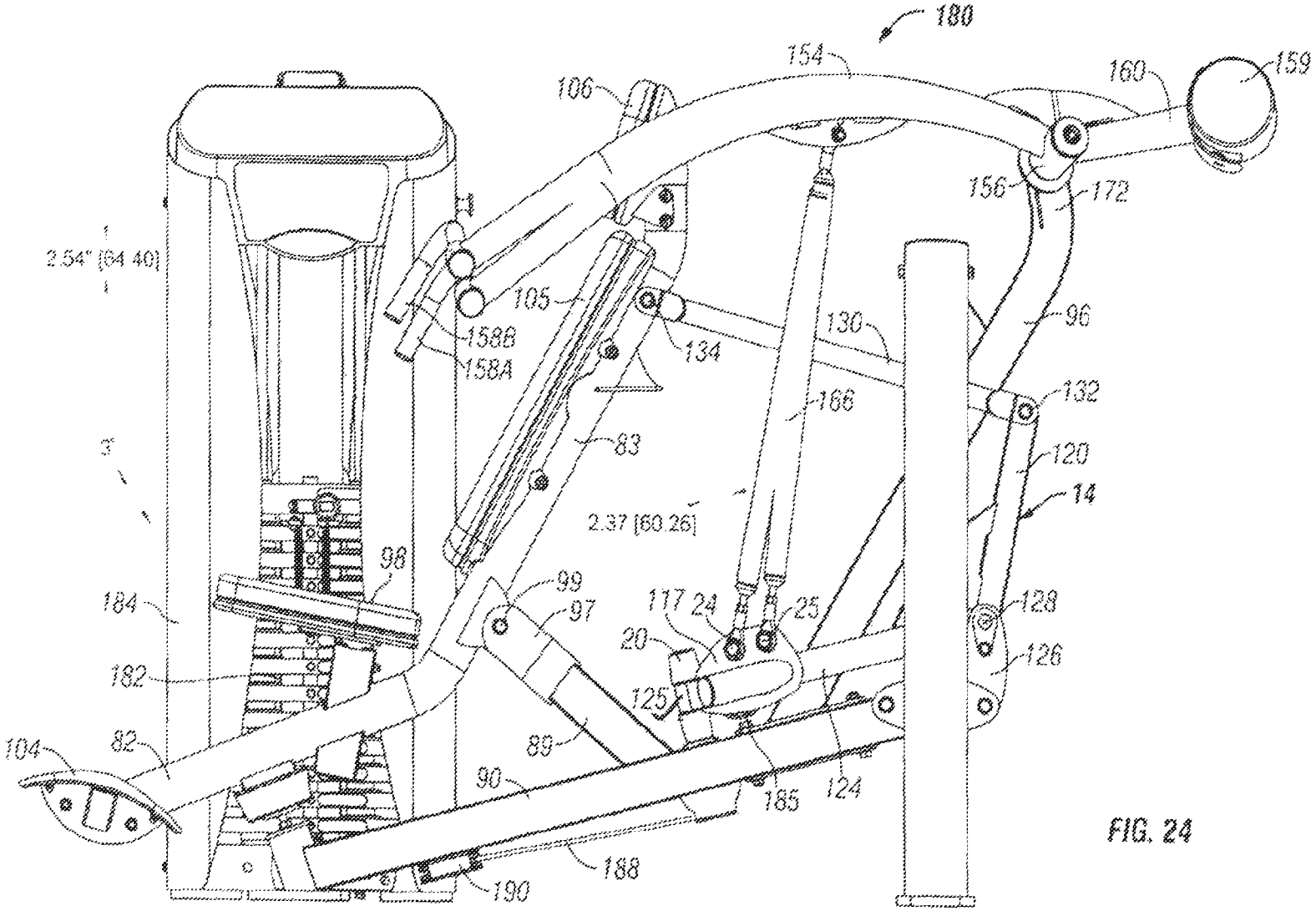
FIG. 24 is a side elevation view similar to FIG. 23 but illustrating two alternative attachment points for the connecting link between the exercise arm and lifting arm.
Figure 25:
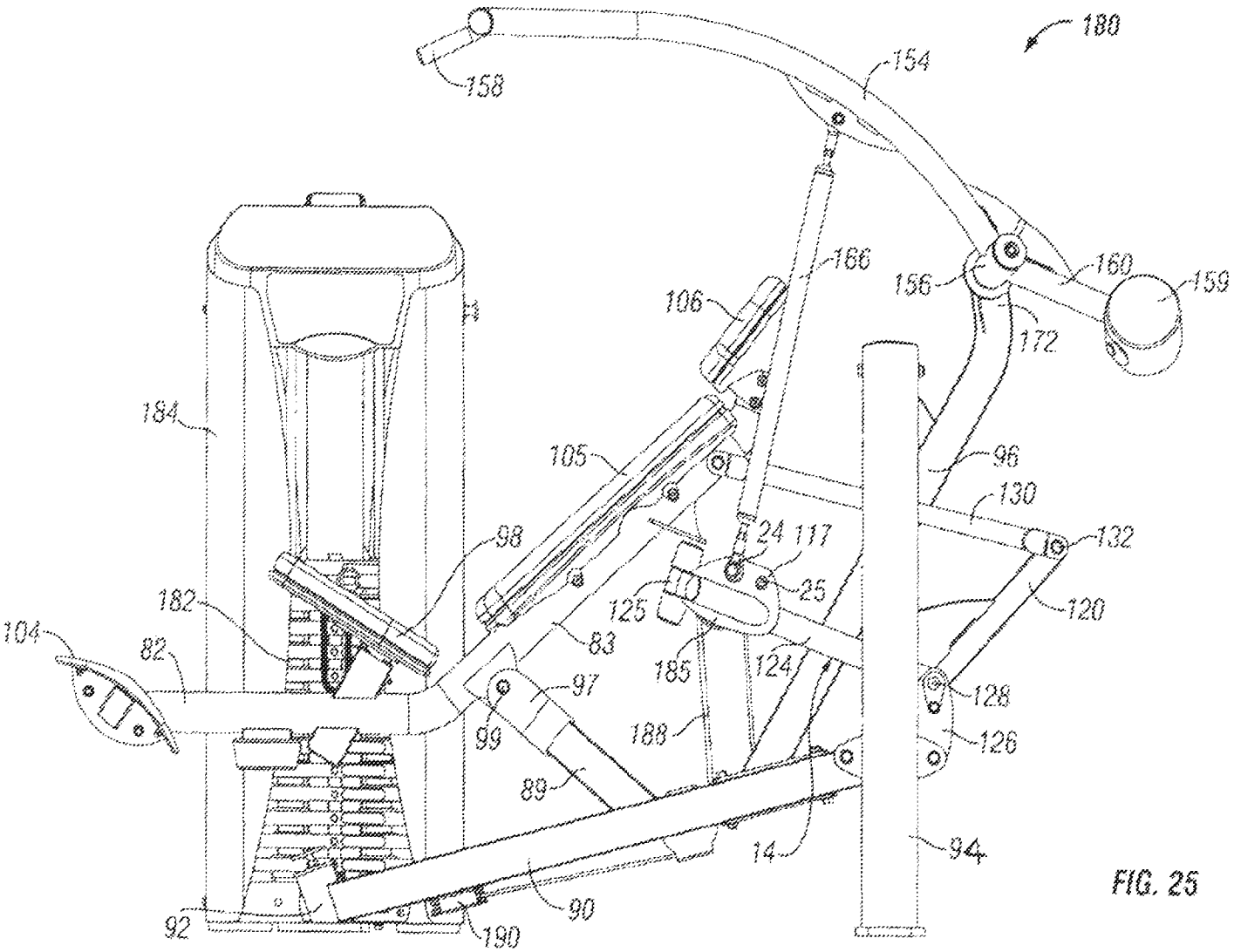
FIG. 25 is a side elevation view similar to FIG. 23 but illustrating the end position of an incline press exercise.

In this embodiment, the forward extension of rods or bars 124 of the lifting arm in the previous embodiment, which included the weight pins 15, is eliminated. The lifting arm 14 is instead linked to the weight stack 182 in housing 184 via a cable and pulley linkage. The linkage comprises one or more cables 188 (see FIGS. 23 and 24). Cable 188 extends from an anchor on base 90 around a pulley 185 mounted at the center of lifting arm cross bar 125 around additional pulleys including pulley 190 in the base 90 of the main frame, and around one or more pulleys (not visible in the drawings) in a connecting strut or tube 186 between the base 90 and weight stack housing 184. The cable then extends over further pulleys (not visible in the drawings) before linking in any conventional manner with the weight stack. An additional support strut 192 extends from the main frame to the weight stack housing 184. In this embodiment, when the exercise arms are actuated by a user to lift the lifting arm 14, as illustrated in FIGS. 24 and 25, this simultaneously pulls on the cable 188 linking the lifting arm to weights in the weight stack 182, lifting the selected number of weights. Since operation of this embodiment is otherwise identical to that of the previous embodiment, reference is made to the description of the previous embodiment as regards the exercise movement.

As in the previous embodiments, the tie rods 166 which connect the exercise arms 154 to the lifting arm 14 may be pivotally linked to rods or bars 124 either at anchor point 24 or at anchor point 25, so as to adjust the start position for handles 158, as illustrated in FIG. 24. In FIGS. 21 to 23 and 25, the tie rods are pivotally linked to the forward anchor 24. This results in handle position 158A as illustrated in FIG. 24. Movement of the tie rods 166 to the rear anchor results in a handle start position 158B as illustrated in FIG. 24, shifting the handles upwardly by about 2.54 inches. This adjustment may be made in any of the foregoing embodiments to provide an appropriate start position for different size users.

In each of the exercise machines described above, the exercise resistance is associated with a lifting arm forming part of a connecting linkage which translates movement of exercise arms into movement of a user support. In any of the previous embodiments, the resistance may be provided by weight plates loaded directly on the lifting arms as in the first embodiment and the embodiments of FIGS. 11 to 20, or by a bi-directional ram or gas shock assembly as in the embodiment of FIGS. 7 to 10, or by a weight stack as in the embodiment of FIGS. 21 to 25. Other alternative types of exercise resistance may be used in other embodiments.

FIGS. 26 to 32B illustrate a decline press exercise machine or apparatus 200 according to another embodiment. The main frame and connecting linkage in this embodiment are similar in some respects to the main frame and connecting linkage of the previous embodiments, and like reference numbers are used for like parts as appropriate. However, unlike the previous embodiments, the user engagement device or exercise arm assembly 202 in this embodiment is pivoted on the base 90 of the main frame 80, below user support 76, and the connecting linkage 204 is modified, as explained in more detail below.

As in the previous embodiments, the main frame 80 comprises base 90 and rear upright portion 84. The base has a ground engaging foot 91 at its forward end, and a short stand off post 92 projects upwards from foot 91. The base is inclined upwardly from the front to the rear end, and is secured to a horizontal cross bar 93 of the rear upright portion at its rear end. Rear upright portion 84 has a pair of upright struts 94 connected together by a cross member 95 at their upper ends, and by cross bar 93 at a location spaced below their upper ends, with the upright struts 94 inclined outward to form a generally A-frame structure. Weight plate storage pegs 16 are located on the outer sides of the upright struts 94. A central, rearwardly inclined upright strut 96 extends from base 90 at a location spaced forward from cross bar 93 to cross member 95. A forwardly inclined pivot support strut 89 extends upwardly from the base 90 at a location spaced forward from central upright strut 96.

Figure 28:
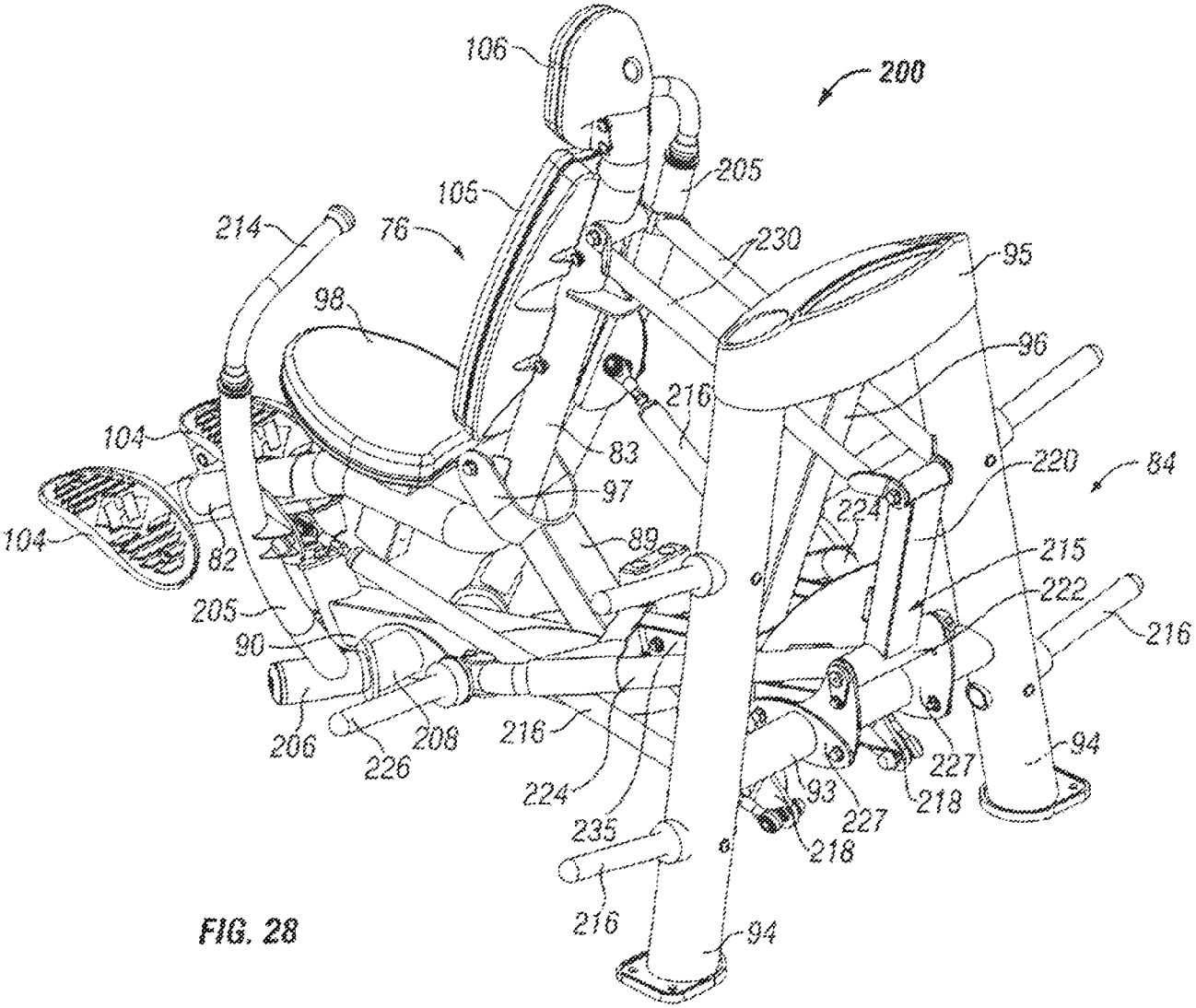
FIG. 28 is a rear perspective view of the decline press machine in the start position of FIG. 26.
Figure 31A:
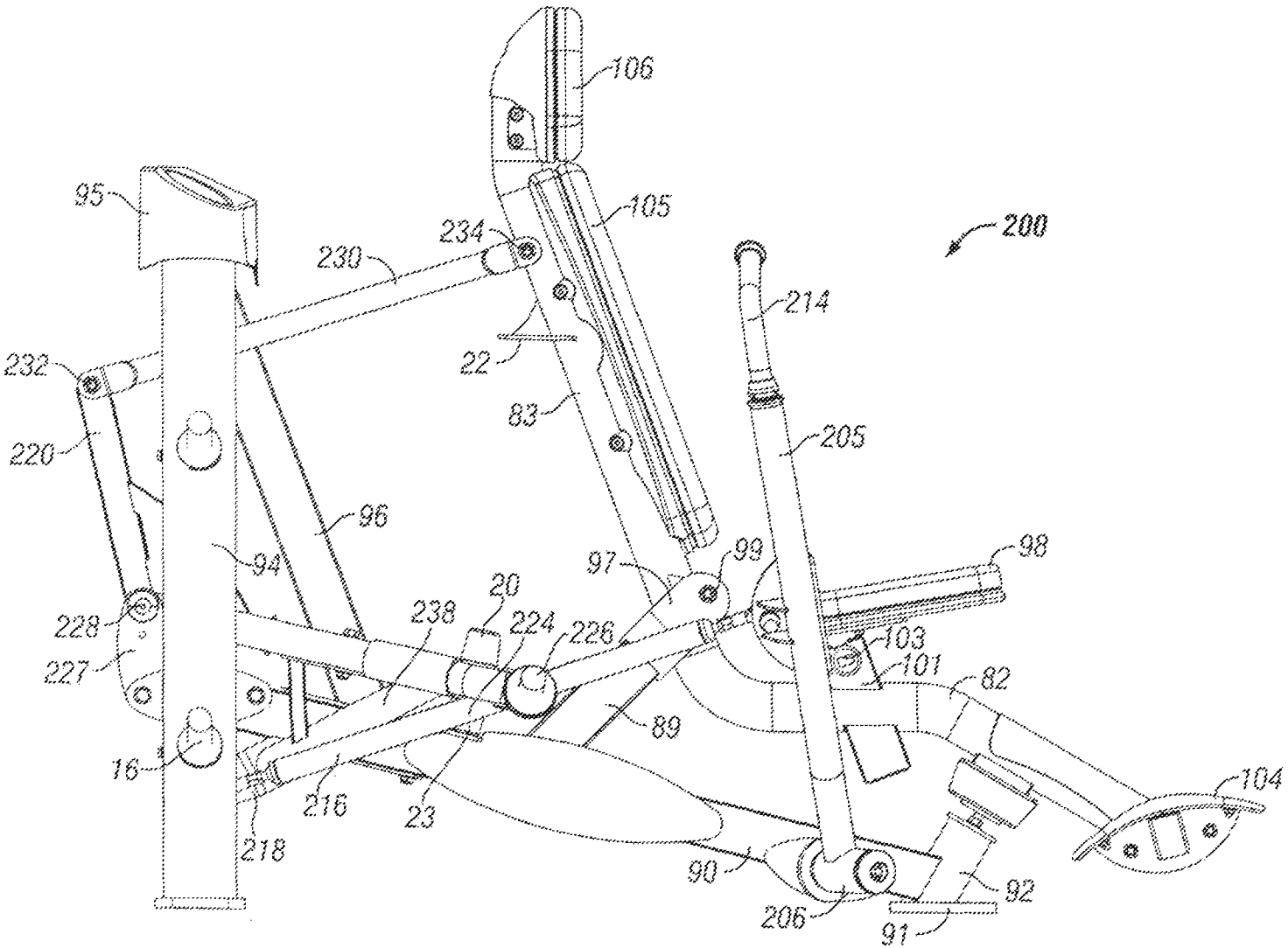
FIG. 31A is a side elevation view of the machine of FIGS. 26 to 30 in the start position of a decline press exercise.

User support frame 76 is generally L-shaped with a base portion 82 and an upright portion 83, and is pivotally supported at the upper end of pivot support 89 for rotation about pivot axis 99 via pivot bracket 97 located above the junction or bend between the base portion 82 and upright portion 83 of the frame. A seat pad 98 is adjustably mounted on the base portion 82 via seat support post 100 which is telescopically engaged in an open upper end of a seat support tube 101 on the base portion. Seat support post 100 has a series of openings for releasable engagement with pull pin 103 to adjust the seat pad height based on user size and preference. The base portion 82 of the user support frame extends forward from the seat support tube 101 and a foot support bar 102 is transversely mounted at the forward end of base portion 82, with a foot support or foot rest 104 mounted at each end of bar 102 for engagement by a user's feet. A back pad 105 and a head rest pad 106 are mounted on the upright portion 83 of the user support frame. The base portion 82 of the user support has a downwardly directed stop which engages the upper end of post or stand-off 92 in a first position of the user support, as illustrated in FIGS. 26, 28, and 31A.

Figure 26:
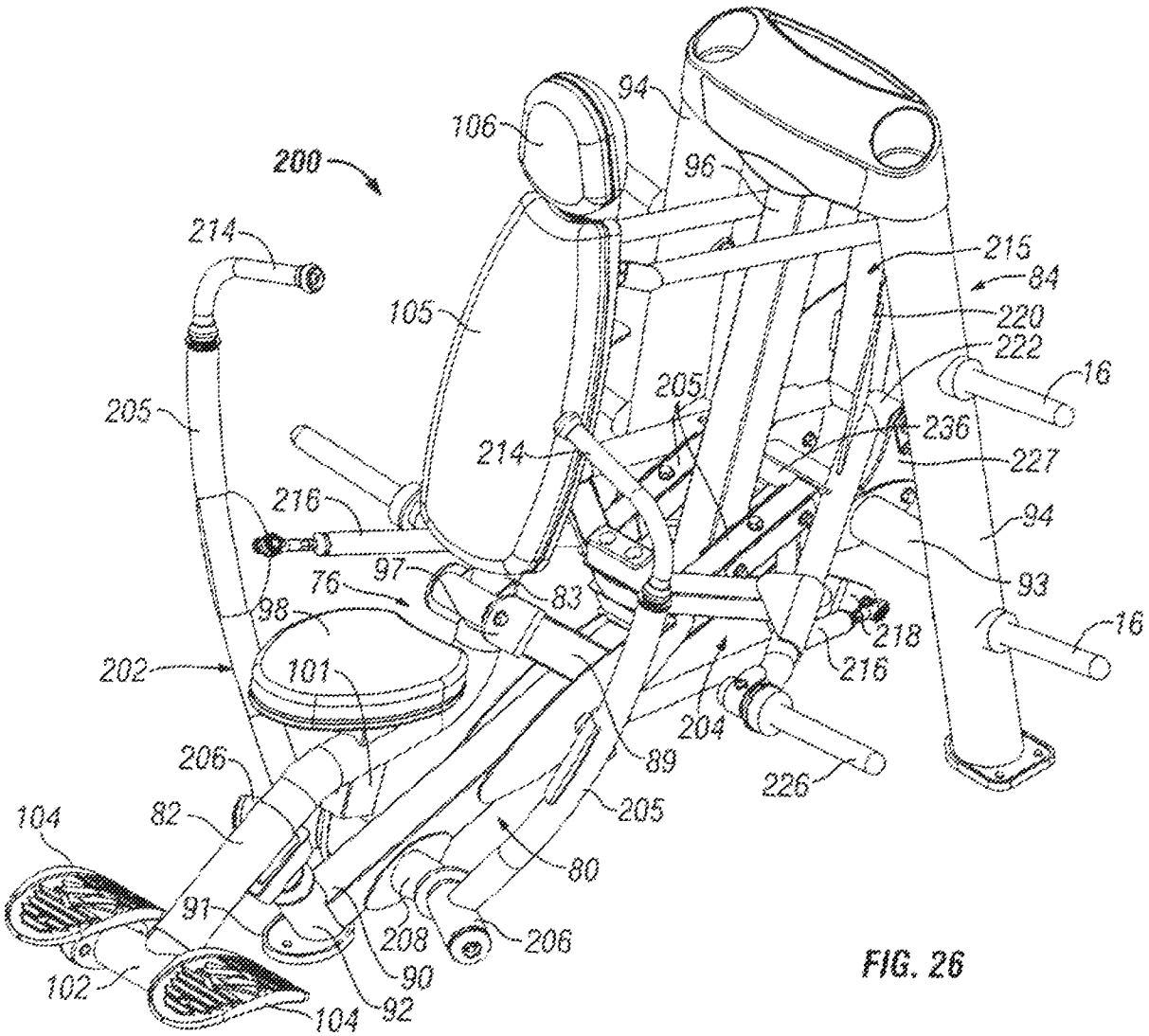
FIG. 26 is a front perspective view of a decline press exercise machine according to another embodiment, which is similar to the chest and incline press machines of FIGS. 11 to 25 but which has exercise arms pivoted below the user support, with the exercise machine shown in the start position for a decline press exercise.
Figure 29:
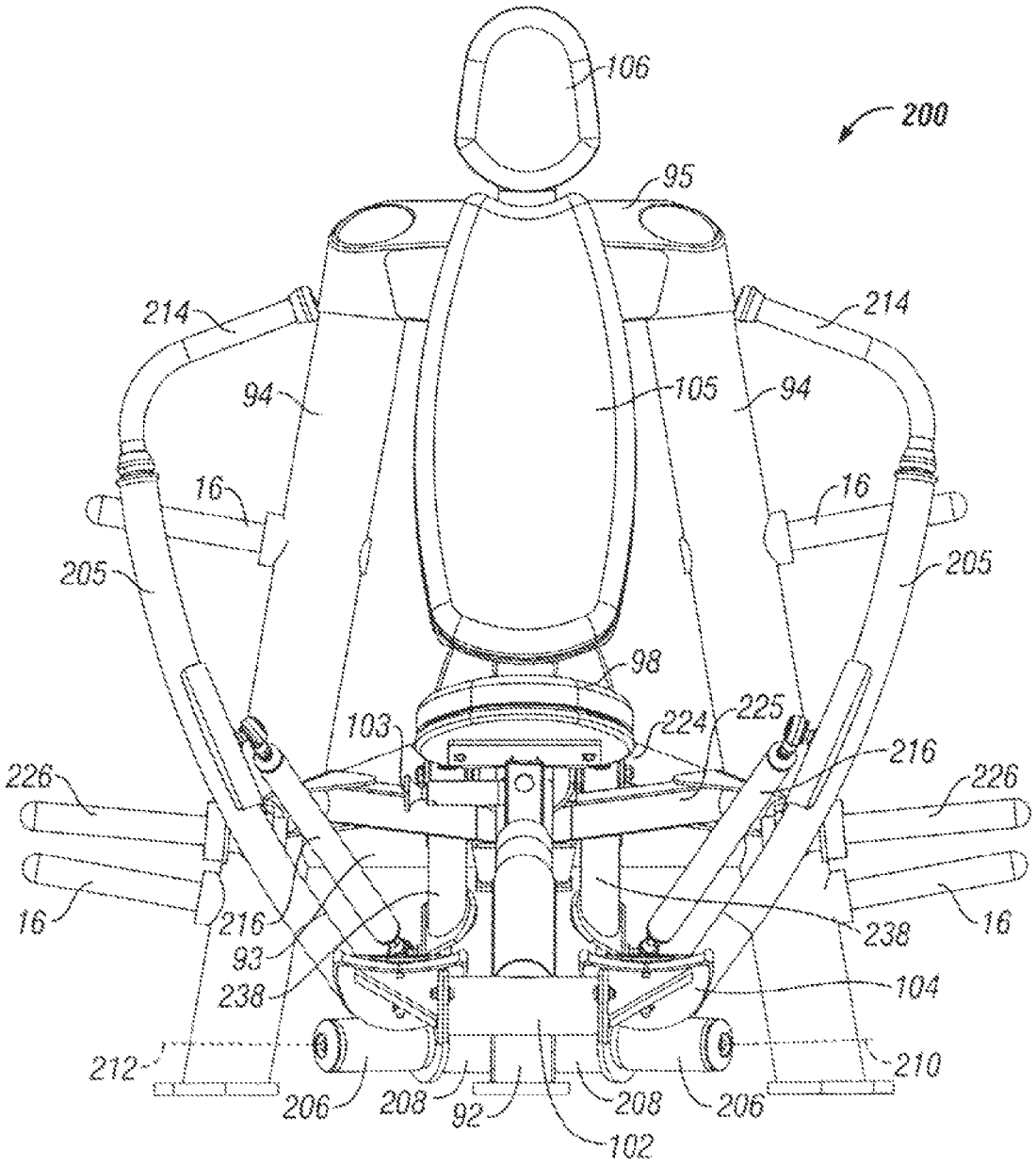
FIG. 29 is a front elevation view of the decline press machine in the start position of FIGS. 26 and 28.
Figure 30:
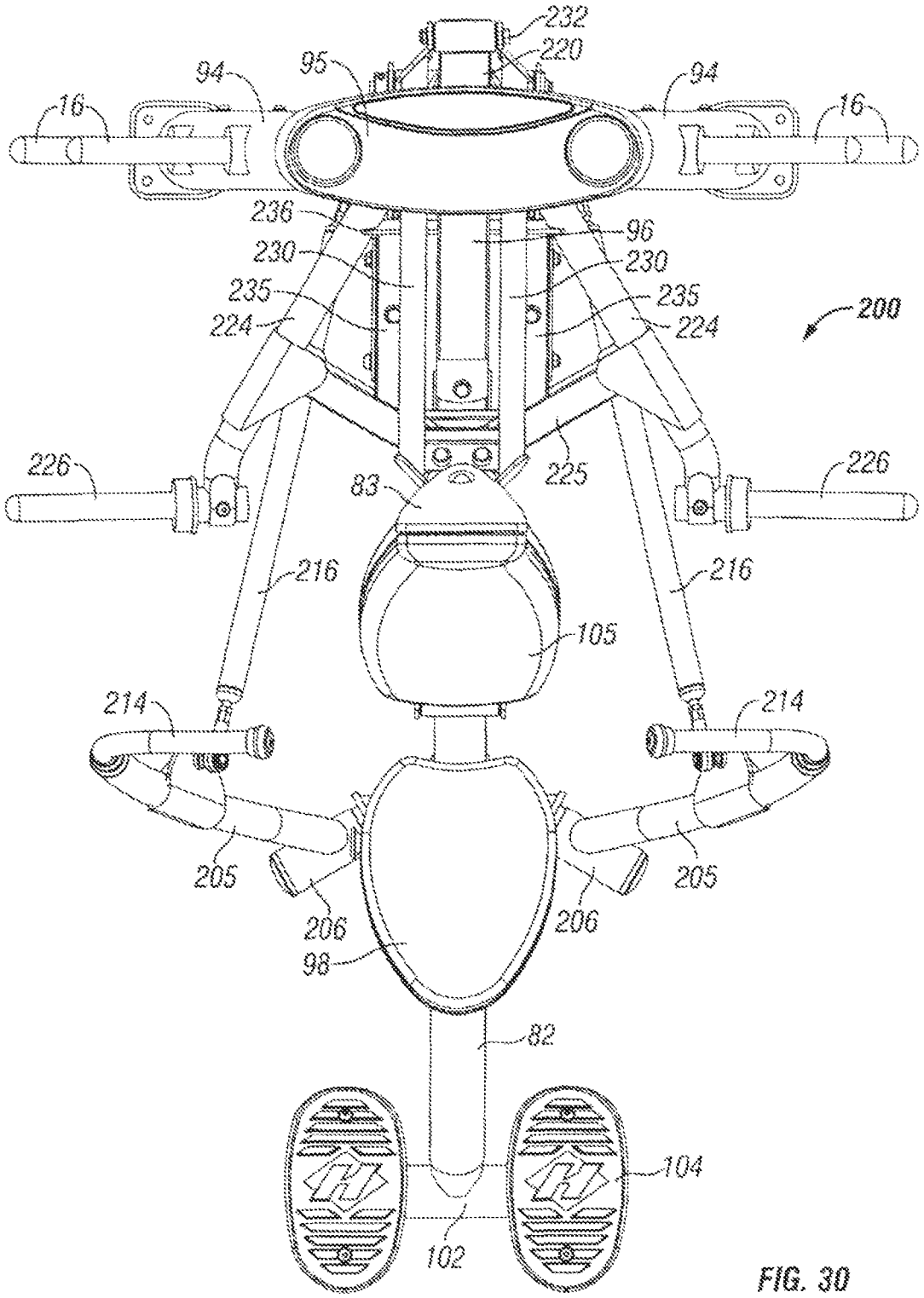
FIG. 30 is a top plan view of the decline press machine in the start position.

The exercise arm assembly 202 comprises a pair of exercise arms or main arm portions 205 pivotally mounted at their lower ends on opposite sides of main frame base strut 90 via pivot sleeves 206, at a location beneath the user support 76, so as to extend upwards on opposite sides of seat pad 98, as illustrated in FIGS. 26 and 29. The pivot sleeves are mounted on pivot mounts 208 via skewed pivot pins for rotation about skewed pivot axes 210, 212, as best illustrated in FIG. 29. Handles or user engaging portions 214 project inwards from the upper ends of exercise arms 205. Due to the skewed pivot mounts, the handles 214 move in a converging path between the start position of FIG. 26 and the end position of FIG. 27.

Figure 31B:
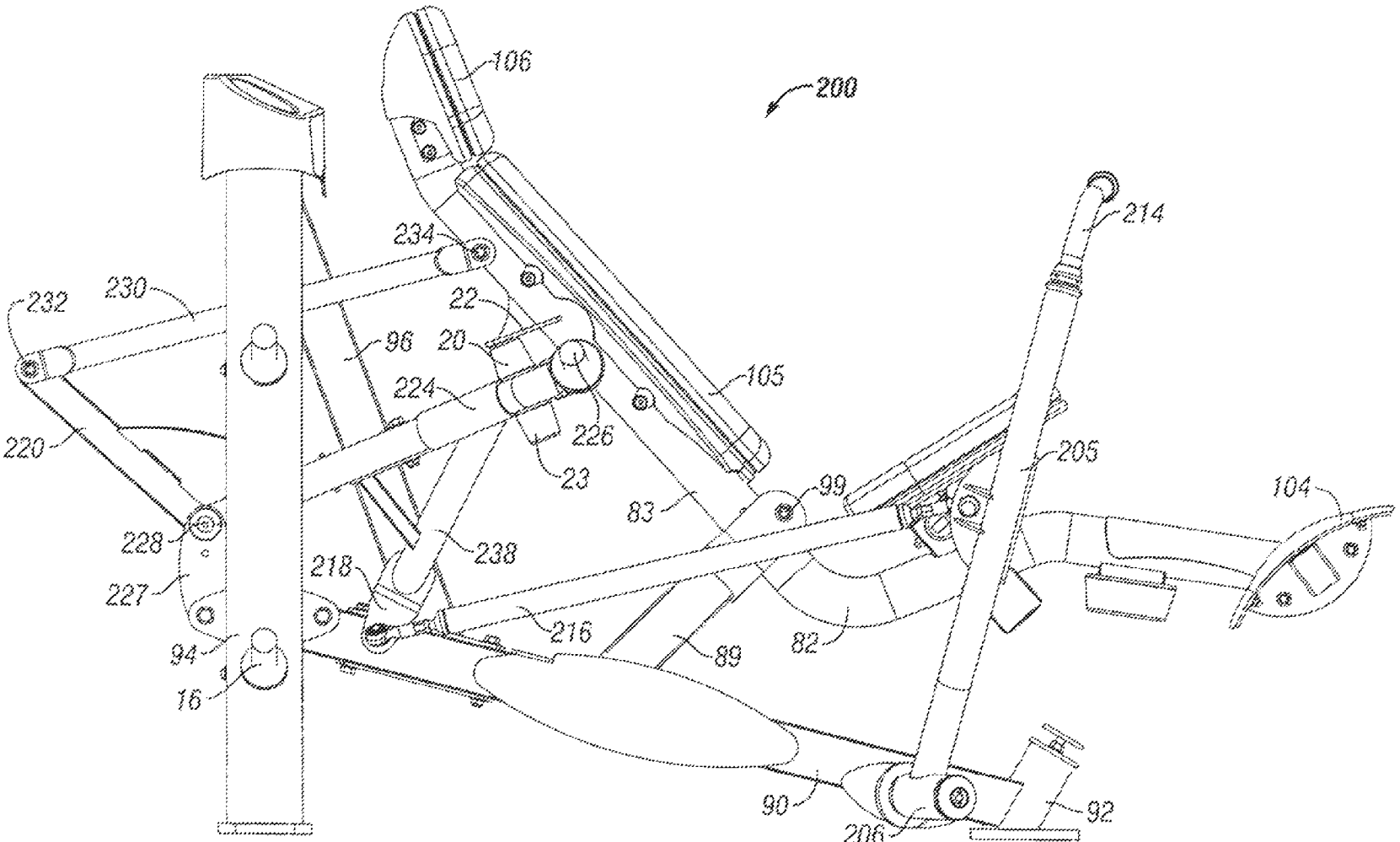
FIG. 31B is a side elevation view similar to FIG. 31A but illustrating the end position of the decline press exercise.

The connecting linkage 204 comprises multiple links between each exercise arm and the user support, the links including a generally L-shaped lifting arm or lifting arm assembly 215. A pair of first links or tie rods 216 each have a first end pivotally connected to the respective exercise arm 205 at a location spaced between the pivot mount and handle, and a second end pivotally connected to a respective bracket 218 which extends under the L-shaped lifting arm 215. Lifting arm 215 has a generally upwardly extending rear portion 220 secured to a pivot sleeve 222 at its lower end (FIG. 28), and a pair of outwardly diverging rods or bars 224 extending forward from pivot sleeve 222. Rods 224 are secured together by a cross bar 225 at a location close to their forward ends, and respective weight plate mounting pegs 226 extend outwardly from the forward ends of the respective rods 224. Pivot sleeve 222 of the lifting arm 215 is rotatably mounted on a pivot pin extending between pivot brackets 227 mounted on the main frame cross bar 93 for rotation about pivot axis 228, as best illustrated in FIGS. 28, 31A and 31B. Two parallel second links 230 are each pivotally secured at their rear ends to the upper end of rear portion 220 of lifting arm 215 for rotation about pivot axis 232, and are pivotally secured at their forward ends to the rear upright 83 of the user support, for rotation about pivot axis 234 (see FIGS. 31A and 31B).

Lifting arm 215 also includes a pair of parallel braces or support struts 235 which have rear ends secured to a bracket or mounting plate 236 secured between rods 224 at a location spaced forward from sleeve 222 (see FIGS. 26, 28 and 30) and forward ends secured to cross bar 225. Mounting arms 238 extend downwardly and rearwardly from the respective support struts 235 (see FIGS. 27, 29, and 31) and the mounting brackets 218 which are pivotally secured to respective tie rods 216 depend from the lower ends of the respective mounting arms 238, as best illustrated in FIG. 31B. The multiple pivot link arrangement of tie rods 216, lifting arm 215, and link arms 230 translates movement of the exercise arms 205 into movement of the user support 76. At the same time, the lifting arm 215 of the connecting link is loaded by weight plates 18 on pegs 226 at the ends of the rods 224 of the lifting arm 215 to provide a selected amount of exercise resistance.

Figure 32A:
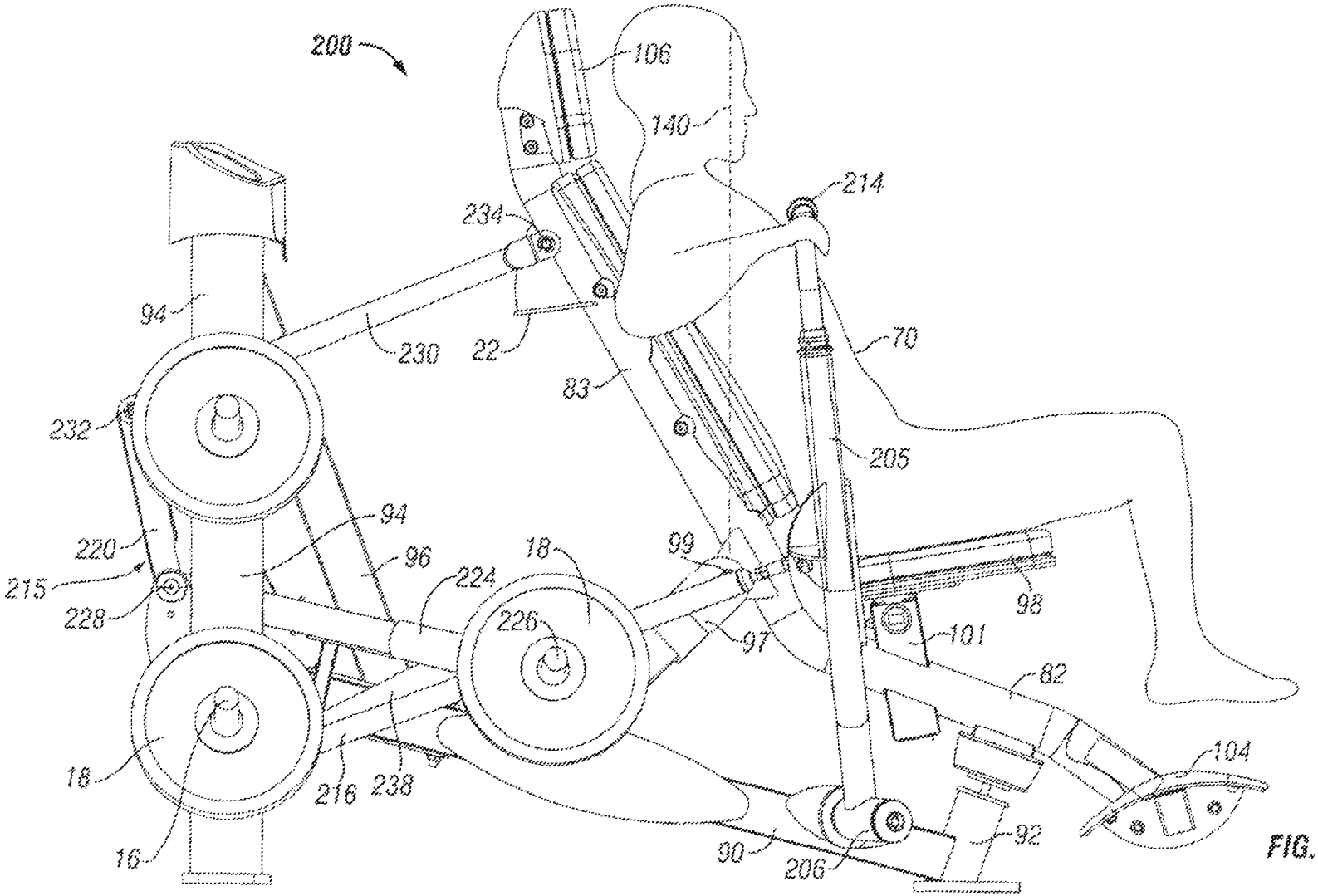
FIG. 32A is a side elevation view similar to FIG. 31A with a user seated on the machine in the start position of a decline press exercise.

The exercise arms 205 may be used to perform a decline press exercise with the user support and exercise arms starting in the start position of FIGS. 26, 28 to 30, 31A and 32A. In this position, the user support is in a slightly reclined orientation, as best illustrated in FIGS. 31A and 32A. In this position, the exercise arms 205 extend upwardly on opposite sides of seat pad 98 with the handles 214 approximately at chest height when a user is seated on the user support as illustrated in FIG. 32A. The user grips the handles 214 and pushes the handles away from their chest, which in turn rotates the handles downward and inward in a converging path, as can be seen by comparison of FIGS. 26 and 27, with the users hands following an equivalent path. The user ends the decline press exercise with their hands extending away from their body in a slight downward inclination, as seen in FIG. 32B.

Figure 27:
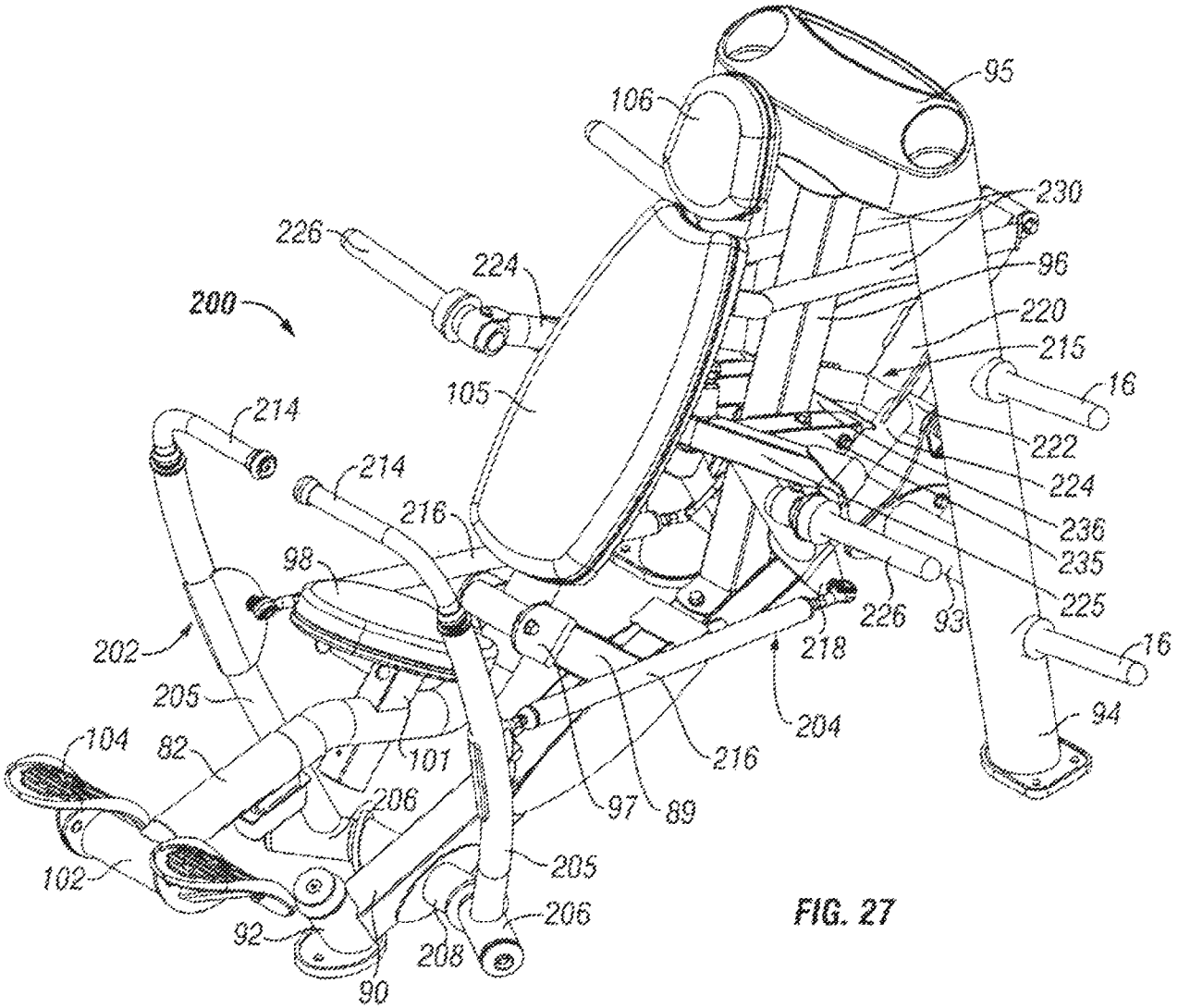
FIG. 27 is a front perspective view similar to FIG. 26 but illustrating the end position for a decline press exercise.
Figure 32B:
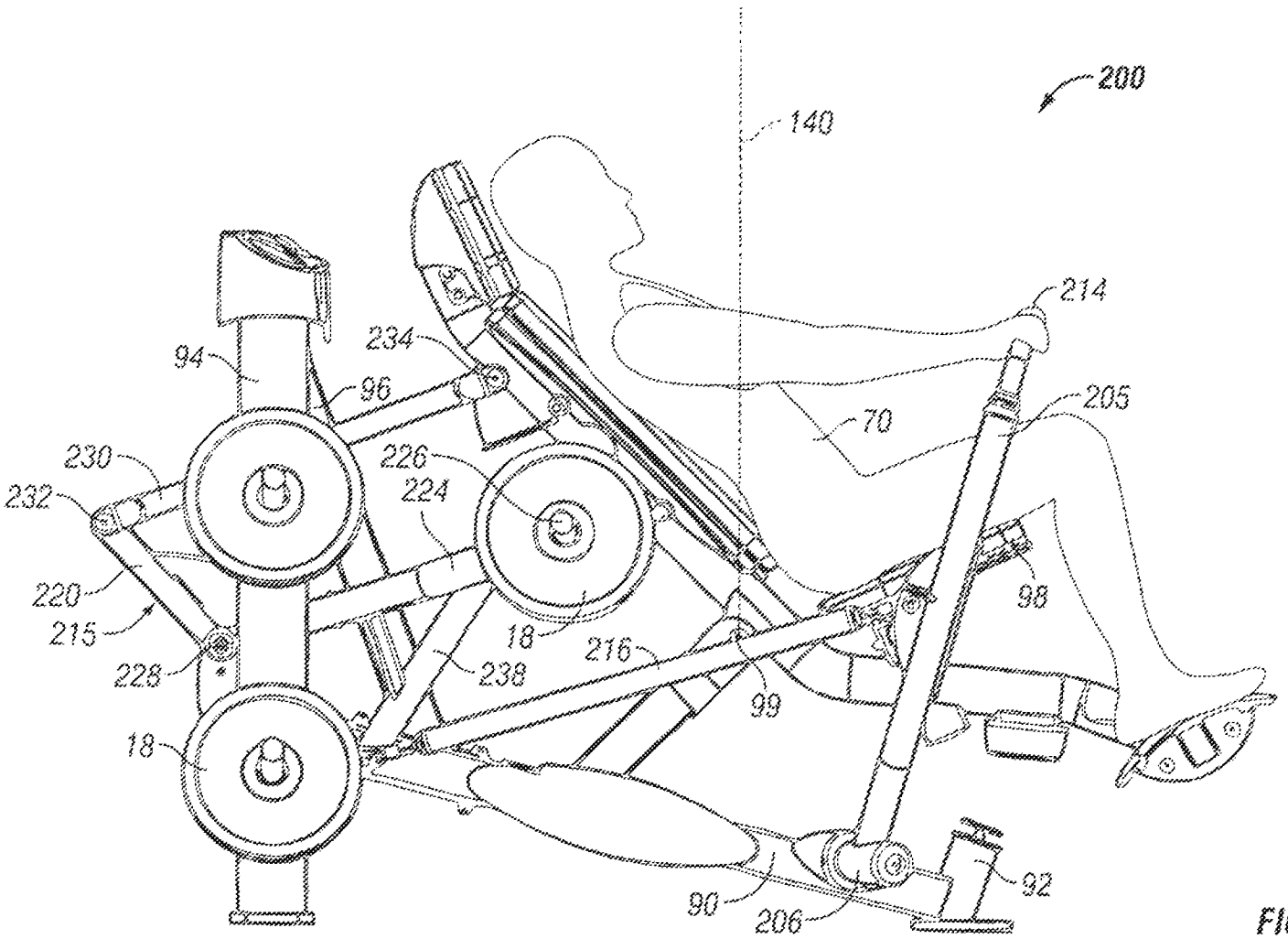
FIG. 32B is a side elevation view similar to FIG. 31B with a user seated on the machine at the end position of the decline press exercise.

As the user presses or pushes the exercise arms between the position of FIGS. 31A and 32A and the end position of FIGS. 31B and 32B, the exercise arms 205 pull tie rods 216 forwards, pushing lifting arm 215 upward and forward and lifting any weight plates mounted on pegs 226, providing the exercise resistance. FIGS. 32A and 32B illustrate weight plates 18 mounted on the pegs 226 on lifting arm 215, along with some weight plates stored on pegs 16 of the rear uprights 94 of the main frame. As the tie rods 216 are pulled forward, this simultaneously pushes the lifting arm upward at its forward end, rotating the sleeve 222 and the associated rear upright portion 220 of the lifting arm rearward about pivot axis 228 so that the upper end of portion 220 pulls the second links 230 rearward and causes the user support to rotate rearward about pivot axis 99, ending in a more rearwardly reclined position. The end position for the decline press exercise is illustrated in FIGS. 27, 31 B and 32B. In the illustrated end position, the stop plate 22 on the user support rear upright 83 engages the stop 20 on lift arm cross bar 225.

FIGS. 32A and 32B also illustrate the vertical gravitational centerline 140 of the user support's pivotal motion, which extends vertically through the user support pivot 99. The amount of weight positioned on each side of centerline 140 varies only slightly from the start to the finish position. The combined weight of the user and user support has little effect on the amount of starting resistance because of substantially equal amount of weight is balanced rearward of the user support pivot. By the same token, because only a small portion of the user passes through the gravitational centerline during the exercise, there is no appreciable drop-off in resistance felt by the user.

Figure 33:
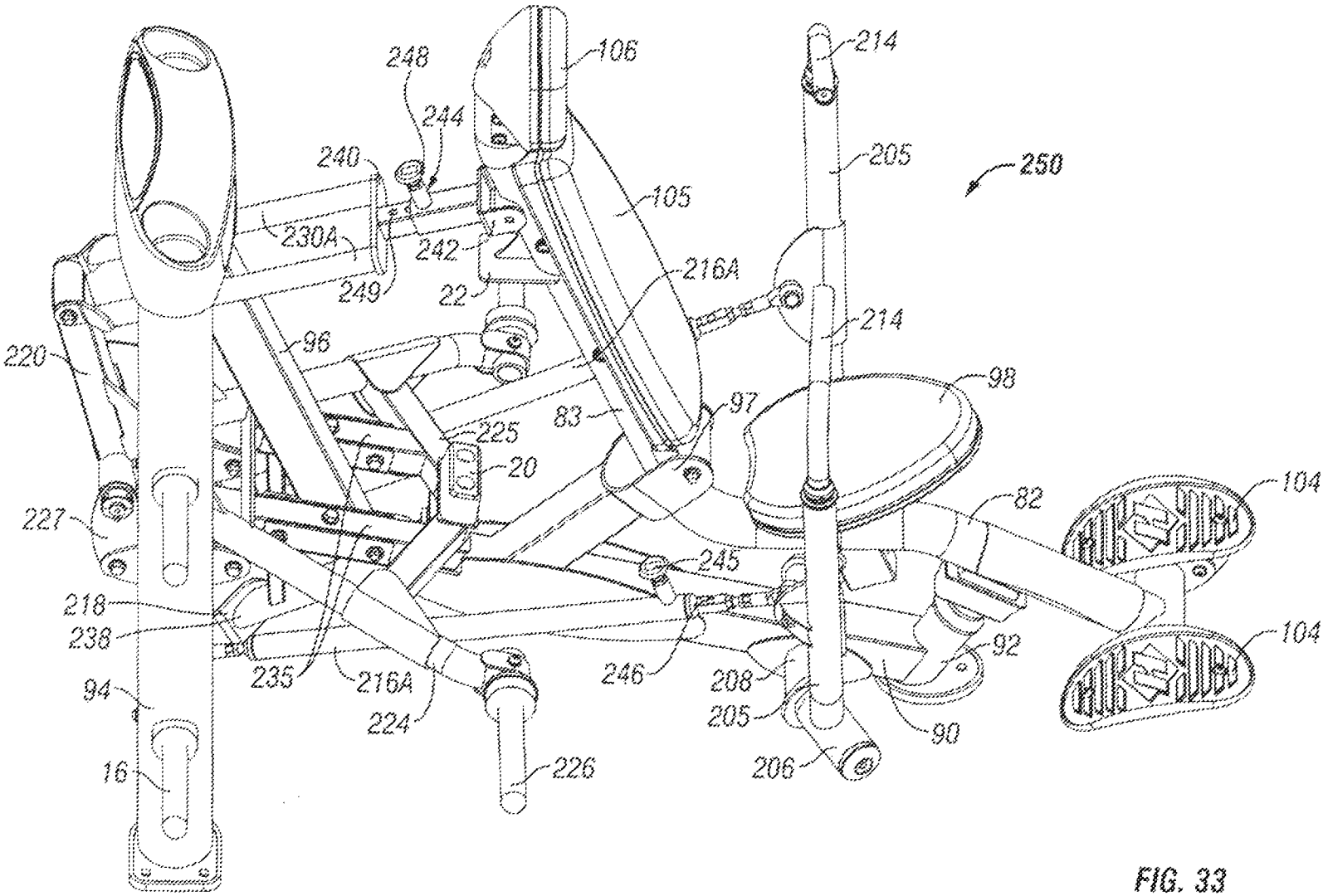
FIG. 33 is a top perspective view of a modified decline press machine which is similar to the machine of FIGS. 26 to 32B but which has adjustable connecting links between the exercise arms and lifting arm and a modified link between the user support and lifting arm.
Figure 34:
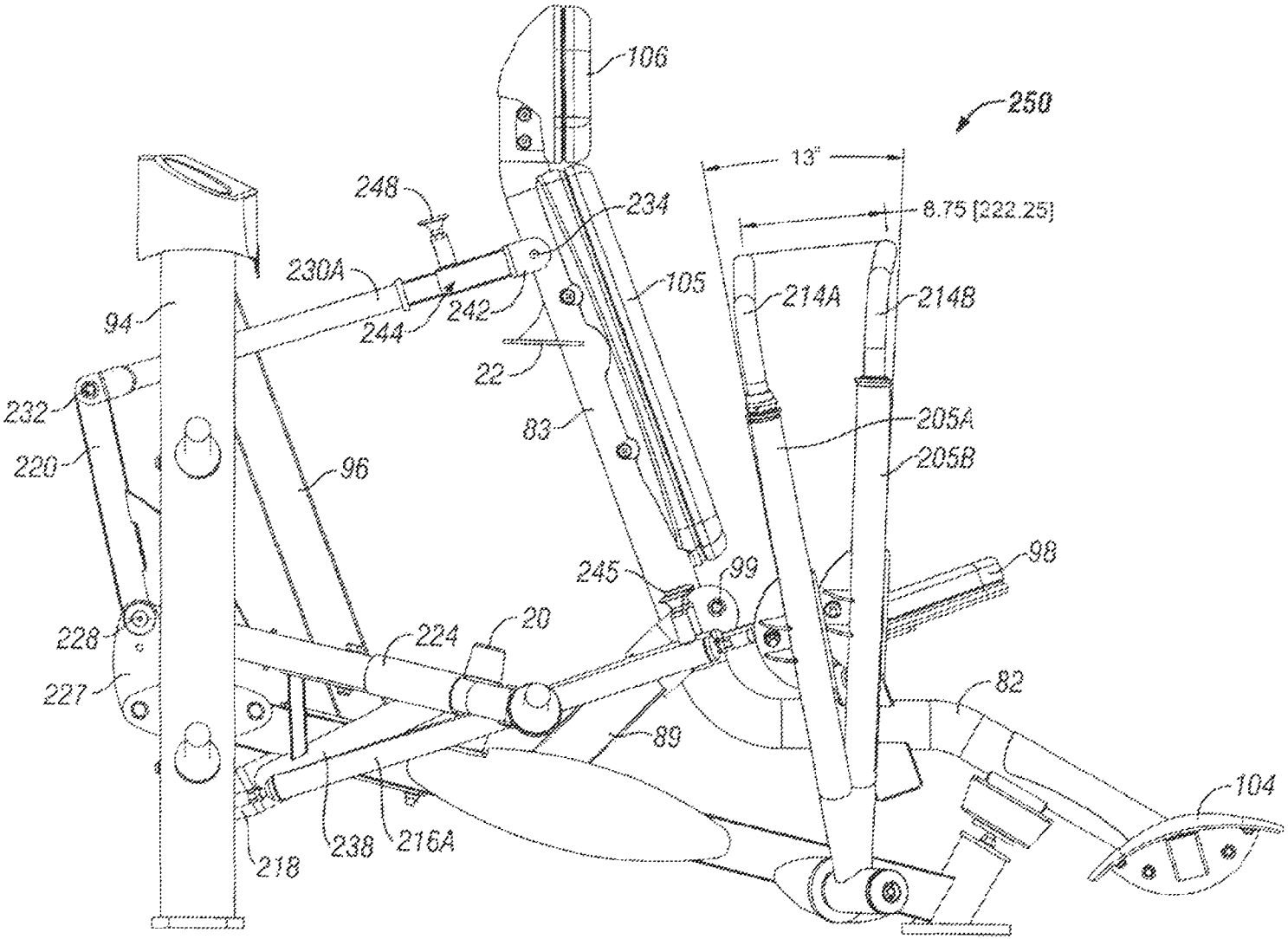
FIG. 34 is a side elevation view of the decline press machine of FIG. 33 illustrating two possible adjusted start positions for the exercise arms.
Figure 35:
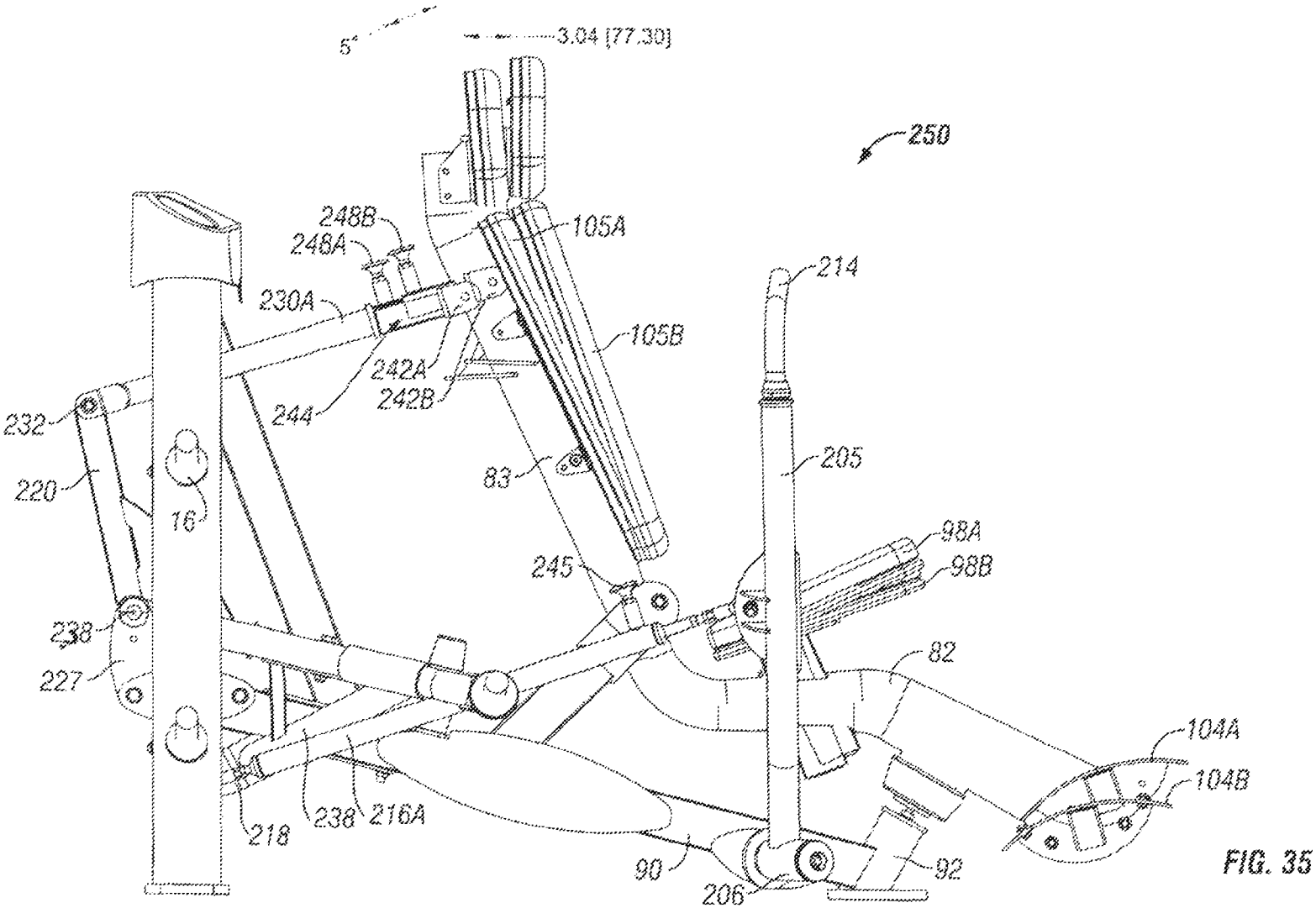
FIG. 35 is a side elevation view of the machine of FIGS. 33 and 34 illustrating adjustment of the user support start position.

FIGS. 33 to 35 illustrate a modified decline press machine 250 which is a modification of the decline press exercise machine 200 of the previous embodiment. This embodiment is identical to the previous embodiment except that the fixed length first links or tie rods 216 of the connecting linkage are replaced by adjustable tie rods or first links 216A between each exercise arm 205 and the lifting arm 215, and the fixed length upper links 230 of the previous embodiment are also modified to provide an adjustable length link between the lifting arm and user support. In this embodiment, upper links 230 of the previous embodiment are replaced by shorter links 230A joined together at their forward ends by a tie plate 240 connected to one end of a telescopic adjustment device 244 pivotally connected to the rear upright 83 at its opposite end via pivot bracket 242. This allows the overall length of the links 230A and adjustment device 244 to be varied. All other parts of the decline press machine in FIGS. 33 to 35 are identical to the previous embodiment and are therefore not described in detail.

In this embodiment, the user may adjust the length of each tie rod or link arm 216A by pulling up the respective pull pin 245, adjusting the telescoping member to the desired length, and then releasing the pull pins to extend into the aligned opening 246. Each tie rod 216A must be adjusted independently. This changes the starting position of the exercise arms 205. FIG. 34 illustrates two different positions of the exercise arms 205A and 205B as a result of adjustment of the length of tie rods 216A. The user may also selectively adjust the orientation of the user support by pulling up the pull pin 248 of telescopic adjustment device 244, adjusting the device to the desired length, then releasing the pull pin 248 to engage in the newly aligned opening 249. In FIG. 35, reference numbers for various parts of the user support 76 are associated with the letter A for one of the two positions shown, and with the letter B for the other position, corresponding to pull pin positions 248A and 248B, respectively. FIG. 35 illustrates two different positions of the user support back pad (105A, 105B) and seat pad (98A, 98B) as a result of changing the length of the telescopic adjustment device 244. Adjusting the lengths of either the tie rods 216A or the telescopic adjustment device 244 of the upper links adjusts the amount of exercise pre-stretch.

Figure 36:
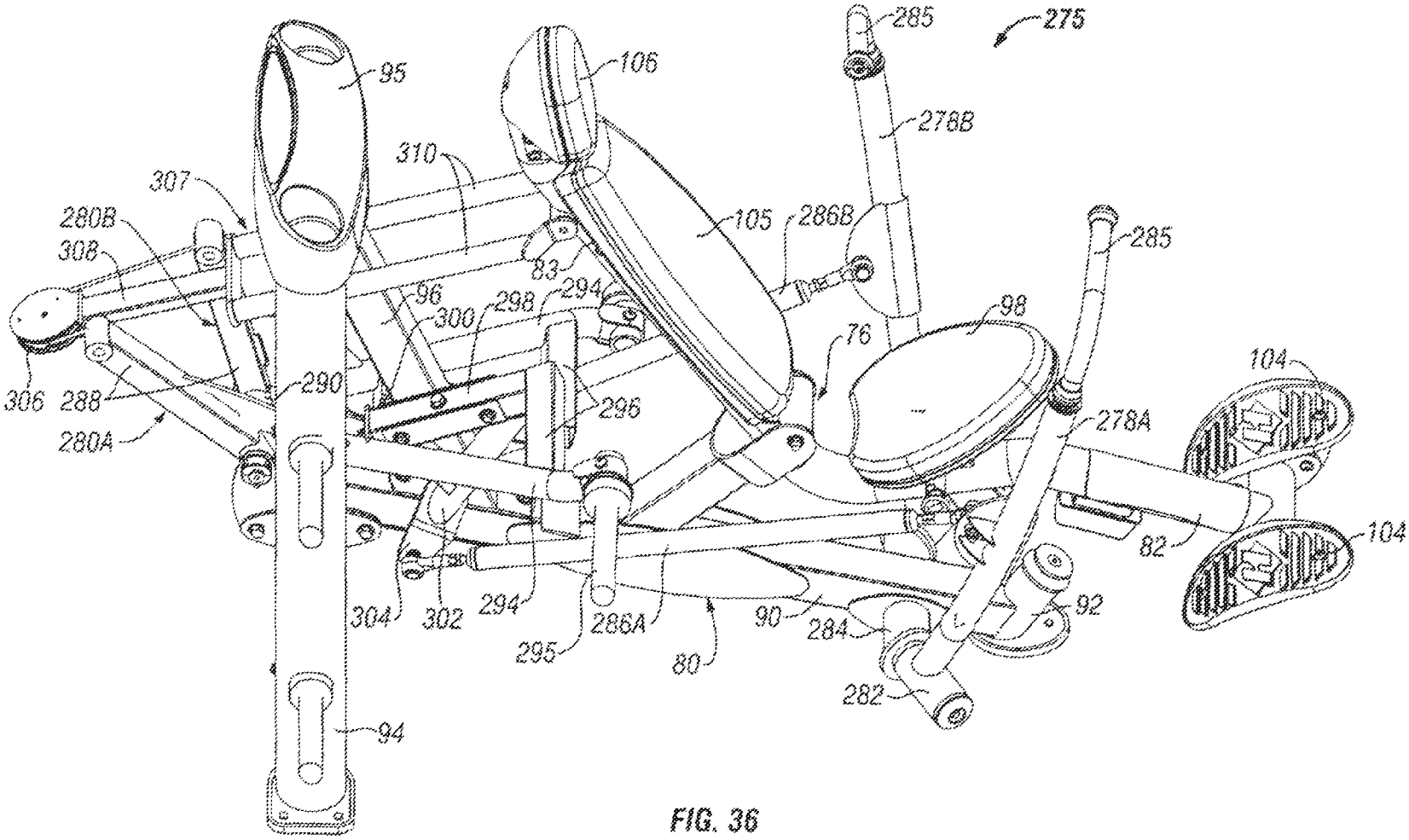
FIG. 36 is a top perspective view of another modified decline press machine which has independent exercise arms associated with their own independent lift arms.
Figure 37:
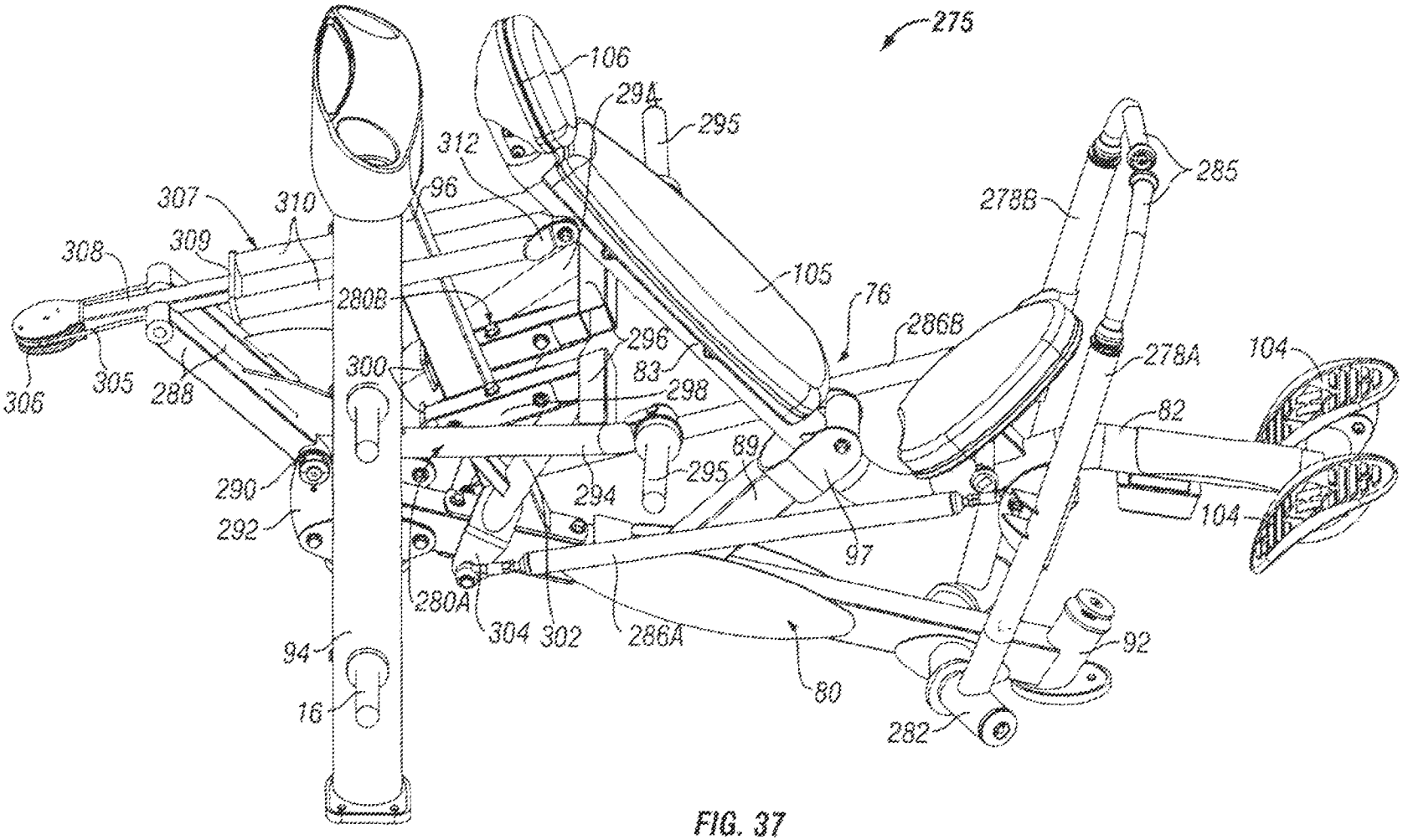
FIG. 37 is a top perspective view of the machine of FIG. 36 with both arms in the end position of a decline press exercise.
Figure 38:
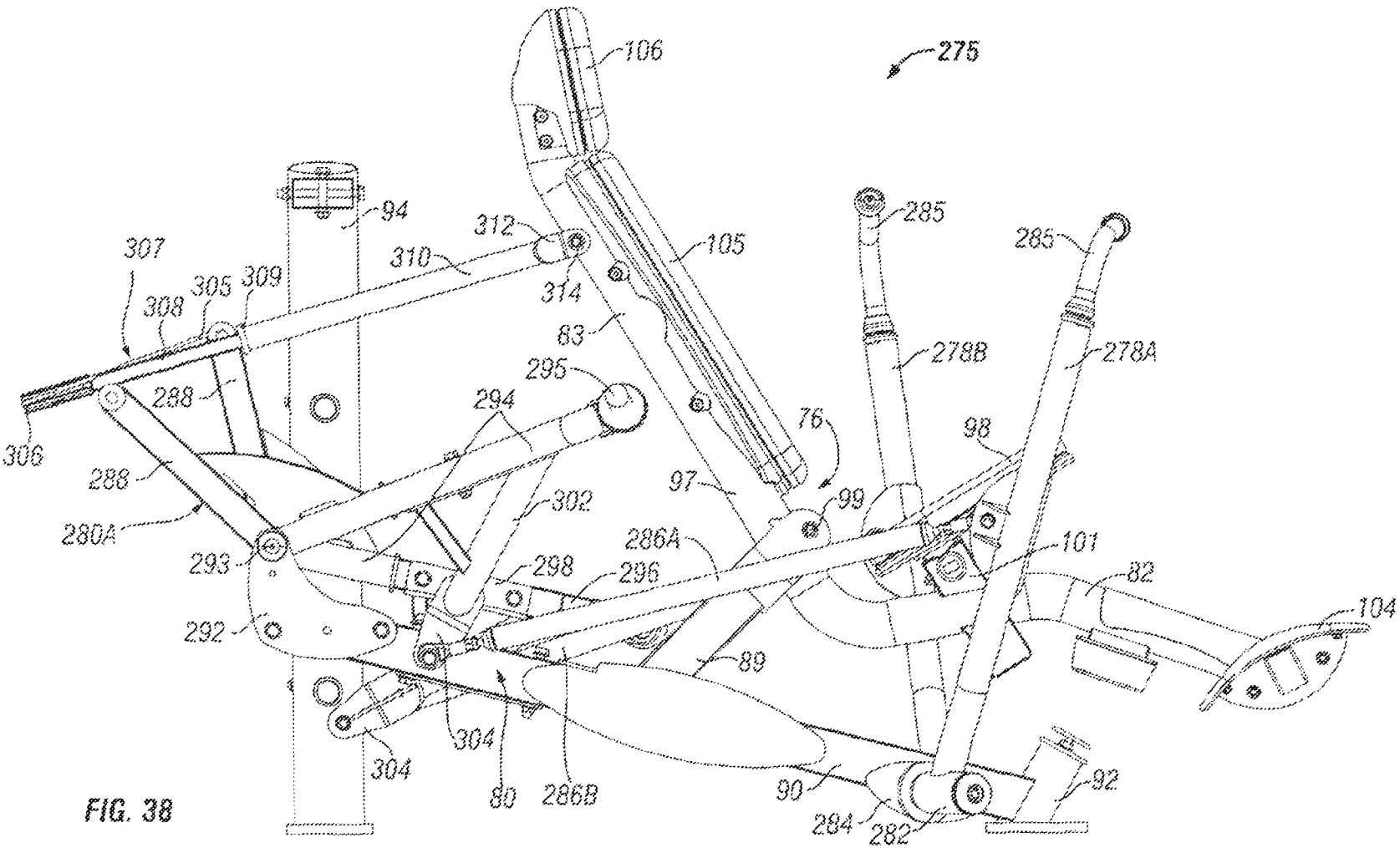
FIG. 38 is a side elevation view of the machine in the position of FIG. 36, with part of the support frame removed to reveal the lifting arm.

FIGS. 36 to 38 illustrate a modified decline press machine 275 according to another embodiment which has independent exercise arms 278A, 278B which are associated with independent lifting arms 280A and 280B, respectively. In the previous embodiments, the exercise arm or arms are connected to a single lifting arm or lifting arm assembly, so that even if the exercise arms are independent or cable driven, they engage the same lifting arm. In this embodiment, each exercise arm is connected to its own lift arm which can be loaded or resisted separately. The main frame 80 and user support frame 76 of this embodiment are identical to those of the previous two embodiments, and like reference numbers are used for like parts as appropriate. Reference is made to the description of the previous embodiments for a description of these parts.

Exercise arms 278A and 278B are each pivotally mounted at their lower ends on opposite sides of main frame base strut 90 via pivot sleeves 282, at a location beneath the user support 76, so as to extend upwards on opposite sides of seat pad 98. The pivot sleeves are mounted on pivot mounts 284 via skewed pivot pins for rotation about skewed pivot axes, as in the previous embodiments. Handles or grips 285 project inwards from the upper ends of exercise arms. Due to the skewed pivot mounts, the handles 285 move in a converging path, as can be seen from the start position of arm 278B in FIG. 36 and the end position of both arms in FIG. 37.

Each exercise arm is linked to the user support by a connecting linkage including tie rods or first links 286A and 286B which are pivotally connected between the respective exercise arm 278A, 278B and lifting arm 280A, 280B. Each lifting arm is generally L-shaped and has a generally upwardly extending rear portion 288 secured to a respective pivot sleeve 290 at its lower end. Each pivot sleeve 290 is independently rotatable on a pivot pin extending between pivot brackets 292 mounted on the respective main frame uprights 94, for rotation about lower pivot axis 293 (FIG. 38). A respective outwardly projecting rod 294 extends outwardly from each sleeve 290, forming a generally L-shape with the rear portion 288, as illustrated in FIG. 38. A weight mounting peg 295 is provided at the end of each rod 294. Separate inwardly projecting bars 296 extend from the respective rods 294, in place of single cross bar 125 of the previous embodiments. A support bar or brace 298 extends from a mounting flange 300 towards the rear end of each rod 294 to connect to the free end of the inwardly projecting bar 296, forming a triangular frame-like structure as the lower limb of the generally L-shaped lifting arm. Mounting arms 302 extend downwardly and rearwardly from the respective triangular support structures, in a similar manner to mounting arms 238 of the previous embodiment, as best seen in FIG. 38. A mounting bracket 304 depends from the lower end of the respective mounting arm 302. The rear ends of the respective link arms are pivotally secured to the respective mounting brackets beneath the lifting arms, as illustrated in FIGS. 36 to 38.

The upper ends of the rear portions of the two lifting arms are linked together by a cable 305 which extends around a pulley 306 secured at the rear end of upper linkage or link arm 307. This ties the two lifting arms 280A and 280B to the rear upright 83 of the user support. Link arm 307 comprises a first, rear member 308 extending forward from the housing of pulley 306 up to end bracket 309, and a pair of parallel forward members 310 extending forward from bracket 309 and pivotally linked to the rear upright 83 at brackets 312 for rotation about pivot axis 314. This arrangement provides a multiple pivot link arrangement from each exercise arm to the user support, comprising a first link or tie rod 286A or 286B, a lifting arm 280A or 280B, and the second link or upper link arm 307. The exercise arms may be actuated together, as illustrated in FIG. 37, or independently, as illustrated in FIGS. 36 and 38. In order to perform a decline press exercise, a seated user pushes back on back rest 105 while pushing one (FIGS. 36 and 38) or both (FIG. 37) exercise arms forward while gripping handles 285. As the back rest is pushed back, rotating the user support rearward about pivot axis 99, the upper link arm is also pushed back, pulling the upper end of one or both rear uprights 288 to rotate rearward about pivot axis 293 and pushing up one or both lifting arms 280A and 280B (depending on whether one or both arms are actuated by the user).

FIGS. 39 to 44B illustrate a seated dip exercise machine 320 according to another embodiment. Machine 320 has a stationary main frame 325 on which a user support 326 is pivotally mounted. A user engagement device or exercise arm assembly 328 has a pair of upper pivot brackets 330 which are pivotally mounted on a main frame upright 332 behind the user support and a U-shaped exercise arm secured at its center portion 333 to a forward end of pivot brackets 330 with arm portions 334 extending forwards from the center portion on opposite sides of the user support. In this embodiment, movement of the exercise arm assembly 328 is linked to movement of the user support 326 by a single connecting link 335, and a pivotally mounted lifting arm 336 serves only to provide resistance to the exercise movement, and not as part of a connecting linkage which translates movement of an exercise arm into movement of a user support.

The main frame 325 comprises base 337 and a rear upright portion with a pair of inwardly inclined uprights 338 connected together by an upper cross member 340 and by a cross bar 342 spaced between the upper and lower ends of the uprights to form a generally A-frame shape, similar to the rear upright frame portions of the previous embodiments. Weight plate storage pegs 344 are provided on each of the rear uprights 338. Base 337 has a ground engaging foot 345 at its forward end, and a short stand off post 346 projects upwards from foot 345. The base is inclined upwardly from the front to the rear end, and is secured to horizontal cross bar 342 at its rear end. Upright strut 332 projects upwards from the base 337 at a location spaced forward from the rear upright portion, and a pivot support or mounting bracket 348 for the user support is spaced forward from strut 332. A stop post 339 extends downward at a forward inclination from the center of upper cross member 340, and is secured to the upright strut 332 by connecting bar 341. Post 339 provides a stop for upward movement of lifting arm 336 during an exercise, as explained in more detail below.

User support frame 326 is generally L-shaped with a base portion 350 and an upright portion 352, and is pivotally supported at the upper end of pivot support 348 for rotation about pivot axis 354 (see FIGS. 43A and 43B) adjacent the rear end of base portion 350. A seat pad 355 is adjustably mounted on the base portion 350 via seat support post 356 which is telescopically engaged in an open upper end of a seat support tube 358 on the base portion, as in the previous embodiments, and secured in a selected position via pull pin 359 to adjust the seat pad height based on user size and preference. A foot support bar 360 is transversely mounted at the forward end of base portion 350, with a foot support or foot rest 362 mounted at each end of bar 360 for engagement by a user's feet. A back pad 364 and a head rest pad 365 are mounted on the upright portion 352 of the user support frame. The base portion 350 of the user support engages the upper end of stand-off post 346 in a first or exercise start position of the user support, as illustrated in FIGS. 39, 41, 43A and 44A.

As noted above, the exercise arm assembly 328 comprises a pair of rigidly connected pivot brackets 330 and a U-shaped exercise arm secured to the forward ends of pivot brackets 330 with arm portions 334 projecting forward from the pivot brackets on opposite sides of the user support. Pivot brackets 330 are pivotally mounted at the upper end of frame upright 332 for rotation about pivot axis 367, and are also pivotally linked to both the user support 326 and the lifting arm 336 via connecting links 335 and 376, respectively, as explained in more detail below. Handles or grips 366 are each adjustably mounted at the forward ends of the respective arm portions 334 via a mounting sleeve 368 which is rotatably mounted at the end of the arm portion 334. A pin extends into slot 370 on sleeve 368 (see FIG. 41) to control the amount of rotation of handles 366. Handles 366 can be rotated from the outermost position illustrated in FIGS. 40 to 42 to an innermost position 366A illustrated in dotted outline in FIG. 42, to adjust to the width of a person performing the exercise.

Figure 41:
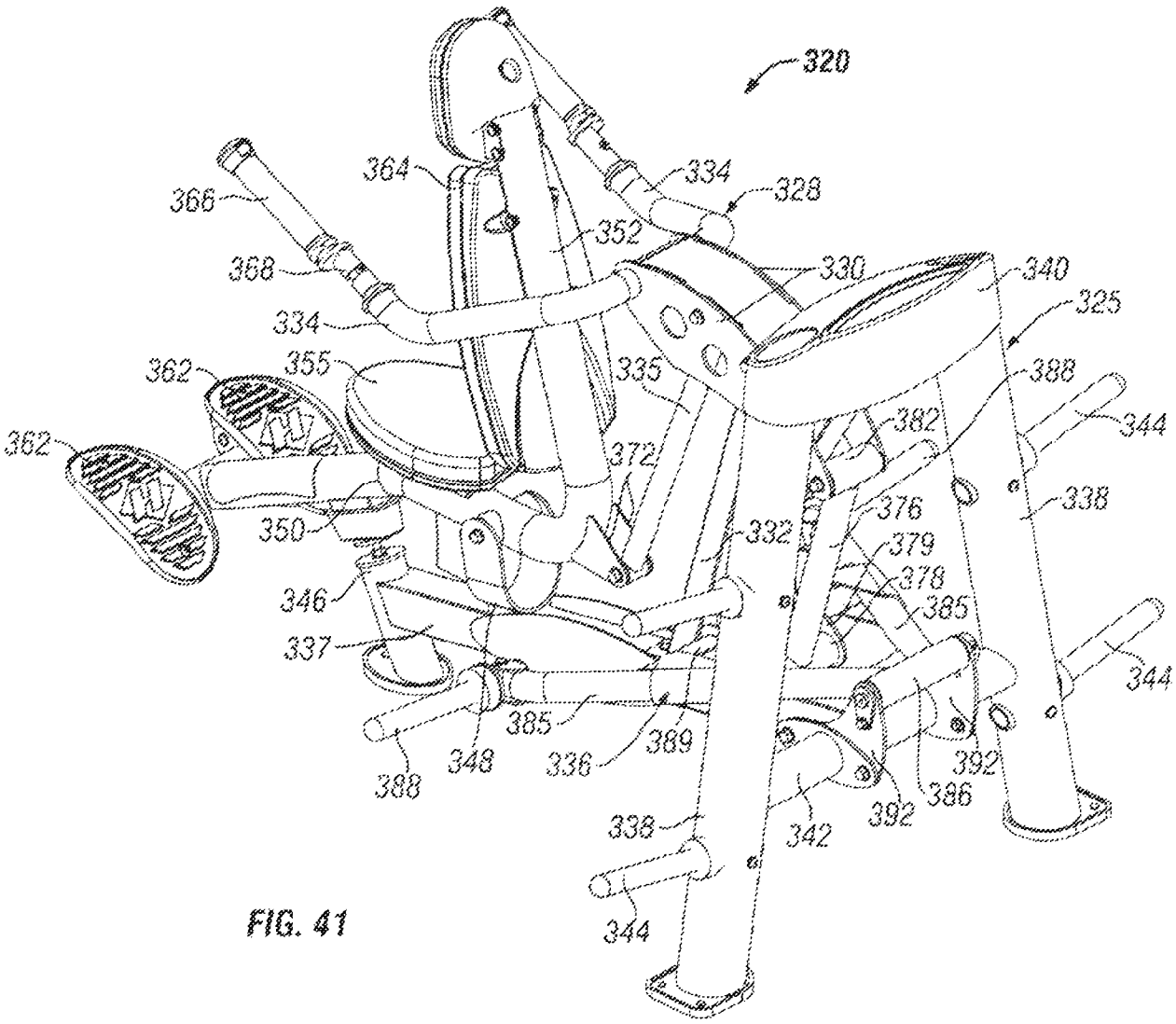
FIG. 41 is a rear perspective view of the machine in the start position of FIG. 39.
Figure 42:
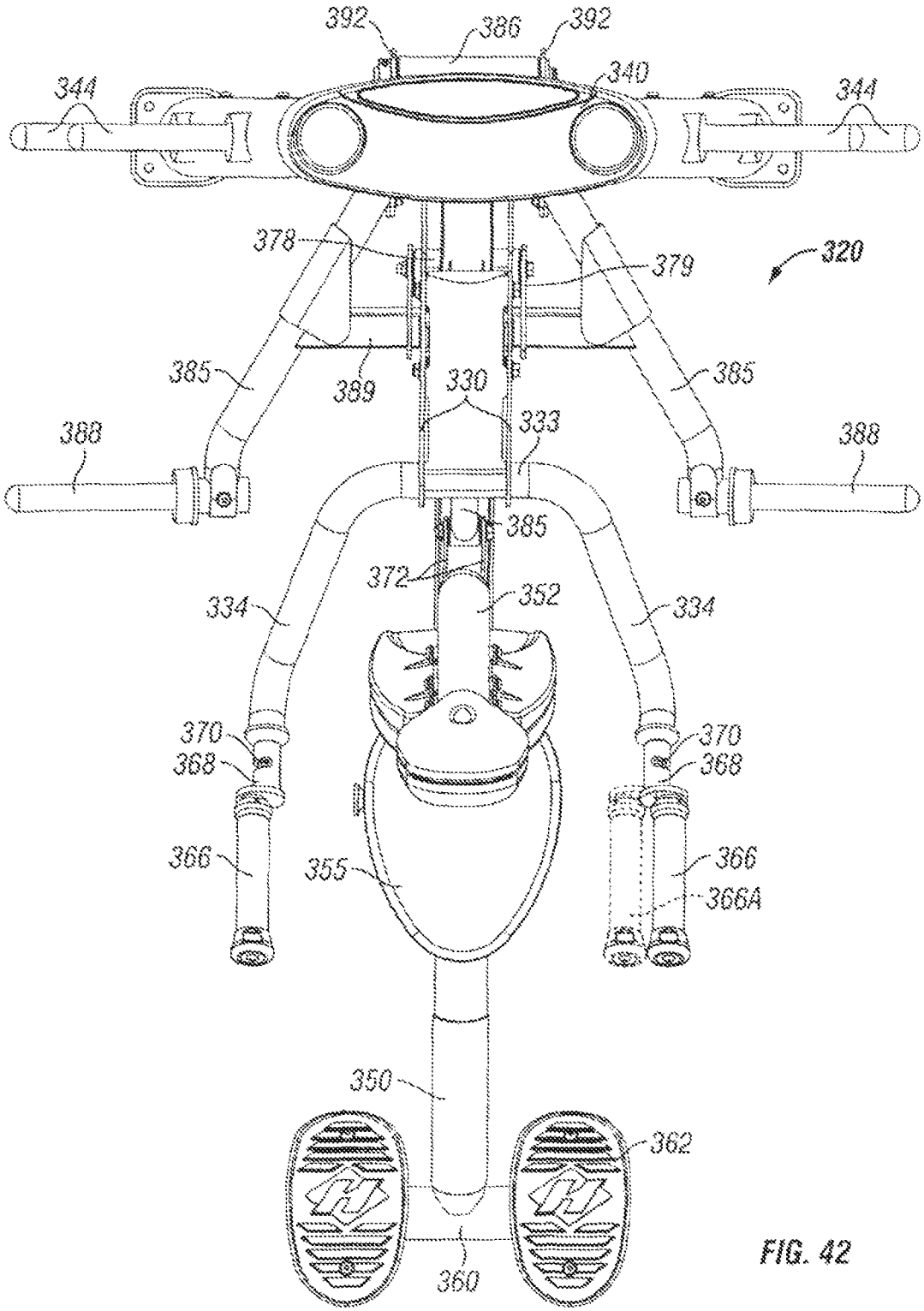
FIG. 42 is top plan view of the machine of FIGS. 39 to 41, with the exercise arm in the start position.
Figure 43A:
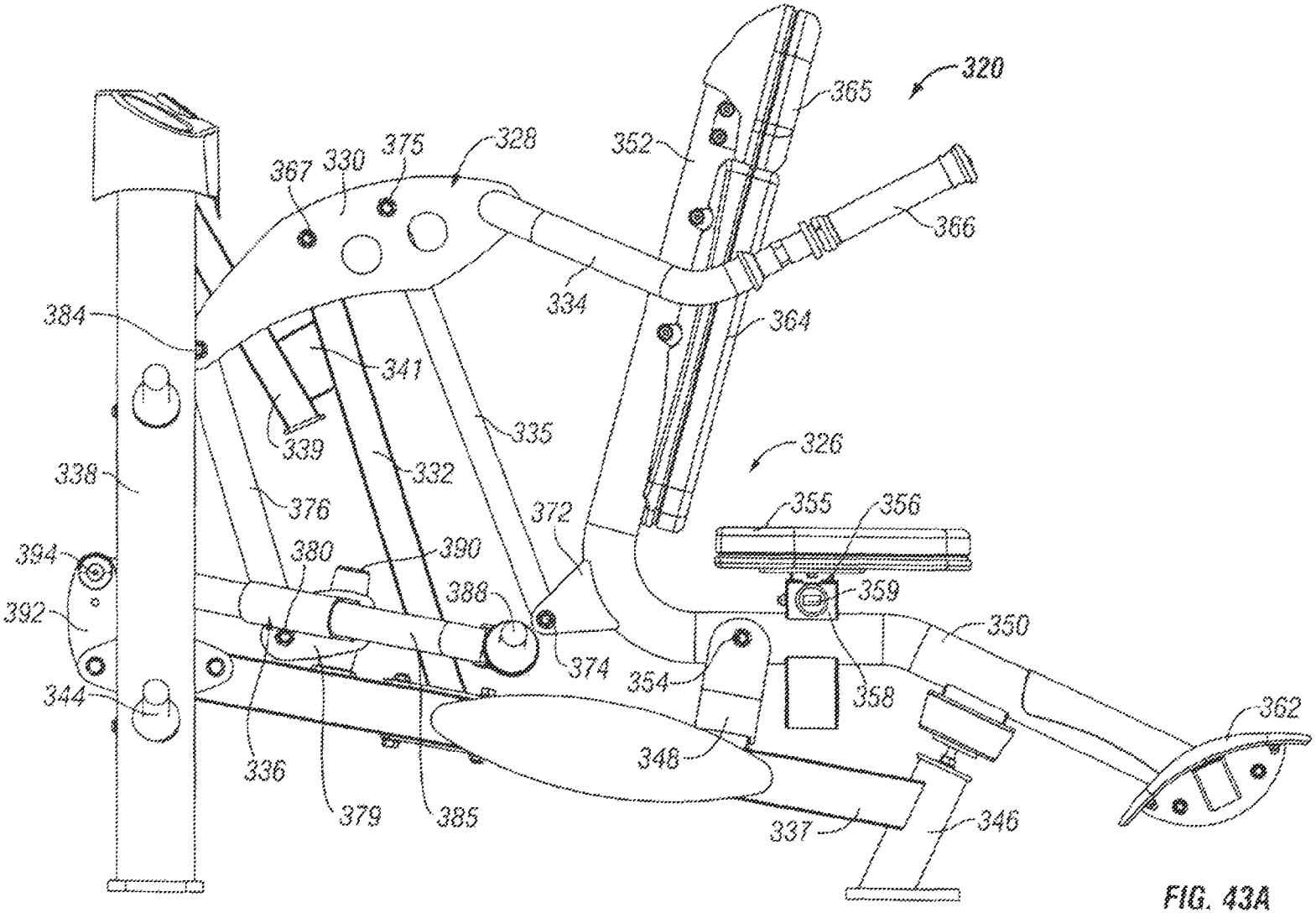
FIG. 43A is a side elevation view of the machine of FIGS. 39 to 42 with the arms in the position of FIG. 39 at the start of a seated dip exercise.
Figure 43B:
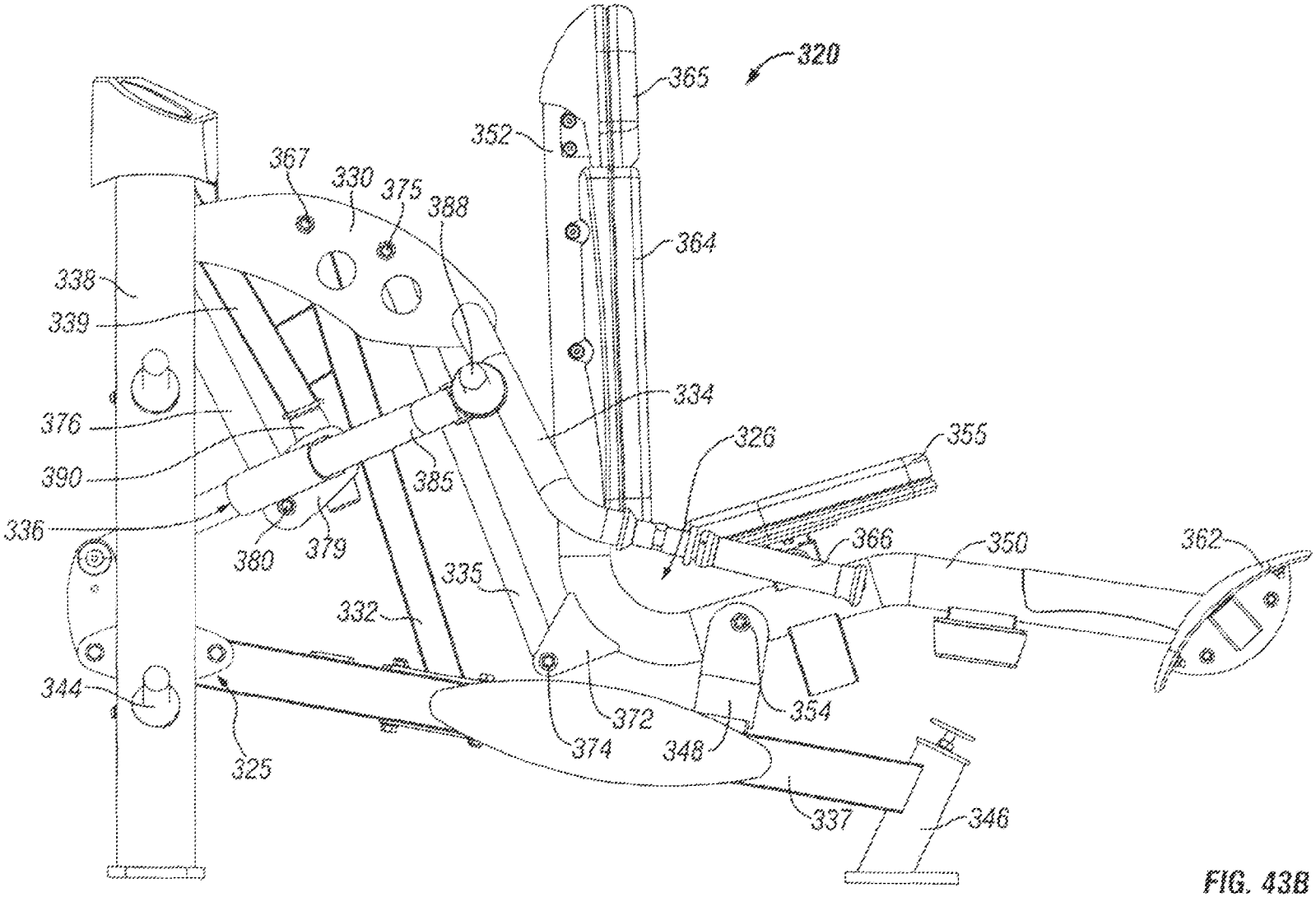
FIG. 43B is a side elevation view similar to FIG. 43A but illustrating the end position of a seated dip exercise.

As best illustrated in FIGS. 43A and 43B, forward connecting link 335 spaced in front of frame upright 332 is pivotally connected at a lower end to the user support frame via bracket 372 for rotation about pivot axis 374, and at the opposite end to the pivot brackets 330 for rotation about pivot axis 375. The second or rear connecting link 376 is spaced rearward from frame upright 332 and has a pivot sleeve 378 at its lower end pivotally mounted between brackets 379 on the lifting arm 336 for rotation about pivot axis 380, and a pivot sleeve 382 at its upper end pivotally mounted between the rear ends of pivot brackets 330 for rotation about pivot axis 384, as best illustrated in FIGS. 41, 43A and 43B.

Figure 39:
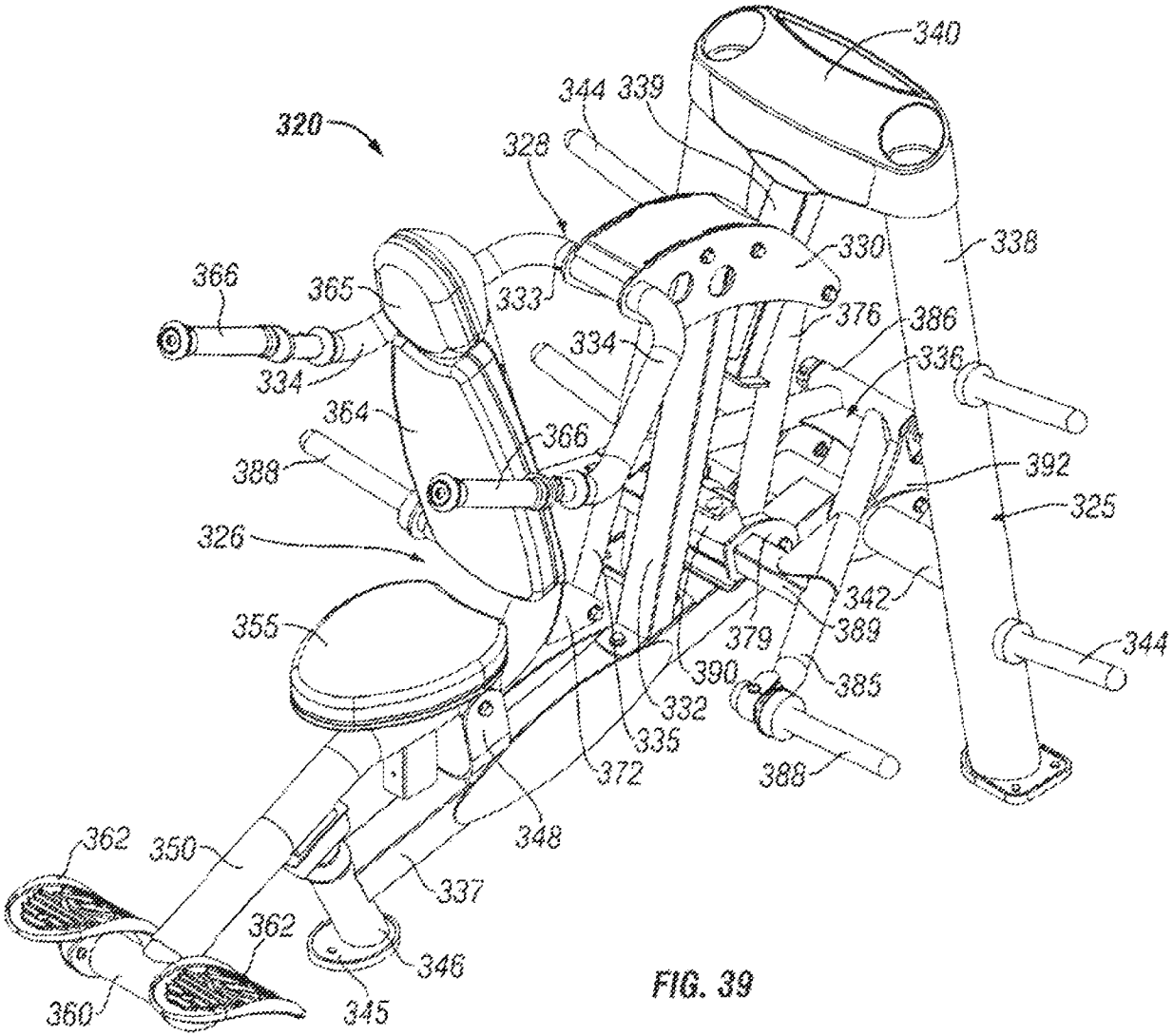
FIG. 39 is a front perspective view of a seated dip exercise machine with a plate loaded lifting arm, with the exercise arms in an exercise start position.
Figure 40:
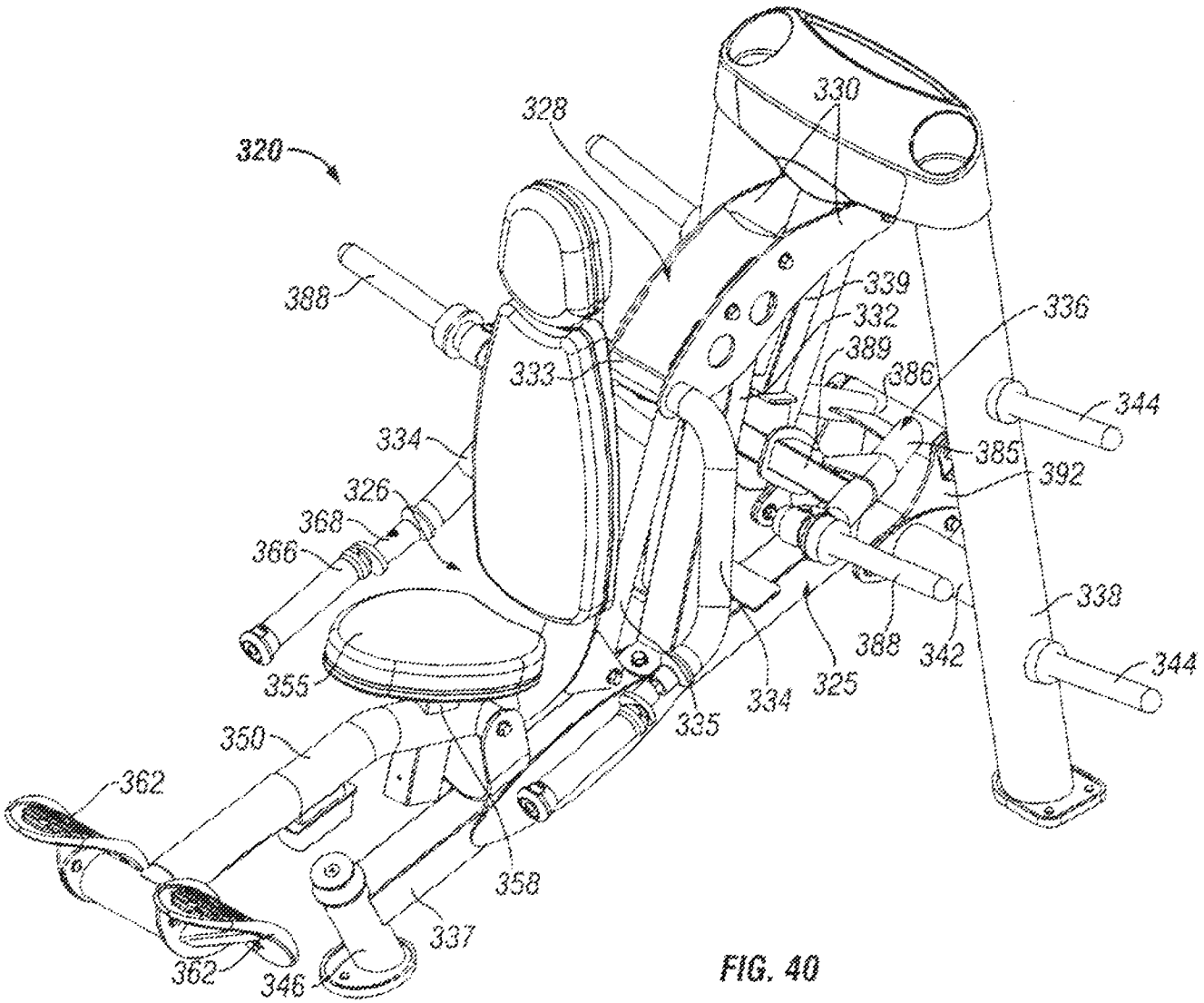
FIG. 40 is a front perspective view of the machine of FIG. 39 with the exercise arm in an exercise end position.

The lifting arm 336 in this embodiment is not L-shaped and does not form part of a connecting linkage, but instead is linked to movement of the exercise arm assembly in order to provide exercise resistance. Lifting arm 336 comprises a pair of outwardly inclined rods 385 rigidly secured to a pivot sleeve 386 at their rear ends and having outwardly directed, weight plate receiving pegs 388 at their forward ends. The rods 385 are secured together by a cross bar or brace 389 at a location spaced between their forward and rear ends, and a stop pad 390 at the center of bar 389 engages the lower end of main frame stop post 339 at the end of an exercise, as illustrated in FIG. 43B. Brackets 379 extend rearward from cross bar 389 on opposite sides of stop pad 390, as best illustrated in FIG. 39. Pivot sleeve 386 is pivotally mounted on a pivot pin which extends between pivot brackets 392 on main frame cross bar 342, as best illustrated in FIG. 41, for rotation about pivot axis 394. With this arrangement, actuation of the exercise arm assembly lifts the forward part of the lifting arm 336 while the rear end pivots about pivot axis 394, as illustrated in FIG. 43B.

Figure 44A:
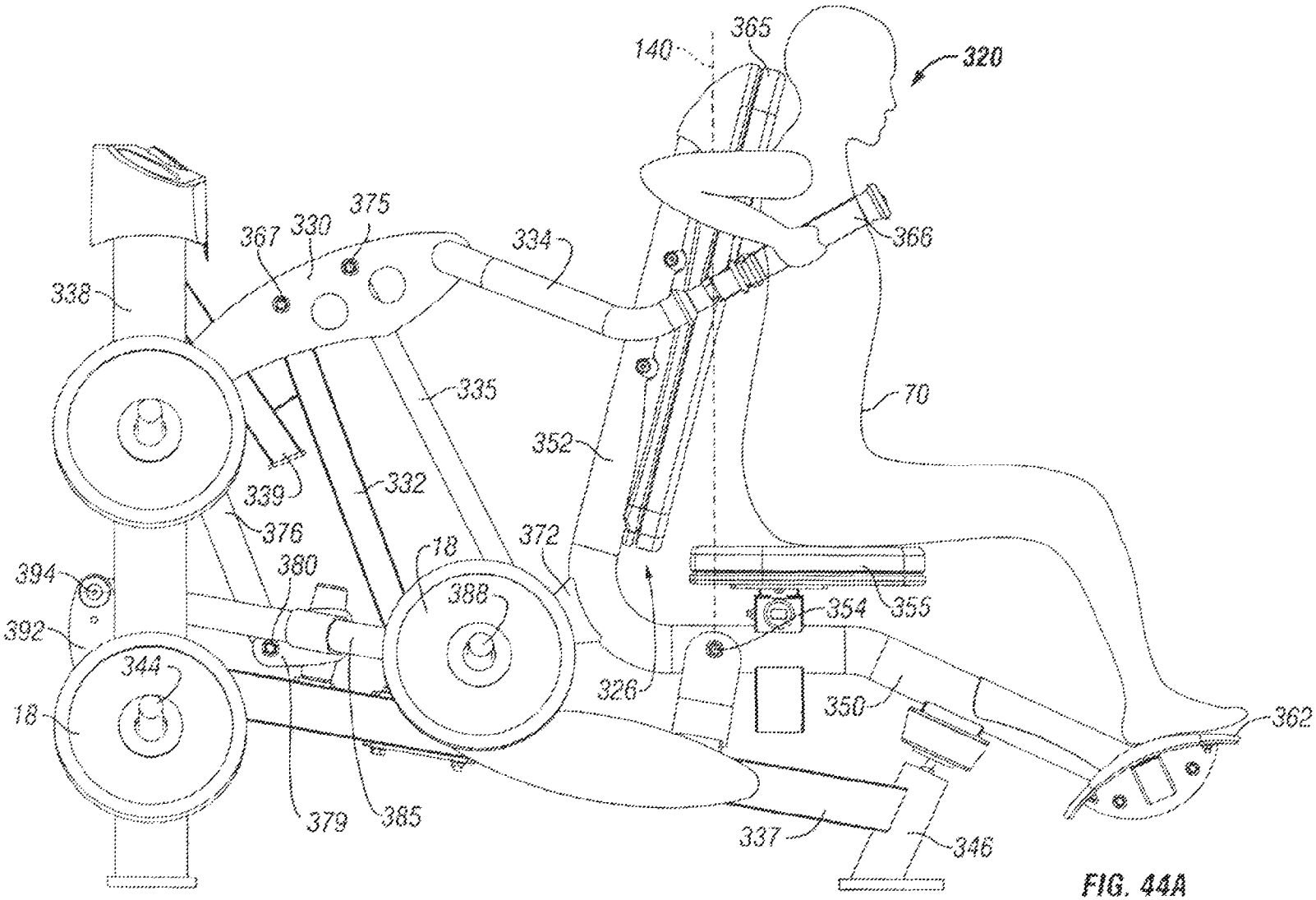
FIG. 44A is a side elevation view similar to FIG. 43A with a user seated on the machine in the start position of a seated dip exercise.
Figure 44B:
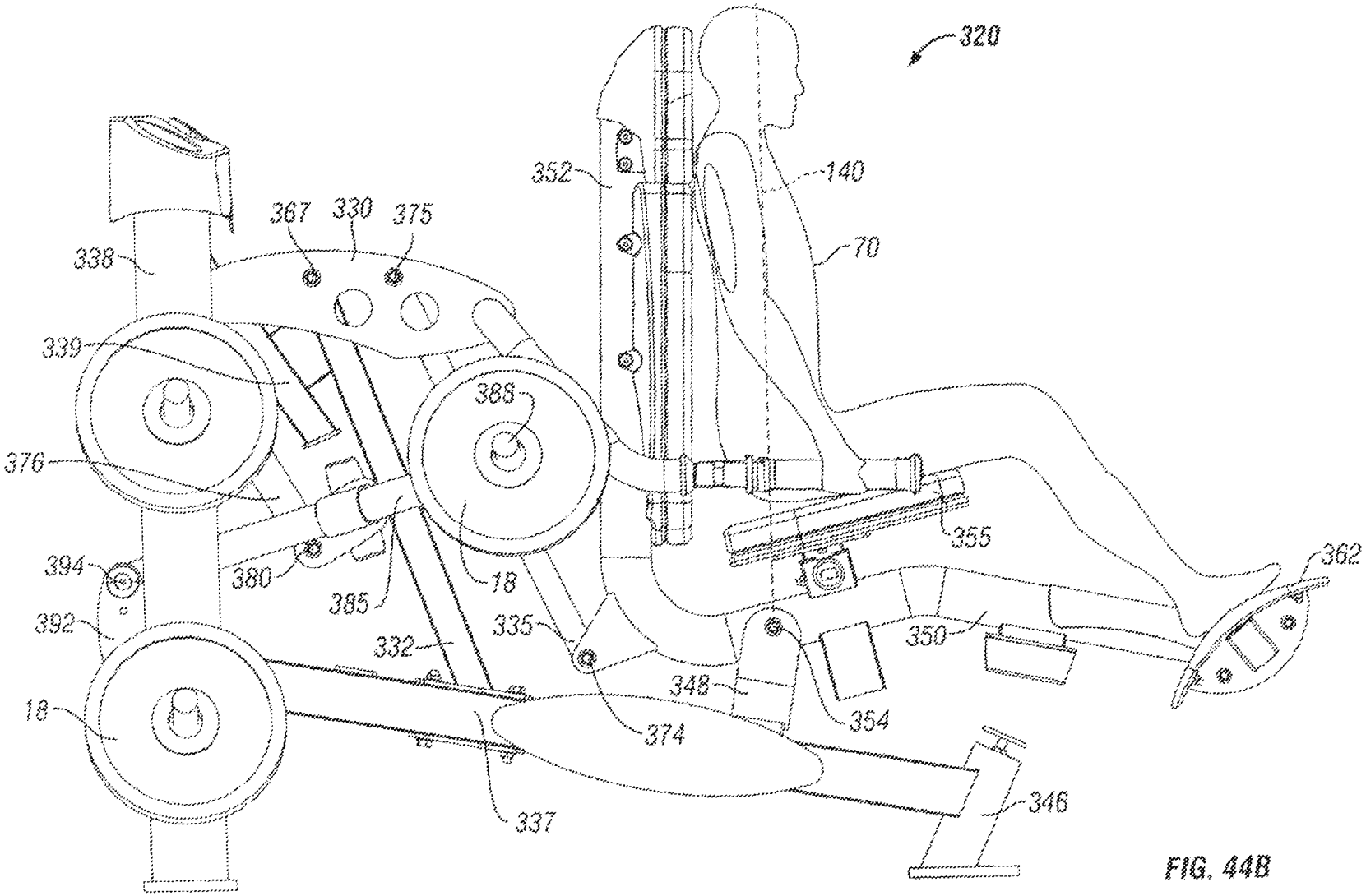
FIG. 44B is a side elevation view similar to FIG. 43B with a user seated on the machine at the end position of the seated dip exercise.

FIGS. 44A and 44B illustrate a user 70 seated on the user support 326 and performing a seated dip exercise. In a free weight bar dip exercise, an exerciser presses downwardly on the bars while raising their body until their arms are straight and aligned with the sides of the body. Seated dip exercise machine 320 of FIGS. 39 to 44 allows a user to perform the same exercise in a similar movement while in a seated position on rocking user support 326. FIGS. 39, 41, 42, 43A and 44A illustrate the start position for a seated dip exercise. In this position, handles 366 are located on opposite sides of back pad 364 and directed upwards on opposite sides of the user's chest, and the user grips the handles with their arms bent and their hands on opposite sides of their chest. In this position, the user support is in a slightly forwardly inclined orientation, as best illustrated in FIGS. 43A and 44A. From this position, the user pushes the handles of the exercise arm straight down, rotating the forward portion of pivot brackets 330 downwards about pivot axis 367 while the rear portion is rotated upwards. This in turn pushes link 335 downward, pivoting the user support 326 rearward about pivot axis 354 into the generally upright end position of FIGS. 43B and 44B. At the same time, link 376 is pulled upwards, raising the lifting arm 336 so that it rotates upwards about pivot axis 394, lifting any weight plates 18 mounted on pins 388, as seen in FIG. 44B. The stop pad 390 on lifting arm 336 may engage the lower end of stop post 339 on the main frame in the end position of the exercise (FIGS. 40 and 43B), depending on the user's arm length.

FIGS. 44A and 44B also illustrate the vertical gravitational centerline 140 of the user support's pivotal motion, which extends vertically through the user support pivot axis 354. As in the previous embodiments, there is a balanced distribution of weight on each side of the centerline 140 both at the start and end position, minimizing the effect that the weight of the exerciser and user support has on the exercise resistance. The amount of weight positioned on each side of centerline 140 varies only slightly from the start to the finish position. The combined weight of the user and user support has little effect on the amount of starting resistance because a substantially equal amount of weight is balanced rearward of the user support pivot. By the same token, because only a small portion of the user passes through the gravitational centerline during the exercise, there is no appreciable drop-off in resistance felt by the user.

Although the exercise resistance in this embodiment is provided by weight plates on the lifting arm 336, alternative types of exercise resistance may be provided in other embodiments, such as a weight stack connected to the lift arm in a similar manner to the embodiment of FIGS. 21 to 25, or a bi-directional ram or gas shock arrangement as in the embodiment of FIGS. 7A to 10B.

Figure 45:
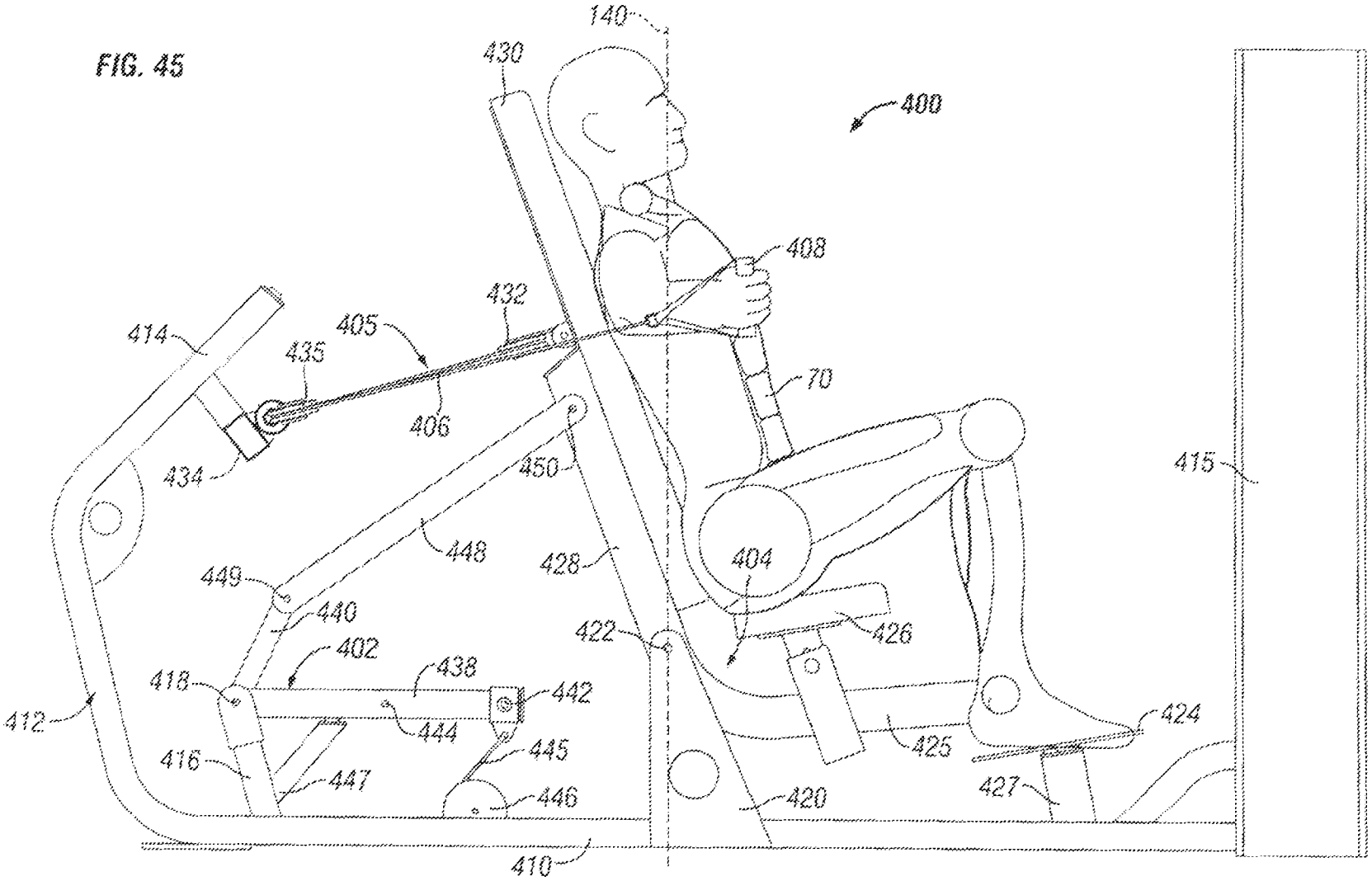
FIG. 45 is a side elevation view of a pec fly exercise machine according to another embodiment, with a user seated in an exercise ready position on the machine in the start position for a pec fly exercise.
Figure 46:
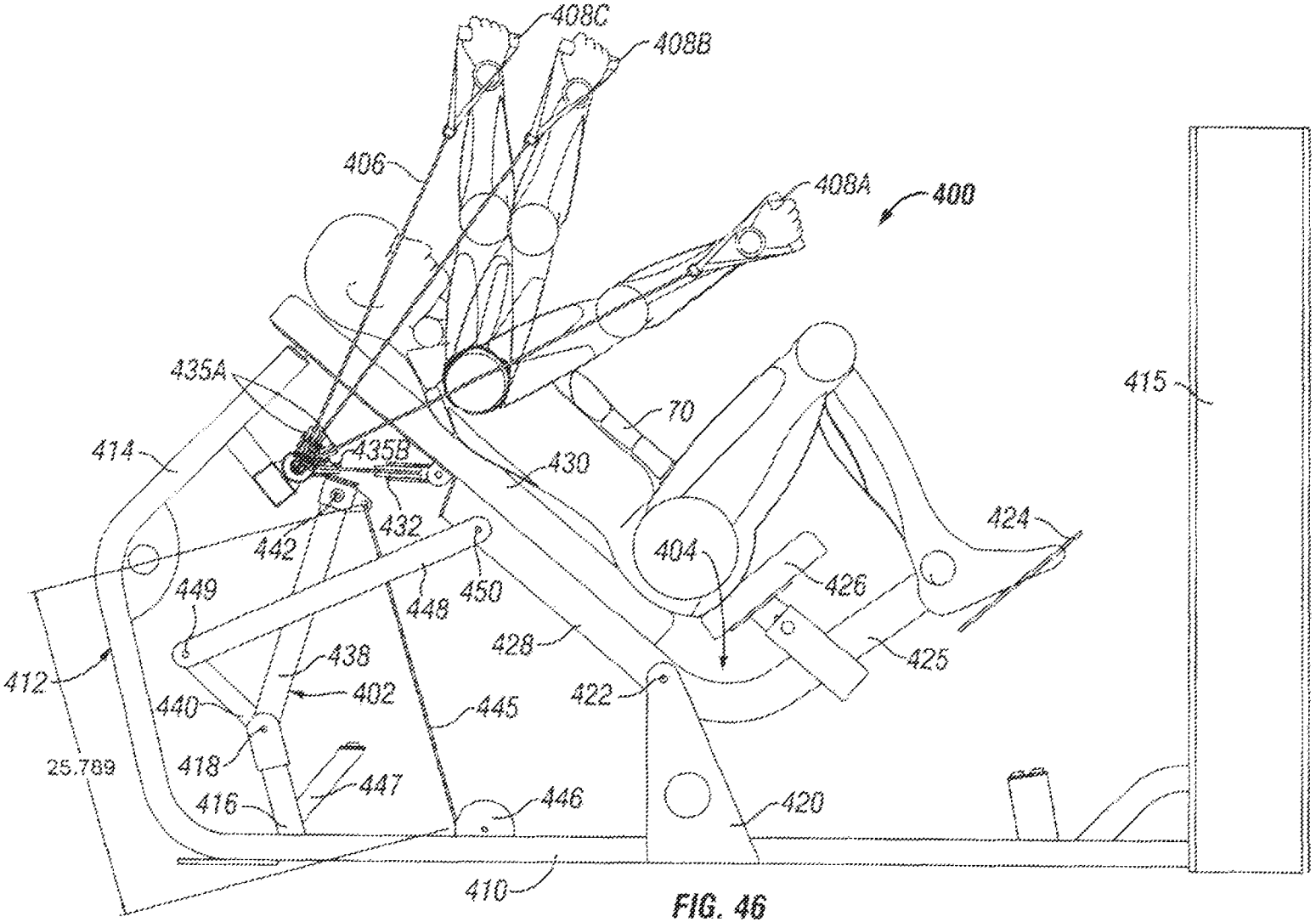
FIG. 46 is a side elevation view similar to FIG. 45 but illustrating the end position for a pec fly exercise as well as several alternative, user-defined handle paths during the exercise.

FIGS. 45 to 49 illustrate a pectoral ("pec") fly exercise machine 400 with a lifting arm 402 according to another embodiment. In this embodiment, as in the previous embodiment, the lifting arm does not form part of a connecting linkage. In this embodiment, the lifting arm is linked to user support 404, and a user engagement device or exercise arm assembly 405 comprises a flexible line or cable 406 which extends around a series of pulleys and terminates in handles or grips 408 at opposite ends of the cable, as described in more detail below. This allows the user to define the path of their hands when performing an exercise, as illustrated in FIGS. 45 and 46.

In this embodiment, a main frame has a horizontal base section 410 and a rear upright section 412 which has a forwardly angled upper end portion 414, and a weight stack housing 415 is secured at the forward end of base section 410. The lifting arm 402, which is generally L-shaped, is pivotally mounted at the upper end of a pivot mounting post 416 on the base section for rotation about pivot axis 418. Pivot mounting post 416 is spaced in front of rear upright section 412. User support 404 is also generally L-shaped and is pivotally connected to pivot support brackets 420 on the base section 410 for rotation about pivot axis 422, at a location spaced between the lifting arm 402 and weight stack housing 415. The user support has a base portion 425 on which seat pad 426 is adjustably mounted and a backrest portion 428 on which back pad 430 is mounted. A footrest 424 is secured to the forward end of base portion 425. Footrest 424 engages a stop post or stand-off 427 on the base section 410 in the exercise start or rest position of FIG. 45.

Figure 49:
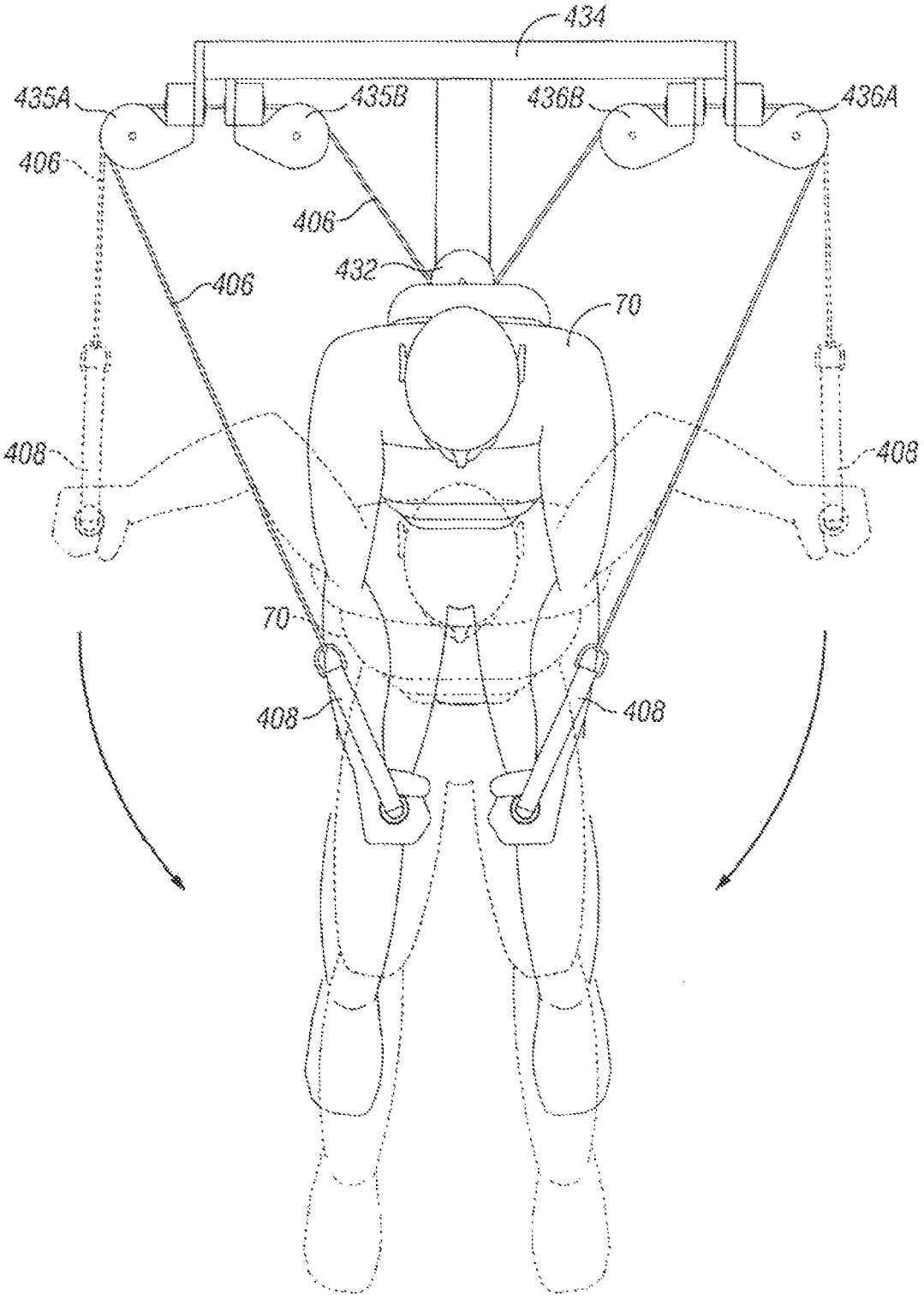
FIG. 49 is a top plan view of the user engaging part of the machine with a seated user engaging the handles and moving the handles in a pec fly movement.

In this embodiment, a first swiveling pulley 432 is pivotally mounted on the backrest portion 428 of the user support and forms a connecting link between the user engagement device and user support. As best illustrated in FIG. 49, a cross tube 434 is mounted on the user end portion 414 of main frame rear upright section 412, and dual pairs 435A, 435B and 436A, 436B of independently swiveling pulleys are mounted at or close to the opposite ends of cross tube 434, facing forwards. Cable or flexible line 406 extends from a first one of the handles 408 around the first pair 435A, 435B of swiveling pulleys on the main frame, then around the first swiveling pulley or connecting link 432 on the backrest section of the user support, and finally around the second pair 436B, 436A of swiveling pulleys, terminating at the second handle 408. The handles may be flexible straps with a grip extending between the ends of the straps. The inner pulley 435B, 436B of each pair of swiveling pulleys tracks the movement of the central swiveling pulley 432, while the outermost pulley 435A, 436A of each pair tracks the movement of the strap handles, as illustrated in FIGS. 45 and 46.

The generally L-shaped lifting arm 402 has a first, longer leg 438 which extends generally horizontally from pivot mount in the exercise start position of FIG. 45, and a second, shorter leg 440 rigidly connected to leg 438 at the pivot 418 and extending at an acute angle to leg 438. Leg 438 has at least two alternative attachment or anchor points 442, 444 for a load bearing cable 445 which links the lifting arm 402 to a weight stack (not visible in the drawings) in housing 415 via a suitable cable and pulley linkage, including a first pulley 446 mounted on the base section 410 of the frame below the lifting arm. Other pulleys in the linkage are not visible in the drawings. A stop post or stand-off 447 extends from pivot mounting post 416 and the longer leg of the L-shaped lifting arm rests on post 447 in the start or rest position of FIG. 45. The shorter leg 440 of the lifting arm is linked to the rear upright 428 of the user support via connecting link 448 which is pivoted to leg 440 for rotation about pivot axis 449, and is pivoted to the rear upright 428 for rotation about pivot axis 450.

Figure 47:
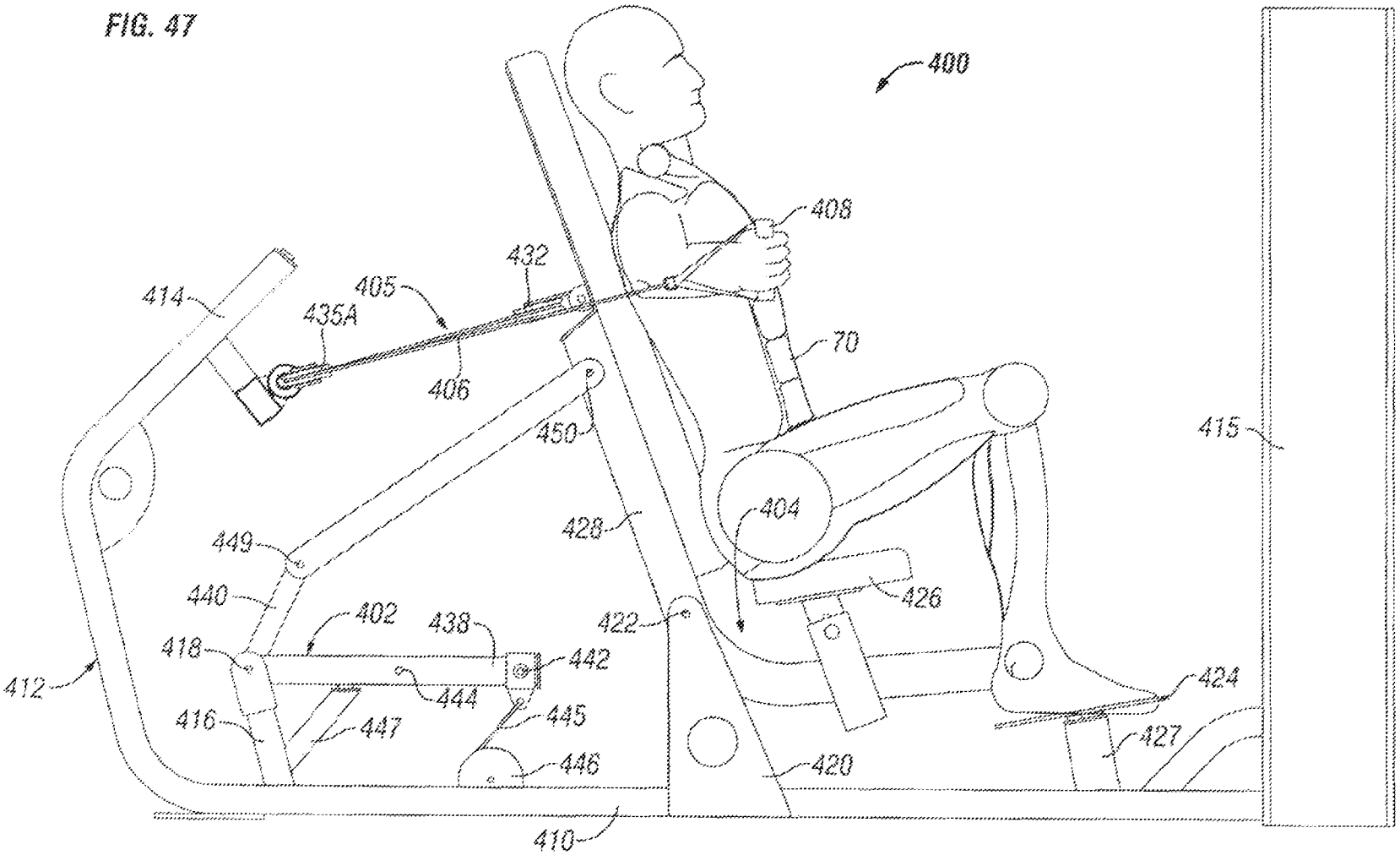
FIG. 47 is a side elevation view similar to FIG. 46 but illustrating attachment of the load at a different position on the lifting arm.
Figure 4B:
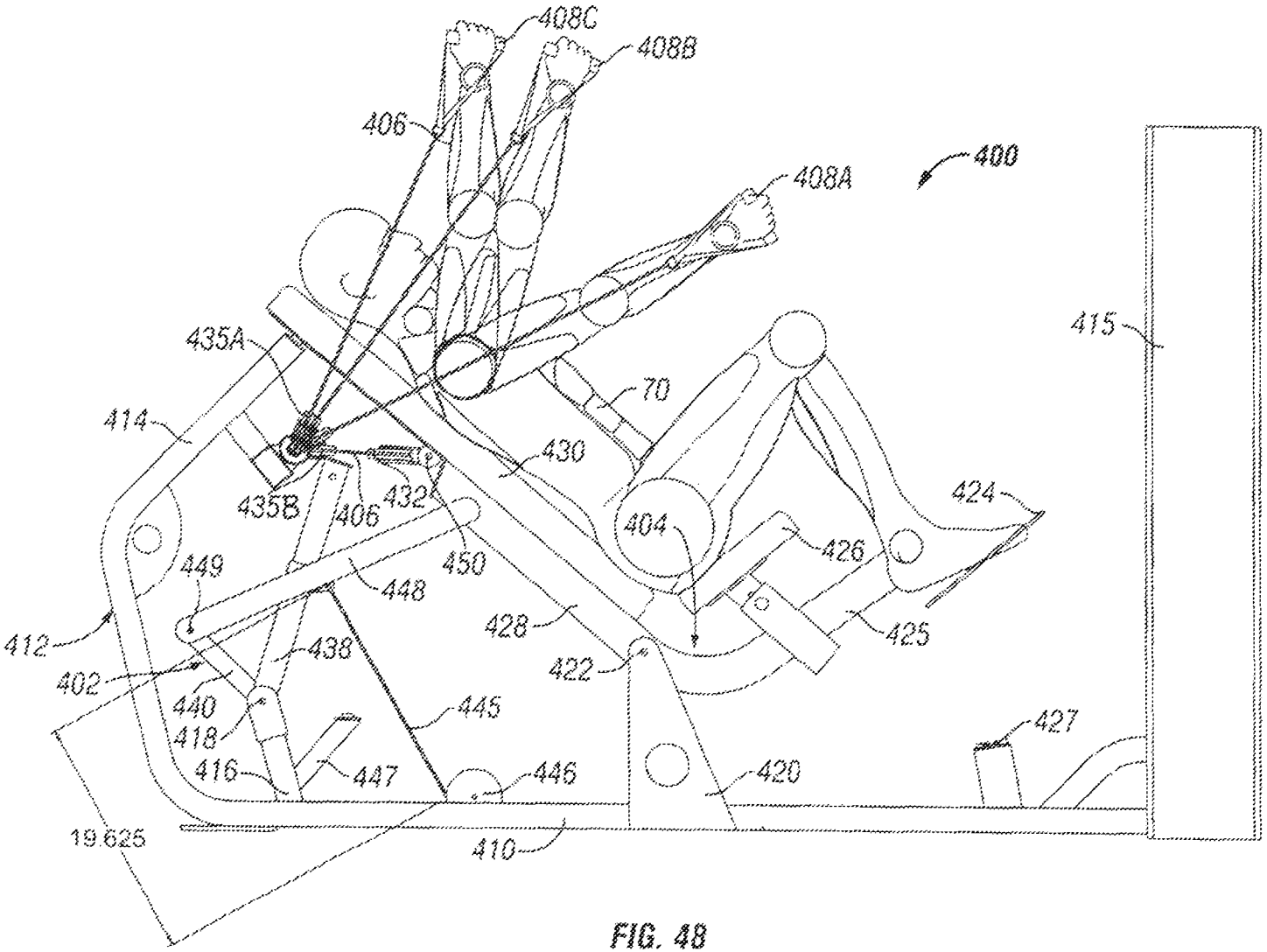

FIGS. 45 and 46 illustrate exercise start and finish positions for a first load option in which the weight bearing cable 445 is connected to the anchor point 442 at the forward end of leg 438, and FIGS. 47 and 48 illustrate exercise start and finish positions for a second load option in which the weight bearing cable 445 is attached to anchor point 444 which is spaced rearwardly from anchor point 442. Additional anchor points may be provided if desired. As can be seen by comparison of FIGS. 46 and 48, attachment to anchor point 442 pulls around six inches more cable and therefore provides a greater load for performing the exercise.

To perform an exercise, the user 70 positions themselves in an exercise ready position on user support 404, as in FIG. 45. The user support is in a slightly reclined orientation in the start position. User 70 then brings the handles 408 to chest level with their arms bent and out to the side of their body, as illustrated in FIG. 45 and in dotted outline in FIG. 49, and extends their arms forward and inward in a pec fly movement, as indicated by the arrows in FIG. 49, ending with their arms extending out from their body. This movement is performed at the angle and movement pattern of the user's choice, with FIG. 46 illustrating three possible handle paths and handle end positions 408A, 408B, and 408C. They can choose to perform a decline exercise finish with their arms extending in a downward path from their body, and the hands at end position 408A. Alternatively, they can extend their arms upwardly, finishing at handle positions 408B or 408C, or at any position between these end positions as desired. In each case, as the arms are extended, pulling on cable 406, the user support is tilted rearward about pivot axis 422 into the more reclined end position of FIG. 46 due to the cable 406 pulling on the back rest via pulley 432. Tilting the back rest rearwards also rotates the lifting arm in an anti-clockwise direction about pivot axis 418, lifting the longer leg 438 and pulling on the weight bearing cable. FIGS. 47 and 48 illustrate the same exercises with the weight bearing cable 445 attached to the other anchor point 444 on the lifting arm, so that less cable is pulled in the exercise. As in the previous embodiment, a vertical gravitational center line 140 of the user support pivotal movement extends through the user and user support in the exercise start and end positions, so that there is a balanced distribution of weight on each side of the centerline 140 both at the start and end position. This minimizes or reduces the effect that the weight of the exerciser and user support has on the exercise resistance.

Figure 50:
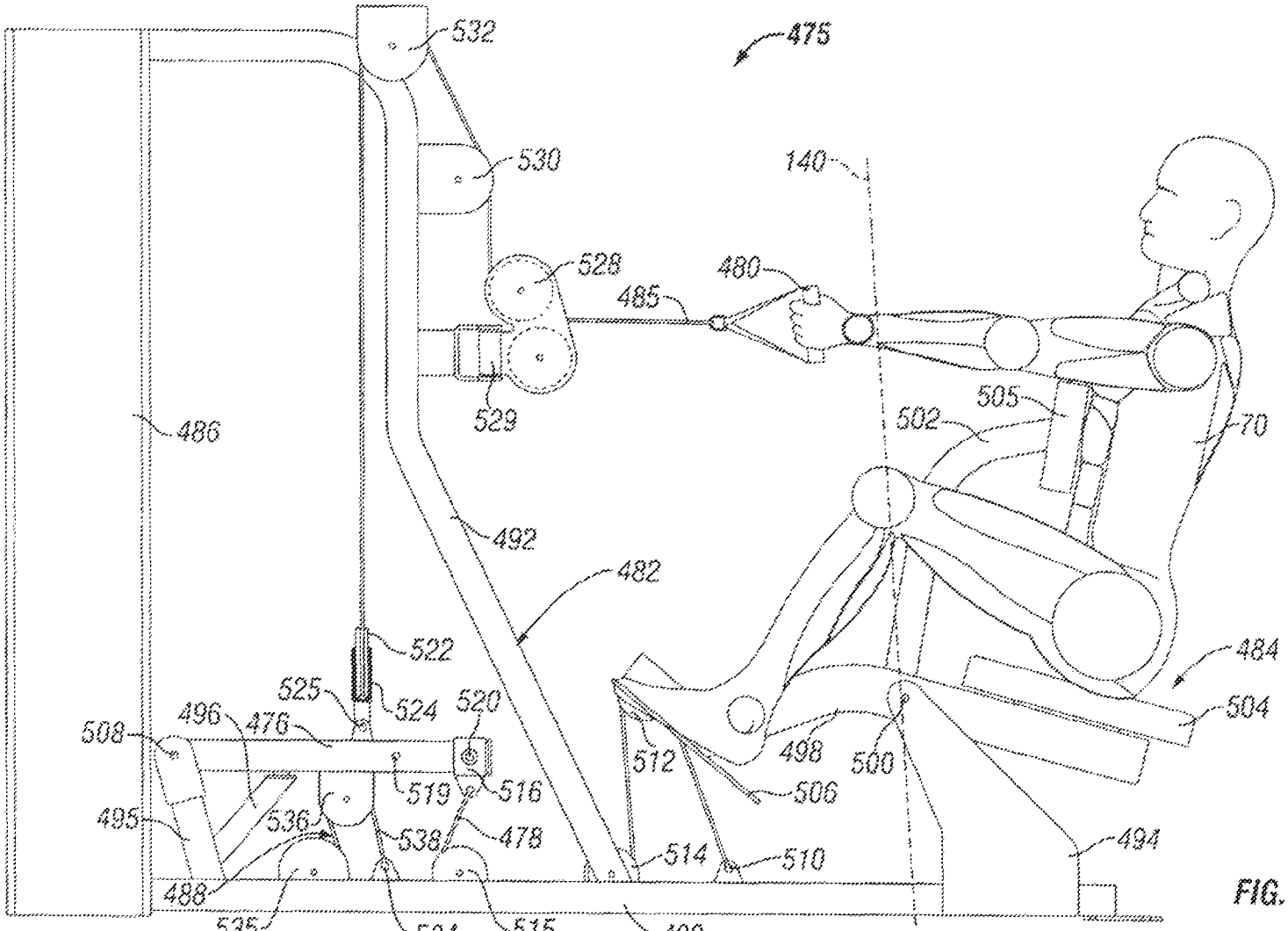
FIG. 50 is a side elevation view of an upper back exercise machine according to another embodiment, with a user seated in an exercise ready position on the machine at the start of an upper back exercise.
Figure 51:
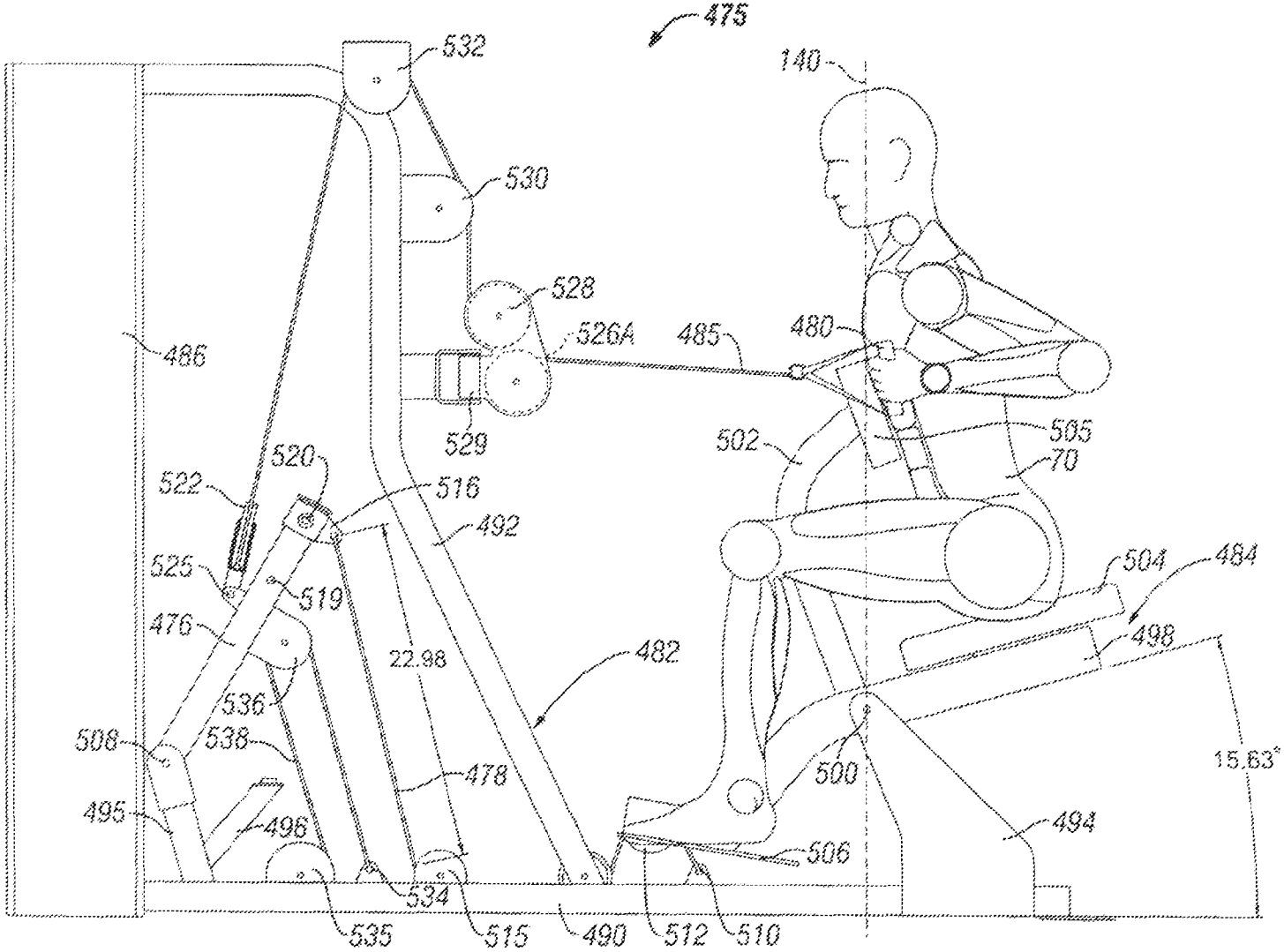
FIG. 51 is a side elevation view similar to FIG. 50 illustrating the exercise end position.
Figure 52:
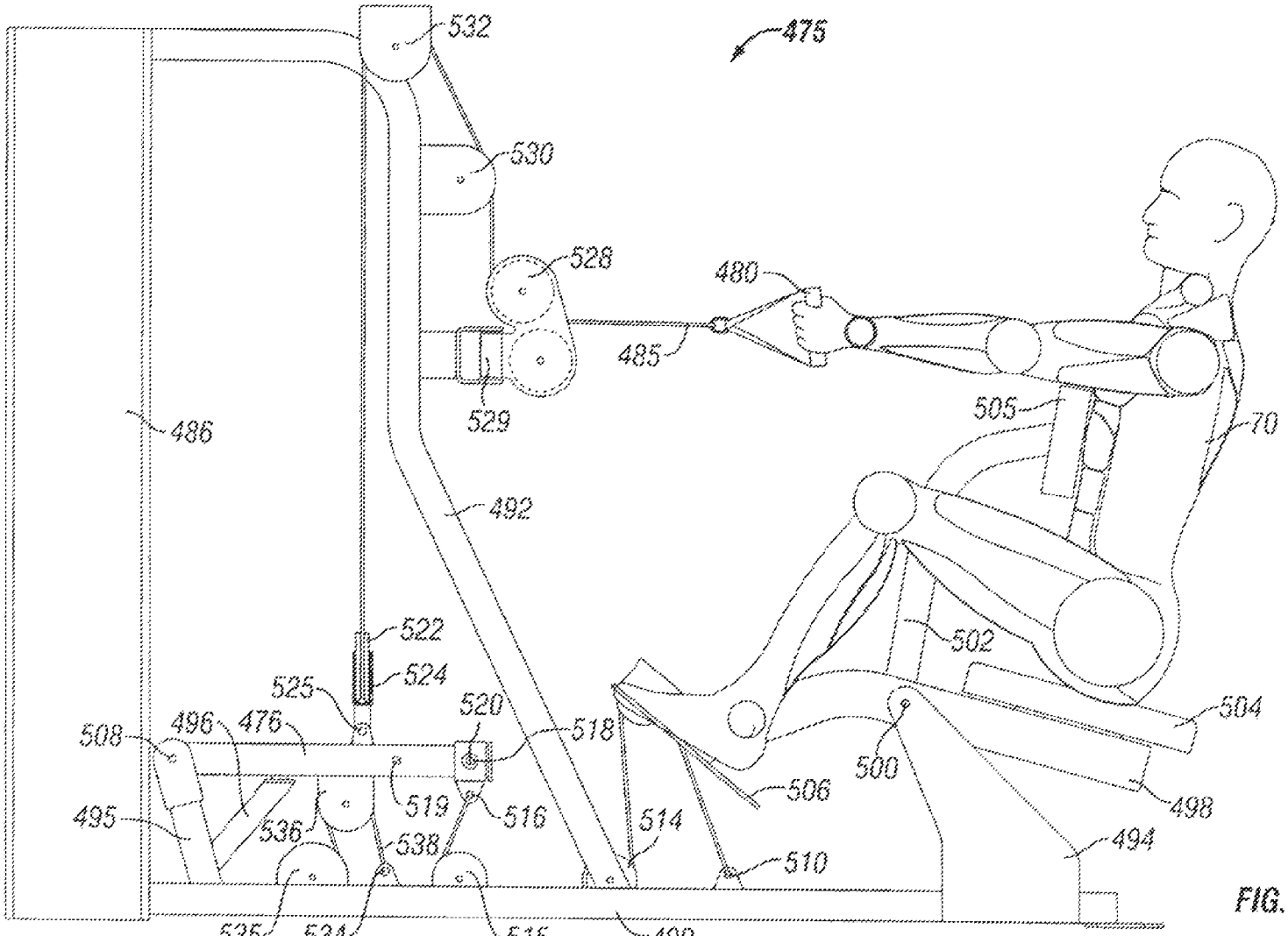
FIG. 52 is a side elevation view similar to FIG. 50 but illustrating attachment of the load at a different position on the lifting arm.
Figure 53:
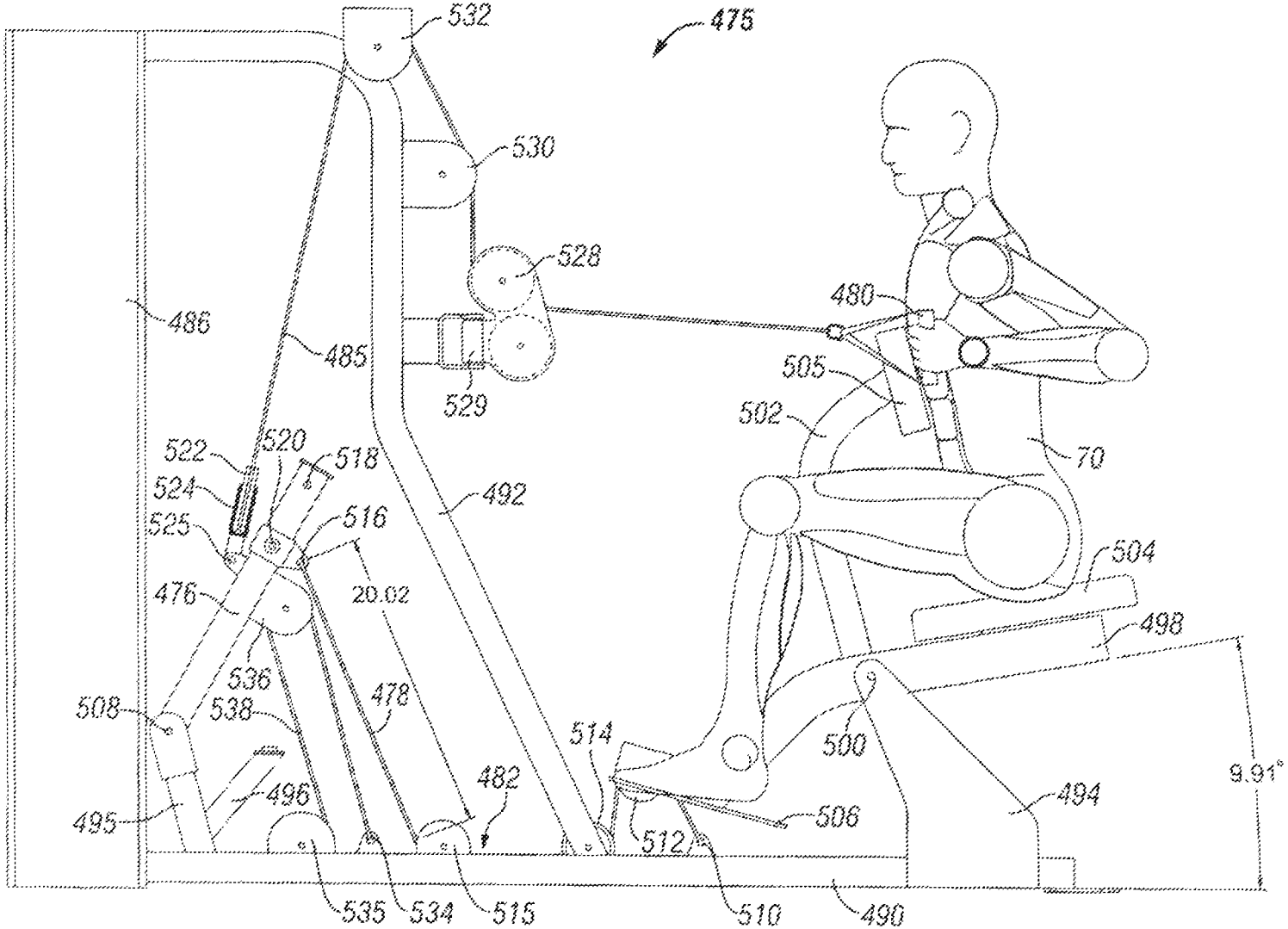
FIG. 53 is a side elevation view similar to FIG. 51 but illustrating the exercise end position with the load attached as in FIG. 52.
Figure 54:
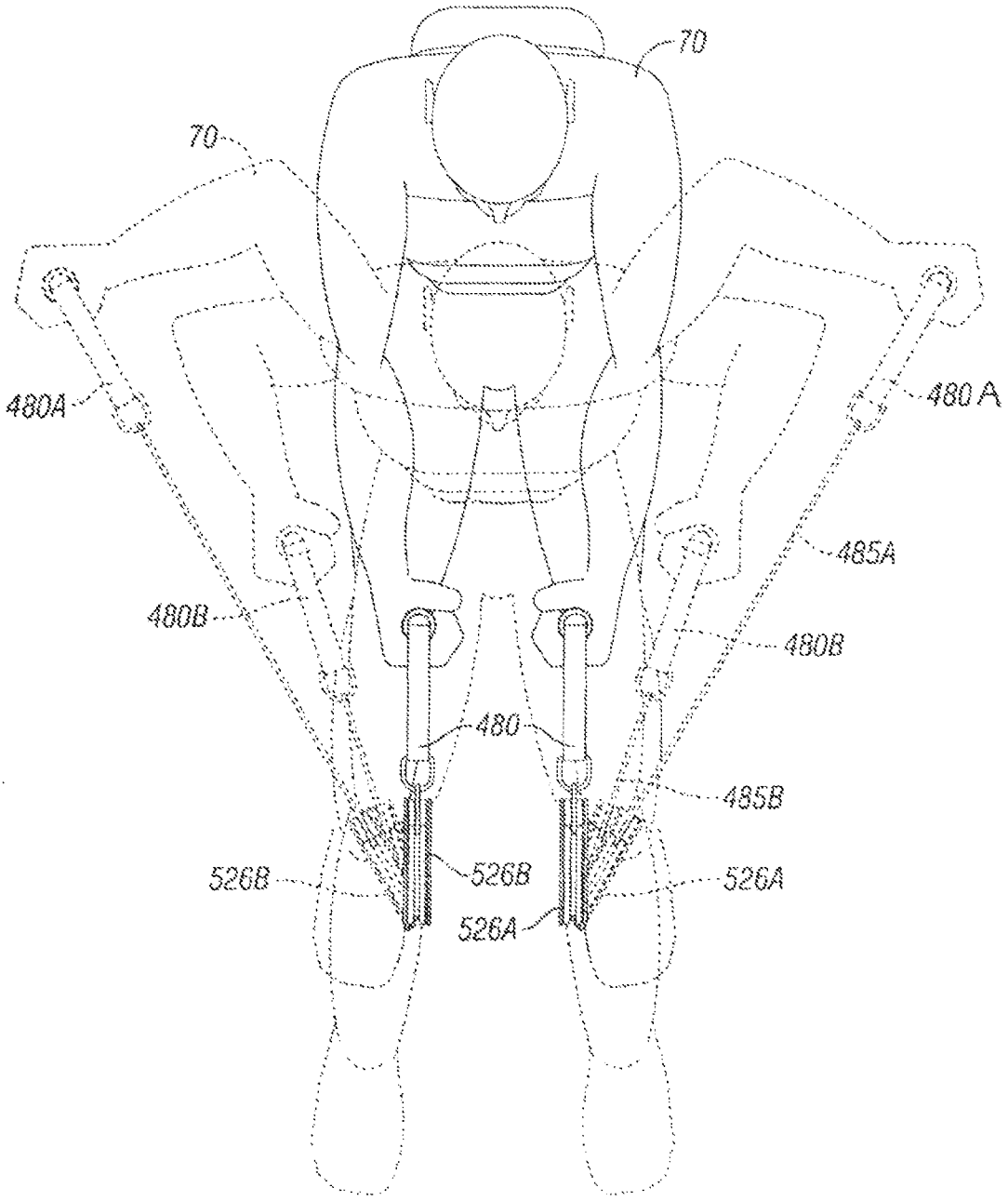
FIG. 54 is a top plan view of the user engaging handles and part of the flexible line attached to the handles in the machine of FIGS. 50 to 53, with a seated user engaging the handles, illustrating user defined movement of the handles to perform different upper back exercises.

FIGS. 50 to 54 illustrate one embodiment of an upper back exercise machine 475 including a lifting arm 476. This is similar to the upper back exercise machine of co-pending application Ser. No. 12/060,689 filed on Apr. 1, 2008, the contents of which are incorporated herein by reference, except that the dual cam linkage of that machine is replaced by a lifting arm assembly including arm 476. FIGS. 50 and 52 illustrate the machine in a start position while FIGS. 51 and 53 illustrate the machine in an end position for the exercise, with different connection positions for a cable 478 which connects lifting arm 476 to a user support 484, as explained below. FIG. 54 illustrates different possible user-defined paths for the user engaging handles 480 of the machine.

The machine 475 has a main frame 482 which has a base strut 490 and a user support 484 is pivotally mounted on the base strut. A user engagement device is movably mounted relative to the frames and comprises user engaging handles 480 attached to opposite end portions or arm portions of a cable or flexible exercise arm member 485. The cable or flexible member 485 extends around a series of pulleys in a cable and pulley assembly, as described in more detail below. Any suitable flexible elongate members such as cables, belts, lines, chains and the like may be used for flexible exercise arm member 485. An exercise resistance comprising a weight stack in housing 486 at the forward end of base strut 490 is linked to the lifting arm via a second cable and pulley assembly. In this embodiment, the lifting arm 476 comprises part of a connecting linkage extending from the user engagement device to the user support frame.

An upright section or strut 492 and user support pivot mount plates 494 extend upwardly from main frame base section or strut 490, and a lifting arm pivot mounting post 495 extends upwardly from the base section between the upright section 492 and the weight stack housing 486. An angled stop member or stand-off 496 extends from pivot mounting post 495 and provides a stand-off or stop for lifting arm 476 in the start position of FIG. 50.

The user support frame 484 is generally T-shaped, with a base 498 pivotally mounted between the upper ends of the pivot mount plates 494 for rotation about pivot axis 500, and an upright post 502 which curves rearward at its upper end. A user support seat pad 504 is mounted on the rear part of the base, while a chest support pad 505 is mounted at the end of post 502. A foot support or footplate 506 is secured to the forward end of the base 498.

In this embodiment, the lifting arm 476 comprises a single, straight arm having a first end pivotally mounted on pivot mounting post 495 for rotation about pivot axis 508, the arm extending rearward from the pivot mount in the start position of FIG. 50. Lifting arm 476 is linked to the forward end of the user support 484 via a cable 478 which extends from an anchor 510 on the base section 490 of the main frame beneath the user support, around a pulley 512 under footplate 506, and around second and third pulleys 514, 515 on the base section 490 before anchoring to anchor member 516 which is slidably mounted on the lifting arm 476. As illustrated in FIGS. 50 and 52, spaced holes 518, 519 on the lifting arm allow the anchor member to be secured at different positions along arm 476, a pull pin 520 or the like, as was the case with the load bearing cable attachment of the previous embodiment. FIG. 50 illustrates the cable 478 secured at hole 518 at or close to the end of lifting arm 476. FIG. 52 illustrates an alternative starting position in which the cable is secured at the location of hole 519, adjusting the amount of ride or movement of the user support between the exercise start and end position, as described in more detail below.

The lifting arm is also linked to the user engagement device. The user engagement device in this embodiment comprises the handles 480 and flexible cable or other elongate member 485 which has opposite ends secured to the respective handles 480. Cable 485 extends in a path around a series of pulleys on the main frame upright 492 and around a pulley 522 mounted in a swivel housing 524 which is pivoted to an upper side of the lifting arm 476 for rotation about pivot axis 525, thereby linking the user engagement device to the lifting arm. As illustrated in FIGS. 50 to 54, cable 485 extends from one handle between pulleys 526A (FIG. 54) of one set of a pair of swivel pulley assemblies 528 mounted on upright 492 via pivot sleeve or swivel housing 529 (FIG. 50), around one of a pair of fixed, side-by-side pulleys 530 on the upright above the swivel pulley assemblies 528, then around one of a pair of parallel pulleys 532 on opposite sides of upright 492, and then downwardly around the pulley 522. From the pulley 522, cable 485 extends back up around the second one of the pulleys 532, around the second one of the pulleys 530, and is then received between the two pulleys 526B (FIG. 54) in the second set of the swivel pulley assemblies 528, before connecting to the second handle 480.

The lifting arm is also linked to the weight stack in housing 486 via cable and pulley assembly 488, which includes an anchor 534 and pulley 535 on the base section 490 of the main frame, and a pulley 536 on the undersurface of lifting arm 476 between the pivot mount and the cable linkage to the user support. A load bearing cable 538 extends from anchor 534 around pulley 536, then around pulley 535 before extending into the weight stack housing 486 where it is suitably linked to the weight stack in a conventional manner.

With this arrangement, rearward movement of one or both handles 480 from the position in FIG. 50 to the position in FIG. 51 pulls up the pulley 522 and the lifting arm 476 which pivots rearwardly in an anti-clockwise direction about pivot axis 508 into the end position of FIG. 51. This simultaneously pulls on both the cable 478 linking the lifting arm to the user support 484 and the load bearing cable 538 which is linked to the weight stack. This in turn rotates the user support frame about pivot axis 500 from the rearwardly reclined start position of FIG. 50 into the forwardly inclined end position of FIG. 51.

The swivel mounts 529 of the two swivel pulley assemblies 528 of the user engagement device allow the assemblies to pivot in and out as indicated in FIG. 54 as the user moves their hands in an exercise movement which exercises the upper back muscles. This allows the user control the exercise path, as indicated in dotted outline in FIG. 54 for two possible alternative exercise paths, and described in more detail below. In order to perform the exercise, the user 70 first sits on the user support in the position of FIG. 50 and the solid line position of FIG. 54, placing their feet on the footplate 506 and their chest against the chest pad 505, then grabs the handles 480 with their arms straight in front of their body, slightly bent, and their hands close together, as indicated in FIG. 50 and in solid lines in FIG. 54. At the start of the exercise, the user is in a slightly reclined orientation at an angle of around 6 degrees to the gravitational centerline or vertical centerline 140 of the user support pivot 500, as indicated in FIG. 50.

From the position illustrated in FIG. 50, the user pulls the handles or hand grips 480 rearward. Since the exercise arm in this embodiment is a flexible cable or other elongate member or line 485 which extends from each handle between pulleys of a respective swivel pulley assembly 528 which can swivel inward and outward independently of the other swivel pulley assembly, the user controls the exercise path and thus the type of upper back exercise performed. In FIG. 54, the outermost handle position 480A corresponds to a rear deltoid exercise in which the user moves their hands rearward and outward into an end position in which the user's arms are bent with their hands positioned out to the sides of their body. As noted above, this movement also pulls the lifting arm upwardly against the exercise resistance, in turn pulling the user support downward at their forward end via connecting linkage or cable 478, with the chest pad and user upper body ending up in a forward lean of around 20 degrees from the vertical. The user's arms finish in a bent position with their hands positioned out to the sides, slightly below and forward of their shoulders.

The user is in three different positions throughout the exercise, starting in a recline or decline position, traveling through a straight, upright position, and ending in a forward incline position. At the same time, there is a change in elevation of the user's shoulders between the start and finish position, which amounts to about a four inch change. Additionally, the user can determine the travel path of the user engaging handles or grips 480. These factors together provide an enhanced workout by involving a greater number of muscles than a rear deltoid exercise performed in only one position, thereby combining multiple exercises into one. Instead of performing a rear deltoid exercise, a user may chose to perform a mid-row type of exercise, pulling their hands back and only slightly outwards, with the handles or grips ending in dotted line position 480B of FIG. 54. Since cable is not pulled as far when the mid row exercise is performed, the end position of the user support for this exercise may slightly different from that of a rear deltoid exercise. The user may define the travel path of the grips as desired throughout the exercise and may end the exercise with the handles in either of the positions illustrated in FIG. 54, or in any other desired position, so that different back muscles can be exercised. Both handles may be actuated simultaneously, or the user may opt to pull only one handle at a time, as desired.

In FIGS. 50 and 51, the cable 478 which connects lifting arm 476 to the user support is anchored to the anchor point or hole 518 adjacent the end of arm 476. This pulls around 23 inches of cable 478 and rotates the user support base 498 into a forward inclination of around 15 to 16 degrees, as indicated in FIG. 51. If a user wishes to reduce the amount of ride, the cable 478 may alternatively be anchored to anchor hole 519 spaced from the end of the arm 476, as indicated in FIG. 52. In this case, the exercise is performed in exactly the same way as described above for FIGS. 50 and 51, but less cable 478 is pulled, so that the user support does not rotate as far. As indicated in FIG. 53, in the end position with the cable 478 attached at anchor hole 519, around 20 inches of cable 478 is pulled and the user support base 498 in the end position is at an angle of around 9.9 degrees. Additional anchor holes may be provided along arm 476 if desired. In an alternative embodiment, the attachment of the pivot housing 524 which links the user engagement device to the lifting arm may also be adjustable along the length of the lifting arm in a similar manner to the cable anchor 516, either in addition to or instead of adjustable anchor 516. This provides an alternative ride adjustment mechanism.

The gravitational centerline or vertical centerline 140 in this embodiment of the user support pivot runs through the exerciser's leg adjacent the knee in the start position and ends at mid thigh in the finish position of the upper back exercise illustrated in FIGS. 50 and 51, with a slightly different end position when the user support cable link is anchored at a different position. In either case, there is a balanced distribution of weight on each side of the centerline 140 both at the start and end position, minimizing the effect that the weight of the exerciser and user support has on the exercise resistance. The amount of weight of the exerciser and user support has on the exercise resistance. The amount of weight positioned on each side of centerline 140 varies only slightly from the start to the finish position. The combined weight of the user and user support has little effect on the amount of starting resistance because a substantially equal amount of weight is balanced rearward of the user support pivot By the same token, because only a small portion of the user passes through the gravitational centerline during the exercise, there is no appreciable drop-off in resistance felt by the user.

In the two previous embodiments, the user engagement device comprises handles attached to a flexible line or cable, to provide a unilateral, three dimensional user defined exercise motion. In an alternative embodiment, the handles may be attached to articulating arms to produce a similar user defined exercise motion. The machine is designed to mimic the natural elliptical movement of the corresponding free weight dumbbell exercise, but is able to combine the effectiveness of multiple exercises by rotating the user from reclined to flat to inclined positions throughout the exercise.

FIGS. 55 to 61 illustrate a first embodiment of a leg exercise machine 550 incorporating a lifting arm 552 and designed for performing leg extension exercises. The lifting arm in this embodiment is generally L-shaped and of similar design to the lifting arms of FIGS. 1 to 6 and 11 to 20. Leg exercise machine has a stationary main frame 554 on which a user support 556 is pivotally mounted, and a user engagement device or exercise arm assembly 551 is pivotally mounted at the forward end of the user support. A connecting linkage including a flexible connecting link 558 and the pivotally mounted lifting arm 552 is provided between the exercise arm 555 and the user support 556 so that movement of the exercise arm is translated into movement of the user support, as described in more detail below. The flexible connecting link 558 also connects the exercise arm with the main frame. In this embodiment, the exercise resistance comprises weight plates mounted on the lifting arm 552, although the exercise resistance may alternatively comprise a bi-directional ram or gas shock assembly similar to that of FIGS. 7 to 10, or the lifting arm may be linked to a weight stack as in the embodiment of FIGS. 21 to 25.

The main frame 554 comprises base 560 having a floor-engaging cross bar 562 at its forward end and rear upright portion comprising an A-frame having a pair of inclined upright struts 564 connected by cross member 565 at their upper ends and a cross bar 566 at location between their upper and lower ends. Floor-engaging cross bar 562 has feet 568 at its opposite ends. A pair of parallel, rearwardly inclined struts 570 extend from base plate 572 located on base strut 560 behind the user support to the upper cross member 565. Weight plate storage pegs 574 are provided on the upright struts 564.

User support frame 556 is generally L-shaped with a base portion 575, an upright portion 576, and a back rest support post 584 adjustably mounted on upright portion 576. A seat pad 578 is mounted on base portion 575. Base portion 575 is pivotally connected to the base section 560 of the main frame by a link 579 pivoted to the base section of the main frame for rotation about first pivot axis 583 and to the user support base portion 575 for rotation about second, floating pivot axis 581, respectively. Upright portion 576 is secured to an upper tube 580 which extends generally transversely across the upper end of upright portion 576. An adjustment post 582 secured to back rest support post 584 is telescopically engaged in the forward end of upper tube 580. The rear end of upper tube 580 is pivoted to the upper end of lifting arm 552, as described in more detail below. A back pad 585 and head engaging pad 586 are secured to the front side of support post 584. Adjustment post 582 extends rearwardly from support post 584 at a location behind back pad 585. A pull pin 588 actuated by handle 590 on one side of the user support (see FIGS. 58 to 60B) extends through aligned openings in upper tube 580 and adjustment post 582 to secure the back support in a selected position. The handle 590 is linked to the pull pin so that pulling the handle in one direction releases the pin, allowing the user to adjust the back rest to the desired position, and releasing the handle allows the pull pin to spring back through the newly aligned opening in post 582. A pair of handles 592 on opposite sides of the seat can be gripped by the user for added stability when performing an exercise.

Figure 56:
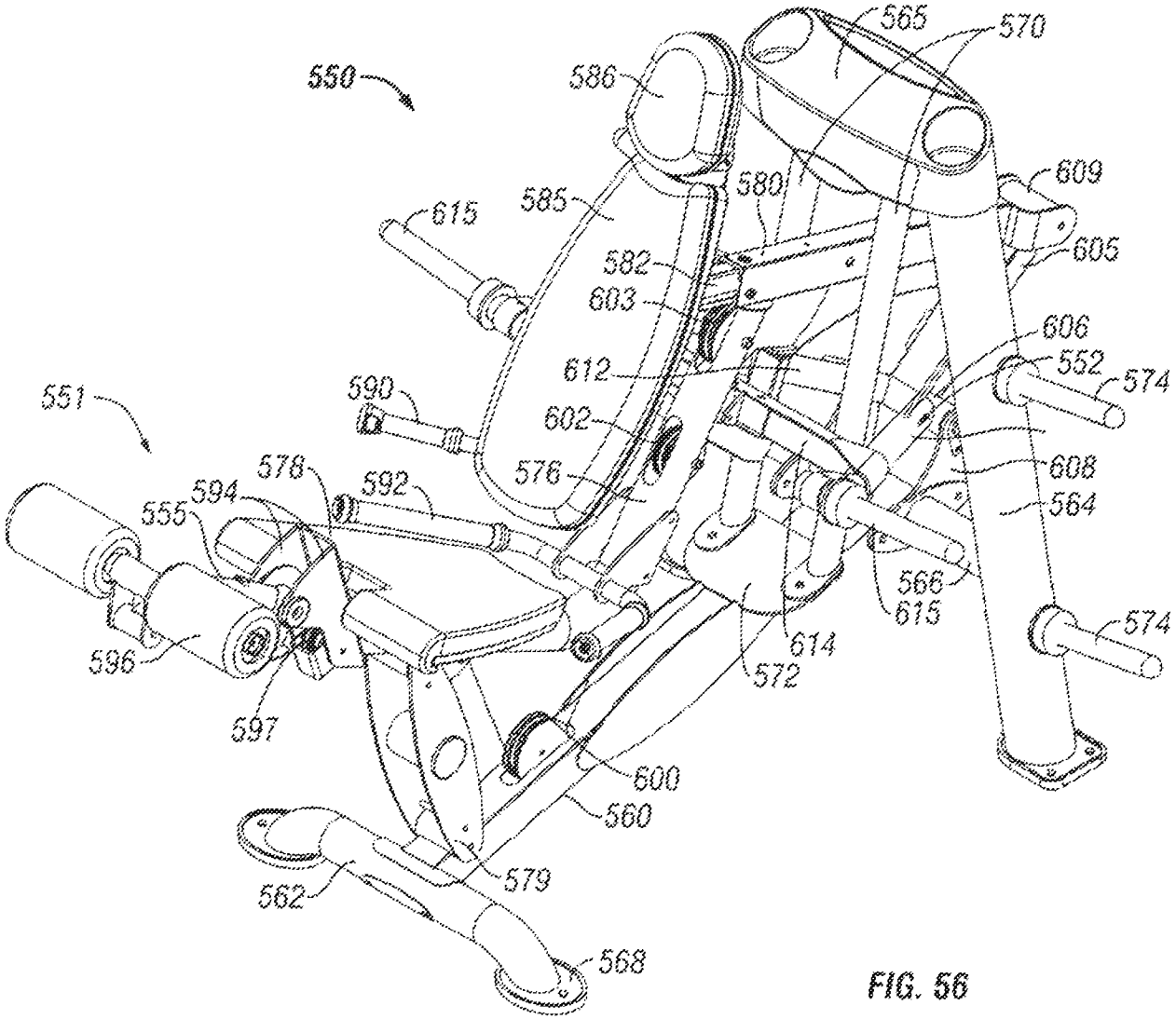
FIG. 56 is a front perspective view similar to FIG. 55 but illustrating an end position for a leg extension exercise.
Figure 57:
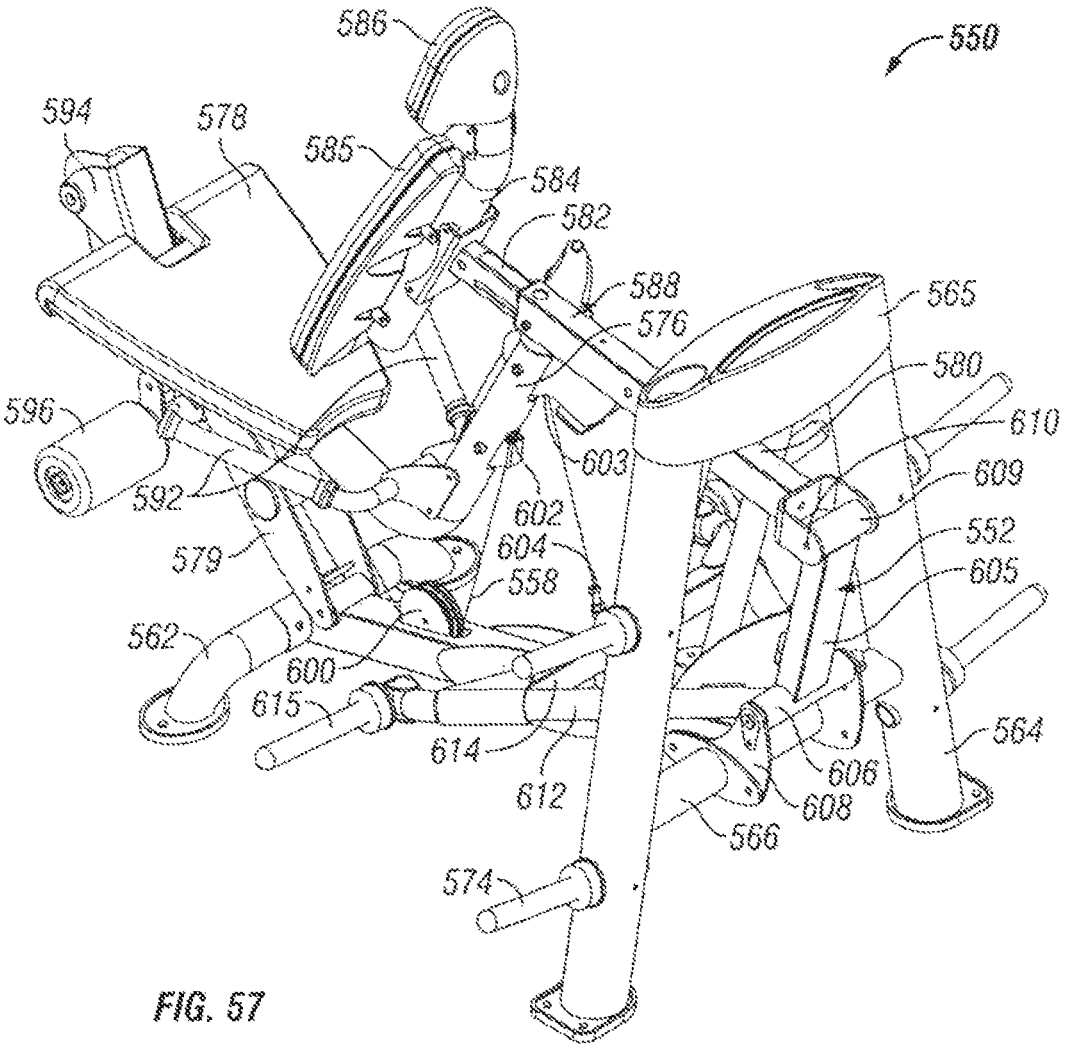
FIG. 57 is a rear perspective view of the machine in the position of FIG. 55.
Figure 58:
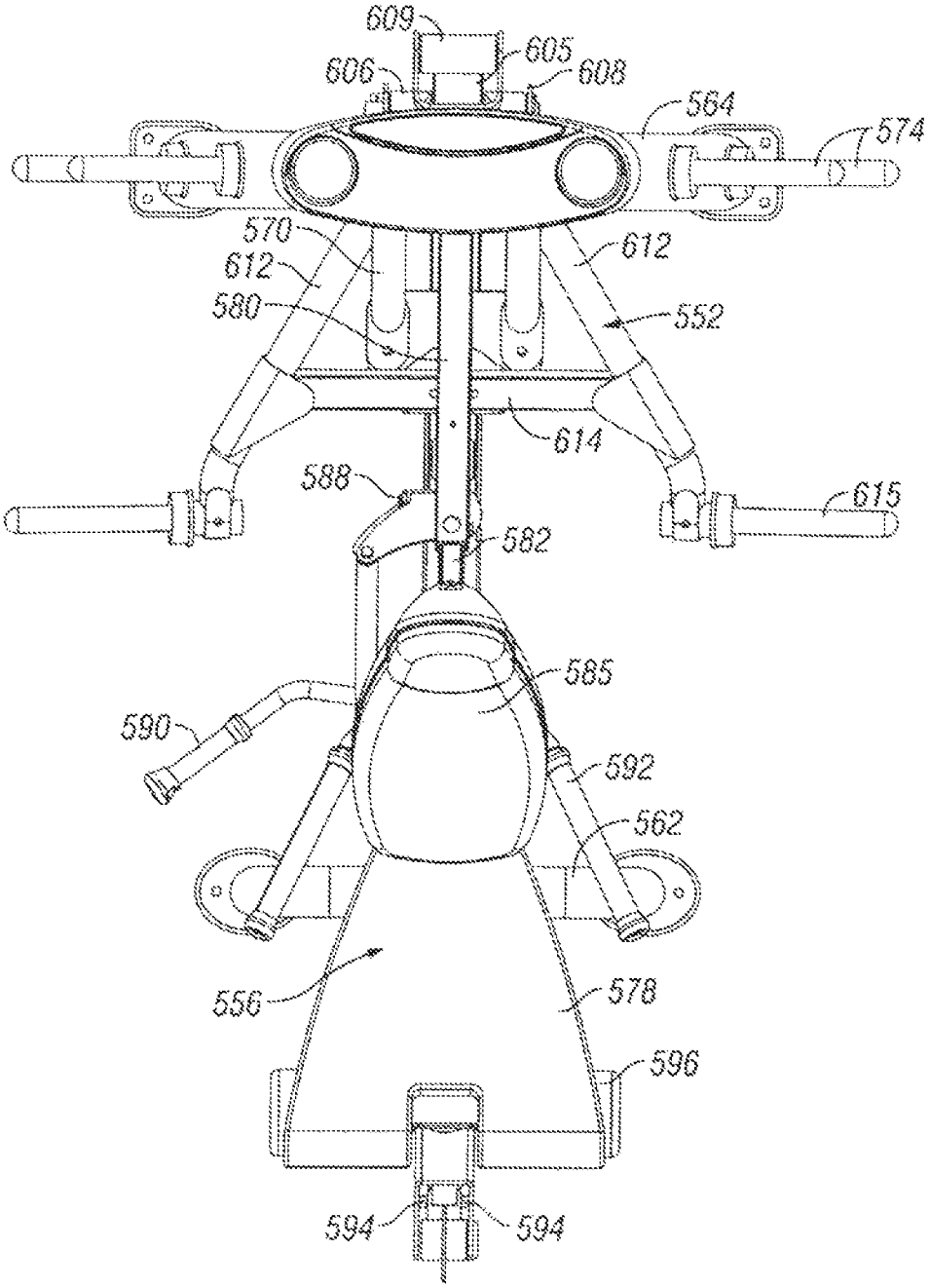
FIG. 58 is a top plan view of the machine of FIGS. 55 to 57 in the exercise start position.

The user engagement device or exercise assembly 551 comprises a leg exercise arm 555 which has a first end pivoted between support brackets 594 at the forward end of the base 575 of the user support for rotation about pivot axis 595, and leg engaging roller pads 596 are pivotally mounted on the arm 555 at a location spaced below pivot axis 595. The roller pads 596 are pivoted at a lower end of arm 555 in the illustrated embodiment, but may be located elsewhere on arm 555 in alternative embodiments. The pivotal attachment allows the user to locate the rollers at the desired position for a leg extension exercise, as illustrated in FIGS. 60A and 60B. Flexible connecting link 558, which may be a cable, flexible line, belt, or other flexible elongate member, is secured to the rear side of exercise arm 555 and extends around cam 599, and is then guided around pulley 597 between the lower ends of plates 594 (see FIG. 56), around a pulley 598 on the base portion 575, and then around a pulley 600 on the base section 560 of the main frame. From pulley 600, cable or flexible link 558 extends around pulleys 602, 603 on the rear upright 576 of the user support, before connecting to anchor 604 on the lifting arm 552, as best illustrated in FIGS. 56, 57, and 59A.

Figure 55:
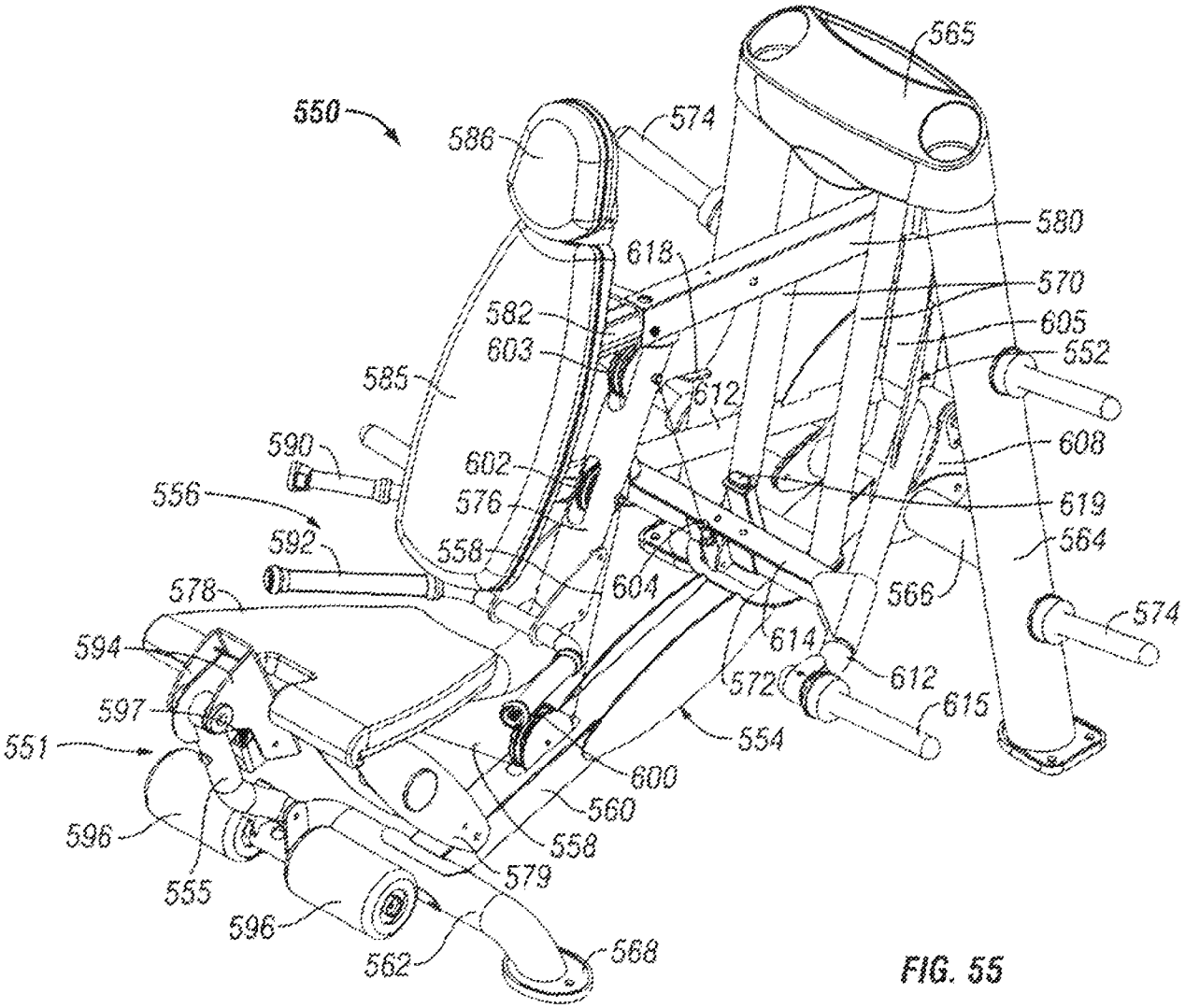
FIG. 55 is a front perspective view of a leg extension exercise machine according to another embodiment, with the moving parts of the machine in a start position for a leg extension exercise.

Lifting arm 552 is generally L-shaped and has a generally upwardly extending rear portion 605 secured to a pivot sleeve 606 at its lower end (FIG. 57) which is rotatably engaged on a pivot pin extending between pivot brackets 608 on the main frame cross bar 566 for rotation about pivot axis 607. The upper end of rear portion 605 is secured to pivot sleeve 609 which is pivotally linked to upper tube or link 580 for rotation about pivot axis 610. With this arrangement, forward floating pivot link 579 and the rear portion 605 of the lifting arm effectively form a four bar pivot linkage between the user support and main frame which defines the pivotal movement of the user support. A pair of outwardly diverging rods or bars 612 extends forward from pivot sleeve 606, as best illustrated in FIGS. 55 to 58. Rods 612 are secured together by a cross bar 614 at a location close to their forward ends, and an outwardly projecting weight plate support peg 615 extends from the forward end of each rod 612. Weight plates 18 may be mounted on pegs 615 as indicated in FIGS. 60A and 60B in order to provide exercise resistance. Cable anchor 604 is pivotally mounted on the forward face of lifting arm cross bar 614, as illustrated in FIG. 55. This multiple connecting linkage arrangement translates movement of the leg exercise arm 555 into movement of the user support, as described in more detail below. At the same time, the lifting arm 552 of the connecting linkage is loaded by weight plates 18 on pins 615 at the ends of the rods 612 of the lifting arm to provide a selected amount of exercise resistance.

Figure 59A:
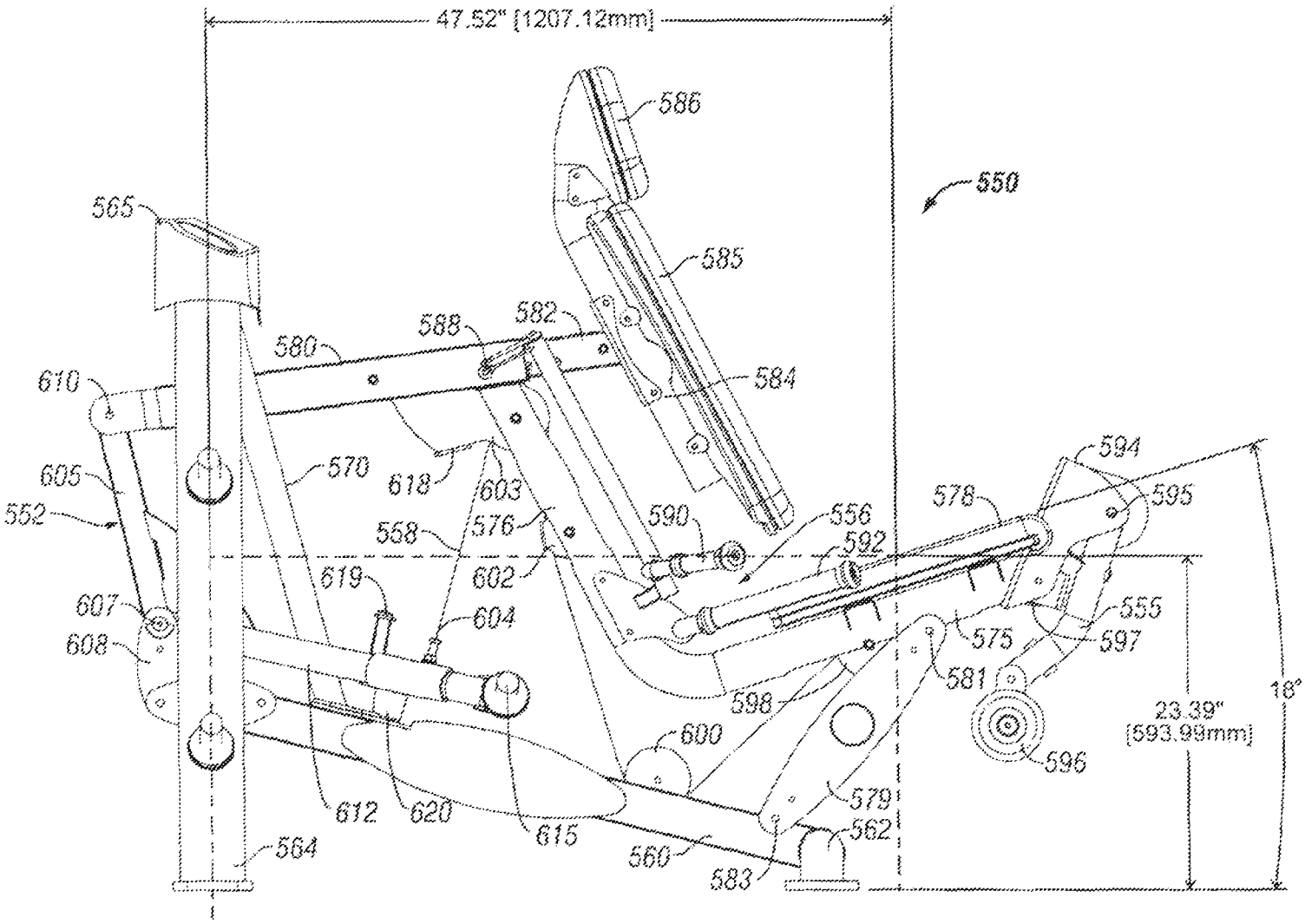
FIG. 59A is a side elevation view of the machine of FIGS. 55 to 58 in the start position for a leg extension exercise.
Figure 59B:
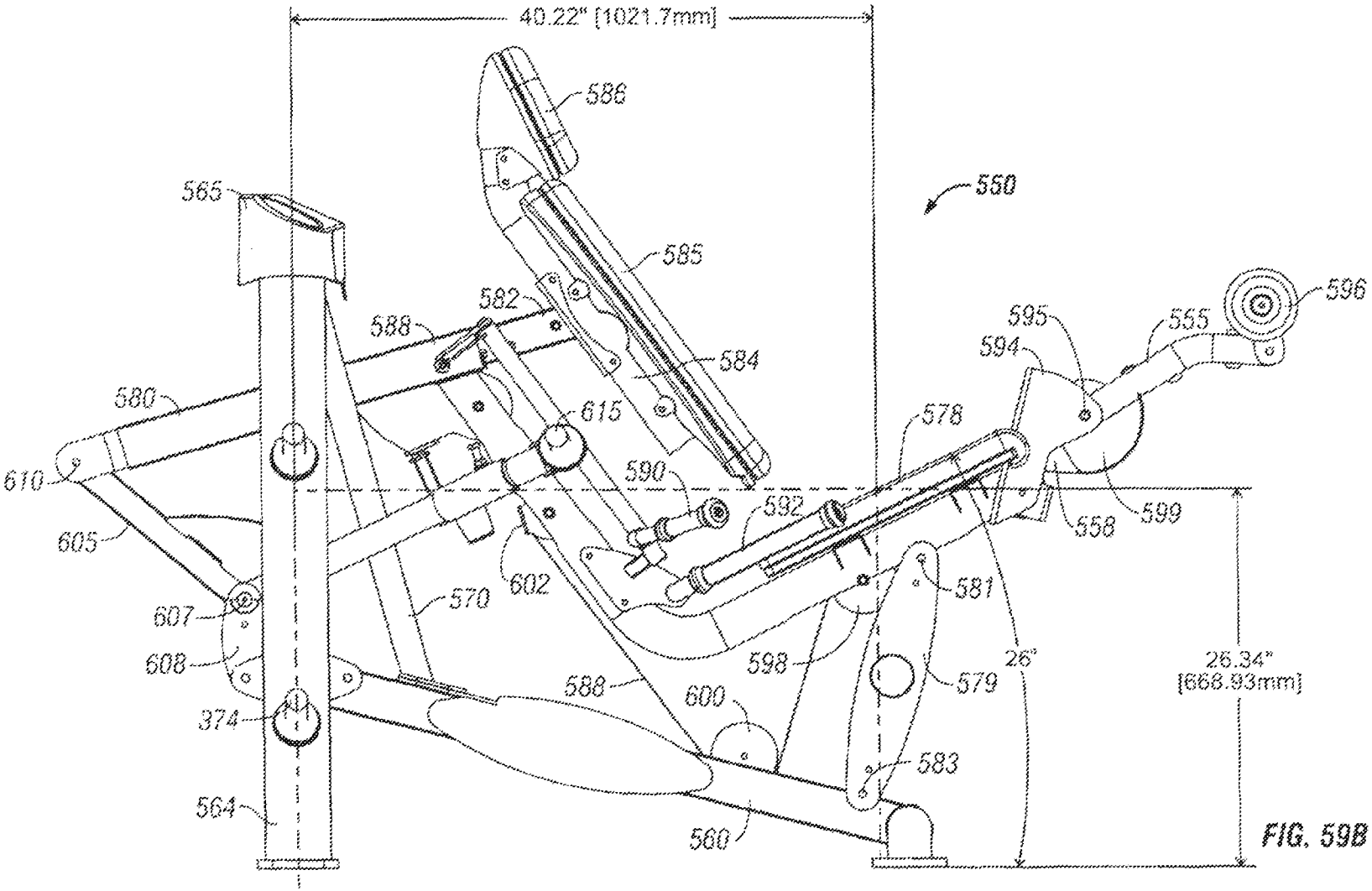
FIG. 59B is a side elevation view similar to FIG. 59A but illustrating the end position of a leg extension exercise.
Figure 60A:
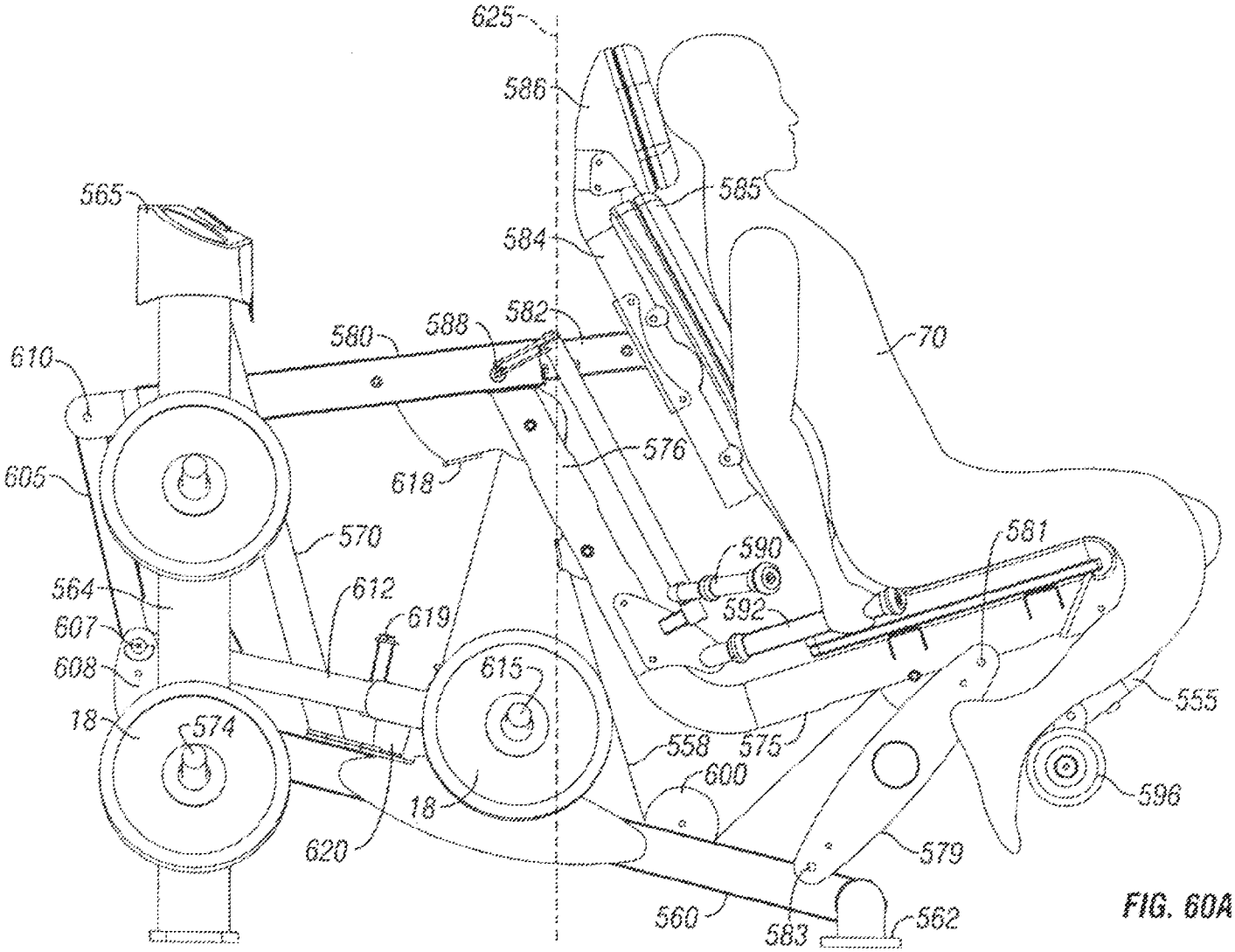
FIG. 60A is a side elevation view similar to FIG. 59A but illustrating a user seated on the machine with their legs engaging the leg extension arm at the start of a leg extension exercise.
Figure 60B:
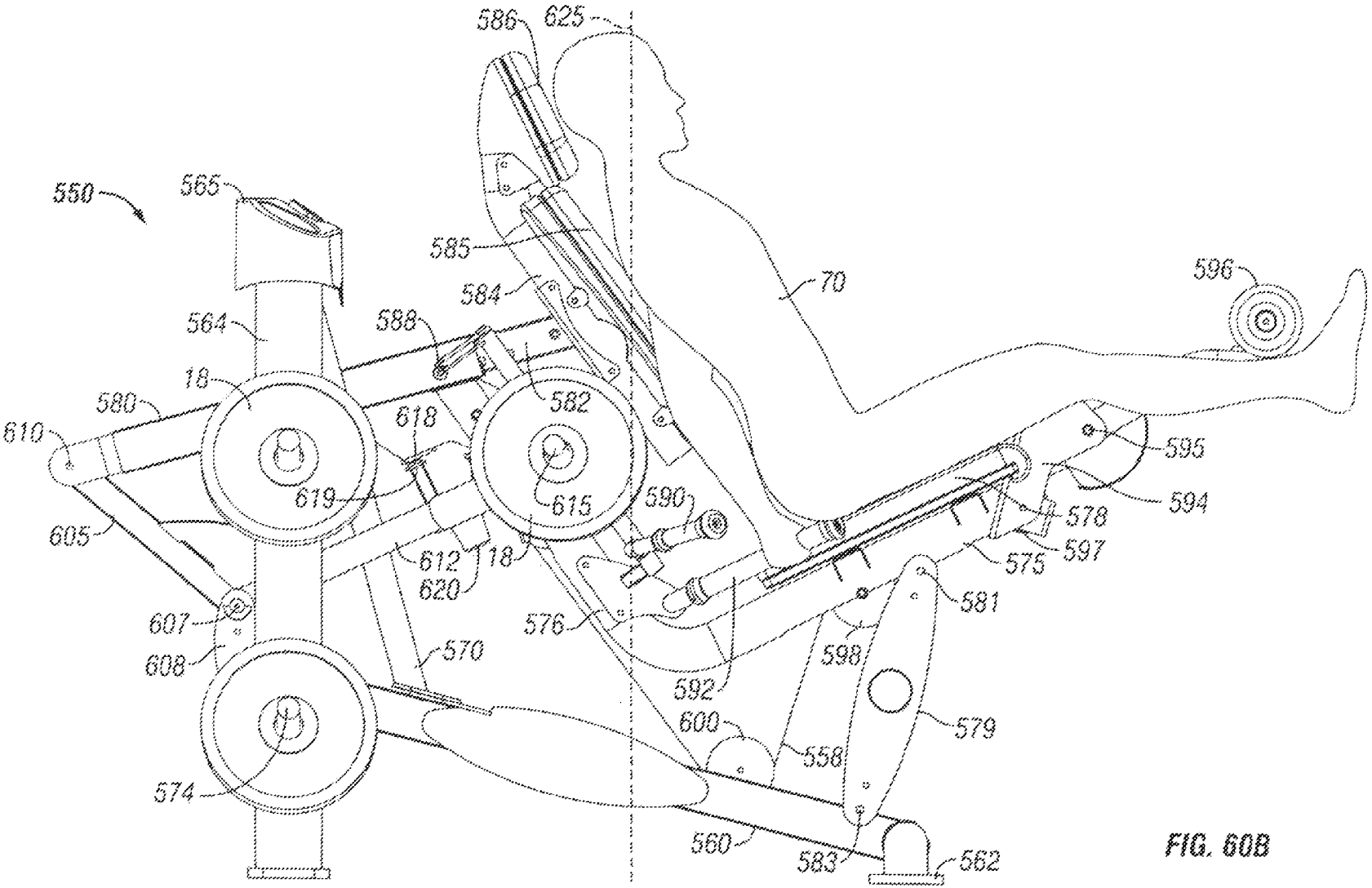
FIG. 60B is a side elevation view of the machine and user similar to FIG. 60A but illustrating the end position of the exercise.

The exercise arm 555 may be used to perform a leg extension exercise with the user support and exercise arm starting in the exercise start position of FIGS. 55, 57, 58, 59A and 60A. In this position, the user support is in a slightly reclined orientation, as best illustrated in FIG. 59A and FIG. 60A. FIG. 60A illustrates a user 70 seated on the user support in the start position for a leg extension exercise, with their hands gripping handles 592 on opposite sides of the seat. The user engages their feet under the rollers 596, then urges arm 555 forward about pivot axis 595 from the start position of FIGS. 59A and 60A into the end position of FIGS. 59B and 60B. As the user pushes arm 555 forward and upward, this simultaneously pulls cable 558, pulling up the forward end of the lifting arm 552 and rotating the rear upright portion rearward and downward about pivot axis 607, pulling the upper post 580 rearward and downward and causing the user support to rotate rearward about its pivotal mounting to the main frame, ending in a more rearwardly reclined position, as illustrated in FIGS. 59B and 60B. A stop plate 618 beneath upper tube 580 engages a stop pin or stand-off 619 at the center of lifting arm cross bar 614 at the end of the exercise. An oppositely directed stop or stand-off 620 at the center of cross bar 614 rests on the plate 572 on the base section 560 of the main frame in the rest or exercise start position, as seen in FIGS. 59A and 60A.

As illustrated in FIGS. 59A and 59B, the user support 556, and thus a user seated on the user support, move both upward and rearward between the start and end positions of the exercise. The upward motion is around three inches, while the rearward motion is around seven to eight inches, as can be seen by comparing the start and end dimensions shown on these drawings. At the same time, seat pad 578 tilts rearward through an angle of around seven degrees, starting at a rearward inclination of 18 degrees to the horizontal and ending at a greater rearward inclination of around 26 degrees.

Figure 61:
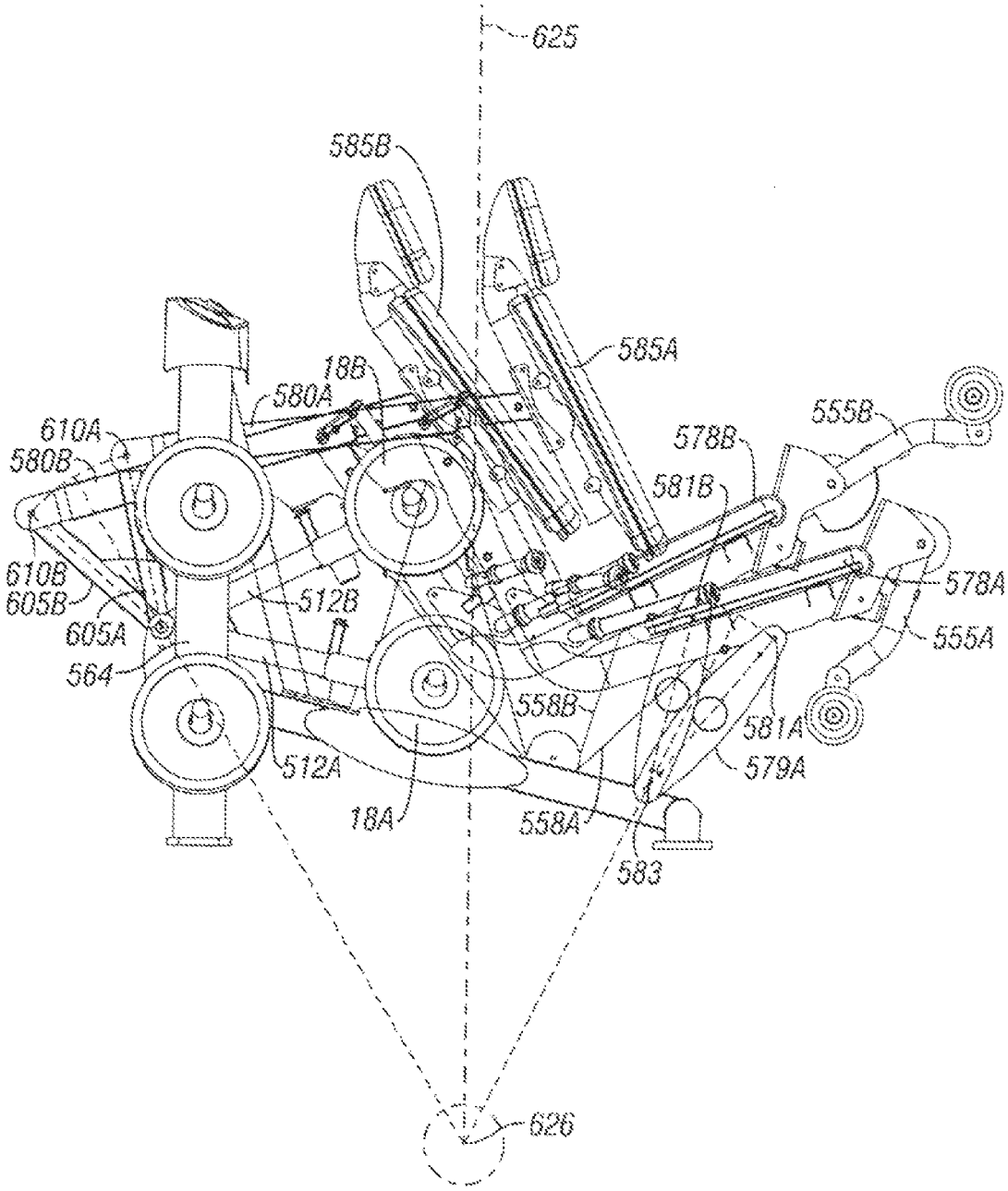
FIG. 61 is a side elevation view of the leg extension machine of FIGS. 55 to 60 with the start and end positions of FIGS. 59A and 59B superimposed to illustrate movement of the moving parts of the machine and also illustrating the theoretical pivot point of the user support movement.

In this embodiment, the user support is pivotally mounted on the main frame via a multiple pivot linkage comprising the lifting arm pivoted to the rear end of the upper tube 580 and the pivoted link 579 between the base section of the main frame and the base portion of the user support. FIG. 61 superimposes the start and finish positions of the machine, with start positions of the various moving components indicated by the letter A following the reference number, and end positions indicated by the letter B following the reference number. FIG. 61 also illustrates the vertical gravitational centerline 625 which extends through the theoretical pivot axis 626 of the user support's pivotal motion, calculated using the start and end positions of each of the pivot links 579 and 605. As in the previous embodiments, the gravitational center line extends through the user support and part of the user positioned on the user support in both the start and end positions of the exercise, with the advantages explained above in connection with the previous embodiments.

Figure 62:
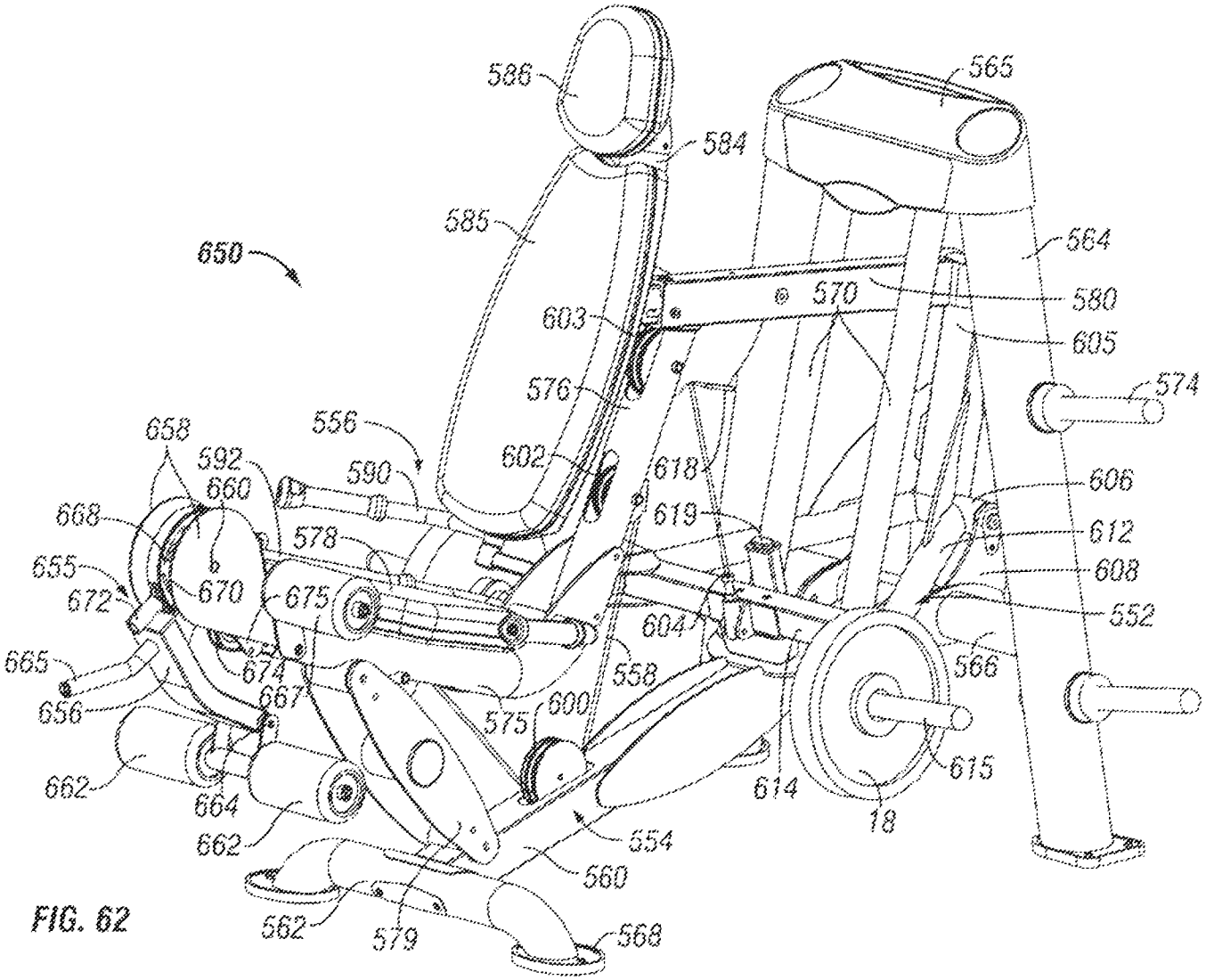
FIG. 62 is a front perspective view of a leg exercise machine according to another embodiment for performing leg extension and leg curl exercises, shown in the start position for a leg extension exercise.
Figure 65A:
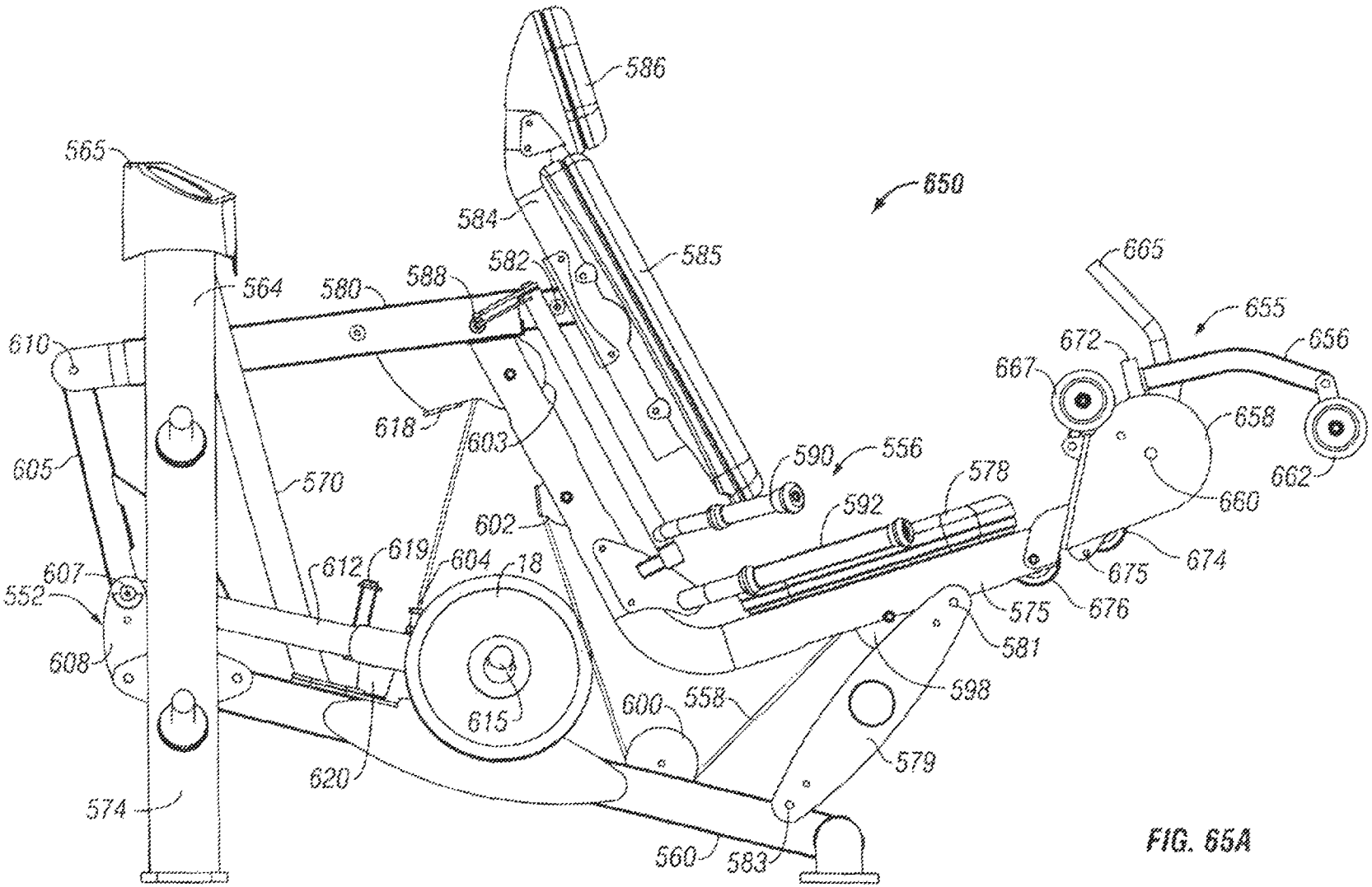
FIG. 65A is a side elevation view of the machine of FIGS. 62 and 63 in the start position for a leg curl exercise.
Figure 65B:
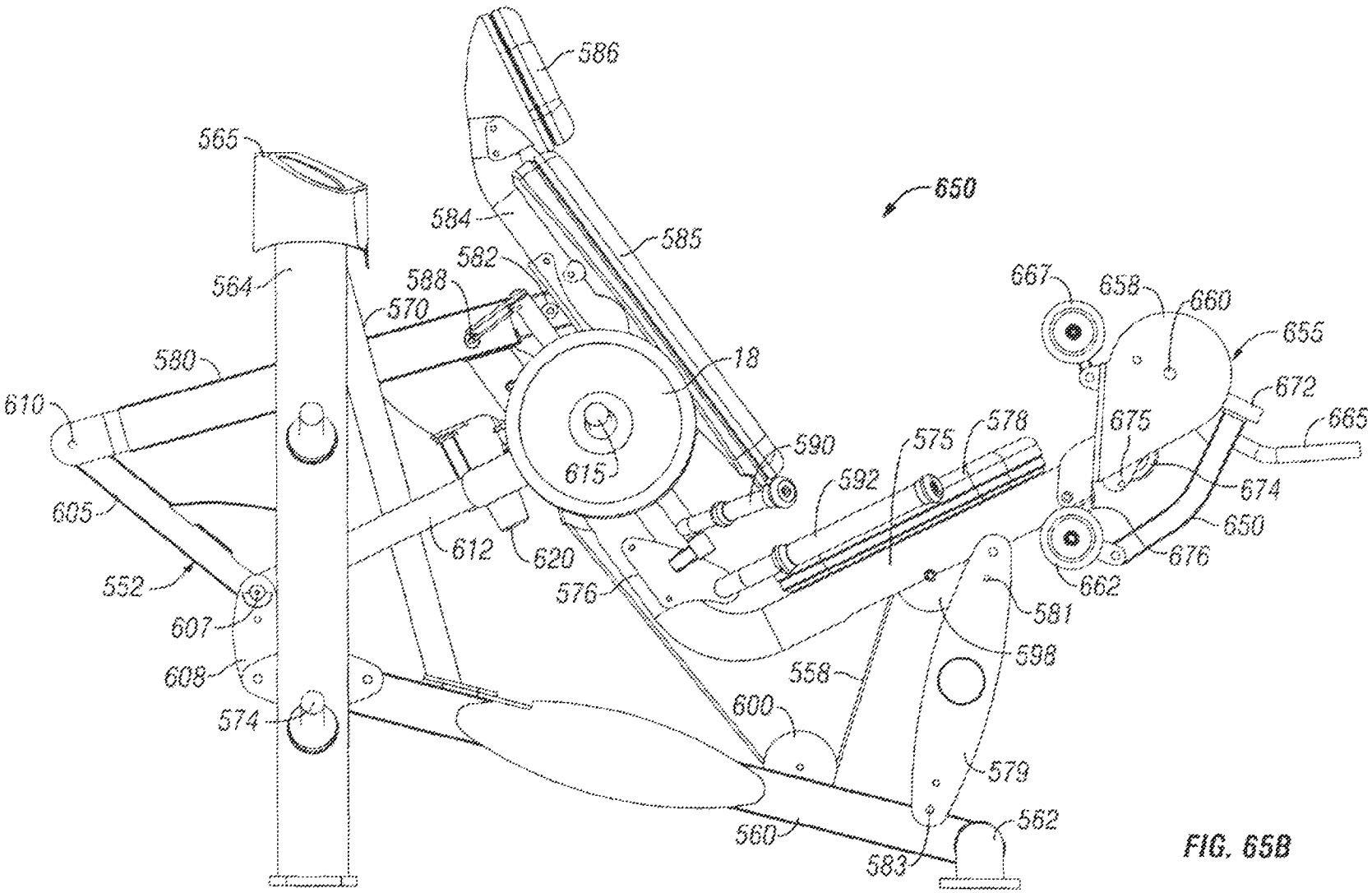
FIG. 65B is a side elevation view of the machine similar to FIG. 65A but illustrating the end position of a leg curl exercise.
Figure 66:
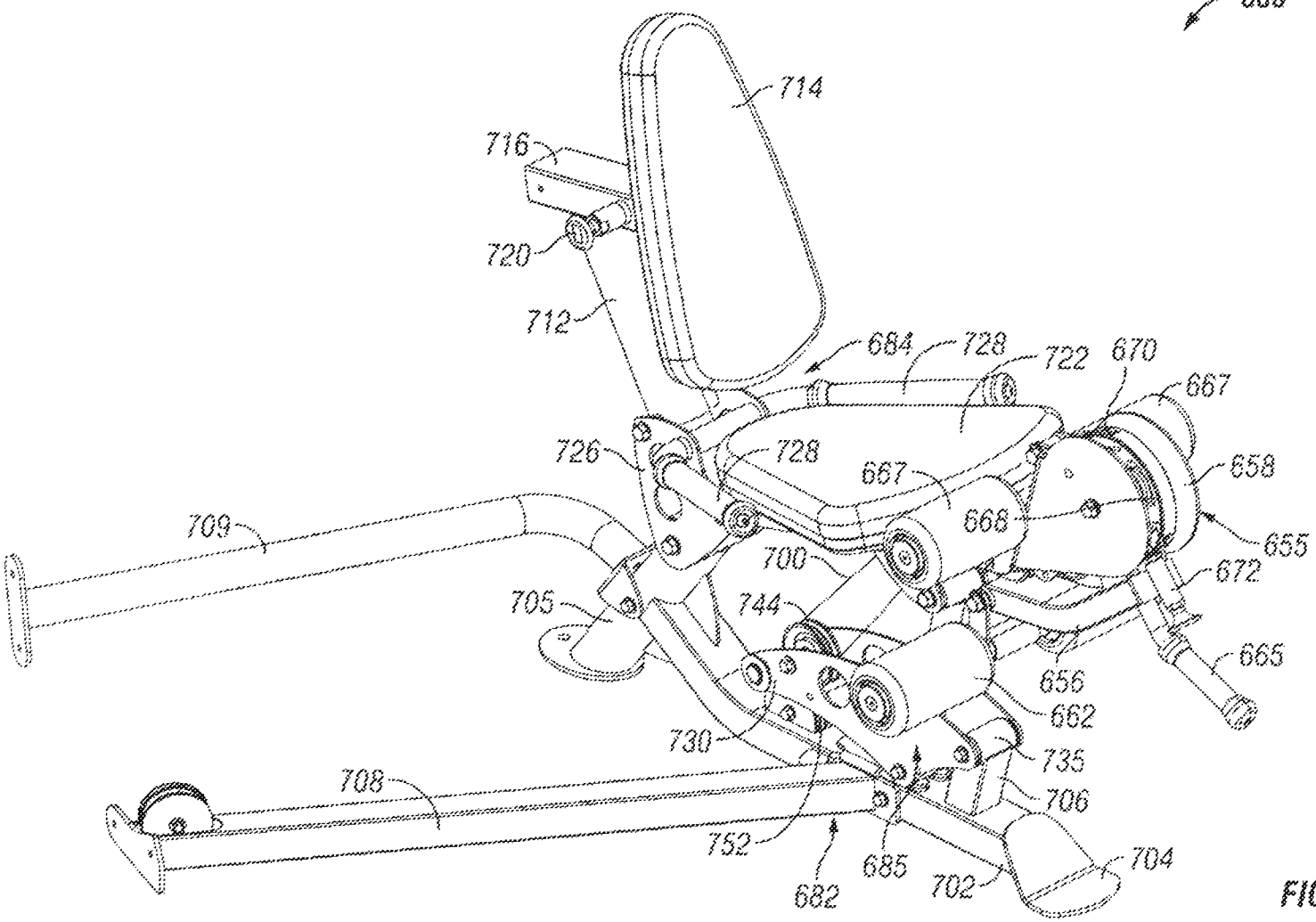
FIG. 66 is a front perspective view of a leg exercise machine according to another embodiment for performing leg extension and leg curl exercises, shown in the start position for a leg extension exercise.

FIGS. 62 and 65B illustrate a second embodiment of a leg exercise machine 650 which is identical to the leg exercise machine of the previous embodiment except for the replacement of the leg extension exercise arm 555 of the previous embodiment with a bi-directional exercise arm assembly 655 to allow performance of both leg extension and leg curl exercises. The bidirectional exercise arm assembly 655 is similar to the bi-directional exercise arm assembly described in co-pending application Ser. No. 11/846,472 of Webber et al. filed on Aug. 28, 2007, the contents of which are incorporated herein by reference. The machine of this embodiment is otherwise the same as the previous embodiment, and like reference numbers are used for like parts. Reference is made to the foregoing description of FIGS. 55 to 61 for a description of these parts.

As in the previous embodiment, the lifting arm 552 in this embodiment is generally L-shaped and of similar design to the lifting arms of FIGS. 1 to 6 and 11 to 20. Leg exercise machine has a stationary main frame 554 on which a user support 556 is pivotally mounted, and the bi-directional exercise arm assembly 655 is pivotally mounted at the forward end of the user support. A connecting linkage including a flexible connecting link 558 and the pivotally mounted lifting arm 552 is provided between the exercise arm assembly and the user support 556 so that movement of the exercise arm assembly in either a leg extension or a leg curl exercise is translated into movement of the user support, as described in more detail below. The flexible connecting link 558 also connects the exercise arm assembly with the main frame. In this embodiment, as in the previous embodiment, the exercise resistance comprises weight plates mounted on the lifting arm 552, although the exercise resistance may alternatively comprise a bidirectional ram or gas shock assembly similar to that of FIGS. 7 to 10, or the lifting arm may be linked to a weight stack as in the embodiment of FIGS. 21 to 25.

The exercise arm assembly 655 comprises a main tube or arm 656 which is pivotally mounted at one end between pivot brackets 658 at the end of the user support base for rotation about pivot axis 660, and user engaging rollers or pads 662 pivotally mounted approximate the other end of tube or arm 656 for rotation about pivot axis 664. The pivotal connection between the user engaging rollers and the main tube or arm 656 enables the user engaging device to self-align to the user during the exercise and automatically adjust to the user's leg length. A handle 665 projects outward from an upper portion of arm 656 for gripping by a user when adjusting the exercise arm between a start position for a leg extension exercise (illustrated in FIGS. 62 and 64A) and a start position for a leg curl exercise (illustrated in FIG. 65A). A pair of thigh brace pads 667 is pivotally secured to a rear connecting portion 669 of pivot brackets 658, as best illustrated in FIG. 63.

A range-of-motion adjuster for the exercise arm assembly comprises a round cam 668 pivotally mounted between the user support pivot brackets 658. Cam 668 has spaced adjustment holes 670 around its circumference, for selective engagement with a pull pin or adjuster pin 672 at the end of the main tube or arm 656 of the exercise arm assembly. Multiple holes 670 are provided, so that the arm can be adjusted not only to switch between leg extension and leg curl exercises, but also to adjust the amount of starting pre-stretch for either exercise. The starting orientation of the exercise arm 656 can be adjusted by releasing pull pin 672, rotating it to the desired orientation, and releasing the pin to engage in the newly aligned opening.

Flexible connecting link 558, which may be a cable, flexible line, belt, or other flexible elongate member, is secured to the range-of-motion (ROM) cam, with the linkage being such that link 558 is pulled regardless of the exercise direction, in a similar manner to that described in pending application Ser. No. 11/846,472 referenced above. Cable or link 558 extends around pulley 674 rotatably mounted between brackets 675 adjacent the forward end of base portion 575, around pulleys 676, 598 on the base portion 575, and then around a pulley 600 on the base section 560 of the main frame. From pulley 600, cable or flexible link 558 extends around pulleys 602, 603 on the rear upright 576 of the user support, before connecting to anchor 604 on the lifting arm 552, as in the previous embodiment.

Figure 63:
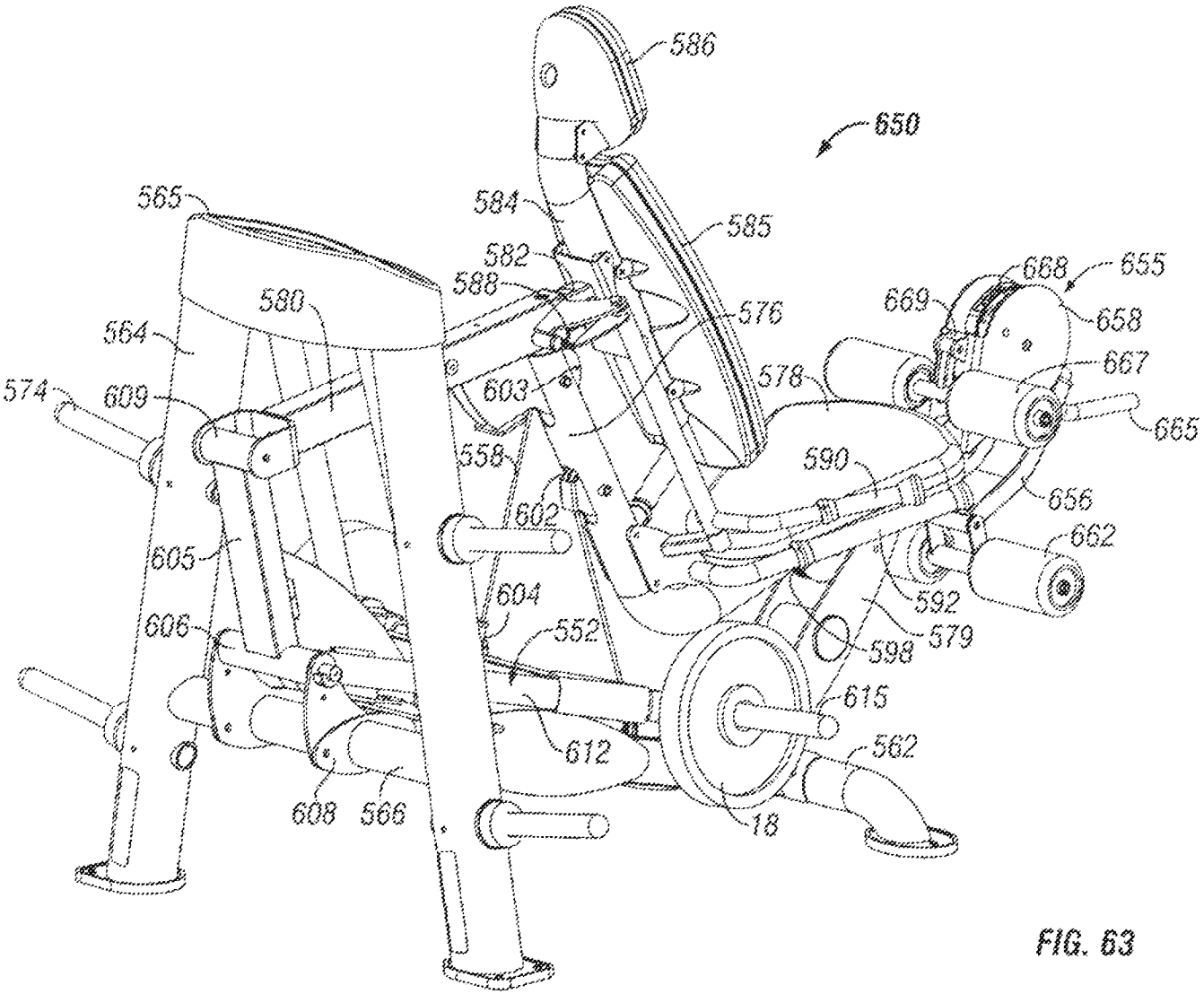
FIG. 63 is a rear perspective view of the machine of FIG. 62.
Figure 64A:
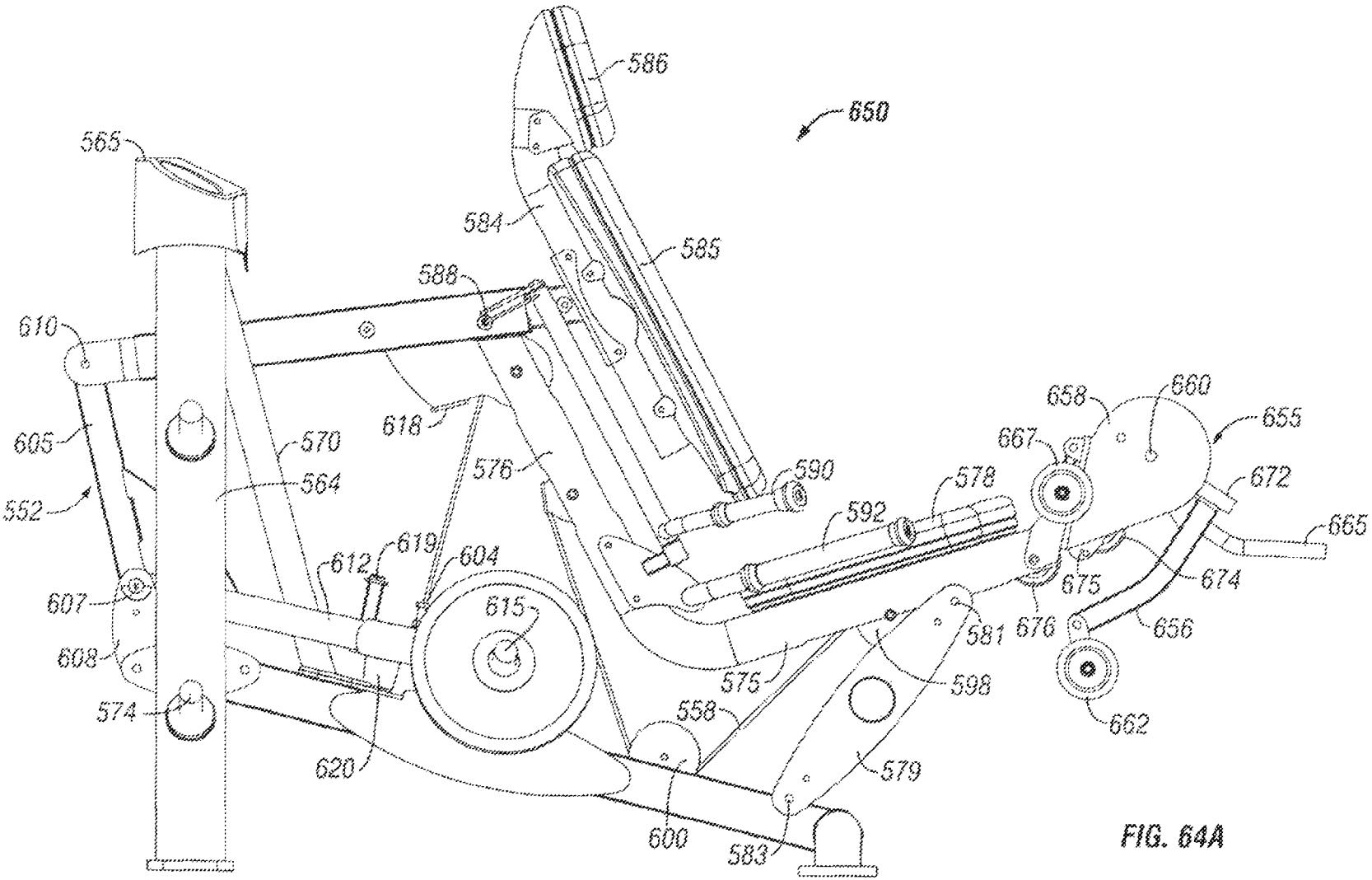
FIG. 64A is a side elevation view of the machine of FIGS. 62 and 63 in the start position for a leg extension exercise.
Figure 64B:
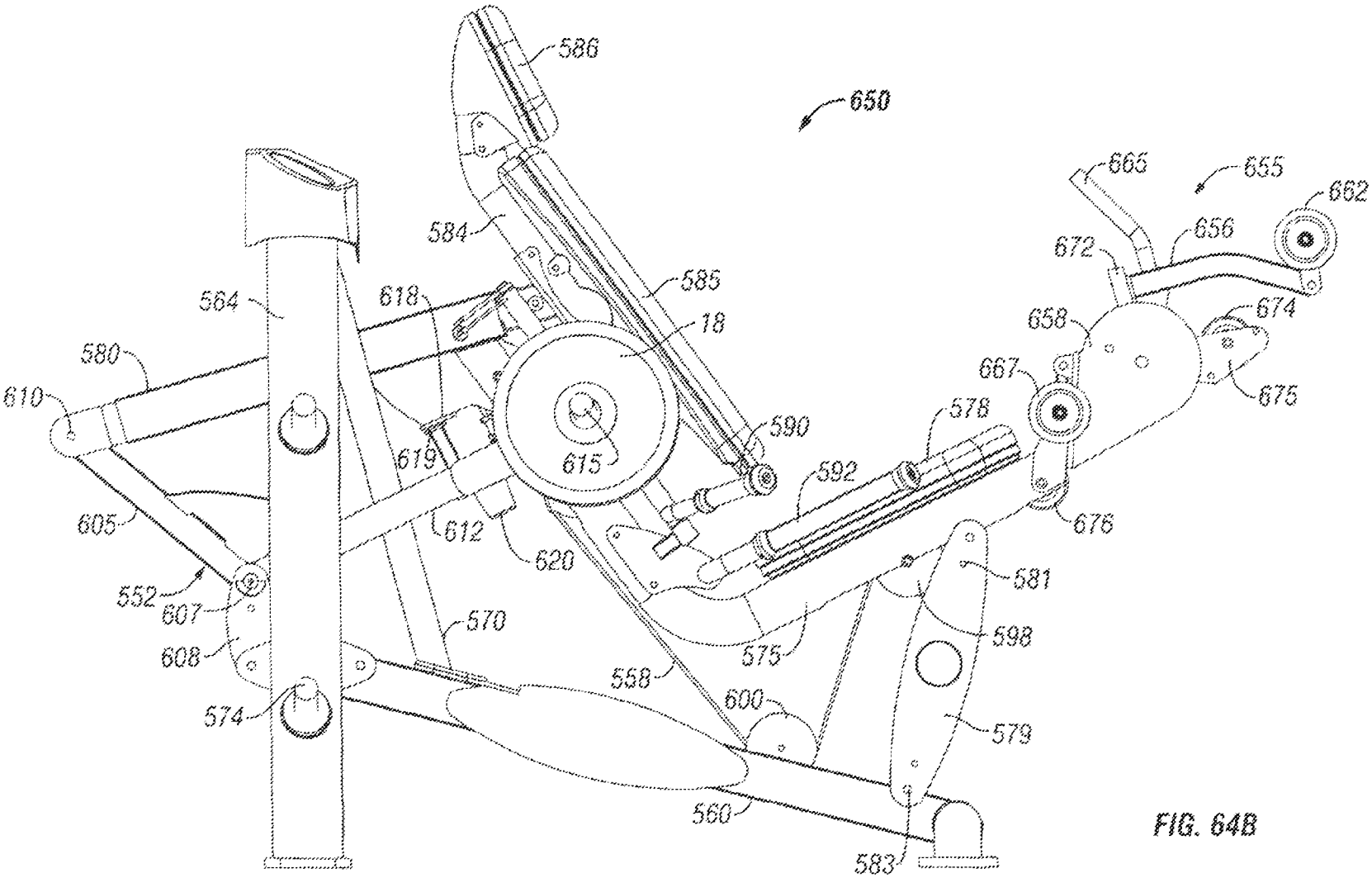
FIG. 64B is a side elevation view of the machine similar to FIG. 64A but illustrating the end position of a leg extension exercise.

The exercise arm assembly 655 may be used to perform a leg extension exercise with the user support and exercise arm 656 starting in the exercise start position of FIGS. 62, 63, and 64A. In this position, the user support is in a slightly reclined orientation, as best illustrated in FIG. 64A. In order to perform the exercise, the user sits on the user support in the start position for a leg extension exercise, with their hands gripping handles 592 on opposite sides of the seat. The user engages their legs over thigh brace pads 667 and hooks their feet under the rollers 662 then urges arm 656 to rotate forward and upward about pivot axis 660 from the start position of FIG. 64A into the end position of FIG. 64B. As the user pushes arm 656 forward and upward into the end position of FIG. 64B, this simultaneously pulls cable 558, pulling up the forward end of the lifting arm 552 and rotating the rear upright portion rearward and downward about pivot axis 607, pulling the upper post 580 rearward and downward and causing the user support to rotate rearward about its pivotal mounting to the main frame, ending in a more rearwardly reclined position, as illustrated in FIG. 64B. Stop plate 618 beneath upper tube 580 engages stop pin or stand-off 619 at the center of lifting arm cross bar 614 at the end of the exercise. An oppositely directed stand-off 620 at the center of cross bar 614 rests on the base section 560 of the main frame in the rest or exercise start position, as seen in FIG. 64A.

If a user wishes to perform a leg curl exercise, they first adjust the start position of exercise arm 656 to the position illustrated in FIG. 65A. The user sits on the user support and engages the thigh brace pads 667 over their thighs, with the back of their legs engaging over pads 662. The user then pushes back against the pads 662 so as to rotate the arm downward and rearward into the end position of FIG. 65B. This also pulls cable 558 so that the user support is moved back into the more reclined end position of FIG. 65B and the lifting arm 552 is raised, simultaneously lifting any weight on weight pegs 615.

In this embodiment, as in the previous embodiment, the user support is pivotally mounted on the main frame via a multiple pivot linkage comprising the lifting arm pivoted to the rear end of the upper tube 580 and the pivoted link 579 between the base section of the main frame and the base portion of the user support.

FIGS. 66 to 70B illustrate a leg exercise machine 680 according to a third embodiment. Machine 680 is also designed for selective performance of either leg extension or leg curl exercises. This machine has the same bi-directional exercise arm assembly 655 with range of motion (ROM) adjustment as in the previous embodiment, and like reference numbers are used for like parts.

Leg exercise machine 680 has a stationary main frame 682 on which a user support 684 is pivotally mounted, and a user engagement device comprising a bi-directional leg extension exercise arm assembly 655 is pivotally mounted at the forward end of the user support. A lifting arm 685 is pivotally mounted under the user support, and a load bearing cable 686 is attached at or adjacent to a rear end of arm 685 (see FIGS. 69C and 70B) and runs from the lift arm around guide pulleys to a weight stack (not illustrated), as described in more detail below. A rigid connecting link or push link 688 pivotally joins lifting arm 685 with the user support, and a flexible link 700 such as a cable or other flexible line or member connects exercise arm assembly 655 with the lifting arm 685. This provides a multiple part connecting linkage between the exercise arm assembly and user support, with the lifting arm forming part of the connecting linkage and being associated with an exercise resistance or load. The weight stack may be replaced with other types of exercise resistance in alternative embodiments.

The main frame 682 has a base strut 702 which is inclined upwardly from its forward end to its rear end and which extends under the user support and exercise arms. Base strut 702 has a floor engaging foot or member 704 at its forward end, an upwardly inclined, floor engaging strut 705 at its rear end, a short pivot support post 706 towards the forward end of strut 702 to which lifting arm 685 is pivotally connected, and first and second connecting struts or bars 708 and 709 which are designed to connect the machine 680 to a weight stack forming part of a multi-function gym having several exercise stations. Alternatively, machine 680 could be a stand-alone unit connected to its own weight stack via connecting struts 708, 709.

Figure 67:
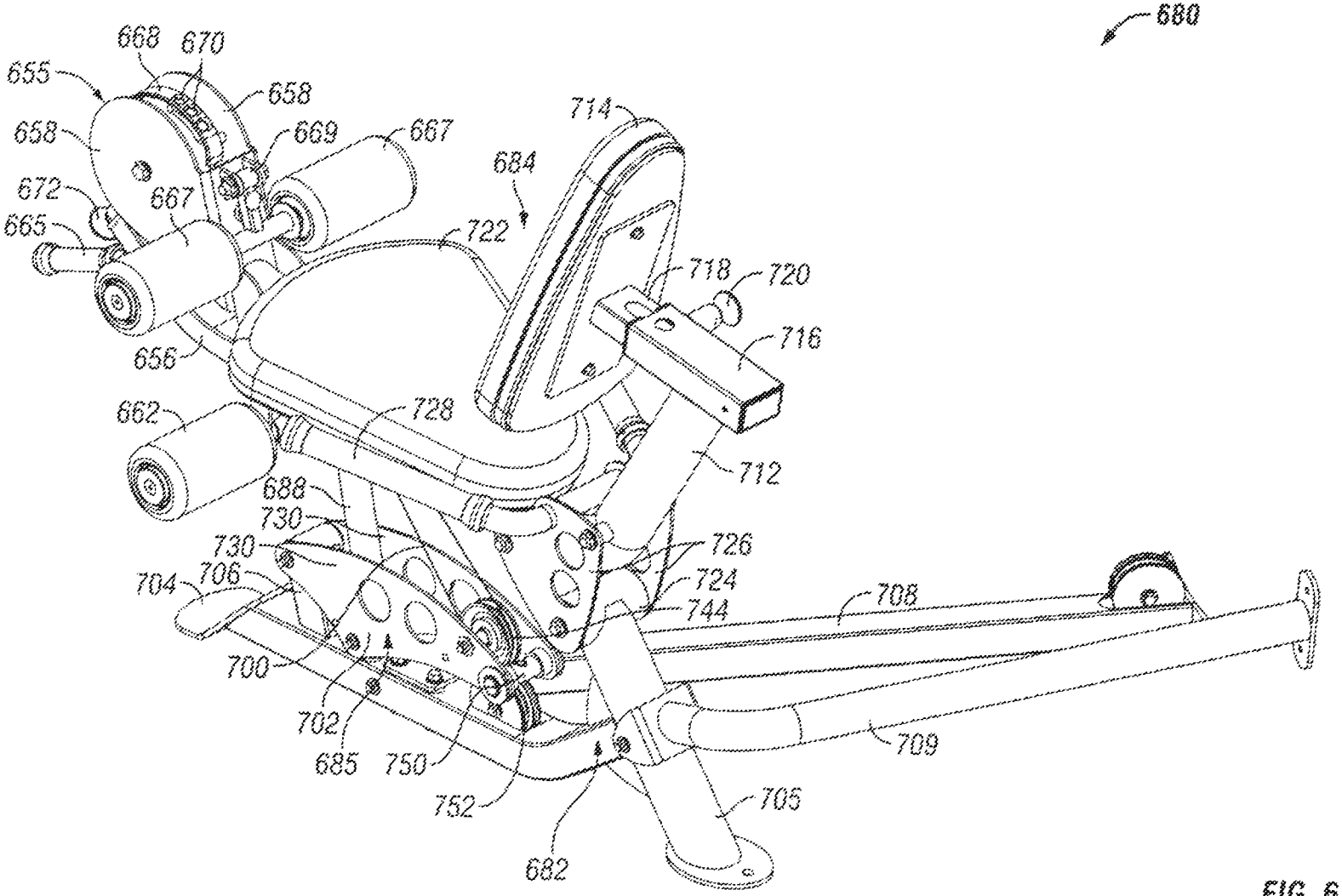
FIG. 67 is a rear perspective view of the machine of FIG. 66, also in the start position for a leg extension exercise.

User support 684 is generally L-shaped with a base 710 on which a seat pad 722 is supported, an upright 712, and a back rest 714 adjustably mounted on upright 712. An adjuster tube 716 extending across the upper end of upright 712 engages telescopically over an adjustment post 718 extending from the rear of back rest 714. A series of openings 719 are provided along post 718 and a spring loaded pull pin 720 engages through an opening in tube 716 and an aligned opening in post 718 in order to secure the back rest at the desired extension from upright 712, as best seen in FIGS. 67 and 69B. Exercise arm assembly 655 is mounted at the forward end of base 710. The user support 684 is pivotally connected to the rear strut 705 of the main frame at the junction between the base 710 and upright 712 via a pivot pin which is rotatably engaged through pivot sleeve 724 at the upper end of strut 705 (see FIG. 67), for rotation about pivot axis 725. The pivot pin is secured between two pivot plates or links 726 which are fastened to the base 710 and upright 712. Handles 728 mounted on plates 726 extend on opposite sides of the seat pad for gripping by the user for added stability when performing an exercise.

As in the embodiment of FIGS. 62 and 65, exercise arm assembly 655 comprises a main tube or arm 656 which is pivotally mounted at one end between pivot brackets 658 at the end of the user support base for rotation about pivot axis 660, and user engaging rollers or pads 662 pivotally mounted approximate the other end of tube or arm 656 for rotation about pivot axis 664. The pivotal connection between the user engaging rollers and the main tube or arm 656 enables the user engaging device to self-align to the user during the exercise and automatically adjust to the user's leg length. A handle 665 projects outward from an upper portion of arm 656 for gripping by a user when adjusting the exercise arm between a start position for a leg extension exercise (illustrated in FIGS. 66, 67, 69A and 69B) and a start position for a leg curl exercise (illustrated in FIG. 70A). A pair of thigh brace pads 667 are pivotally secured to a rear connecting portion 669 of pivot brackets 658, as best illustrated in FIG. 67, for rotation between a lower position for engagement under a user's thighs when performing a leg extension (FIGS. 69A to 69C), and an upper position engaging above the user's thighs when performing a leg curl exercise (FIGS. 70A and 70B).

A range-of-motion adjuster for the exercise arm assembly comprises a round cam 668 pivotally mounted between the user support pivot brackets 658 for rotation about pivot axis 660. The exercise arm 656 is adjustably secured to cam 668 via pull pin 672 for movement between the leg extension and leg curl start positions. Cam 668 has spaced adjustment holes 670 around its circumference, for selective engagement with a pull pin or adjuster pin 672 at the end of the main tube or arm 656 of the exercise arm assembly. Multiple holes 670 are provided for both a leg extension and a leg curl exercise, so that the arm can be adjusted not only to switch between leg extension and leg curl exercises, but also to adjust the amount of starting pre-stretch for either exercise. The starting orientation of the exercise arm 656 can be adjusted by releasing pull pin 672, rotating it to the desired orientation, and releasing the pin to engage in the newly aligned opening.

Lifting arm 685 comprises a pair of generally triangular plates 730 with arcuate edges, which are pivotally connected to the upper end of post 706 at their forward ends for rotation about pivot axis 732 via a pivot pin extending between the plates and rotatably engaged in a pivot sleeve 735 (FIG. 66) at the upper end of post 706. Connecting link or push rod 688 is pivotally connected at or adjacent its upper end between pivot brackets 736 secured to user support base 710, for rotation about first pivot axis 738. The opposite end of connecting link 688 is pivotally connected between lifting arm plates 730 for rotation about second pivot axis 740, as best seen in FIGS. 69A to 69C, 70A, and 70B. Flexible connecting link or cable 700 extends from an anchor 742 between pivot brackets 736, around a pulley 744 connected between the lifting arm plates 730, and then travels around first and second pulleys 745, 746 secured to user support base 710, and a pulley 748 mounted between brackets 658 of the bi-directional exercise arm assembly 655, before anchoring to the ROM mechanism or cam 668. With this arrangement, actuation of the exercise arm to perform a leg exercise pulls the flexible link 700, which in turn pulls the lifting arm 685, forcing the connecting link or push rod 688 upward. This pushes the forward end of the user support upwards, pivoting user support 684 rearward about pivot axis 725, as described in more detail below.

The load bearing cable 686 is attached to the rear end of lifting arm 685, to an anchor 750 (FIG. 67) secured between the ends of plates 730. Cable 686 extends from the lift arm around pulley 752 in the main frame base strut 702, as illustrated in FIGS. 67, 69C and 70B, then to one or more pulleys in cross strut 708 which connects the main frame to a multi-function gym frame or to a free standing weight stack housing.

Figure 69A:
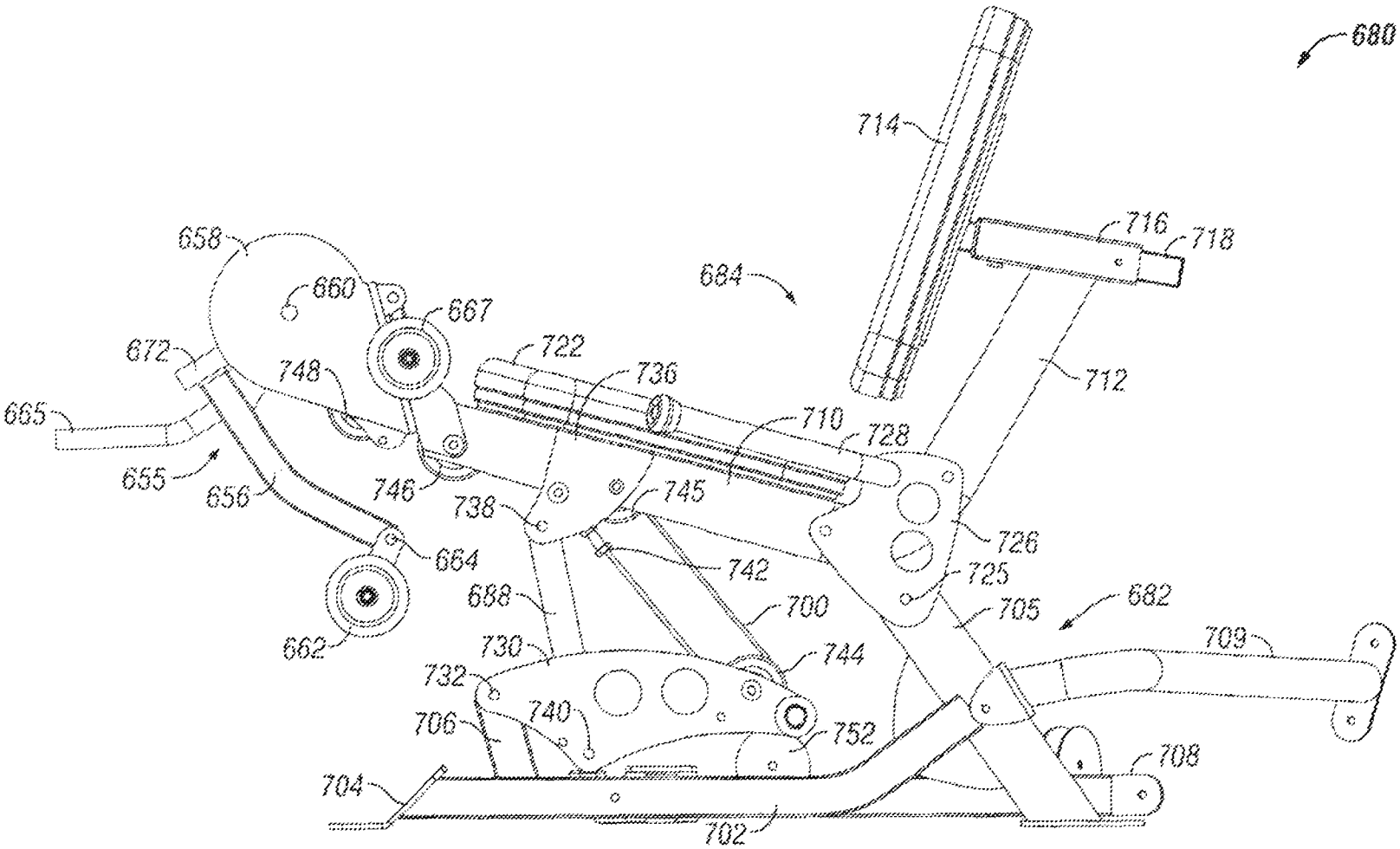
FIG. 69A is a side elevation view of the machine of FIGS. 66 to 68 in the start position for a leg extension exercise.
Figure 69B:
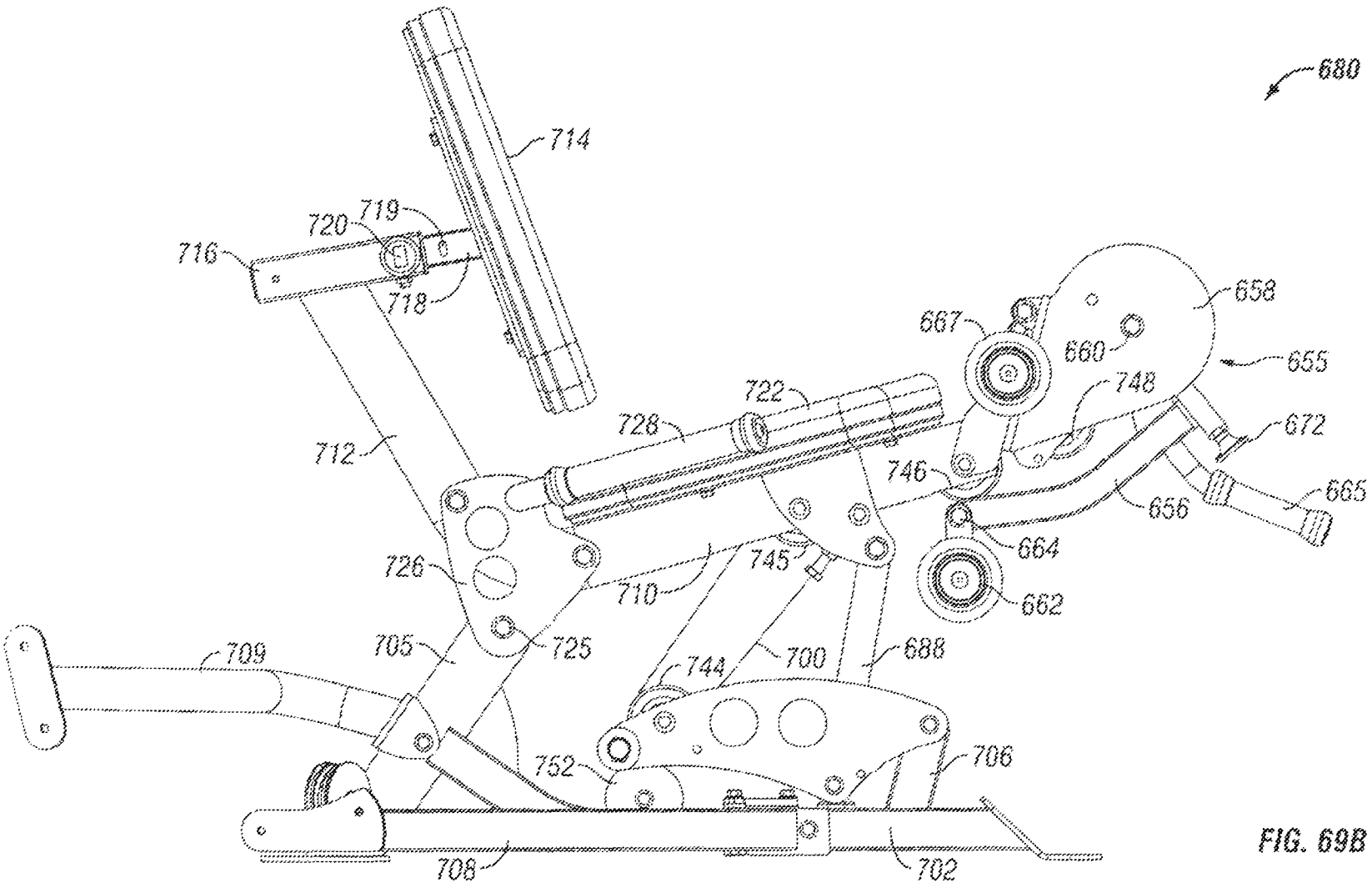
FIG. 69B is a side elevation view of the machine in the position of FIG. 69A but taken from the opposite side.

The exercise arm assembly 655 may be used to perform a leg extension exercise with the user support and exercise arm 656 starting in the exercise start position of FIGS. 67, 68, 69A and 69B. In this position, the user support is in a slightly reclined orientation, as best illustrated in FIG. 69A. In order to perform the exercise, the user sits on the user support in the start position for a leg extension exercise, with their hands gripping handles 728 on opposite sides of the seat. The user engages their legs over thigh brace pads 667 and hooks their feet under the rollers 662, then urges arm 656 forward about pivot axis 660 from the start position of FIG. 69A into the end position of FIG. 69C. As the user pushes arm 656 forward and upward into the end position of FIG. 69C, this simultaneously pulls cable 700, pulling up the rear end of the lifting arm 685 so that the lifting arm rotates upward and rearward about pivot axis 732. This simultaneously pushes the connecting link 688 upward, pushing up the user support base 710 in the vicinity of its forward end and causing the user support to rotate rearward about its pivotal mounting to the main frame, ending in a more rearwardly reclined position, as illustrated in FIG. 69C. At the same time, load bearing cable 686 is pulled to lift a selected amount of weight in the weight stack (not illustrated), providing resistance to the exercise.

Figure 69C:
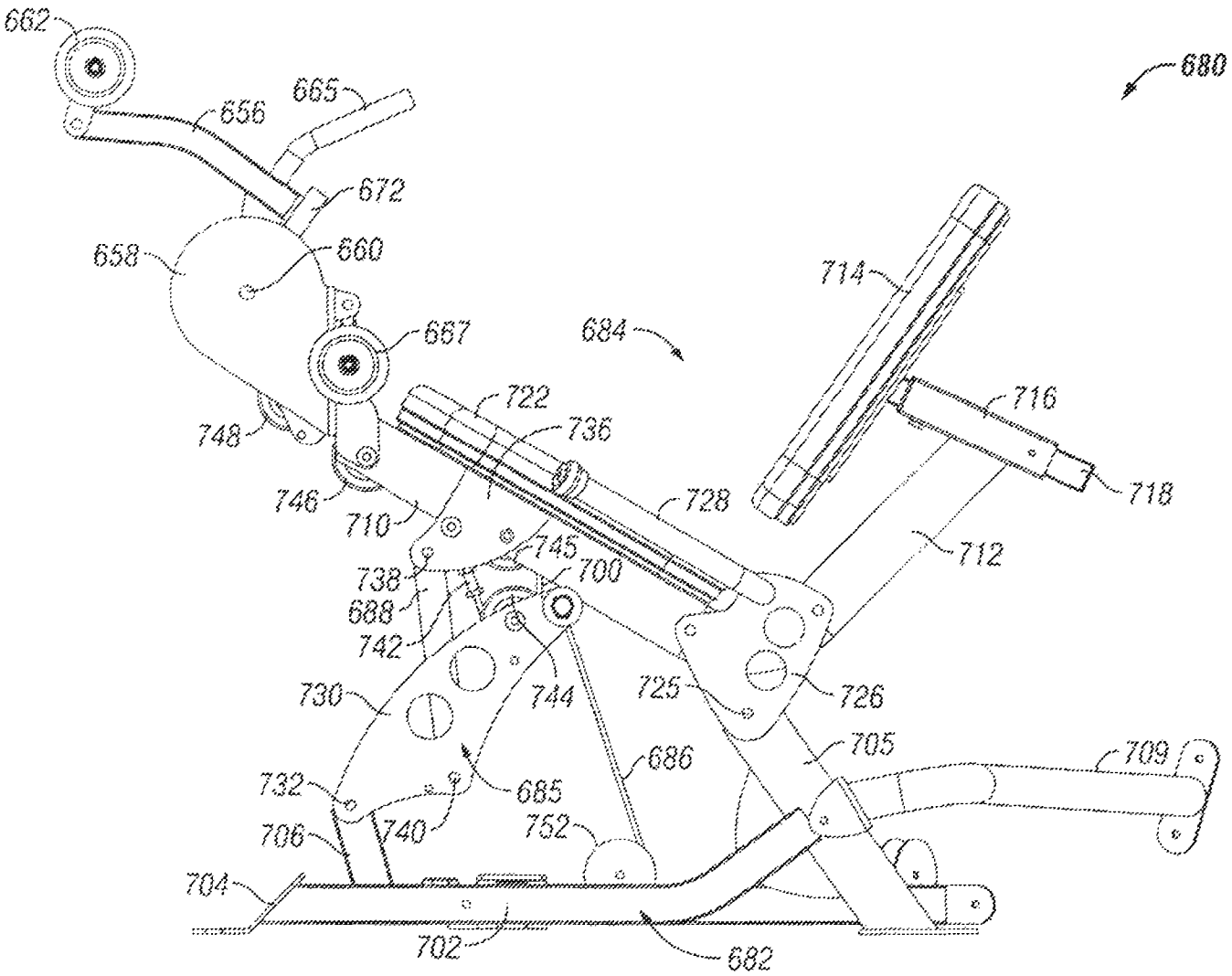
FIG. 69C is a side elevation view similar to FIG. 69A but illustrating the end position of a leg extension exercise.
Figure 69D:
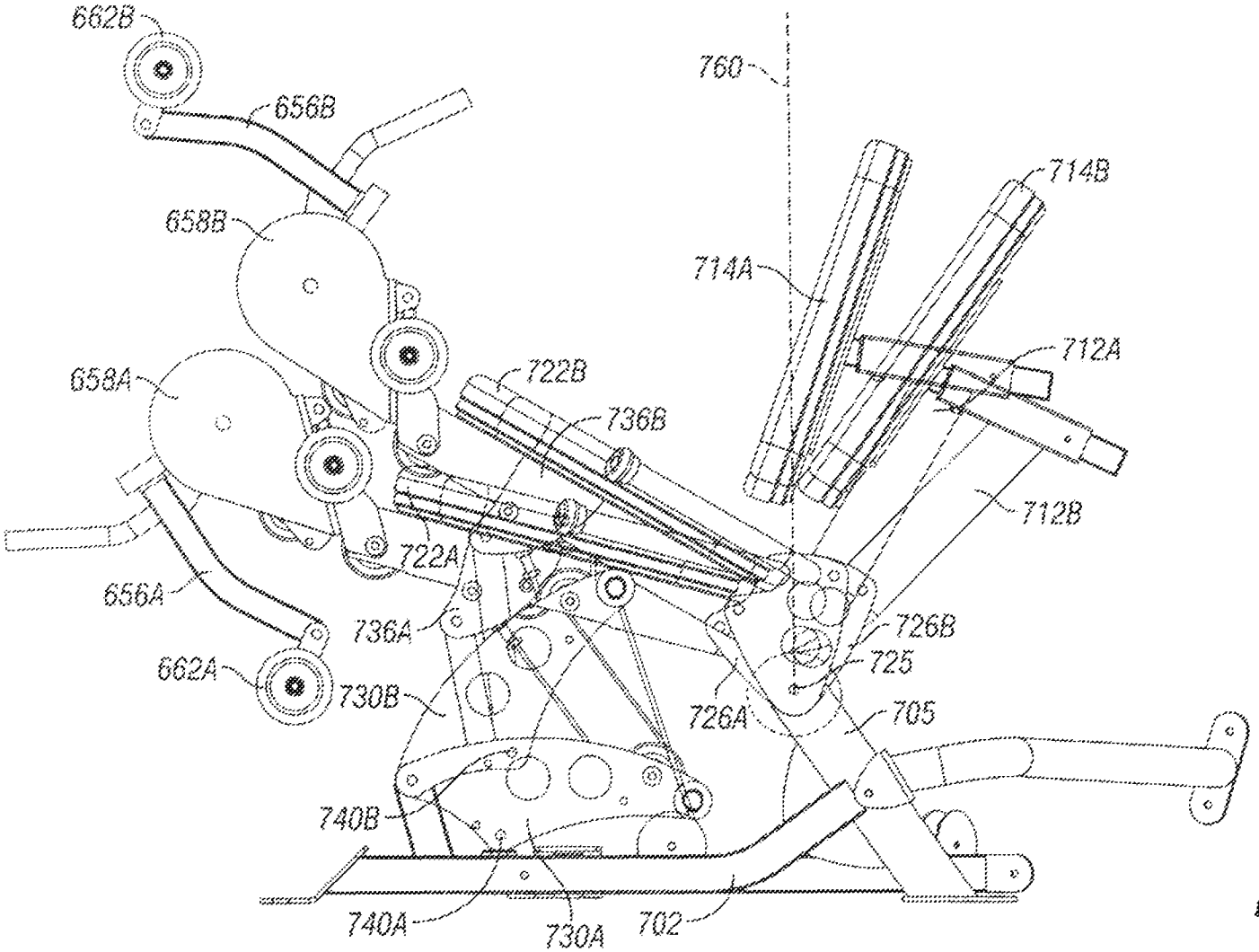
FIG. 69D illustrates the exercise start and end positions of FIGS. 69A and 69C superimposed, as well as the gravitational center line of the user support pivotal motion.
Figure 70A:
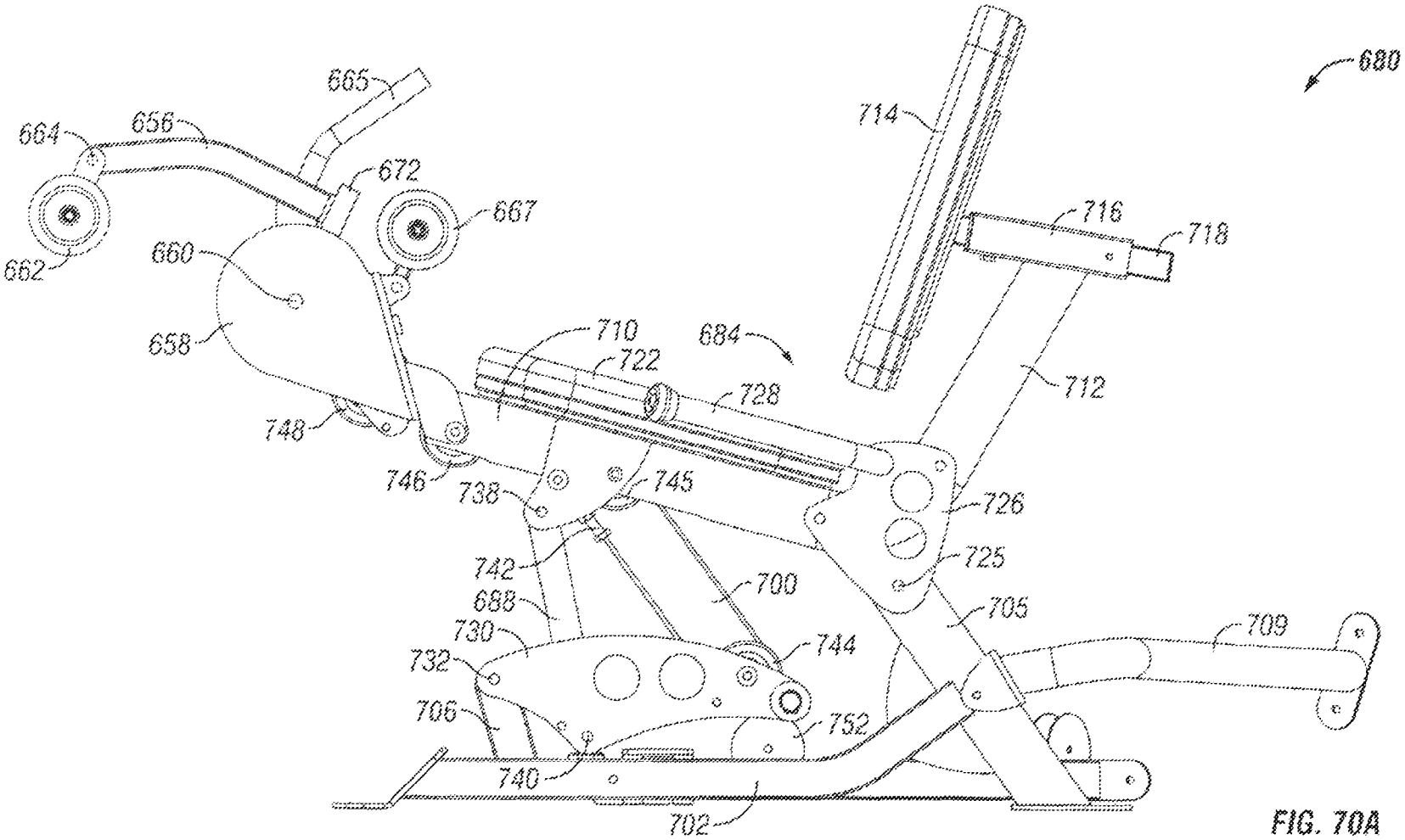
FIG. 70A is a side elevation view of the machine of FIGS. 66 to 69 in the start position for a leg curl exercise.
Figure 70B:
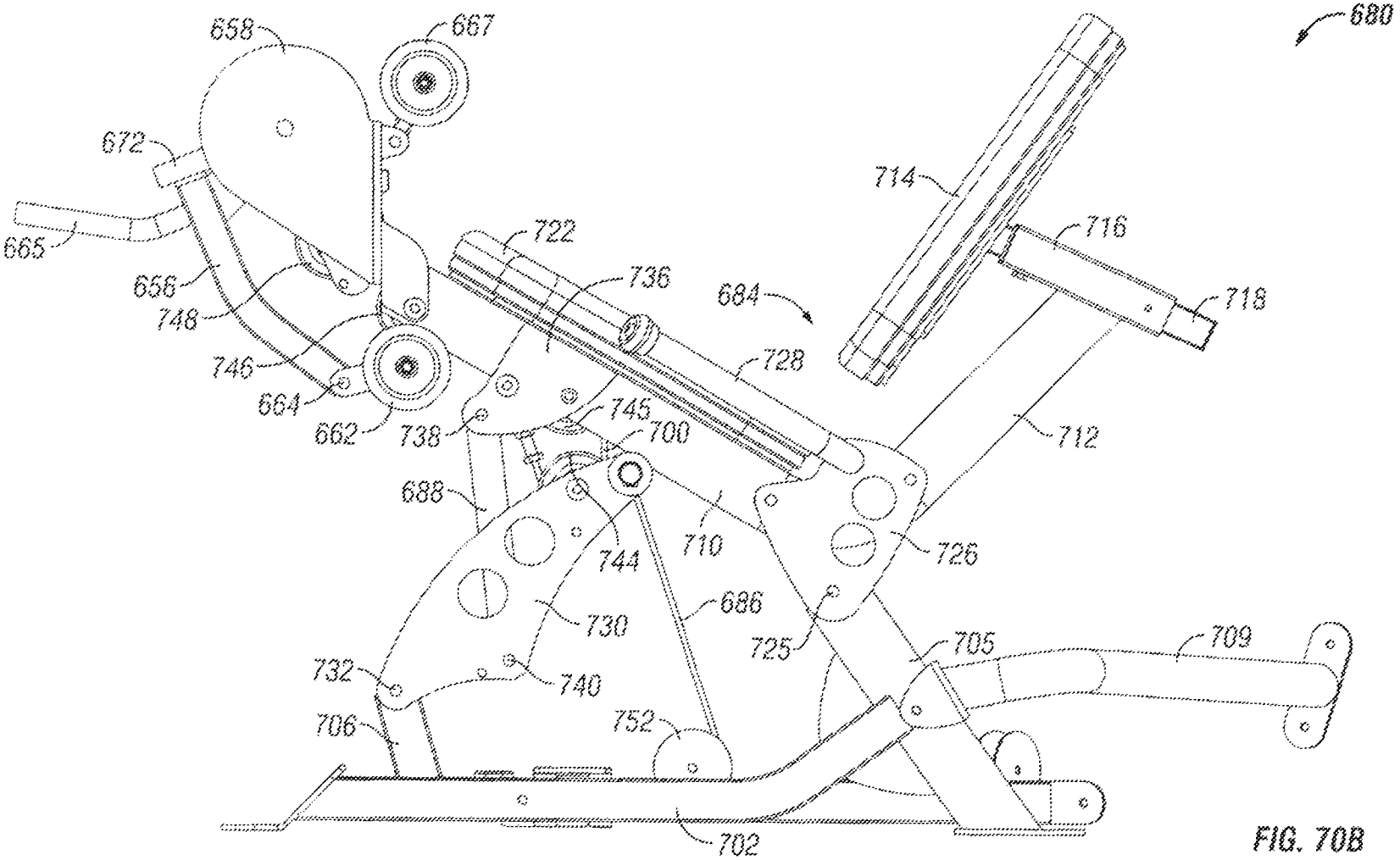
FIG. 70B is a side elevation view similar to FIG. 70A illustrating the end position for a leg curl exercise.

FIG. 69D superimposes the start and finish positions of a leg extension exercise as illustrated in FIGS. 69A and 69C, with start positions of the various moving components indicated by the letter A following the reference number, and end positions indicated by the letter B following the reference number. FIG. 69D also illustrates gravitational center line 760 of the user support's pivotal motion, which extends through the user support pivot axis 725. As illustrated, the gravitational center line extends through the user support (and part of a user's body when seated on the user support) in both the exercise start and finish positions. As in previous embodiments, the amount of weight positioned on each side of centerline 760 varies only slightly from the start to the finish position. The combined weight of the user and user support has little effect on the amount of starting resistance because a substantially equal amount of weight is balanced rearward of the user support pivot. By the same token, because only a small portion of the user passes through the gravitational centerline during the exercise, there is no appreciable drop-off in resistance felt by the user. This is true for both leg extension and leg curl exercises, which have similar exercise start and end positions. Adjustment of the back pad position via telescopic adjuster 716, 718 changes the user position relative to the gravitational centerline, and in some positions there is a reduction in this counterbalance effect, so that more of the user's weight is felt in an exercise.

If a user wishes to perform a leg curl exercise, they first adjust the start position of exercise arm 656 to the position illustrated in FIG. 70A, and rotate the thigh brace pads 667 into the upper position spaced above the forward end of the user support. The user then sits on the user support and engages the thigh brace pads 667 over their thighs, with the back of their legs engaging over pads 662. They then push back against the pads 662 so as to rotate the arm rearward into the end position of FIG. 70B. This also pulls cable 700 so that the lifting arm rotates upward about pivot axis 732 into the end position of FIG. 70B, which also pushes the user support upward to rotate back into the more reclined end position of FIG. 70B and pulls on the load bearing cable 686, simultaneously lifting the selected weights in the weight stack (not illustrated), FIGS. 71 to 78E illustrate a lat pulldown exercise machine 780 according to another embodiment. The machine 780 has a stationary main frame 782 on which a user support 784 is pivotally mounted. The user engagement device in this embodiment comprises a pair of exercise arms 785 pivotally mounted on opposite sides of an upper portion of the main frame above the user support, and a connecting linkage 786 extends between the exercise arms 785 and the user support 784 so that movement of the exercise arms is translated into movement of the user support. The connecting linkage 786 includes a lifting arm 788 which has outwardly directed weight plate receiving pegs 790 at its forward ends, as in a number of previous embodiments.

Main frame 782 has an upwardly inclined base strut 792 with a short pivot mount post 794 at its forward end, a transverse support strut 791 at an intermediate point in its length which has floor engaging feet at both ends, and an upright A-frame section secured at the rear end of base strut 792 comprising a pair of inwardly inclined uprights 795 connected by an upper cross member 796 and a cross bar 797 spaced between the upper and lower ends of uprights 795. As in previous embodiments, weight storage pegs 798 are provided on the A-frame uprights 795. Rearwardly inclined upright strut 799 extends from an intermediate location on base strut 792 to the A-frame upper cross member 796, and an exercise arm support strut 800 is angled upwardly and forwardly from an intermediate location on upright strut 799, with a connecting brace 802 extending between the struts 799 and 800 for added strength. A stop member or stand-off 803 (FIG. 72) on the base strut acts as a rest for part of the connecting linkage in the exercise start position.

Figure 74:
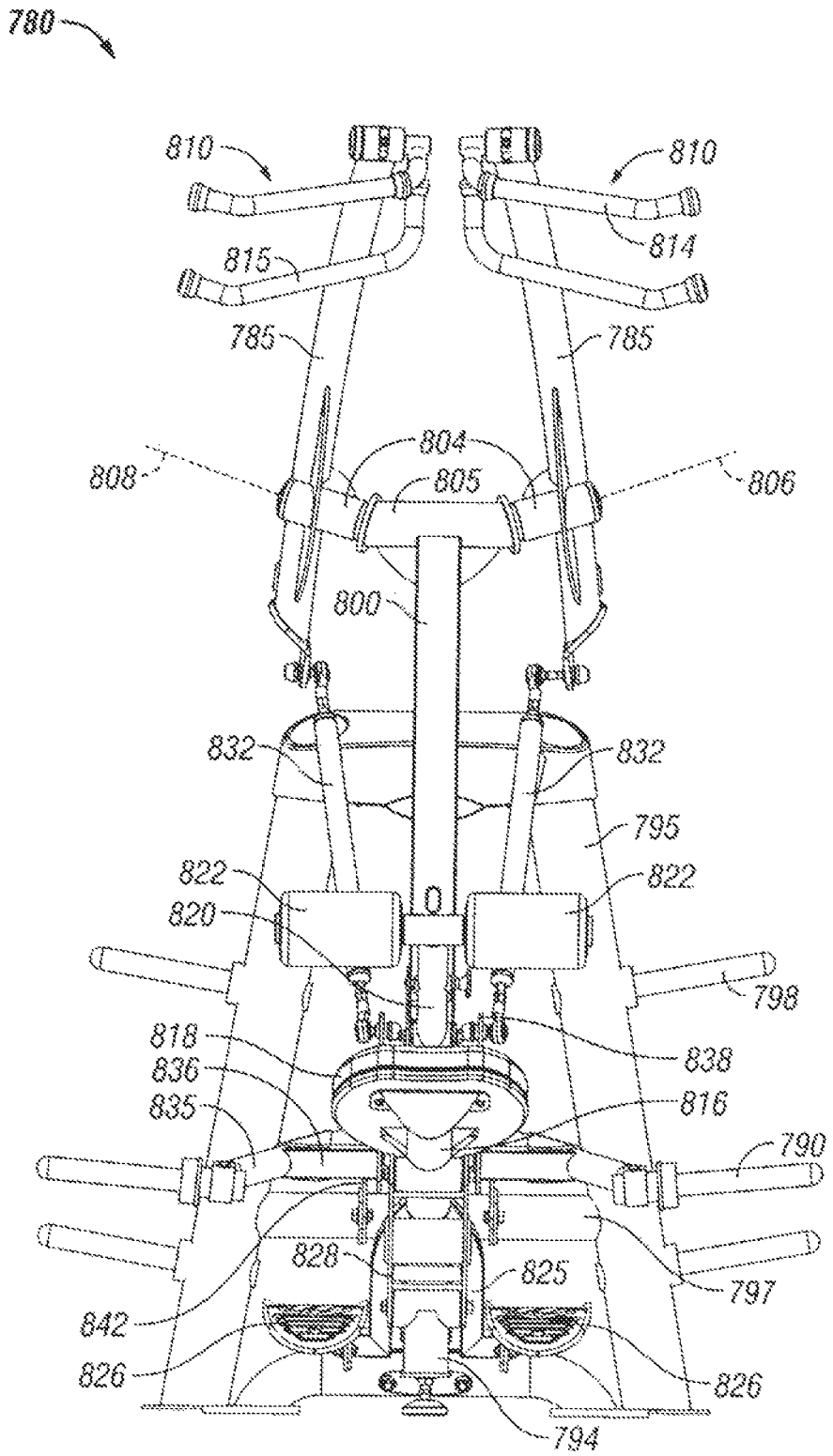
FIG. 74 is a front elevation view of the machine in the position of FIG. 71.

Each exercise arm 785 comprises an arcuate member which is pivotally connected to an upper end of main frame upright 800 via a respective pivot sleeve 804. Pivot sleeves 804 are each pivotally secured via skewed pivot pins to opposite ends of an upper pivot housing or support 805, defining skewed, non-parallel pivot axes 806, 808 for the exercise arms, as best illustrated in FIG. 74. This means that the exercise arms travel in a diverging path from the upper, start position of FIG. 71 and the lower, end position of FIG. 72. An outwardly directed, angled grip assembly 810 is pivotally secured to the end of each arcuate exercise arm for rotation about pivot axis 812 (see FIGS. 76A and 76B). Each grip assembly has two handle 814, 815 at different heights for selective gripping by the user.

The user support 784 has an elongate base strut 816 and an inclined upright strut 817 extending upward and rearward at an intermediate point on base strut 816. A seat pad 818 is located on a forward end portion of strut 816, and a support post 820 carrying thigh engaging roller pads 822 is connected to the upright strut 817 via an adjustable ROM mechanism 823 (see FIGS. 76A and 76B) for adjusting the height of pads 822 for individual users. A rear end of base strut 816 is pivotally connected to the connecting linkage 876 for rotation about pivot axis 824, as explained in more detail below. A pair of support struts 825 extends downwardly on opposite sides of base strut 816 beneath upright strut 817. Each support strut 825 carries a respective foot support or foot plate 826 at its lower end. The user support is pivotally linked to the main frame by a floating pivot link comprising a pair of pivot link plates 828 pivoted at one end to the pivot support post 794 for rotation about pivot axis 834 and pivoted at the opposite end to the base strut 816 beneath seat pad 818 for rotation about floating pivot axis 830.

Figure 71:
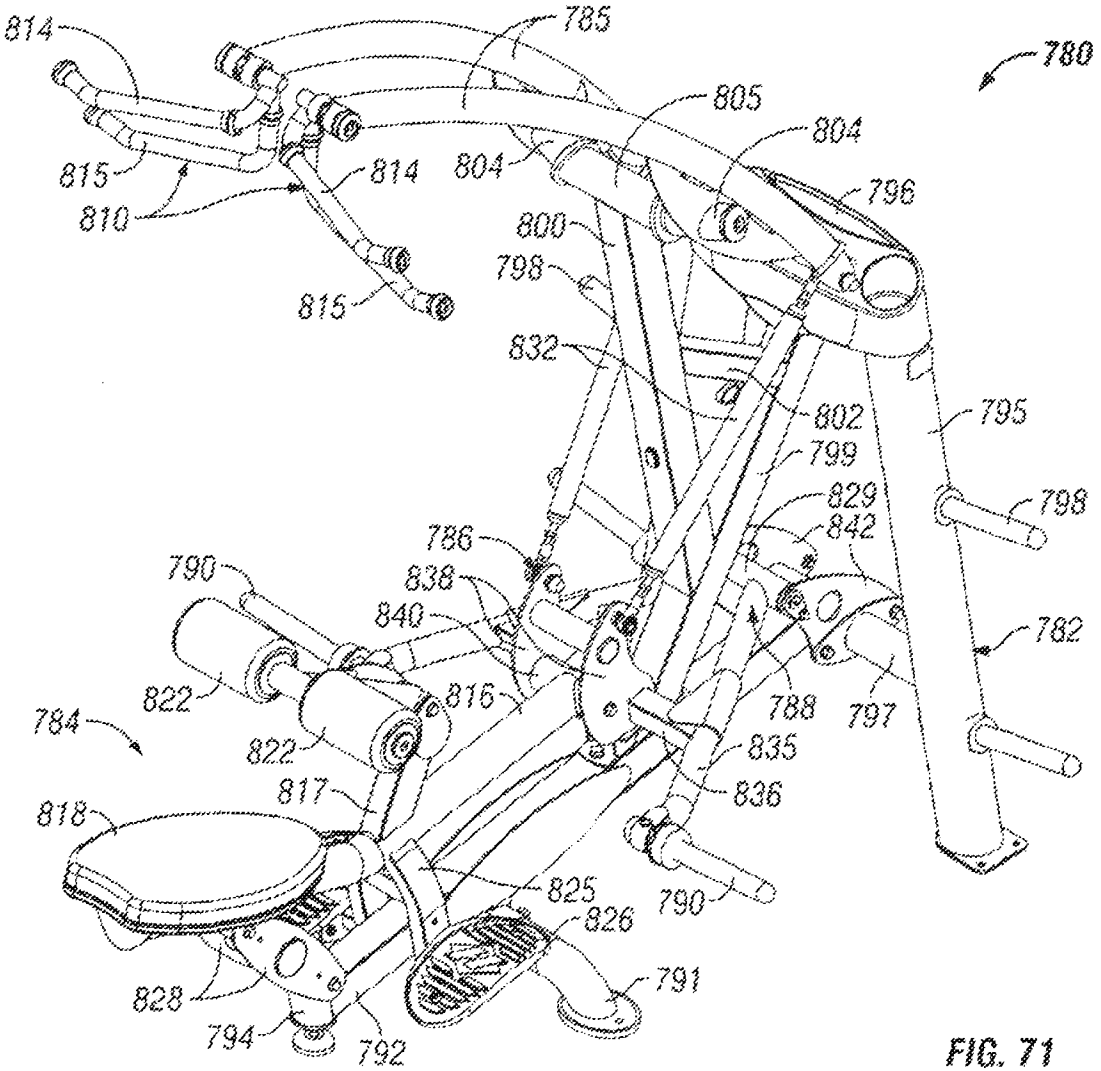
FIG. 71 is a front perspective view of a lat pulldown machine according to another embodiment in the start position of a lat pull down exercise.
Figure 72:
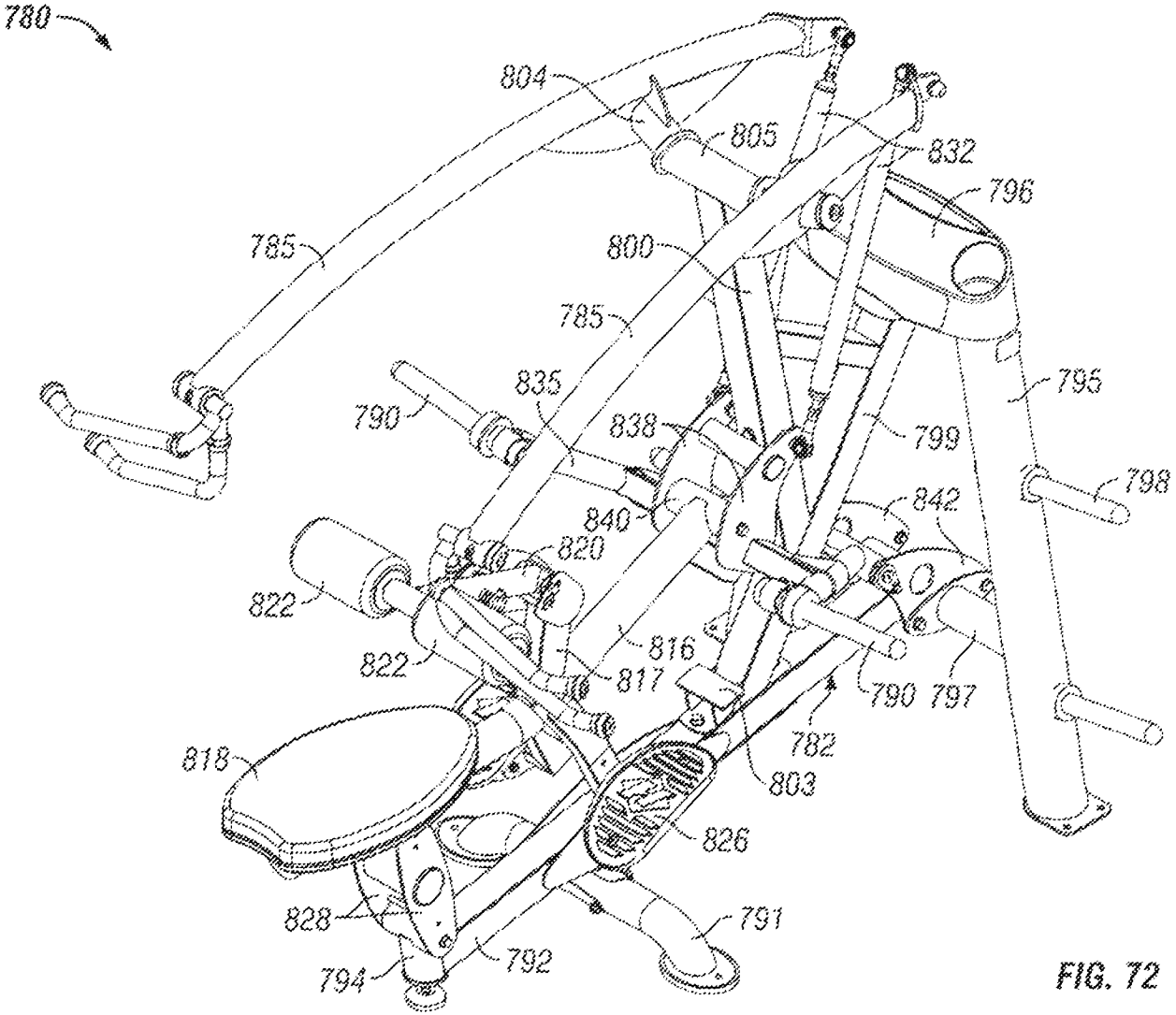
FIG. 72 is a front perspective view similar to FIG. 71 but illustrating the end position of a lat pulldown exercise.
Figure 73:
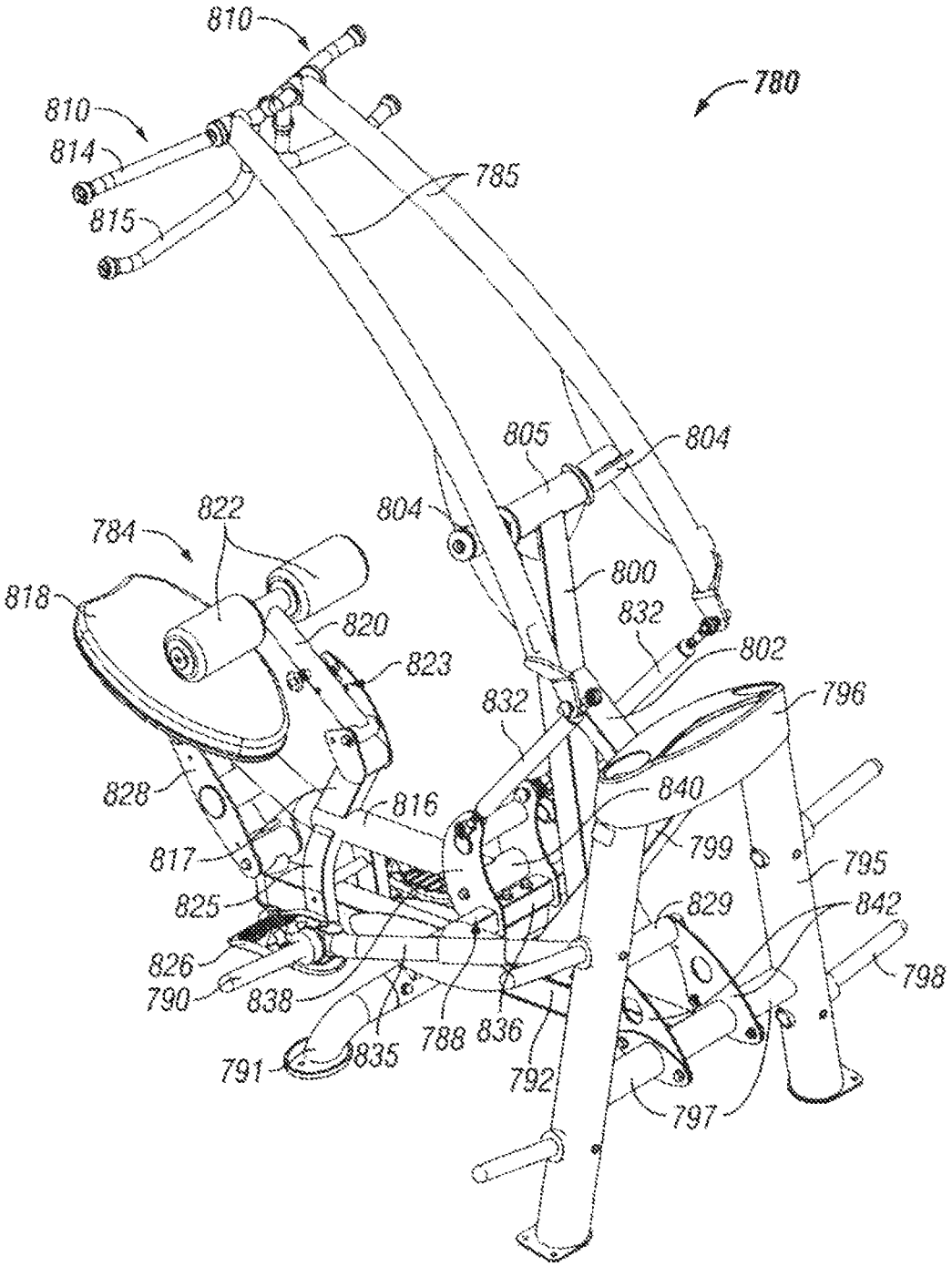
FIG. 73 is a rear perspective view of the lat pulldown machine in the start position of FIG. 71.
Figure 75:
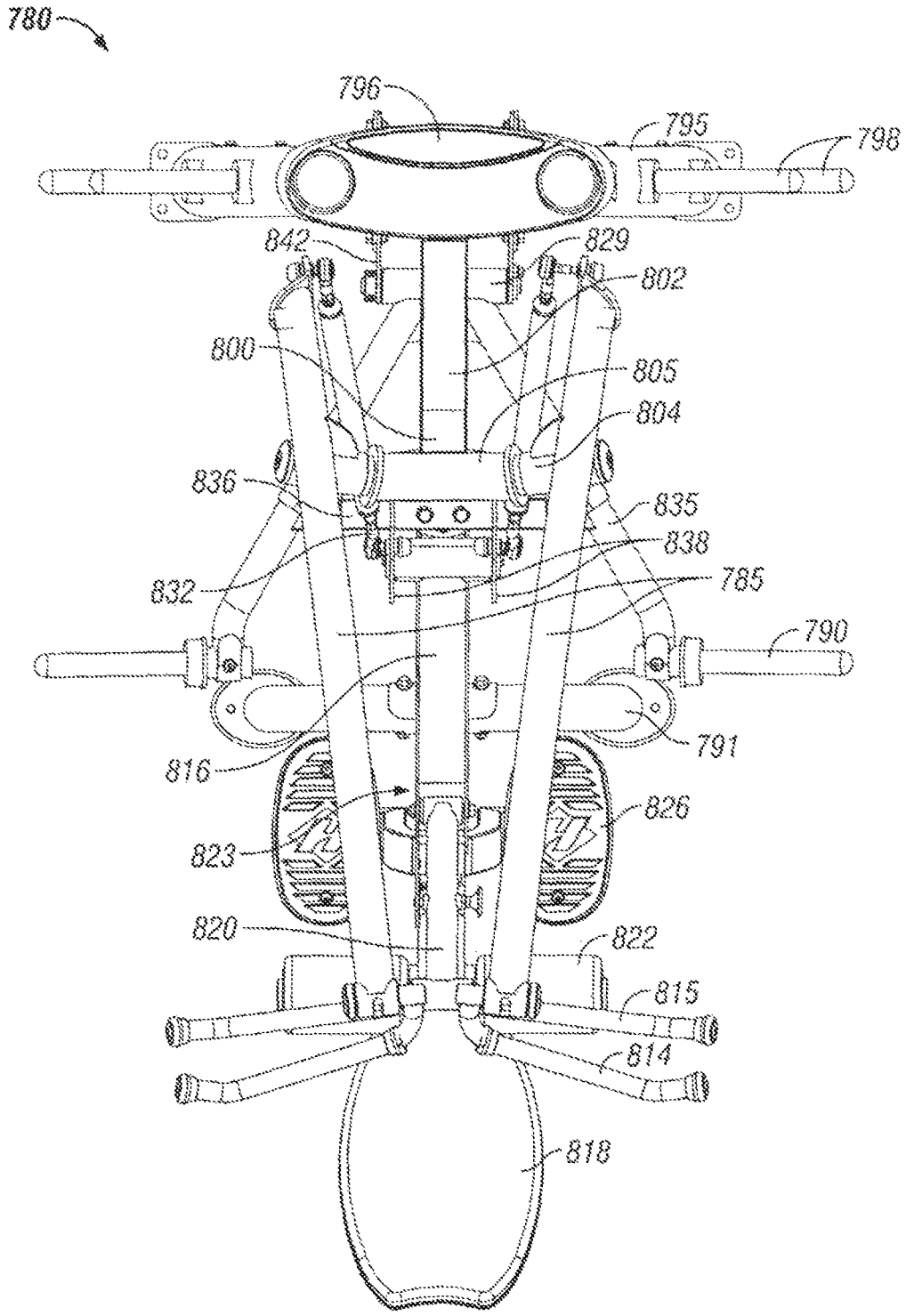
FIG. 75 is a top plan view of the machine in the position of FIGS. 71, 73 and 74.
Figure 76A:
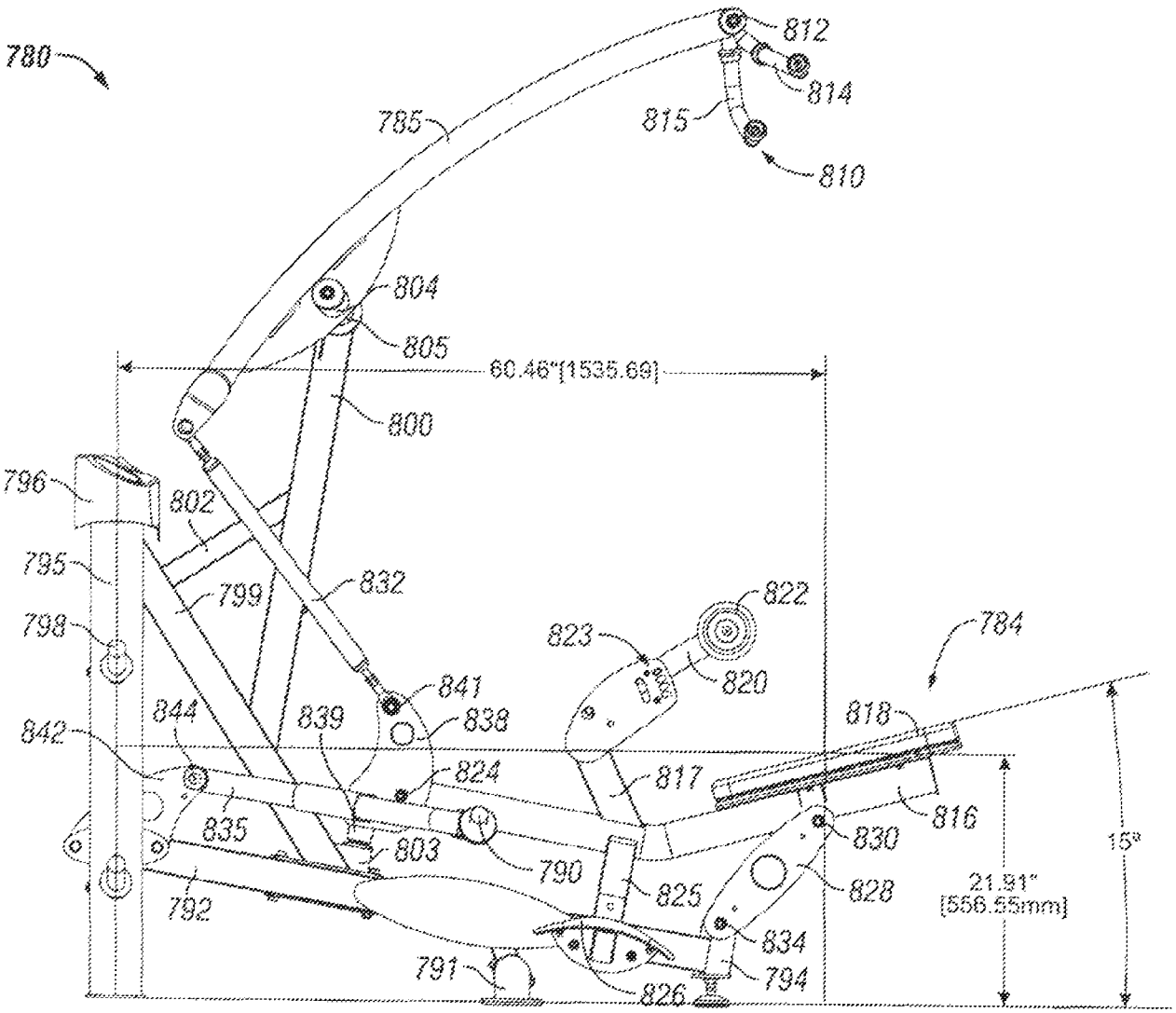
FIG. 76A is a side elevation view of the machine of FIGS. 71 to 75 in the start position for a lat pulldown exercise.
Figure 76B:
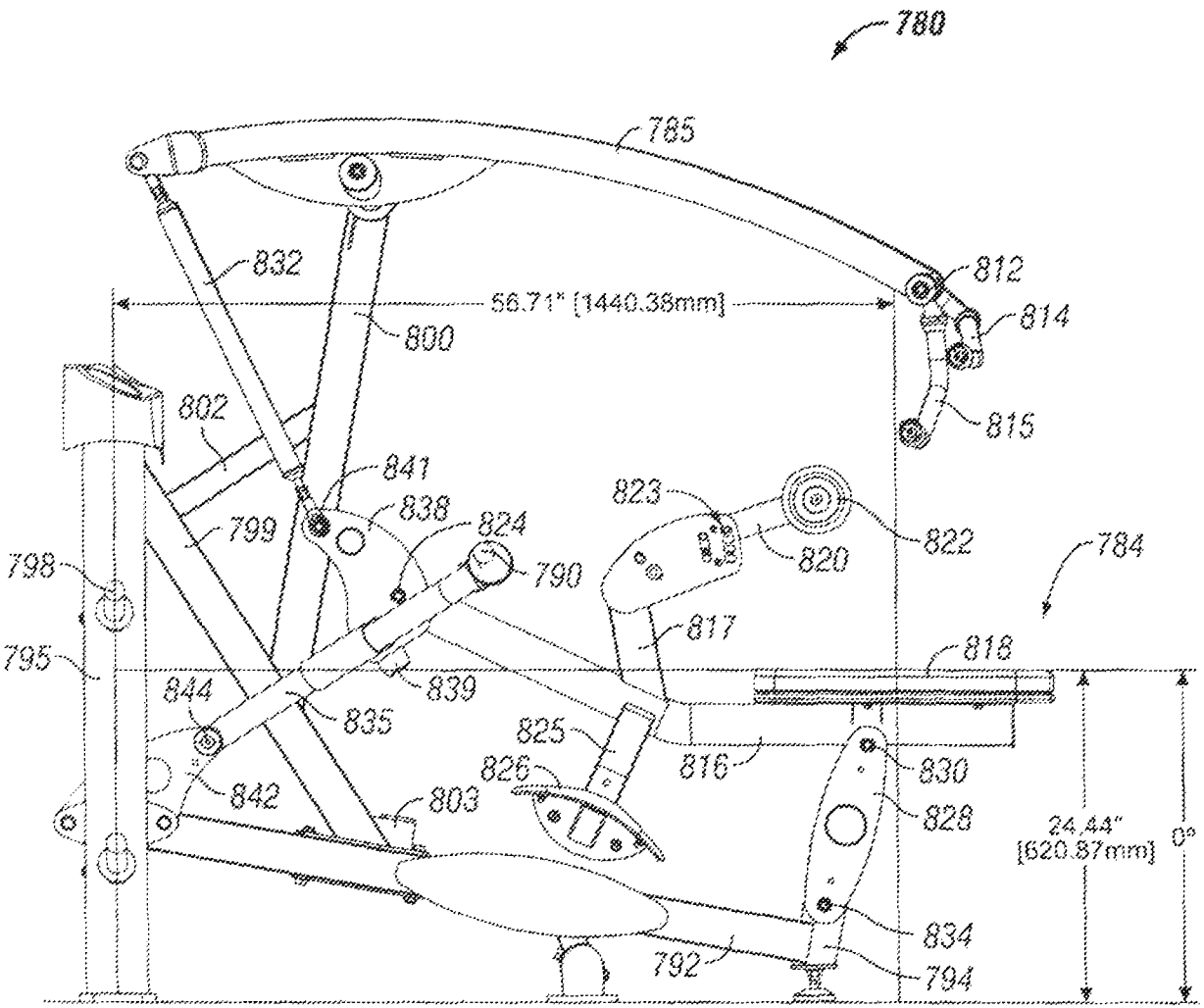
FIG. 76B is a side elevation view of the machine similar to FIG. 76A but illustrating the end position of a lat pulldown exercise.

As in several of the previous embodiments, the connecting linkage 786 comprises multiple links between each exercise arm and the user support, the links including lifting arm 788. Two first links or tie rods 832 each have a first end pivotally connected to rear end of a respective exercise arm and a second end pivotally connected to lifting arm 788. Lifting arm 788 has a pivot sleeve 829 at its rear end and a pair of outwardly diverging rods or bars 835 extend forward from pivot sleeve 829, as best illustrated in FIGS. 71 and 75. The weight receiving pegs 790 are located at the forward ends of rods 835, and the rods are secured together by a cross bar 836 at a location spaced rearward from their forward ends. A pair of generally triangular pivot brackets 838 are mounted on cross bar 836 and provide a pivot connection to the forward end of user support 784, via a pivot pin which extends between the brackets 838 and is rotatably engaged in pivot sleeve 840 at the forward end of user support base strut 816 for rotation about pivot axis 824 (FIGS. 76A and 76B). A stop pad or stand-off 839 extends down from the center of cross bar 836 to engage stop post 803 on the main frame base strut in the rest or start position (see FIG. 76A). The lower ends of tie rods 832 are pivoted to a spaced location adjacent the upper ends of pivot brackets 838 for rotation about pivot axis 841, as best illustrated in FIGS. 71, 72, 76A and 76B. Pivot sleeve 829 at the rear end of lifting arm 788 is rotatably mounted on a pivot pin extending between pivot brackets 842 mounted on the main frame cross bar 797 for rotation about pivot axis 844. As in some of the previous embodiments, this multiple pivot link arrangement translates movement of the exercise arms into movement of the user support. At the same time, the lifting arm 788 of the connecting linkage is loaded by weight plates 18 on pins 790 at the ends of the rods 835 of the lifting arm to provide a selected amount of exercise resistance. In alternative embodiments, the resistance may be provided by a link to selectorized weight stack, or by a bi-directional hydraulic ram or gas shock assembly, as in the embodiment of FIGS. 7 to 10, so that both pushing and pulling exercises can be carried out using arms 785.

This arrangement effectively provides a multiple pivot connection or four bar pivot linkage between the user support and the main frame. The four bar or multiple pivot linkage has a first, floating link at its rear end comprising pivot link plates 828 and a second link provided by the lifting arm 788 which is pivotally connected between the main frame at pivot axis 844 and the user support at pivot axis 824. Pivot link plates 828 provide a floating pivot link similar to the link described in connection with the first embodiment of co-pending U.S. patent application Ser. No. 11/846,459 of Webber et al. filed on Aug. 28, 2007, the contents of which are incorporated herein by reference.

Figure 77A:
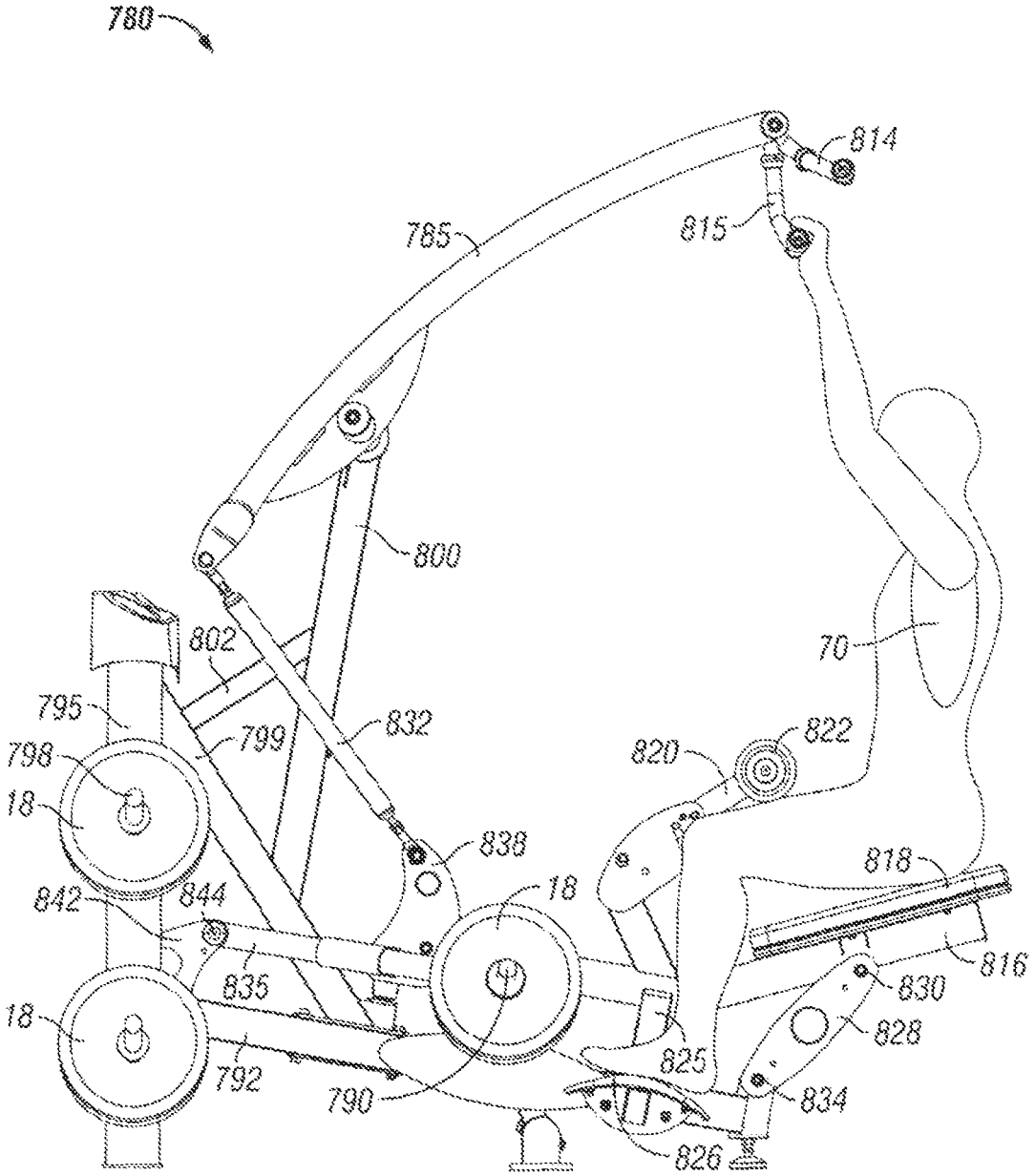
FIG. 77A is a side elevation view of the machine similar to FIG. 76A but illustrating a user seated on the user support in the start position for a lat pulldown exercise.
Figure 77B:
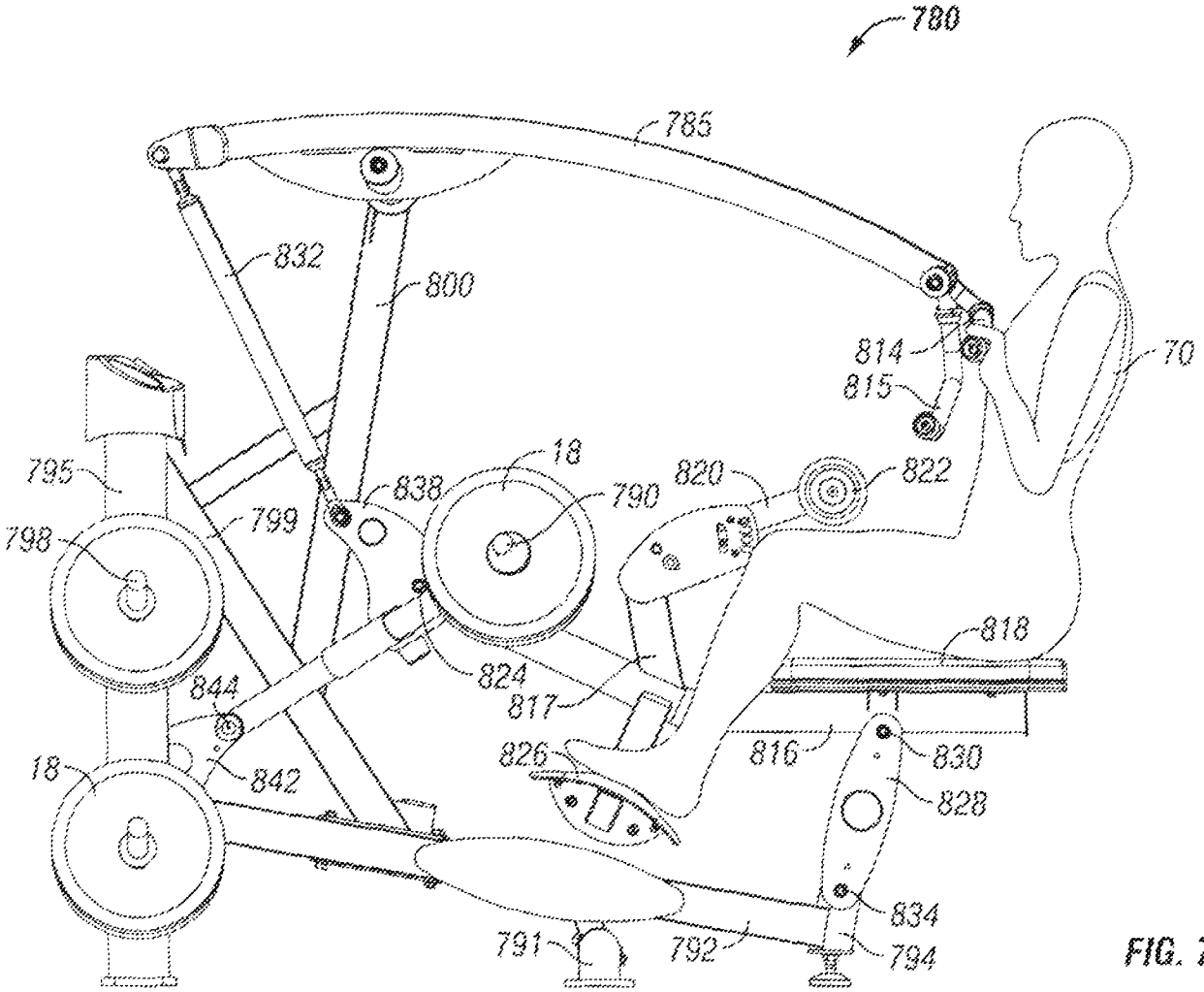
FIG. 77B is a side elevation view of the machine similar to FIG. 76B but illustrating the user seated on the machine at the end position of a lat pulldown exercise.

The exercise arms 785 may be used to perform a lat pulldown exercise with the user support and exercise arms starting in the position of FIGS. 71, 73, 74, 75, 76A and 77A. In this position, the seat pad 818 is in an inclined orientation, and the grips 810 are located above the seat pad, as illustrated in FIGS. 76A and 77A. FIG. 77A illustrates a user 70 seated on the user support in the start position for a lat pulldown exercise, with their hands gripping handles 815 and the thigh hold down pads 822 adjusted using ROM adjuster 823 to rest comfortably on top of their thighs. The user may alternatively choose to grip handles 814 when performing the exercise, depending on which is the more comfortable grip position. The user's feet are located on foot plates 826. Thus, the user is positioned securely on the user support by support portions engaging three spaced locations on the user's body, with all three support portions moving together during the exercise. From the start position of FIG. 77A, the user pulls the handles downward, which in turn rotates the forward ends of the exercise arms 785 downward and outward in a slightly diverging path, as can be seen by comparison of FIGS. 71 and 72. As the user pulls the forward ends of the exercise arms downward, between the position of FIG. 77A and the end position of FIG. 77B, the rear ends of the exercise arms are raised, pulling tie rods 832 upwards, and pulling the cross bar 836 and both of the rods 835 of the lifting arm upward adjacent their forward ends while the rear end of the lifting arm rotates about pivot axis 844. This simultaneously lifts any weight plates 18 mounted on pegs 790, providing the exercise resistance. At the same time, the forward end of the user support is lifted via its pivot connection to pivot brackets 838, causing the user support to rotate about the multiple pivot linkage into a more horizontal orientation at the end of the exercise, while the user ends the lat pulldown exercise with their upper body inclined slightly rearward and their hands in front of their chest, as illustrated in FIG. 77B.

As illustrated by the dimensions marked in FIGS. 76A and 76B, the user support 784, and thus a user seated on the user support, move both upward and forward between the start and end positions of the exercise. The upward motion is around two to three inches, and the forward motion is around three to four inches, as can be seen by comparing the start and end dimensions shown on these drawings. At the same time, seat pad 818 tilts through an angle of around fifteen degrees, starting at an inclination of 15 degrees to the horizontal and ending in a horizontal orientation in the illustrated embodiment.

Figure 78A:
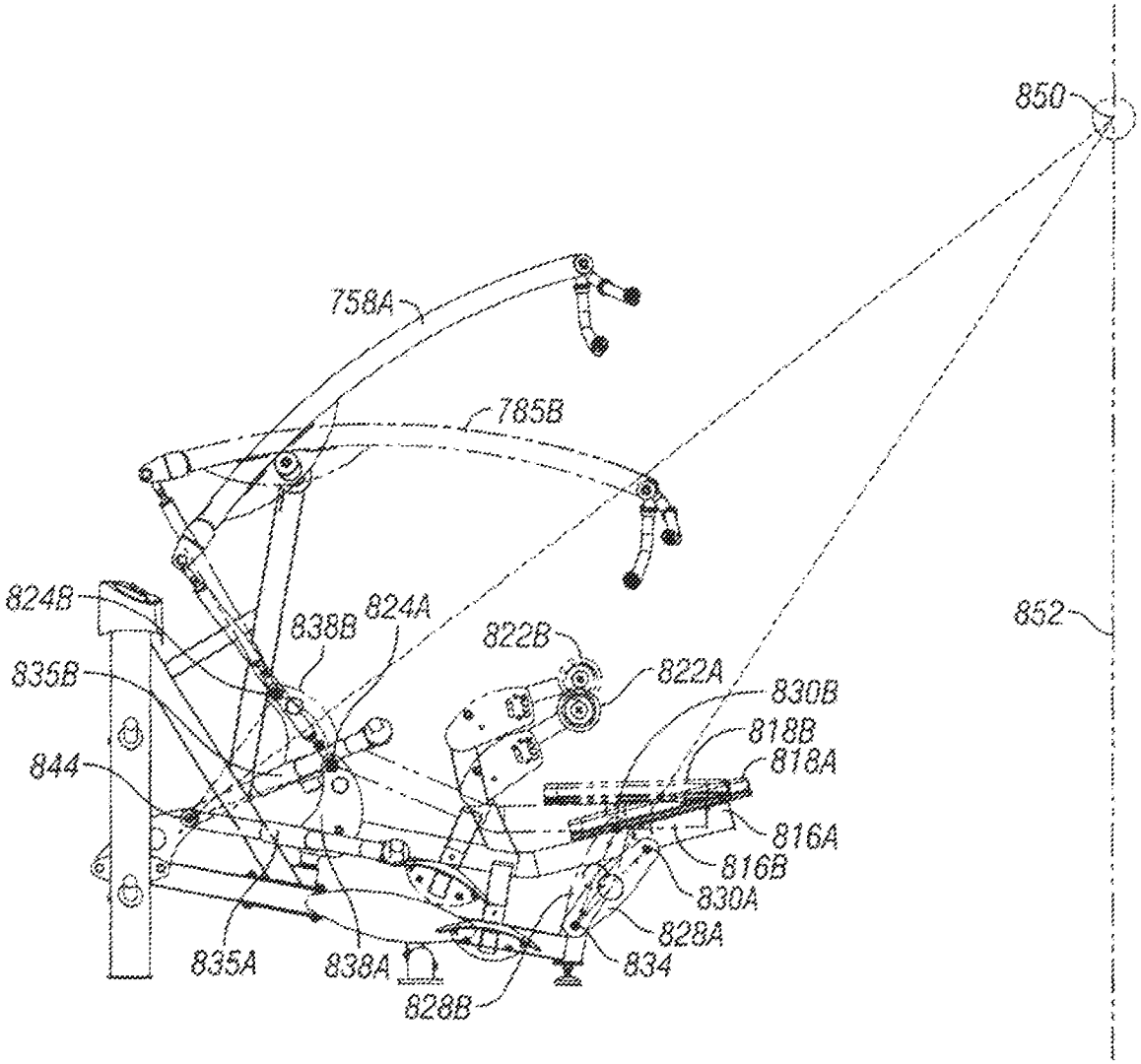
FIG. 78A illustrates the start and end positions of FIGS. 76A and 76B superimposed, showing the location of the theoretical pivot axis of the user support pivotal movement.

In this embodiment, the user support is pivotally mounted on the main frame via a multiple pivot linkage comprising the lifting arm 788 pivoted to the rear end of the user support and the floating pivot link 828 between the base strut of the main frame and the base 816 of the user support. FIG. 78A superimposes the start and finish positions of the machine, with start positions of the various moving components indicated by the letter A following the reference number, and end positions indicated by the letter B following the reference number. FIG. 78 also illustrates the theoretical pivot axis 850 of the user support's pivotal motion, calculated using the start and end positions of each of the user support pivot axes 824 and 830. In this embodiment, the vertical gravitational center line 852 of the pivotal motion does not extend through any part of the machine.

Figure 78B:
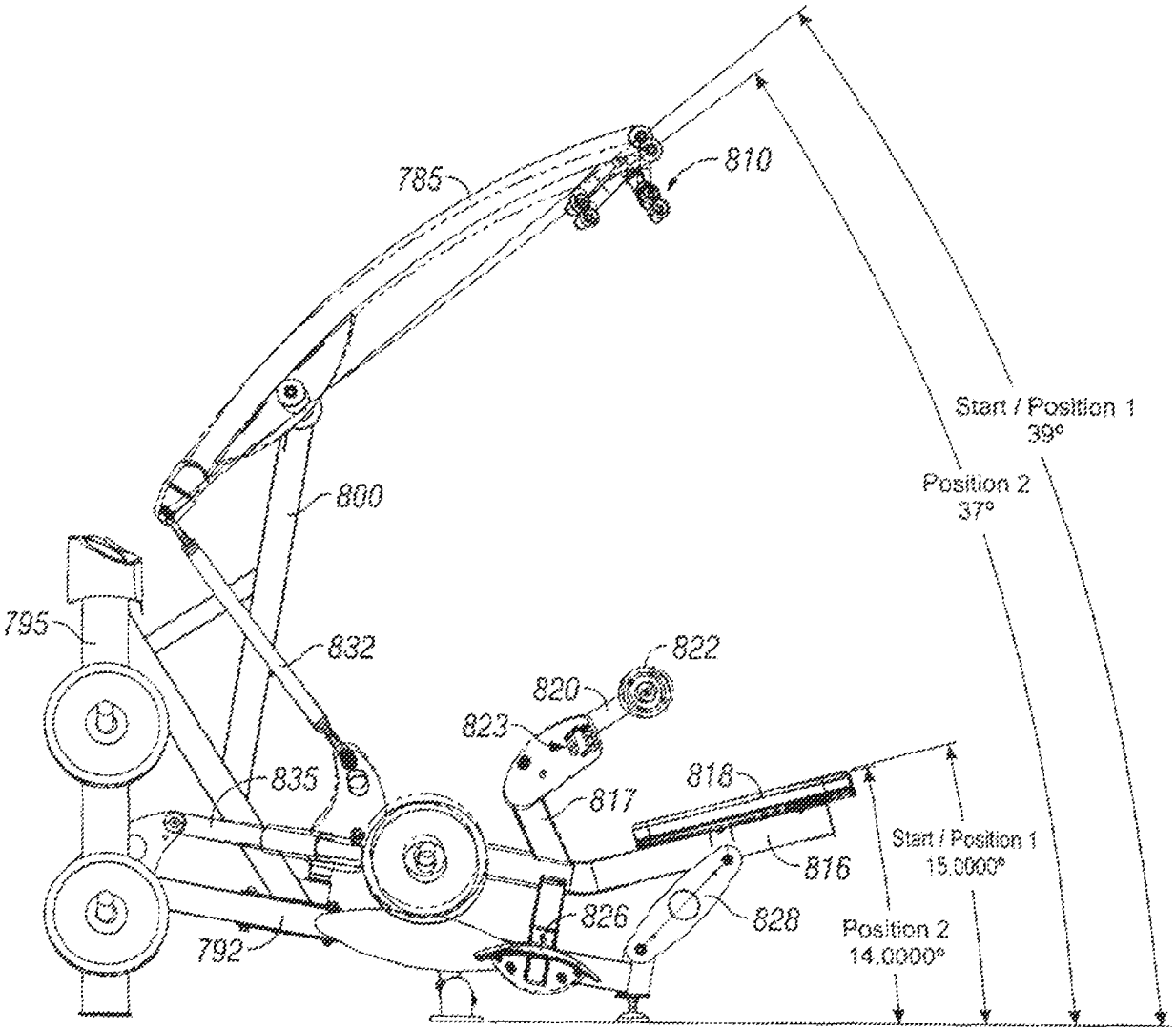
FIGS. 78B to 78D are side elevational views illustrating a sequence of positions of the moving parts of the lat pulldown machine during an exercise.
Figure 78C:
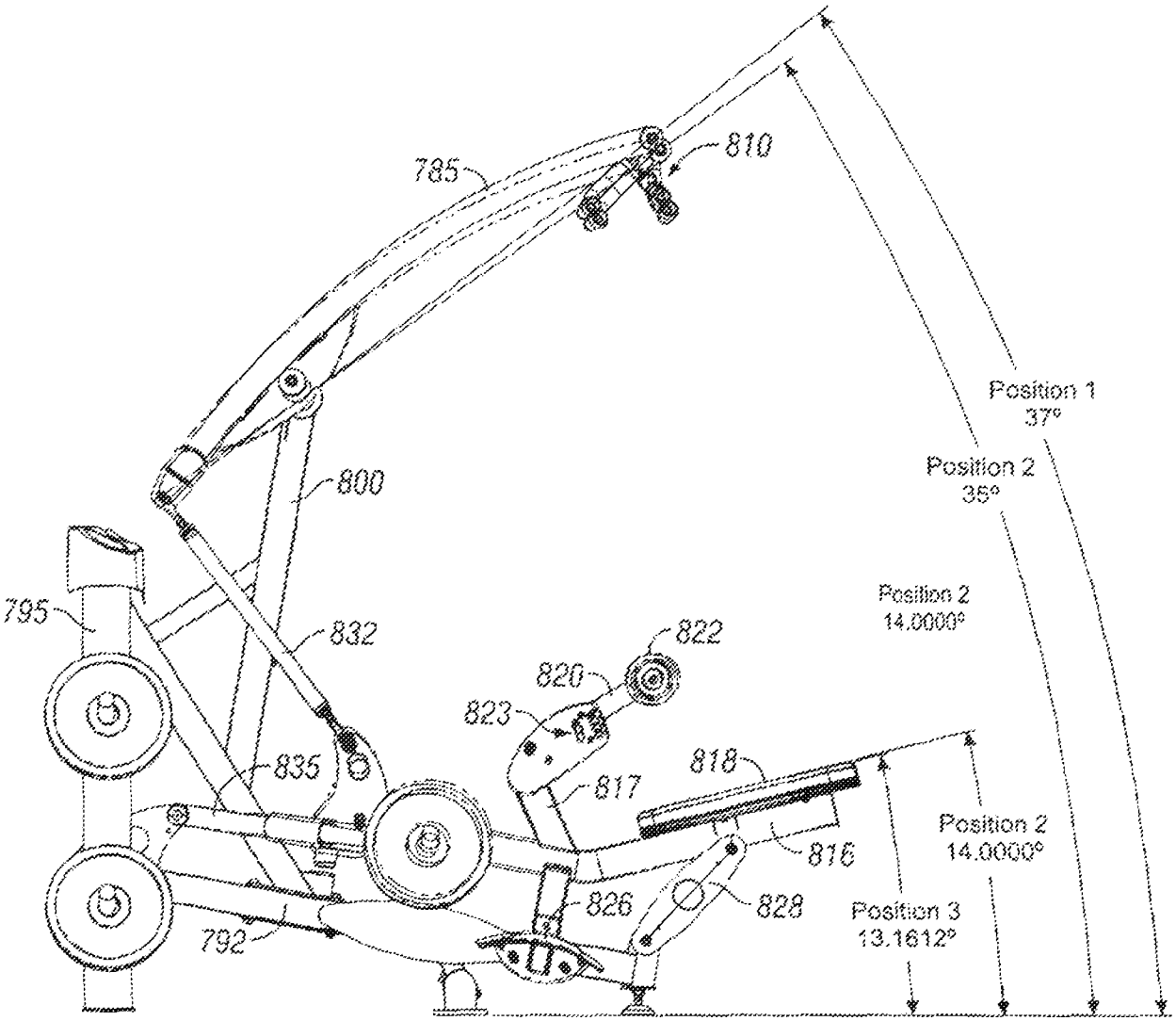
Figure 78D:
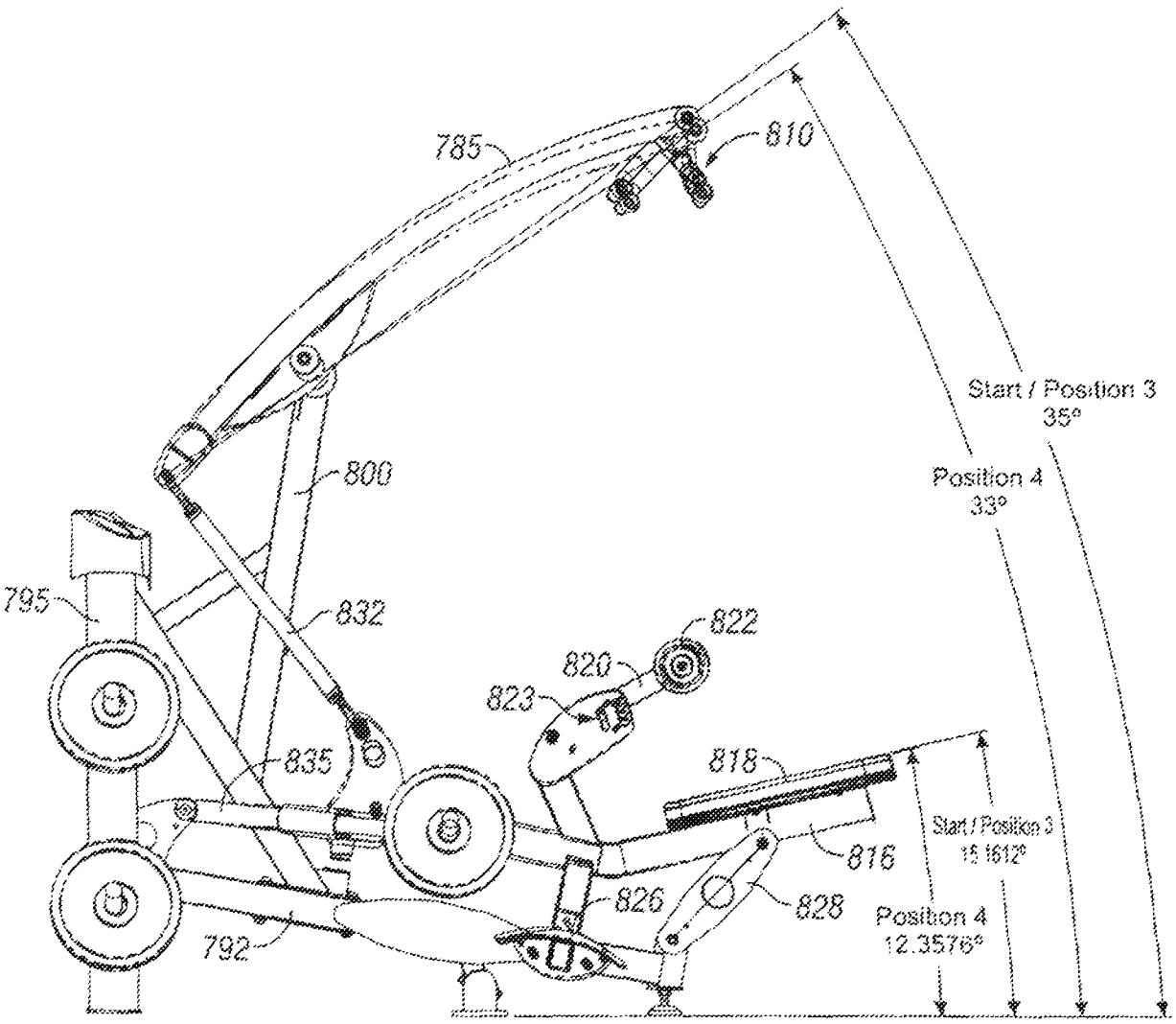

The floating link 828 which provides a pivotal link between a rear portion of the user support and the main frame helps to ensure a proper arcing motion of the user support throughout the exercise movement. FIGS. 78B to 78D illustrate successive stages during part of the exercise movement from the exercise start position shown in solid line in FIG. 78B and a subsequent position shown in dotted line in FIG. 78D. In these drawings, the bold or solid outline represents the machine in a first position while the dotted outline represents the end position for that incremental movement sequence. In the next sequence, the solid line start position is the same as the dotted or end position of the previous drawing. This helps to illustrate exactly how the floating link 828 and other parts of the machine move throughout the exercise. In FIG. 78B, the dotted line position represents a two degree rotational movement in the exercise arm, which results in a one degree shift in the angle of the seat pad.

The second sequence in FIG. 78C takes the end position (dotted line) of FIG. 78B and uses it as the starting position (solid line) for this sequence. The arm is rotated the same two degrees with a resultant shift of less than one degree in the angle of the seat pad. The third sequence of FIG. 78D takes the dotted line position of FIG. 78C as the start position (solid line), with the exercise arm again rotating through two degrees while the seat pad rotates through less than one degree.

Figure 78E:
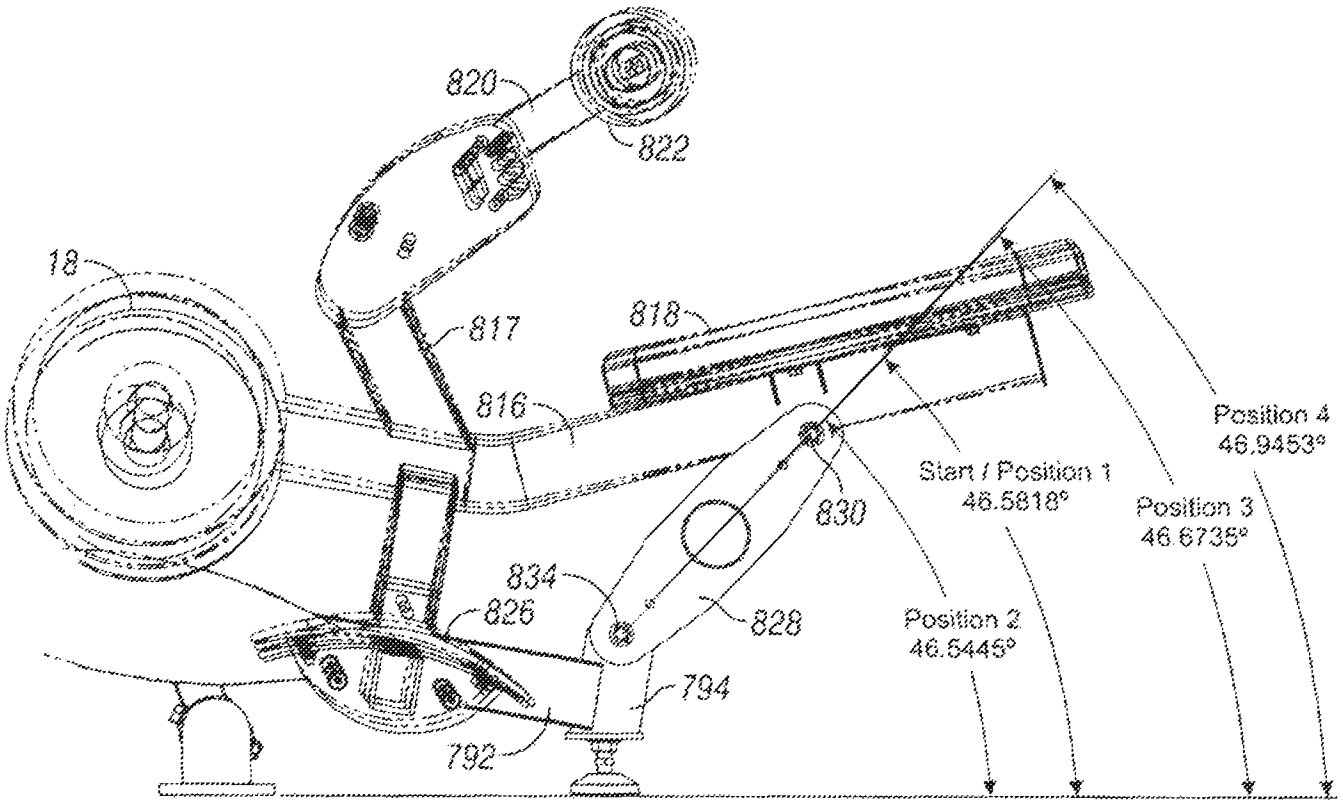
FIG. 78E is a close up view of the floating link of the machine of FIGS. 71 to 78, illustrating the four different positions of the floating link in FIGS. 78B to 78D.

The close up view of FIG. 78E show the rotation pattern for the link 828 during the three sequences of FIGS. 78B through 78D which comprise a part of the exercise movement. It takes a line that bisects both pivot axes 834 and 830 of the link and measures the angle of this line from the floor for each of the four sequential positions of the exercise arm as illustrated in FIGS. 78B to 78D. This shows that position 1 (start position) is minutely higher than the second position which means the link travels downward when the arm is moving from position 1 to position 2. It then shows that the link reverses direction and moves upward from position 2 to position 3, past the initial starting point of position 1. Thus, the link 828 reverses direction during an exercise movement.

FIGS. 79 to 86 illustrate a mid row exercise machine 875 according to another embodiment which has a user engagement device comprising articulating exercise arm assemblies 876 which provide three dimensional movement to automatically align to the hand and arm movement of the user during an exercise. This embodiment also has a connecting linkage 878 which includes a lifting arm 890 similar to the lifting arm of the previous embodiment, as discussed in more detail below.

The machine 875 has a stationary main frame 892 on which a user support 894 is pivotally mounted, and the articulating exercise arm assemblies 876 are pivotally mounted on the main frame to extend on opposite sides of the user support. Connecting linkage 878 links movement of the exercise arms to movement of the user support 894. Lifting arm 890 has oppositely directed pegs 895 at its forward ends which receive weight plates which act as the exercise resistance, as in a number of previous embodiments. Alternative exercise resistance may be provided in other embodiments, such as a selectorized weight stack or bi-directional ram or gas shock assembly, as has been discussed above in connection with the preceding embodiments.

Main frame 892 has an upwardly inclined base strut 896 with a short, ground engaging post 897 at its forward end, an upright A-frame section secured at the rear end of base strut comprising a pair of inwardly inclined uprights 898 connected by an upper cross member 899 and a cross bar 900 spaced between the upper and lower ends of uprights 898. As in previous embodiments, weight storage pegs 902 are provided on the A-frame uprights. Rearwardly inclined upright strut 904 extends from an intermediate location on base strut 896 to the A-frame upper cross member 899. A stop member or stand-off 905 on the base strut acts as a rest for part of the user support in the exercise start position.

Figure 79:
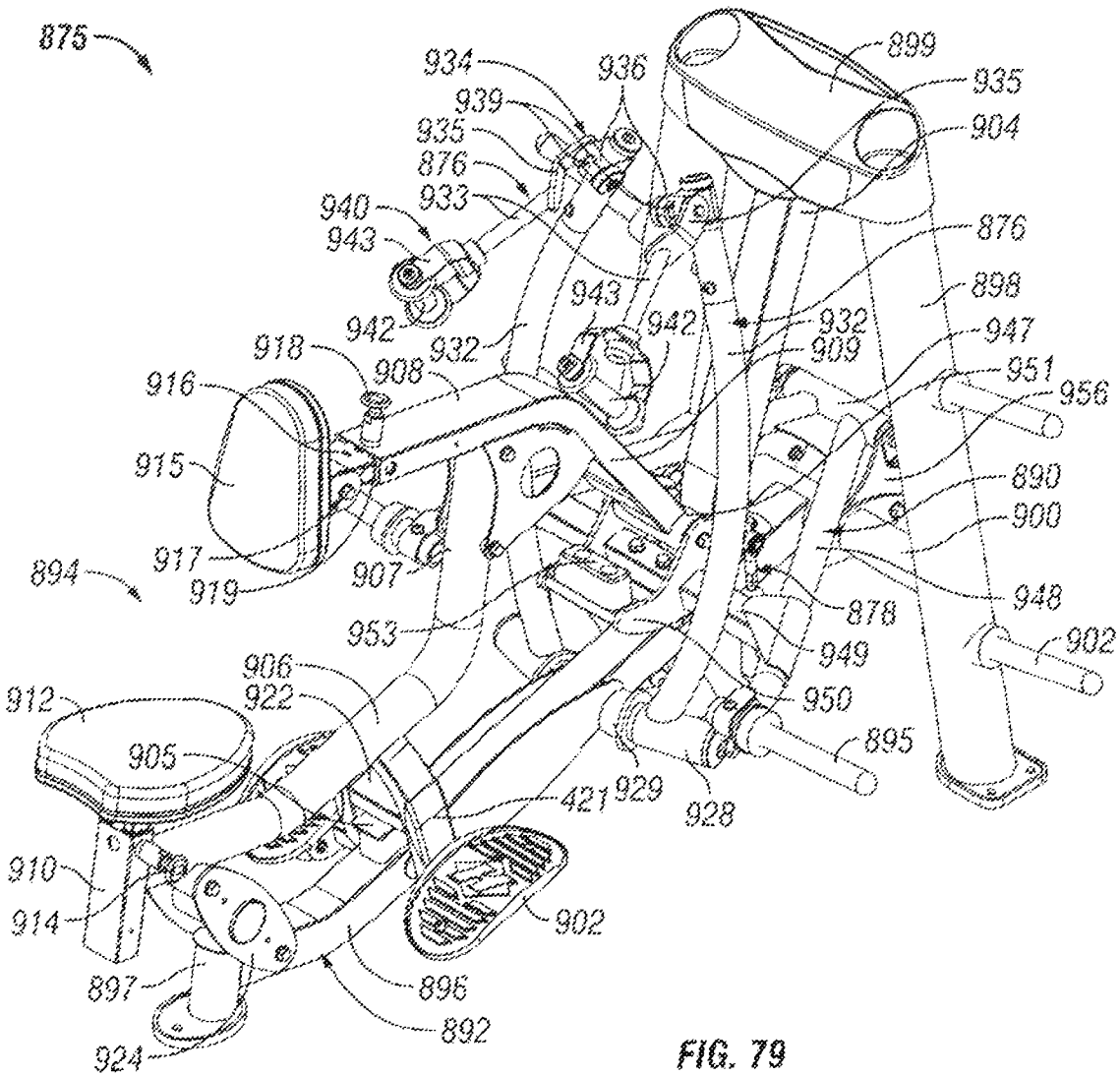
FIG. 79 is a front perspective view of a mid row exercise machine according to another embodiment, in the start position of a mid row exercise.
Figure 80:
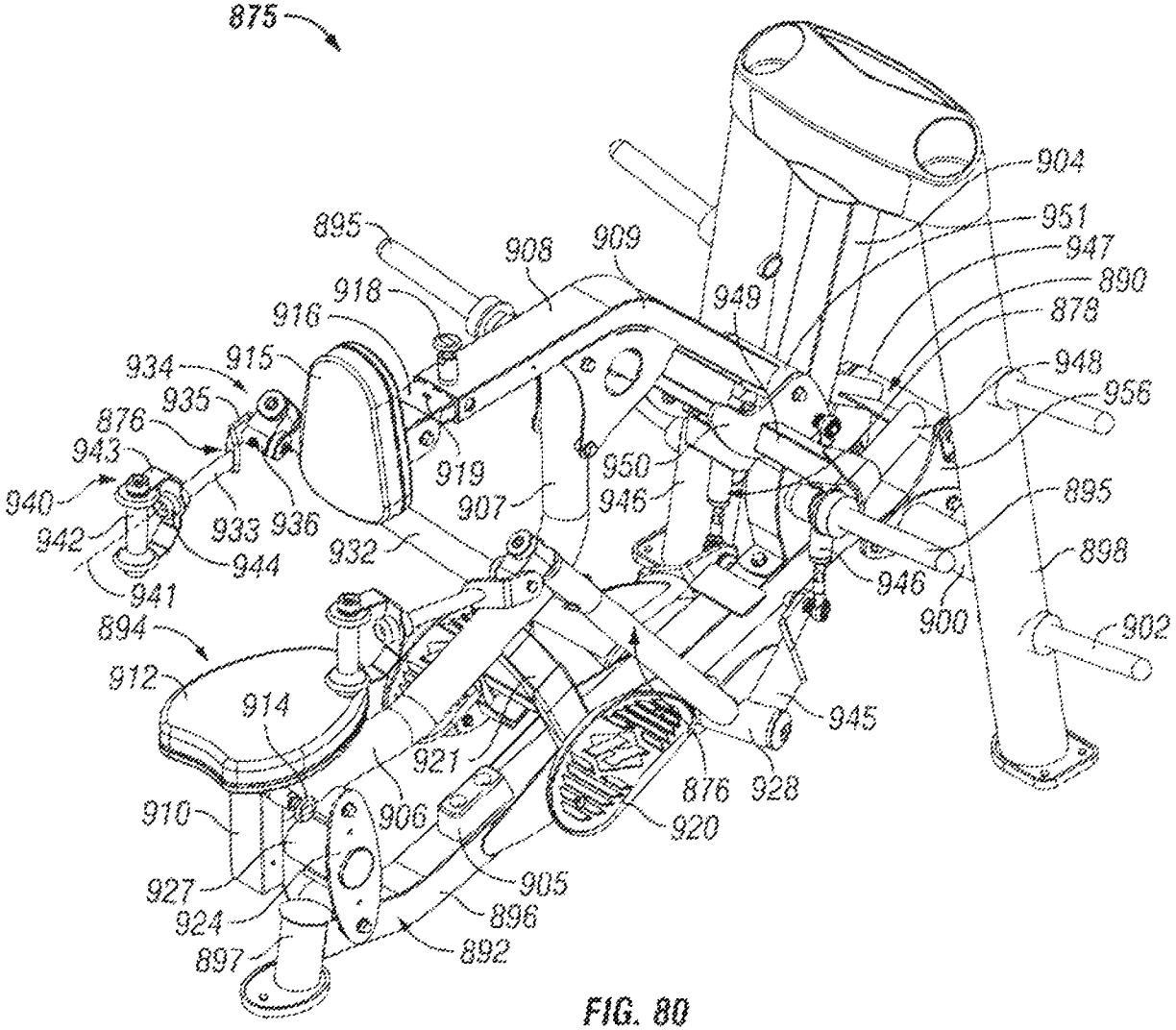
FIG. 80 is a front perspective view similar to FIG. 79, illustrating the end position of a mid row exercise.
Figure 81:
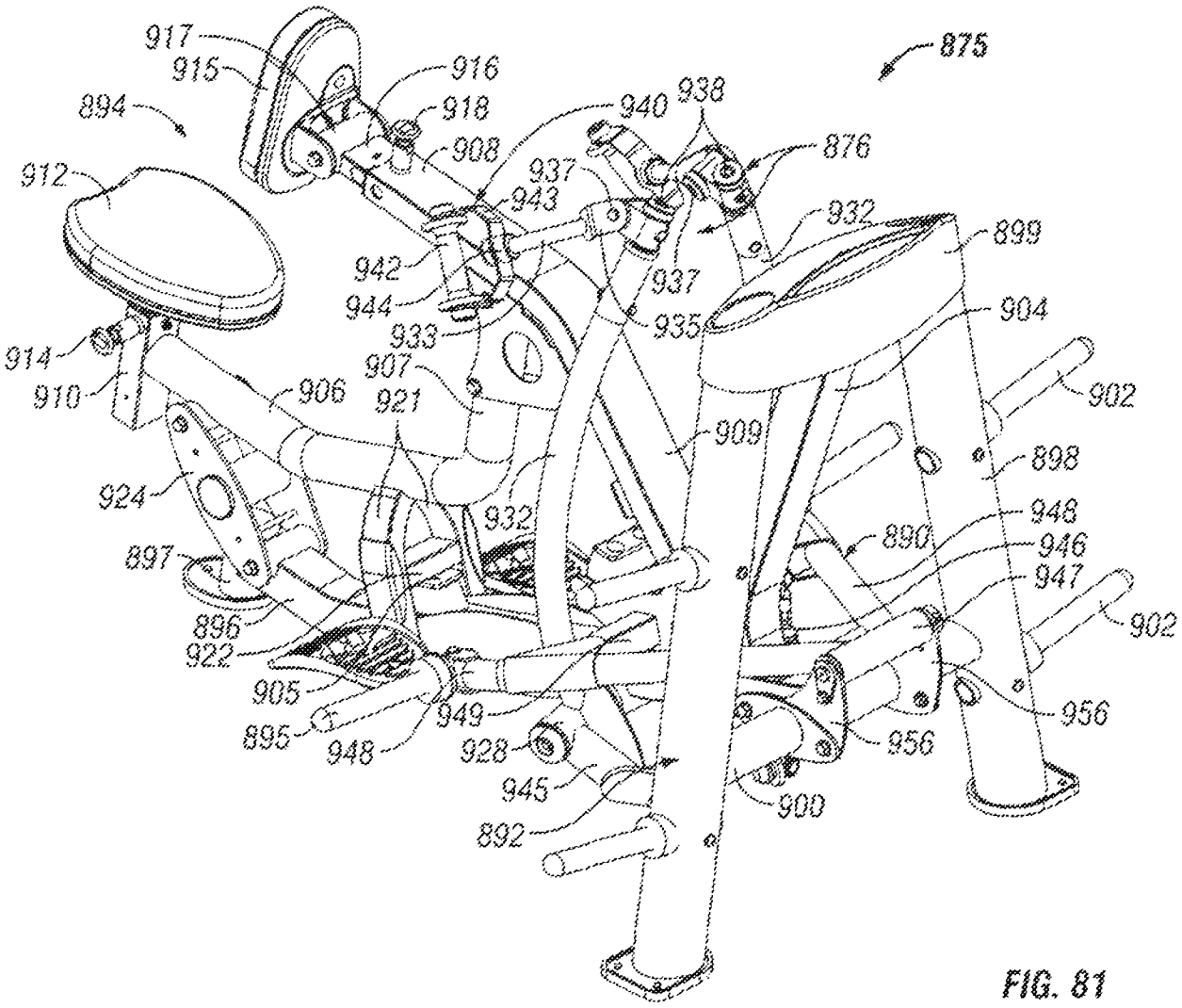
FIG. 81 is a rear perspective view of the machine of FIGS. 79 and 80 in an exercise start position.
Figure 85A:
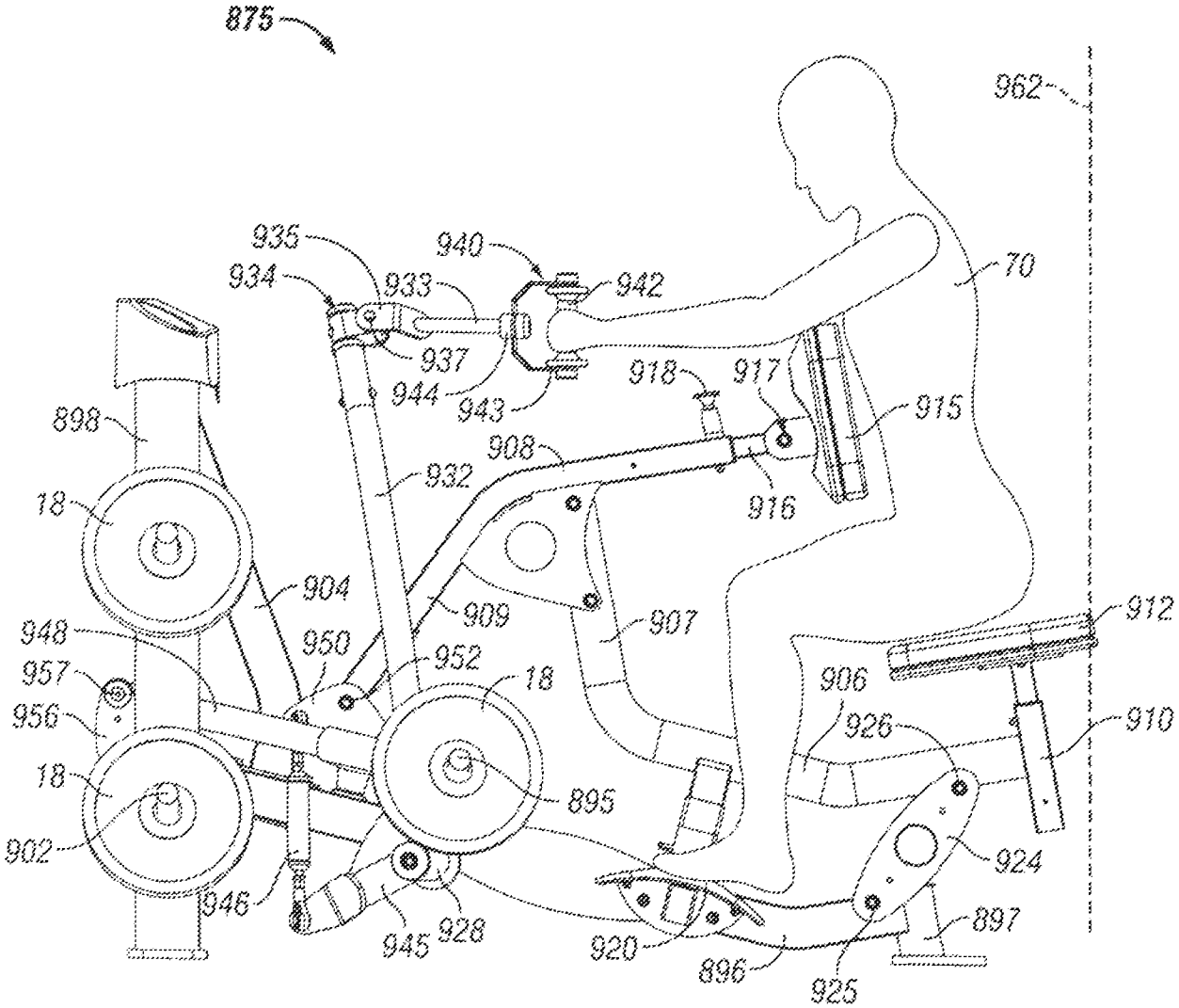
FIG. 85A is a side elevation view of the machine similar to FIG. 84A but illustrating a user seated on the user support in the start position for a mid row exercise.
Figure 85B:
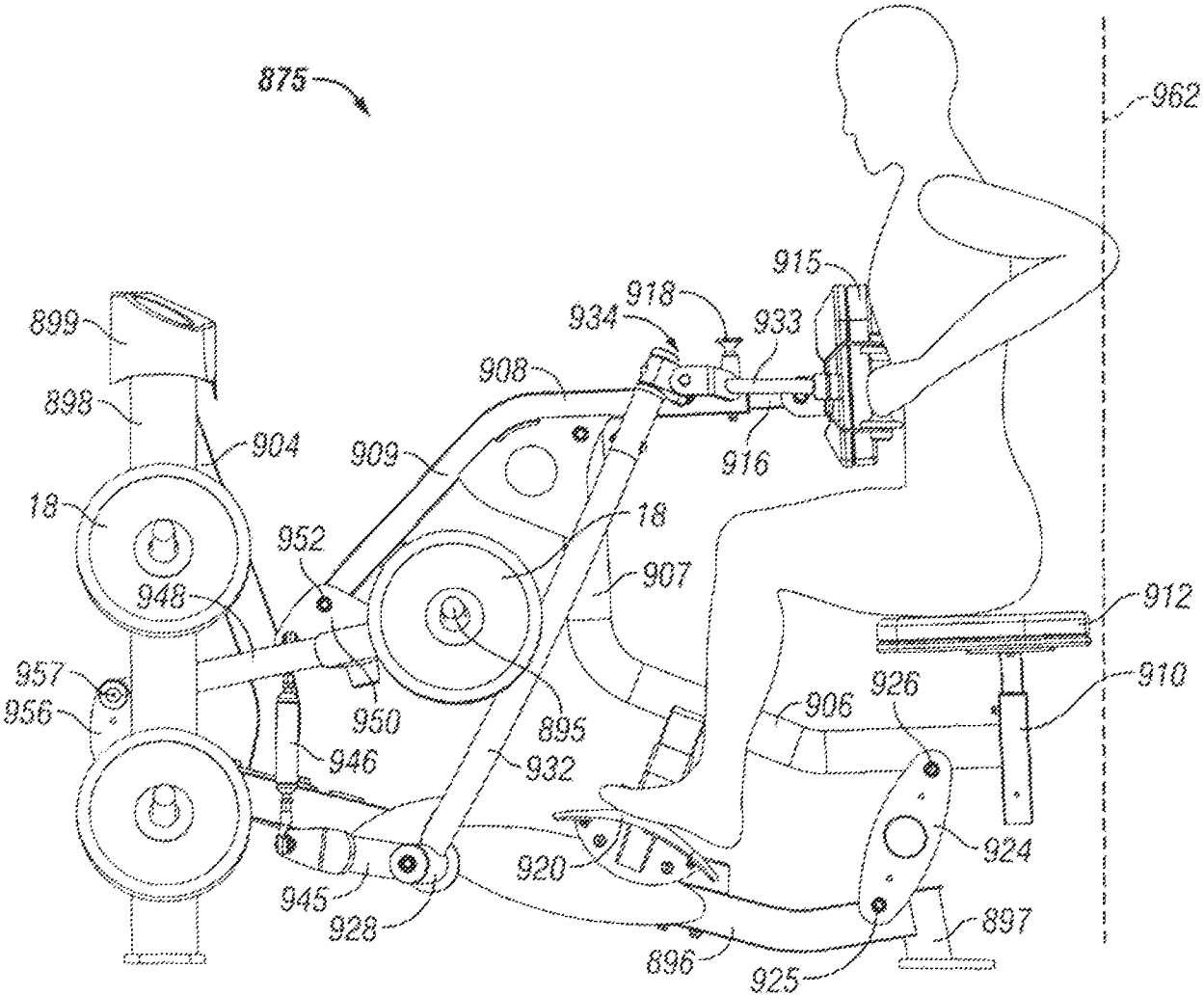
FIG. 85B is a side elevation view of the machine similar to FIG. 84B but illustrating the user seated on the machine at the end position of a mid row exercise.

The user support 894 has base strut 906 having an upwardly inclined end portion 907, and an upper tubular strut 908 extends transversely across the upper end of portion 907. A downwardly inclined end portion 909 of strut 908 is pivotally connected to the lifting arm 890, as described in more detail below. An upright seat supporting tube 910 is secured to the rear end of base strut 906, and a seat pad 912 is adjustably secured in seat supporting tube 910 via seat support post 913 which is telescopically engaged in the open upper end of tube 910. A pull pin 914 engages through aligned openings in tube 910 and post 913 when the seat pad is at the desired height. A chest engaging pad 915 is adjustably secured to the open rear end of upper strut 908 via adjuster post 916 which extends from the pad 915 into telescopic engagement with tubular strut 908, as illustrated in FIGS. 79 to 81. Chest pad 915 is pivotally connected to the adjuster post 916 via pivot connection 917 so that it can self-align to the position of the user's chest during an exercise, as illustrated in FIGS. 85A and 85B. Pull pin 918 allows the extension of pad 915 to be adjusted, and engages through an opening in strut 908 into a selected aligned opening 919 in post 916 to secure the chest pad at the desired position. Foot plates 920 are secured at the lower ends of respective foot plate support struts 921 which extend downward from opposite sides of the base strut 906, and a cross bar 922 between struts 921 engages the stand-off 905 on the main frame base strut 896 in the exercise start position, as best illustrated in FIGS. 79 and 81. The user support is pivotally linked to the main frame by a floating link comprising a pair of pivot link plates 924 pivoted at one end to the main frame base strut 896 at a location in the vicinity of post 897, for rotation about fixed pivot axis 925, and pivoted at the opposite end to the user support base strut 906 beneath seat pad 912 for rotation about floating pivot axis 926. A connecting post 927 extends between the plates 924 at a location between their pivoted ends.

Figure 82:
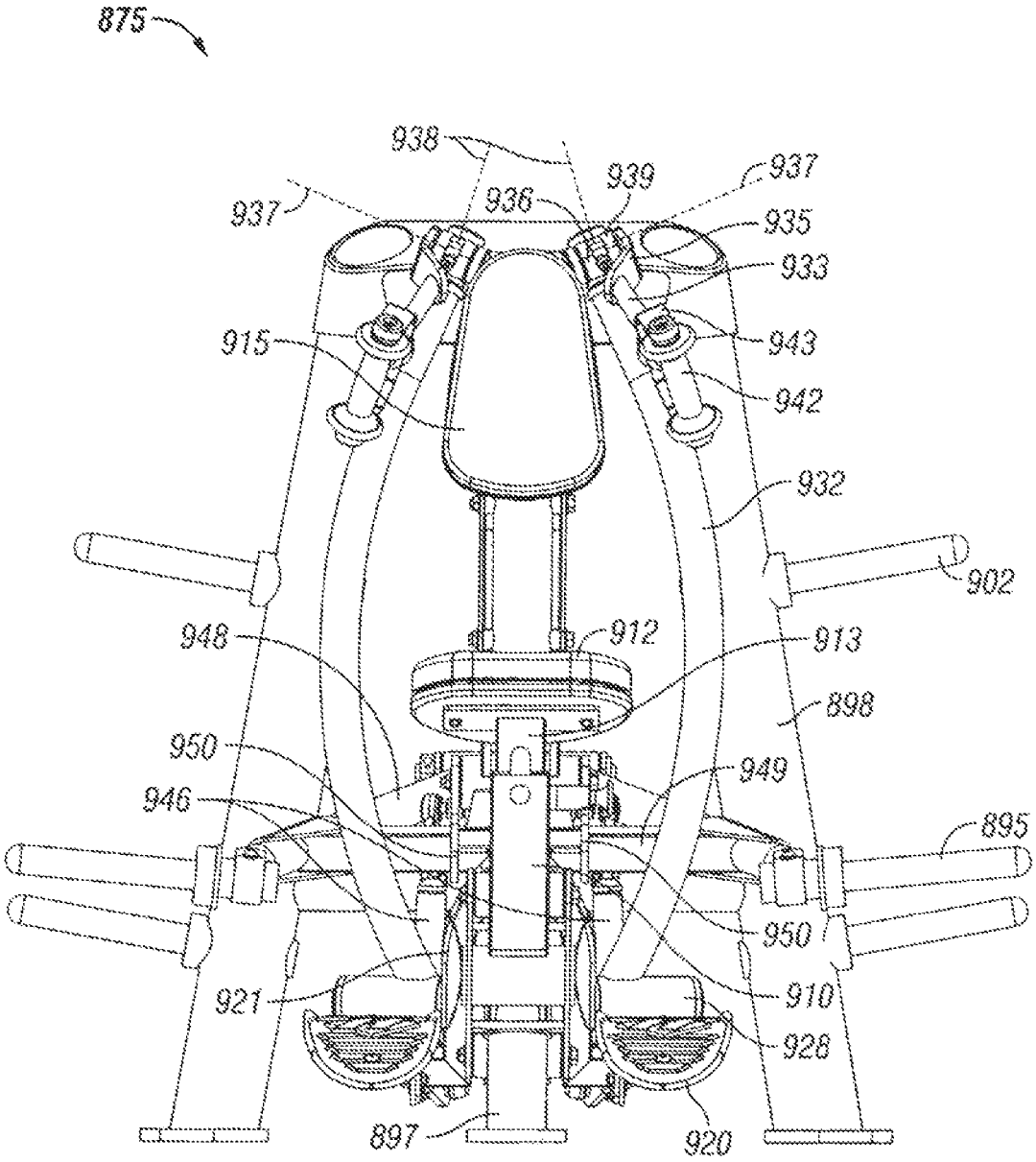
FIG. 82 is a front elevation view of the mid row exercise machine in the start position of FIGS. 78, 80 and 81.
Figure 83:
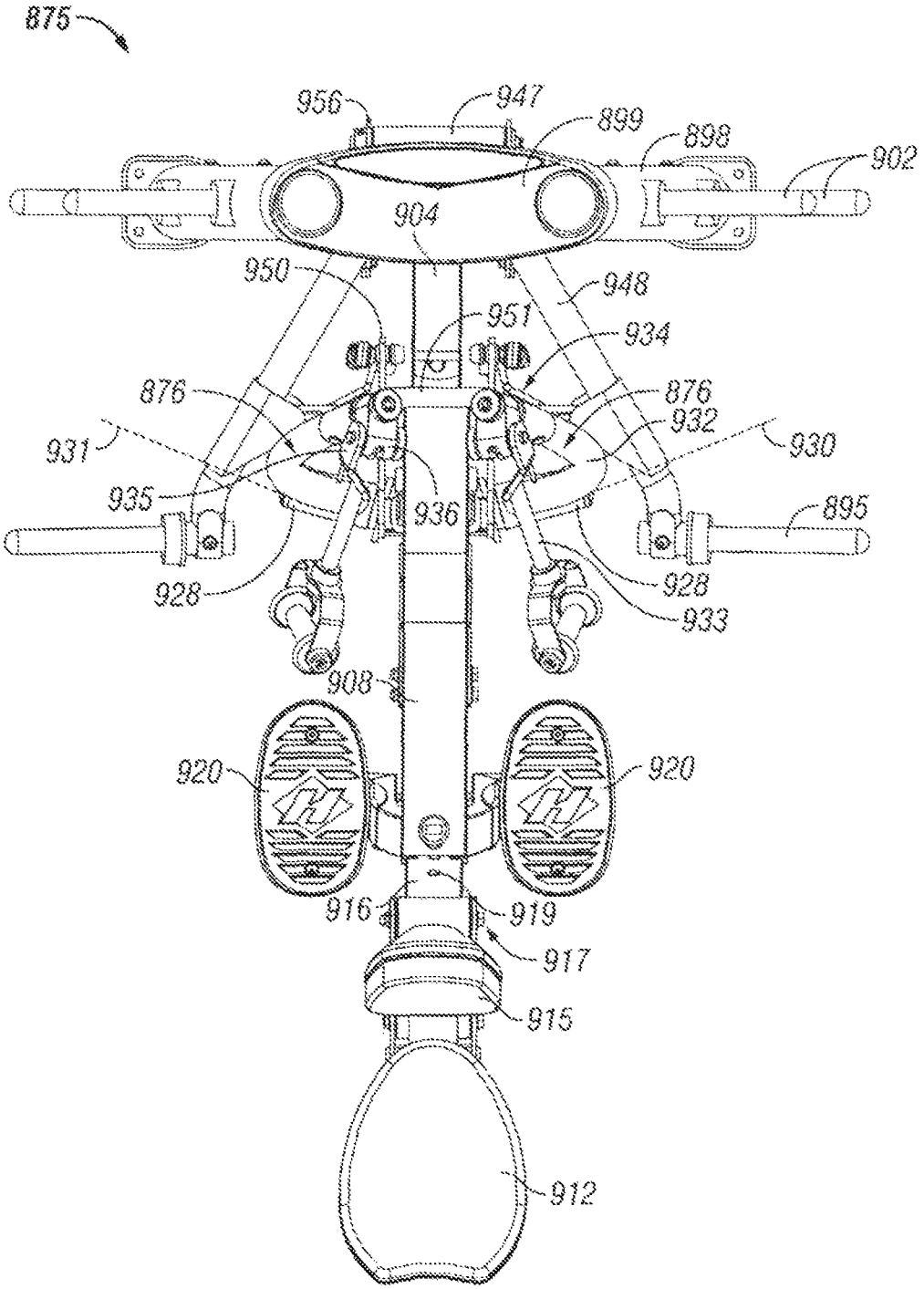
FIG. 83 is a top plan view of the machine in the start position of FIGS. 78 and 80 to 82.
Figure 84A:
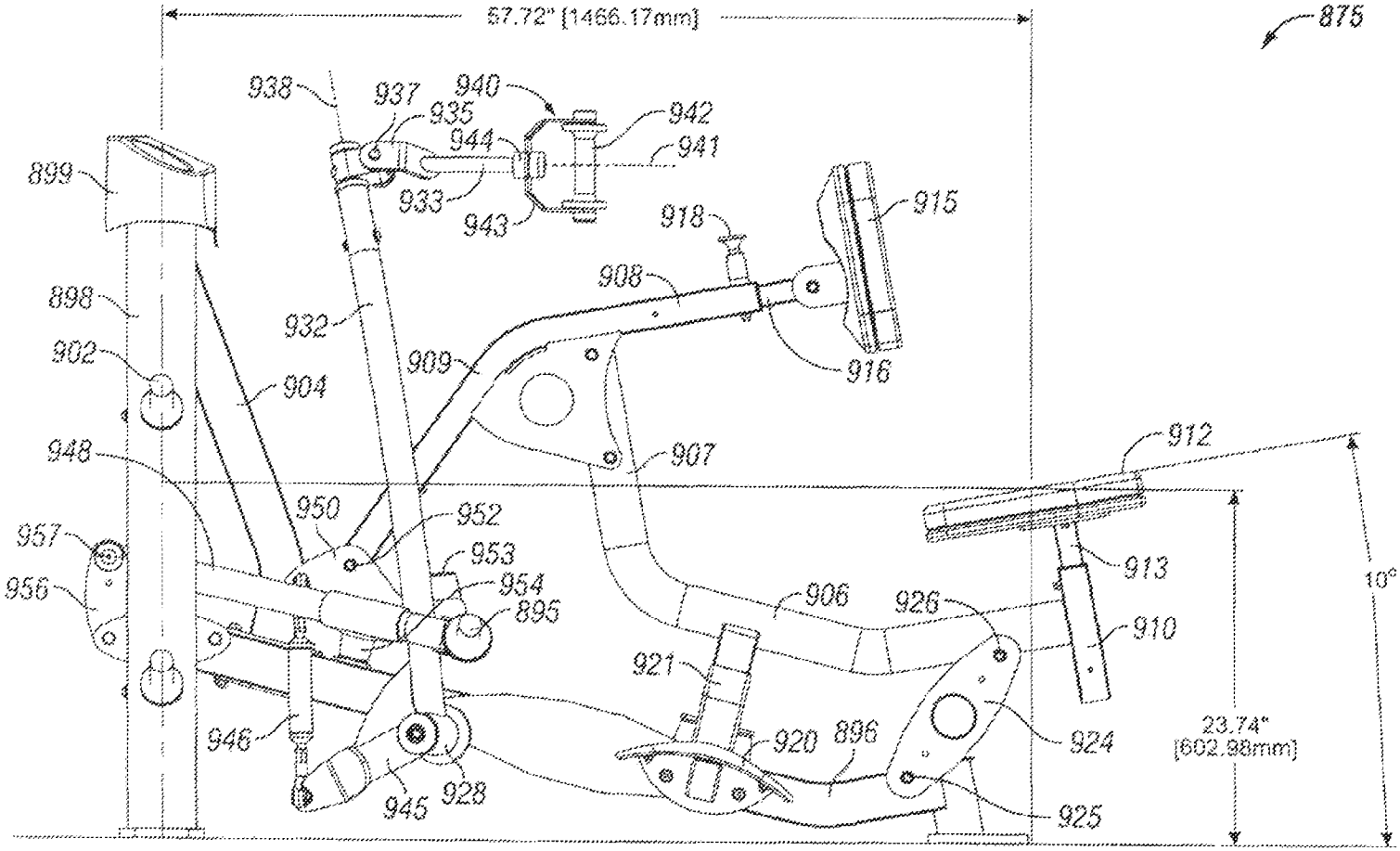
FIG. 84A is a side elevation view of the machine of FIGS. 79 to 83 in the start position for a mid row exercise.

The multi-part, articulating exercise arm assemblies 876 are pivoted to the base of the main frame to extend upwardly on opposite sides of a forward end of the user support in the start position of a mid-row exercise. Each exercise arm assembly is rotatably mounted via a respective pivot sleeve 928 at its lower ends on a pivot mount 929 on a respective side of the base strut 896 of the main frame, as best illustrated in FIGS. 79 and 82. Sleeves 928 are rotatably mounted on rearwardly angled pivot pins extending from the respective pivot mounts 929, producing skewed pivot axes 930, 931 (FIG. 83). Each exercise arm has a first elongate, arcuate main arm 932 having a first or lower end secured to the respective pivot sleeve 928 for rotation about the respective pivot axes 930, 931, and a second end, and an elongated handle arm 933 which has a first end rotatably coupled to the main arm via a multiple pivot joint or swivel joint 934. In the illustrated embodiment, each handle arm 933 has a pivot bracket 935 at its first end which is secured to a pivot pin rotatably engaged in pivot sleeve 936 for rotation about a first pivot axis 937, and the sleeve 936 is rotatably connected to the upper end of the respective main arm 932 for rotation about a second pivot axis 938 transverse to the first pivot axis (see FIGS. 82 and 84A), providing an articulating joint. A pin extending from the pivot pin on bracket 935 engages a slot 939 in sleeve 936 to limit the rotation of the respective handle arms about pivot axis 937 to a predetermined angular range. As illustrated in FIG. 82, each pivot axis 937, 938 of the articulating joint of one exercise arm assembly is skewed or non-parallel to the corresponding pivot axis of the other exercise arm assembly. A user-engaging grip 940 is rotatably mounted on the second end of each handle arm 933 for rotation about a fourth pivot axis 941 (FIG. 84A). Each hand grip 940 comprises a grip member 942 rotatably mounted between the ends of a generally C-shaped mounting bracket 943, for additional adjustment of the user's hand position throughout an exercise. Mounting bracket 943 is rotatably secured to the end of the respective handle arm via pivot sleeve 944 for rotation about the pivot axis 941. The articulating exercise arm assemblies 876 are designed to provide three dimensional movement and automatically align to the hand and arm movement of a user when performing an exercise. The exercise arm assemblies 876 are similar to articulating exercise arm assemblies described in U.S. Pat. No. 7,316,634 of Webber, the contents of which are incorporated herein by reference.

As in several of the previous embodiments, the connecting linkage 878 comprises multiple links between each exercise arm assembly and the user support, the links including lifting arm 890. As best illustrated in FIGS. 80 and 84A, each pivot sleeve 928 at the lower end of the respective main arm 932 has a projecting post or rod 945 which is pivotally secured via a pivot bracket to a first end of a respective first link or tie rod 946 of the connecting linkage, and the second end of each tie rod 946 is pivotally connected to the lifting arm 890, as described in more detail below. The lifting arm 890 is also pivotally connected to the lower end of the downwardly extending portion 909 of upper tube 908 of the user support. Lifting arm 890 has a pivot sleeve 947 at one end and a pair of outwardly diverging rods or bars 948 extends from pivot sleeve 947 towards the user support, as best illustrated in FIGS. 79, 81, and 83. The weight receiving pegs 895 are located at the forward ends of rods 948, and the rods are secured together by a cross bar 949 at a location spaced rearward from weight receiving pins 895. A pair of generally triangular pivot brackets 950 are mounted on cross bar 949 and provide the pivot connection to the forward end of user support 894, via a pivot pin which extends between the brackets 950 and is rotatably engaged in pivot sleeve 951 secured to the lower end of the downwardly projecting portion 909 of user support upper strut 908, for rotation about pivot axis 952. An upwardly facing stop pad or stand-off 953 is secured between the ends of pivot brackets 950 (see FIG. 79) to provide a stop for the exercise arm movement. A second stop pad or stand-off 954 extends down from the center of cross bar 949 to engage a stop plate or pad 955 on the main frame base strut in the rest or start position (see FIGS. 84A and 84B). The upper ends of tie rods 946 are pivoted to a location on brackets 950 which is spaced from the user support pivot, as best illustrated m FIGS. 80, 84A and 84B.

Pivot sleeve 947 at the rear end of lifting arm 890 is rotatably mounted on a pivot pin extending between pivot brackets 956 mounted on the main frame cross bar 900 for rotation about pivot axis 957. As in some of the previous embodiments, this multiple pivot link arrangement (tie rods or first links 946 and lifting arm 890) translates movement of the exercise arms into movement of the user support. At the same time, the lifting arm 890 of the connecting linkage is loaded by weight plate 18 on pegs 895 at the ends of the rods 948 of the lifting arm to provide a selected amount of exercise resistance. In alternative embodiments, the resistance may be provided by a link to selectorized weight stack, or by a bi-directional hydraulic ram or gas shock assembly, as in the embodiment of FIGS. 7 to 10, so that both pushing and pulling exercises can be carried out.

The start position of the moving parts of the mid row exercise machine is illustrated in FIGS. 79, 81 to 83, 84A and 85A, with FIG. 85A illustrating a user 70 positioned on the user support in an exercise ready position. The seat pad 912 in this embodiment starts in a slightly forwardly inclined orientation, at an angle of around 10 degrees to the horizontal, as illustrated in FIG. 84A. In order to perform a mid row exercise, a user 70 sits on the seat pad 912 facing the exercise arm assemblies 876 with their feet engaging foot plates 920, and reaches forward with their arms to grip the hand grips 942 with their chest engaging chest pad 915, as illustrated in FIG. 85A. The height of seat pad 912 and the position of chest pad 915 relative to the seat pad can both be adjusted by the user so as to accommodate different body sizes. From the start position of FIGS. 79, 84A and 85A, the user pulls the handles rearward and outward to end the exercise with their arms bent and their hands positioned on opposite sides of their body, as illustrated in FIG. 85B. This motion is accommodated by the three dimensional pivot movement provided by swivel joints 934 between each handle arm and the respective main arm, and the pivotal attachment of the handles to the ends of the handle arms. Pulling on the exercise arms causes the main arms to rotate towards the user about pivot axes 930, 931, respectively, rotating posts 945 upward, which in turn pushes links or tie rods 946 upward, which pushes the lifting arm 890 upwards so that it pivots about pivot axis 957, lifting the weight plates 18 at the opposite end of arms or rods 948, as seen in FIG. 85B. This movement also pushes the forward end of the user support upwards, lifting and rotating the user support via the multiple pivot linkage of the lifting arm and floating link 924. The chest pad 915 provides a secondary support for the user during the exercise, and pivots via pivot connection 917 during the exercise to self-align to the user's chest movement.

Figure 84B:
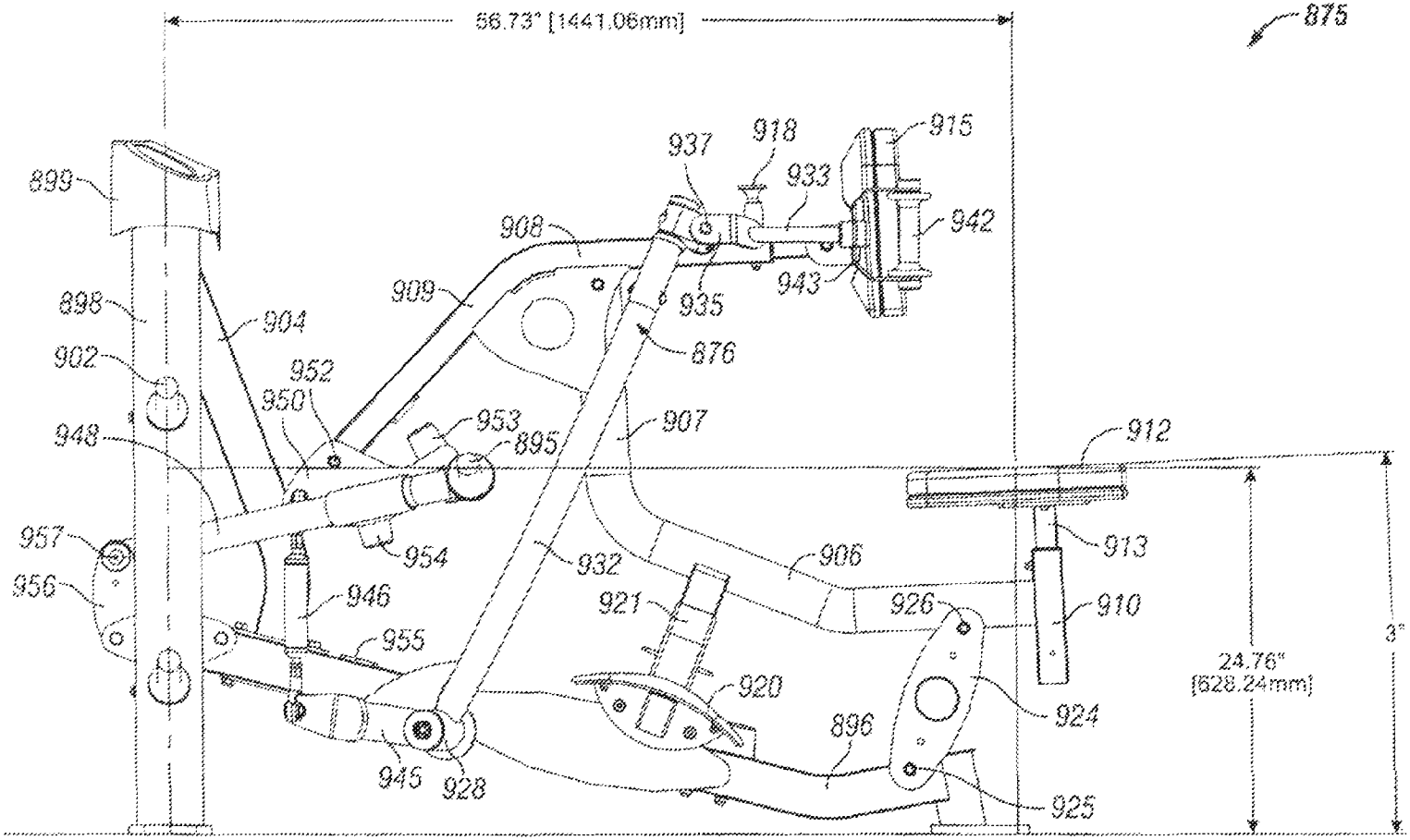
FIG. 84B is a side elevation view of the machine similar to FIG. 84A but illustrating the end position of a mid row exercise.

As illustrated by the dimensions marked in FIGS. 84A and 84B, the user support 894, and thus a user seated on the user support, move both upward and forward between the start and end positions of the exercise. The upward motion is around one inch, and the forward motion is also around one inch, as can be seen by comparing the start and end dimensions shown on these drawings. At the same time, seat pad 912 rotates through an angle of around seven degrees, starting at an inclination of ten degrees to the horizontal and ending at an inclination of around three degrees to the horizontal orientation in the illustrated embodiment.

Figure 86:
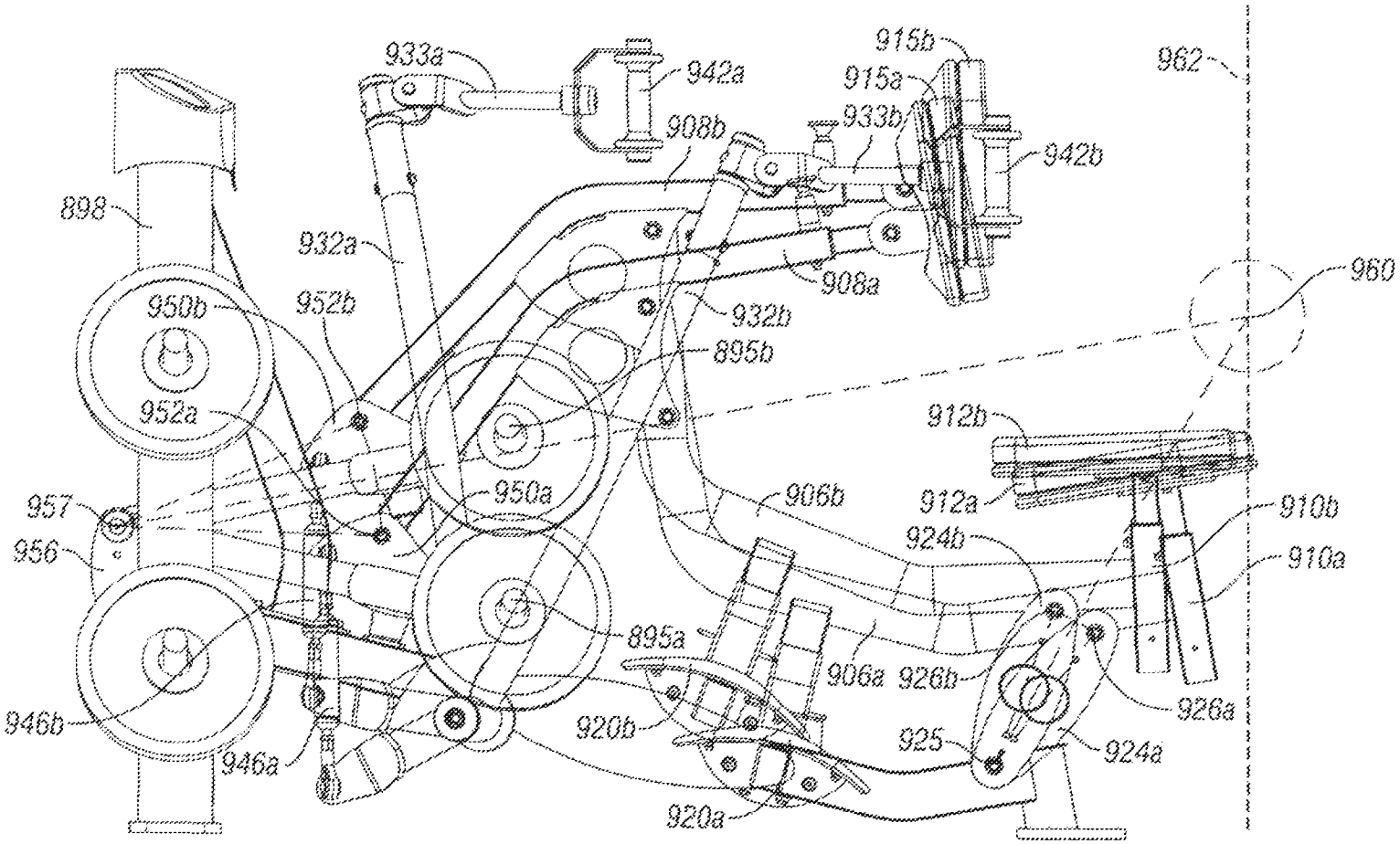
FIG. 86 illustrates the start and end positions of FIGS. 84A and 84B superimposed, showing the location of the theoretical pivot axis of the user support pivotal movement.

In this embodiment, the user support is pivotally mounted on the main frame via a multiple pivot linkage comprising the lifting arm 890 which is pivoted to the main frame and pivoted to the forward end of the user support at pivot axis 952, and the floating pivot link 924 between the base strut of the main frame and the base strut 906 of the user support. FIG. 86 superimposes the start and finish positions of the machine, with start positions of the various moving components indicated by the letter A following the reference number, and end positions indicated by the letter B following the reference number. FIG. 86 also illustrates the theoretical pivot axis 960 of the user support's pivotal motion, calculated using the start and end positions of each of the moving or floating user support pivot axes 952 and 926. In this embodiment, the vertical gravitational center line 962 of the pivotal motion is located to the rear of the user throughout the exercise, with most of the user and user support spaced forward from the center line 962 throughout the exercise.

FIGS. 87 to 94 illustrate a biceps curl exercise machine 970 according to another embodiment. As in each of the previous embodiments, the machine 970 has a stationary main frame 971 and a pivotally mounted user support 972. The user engagement device comprises independent exercise arms 974 which are pivotally mounted on the user support 972. A lifting arm 975 similar to the lifting arms in the previous two embodiments is pivotally mounted on the main frame 971 and linked to both the user support and the exercise arms, as explained in more detail below. In this embodiment, the main frame 971 is similar to the main frame of the previous embodiment (FIGS. 79 to 86) and like reference numbers are used for like parts as appropriate. As noted above, lifting arm 975 is also similar to lifting arm 890 of the previous embodiment, and like reference numbers are also used for like parts of the lifting arms 890 and 975.

Main frame 971 has an upwardly inclined base strut 976 with a short, ground engaging post 977 at its forward end, and an upright A-frame section secured at the rear end of base strut comprising a pair of inwardly inclined uprights 898 connected by an upper cross member 899 and a cross bar 900 spaced between the upper and lower ends of uprights 898. As in the previous embodiment, weight storage pegs 902 are provided on the A-frame uprights. Rearwardly inclined upright strut 904 extends from an intermediate location on base strut 976 to the A-frame upper cross member 899.

The user support 972 has base strut 978 which is pivotally connected to the lifting arm 975 at its forward end and has a seat support tube 979 at its rear end on which a seat pad 980 is adjustably mounted in a similar manner to the seat pad of the previous embodiment. An upright strut 981 (FIG. 89, 90, 92A) having a rearwardly inclined upper portion 982 extends upwardly from an intermediate position on the base strut 978, and an arcuate padded support 983 is secured around a cross bar 984 which extends across the rear end of upper portion 982, so as to face a user seated on the seat pad 980. Opposite ends of the cross bar 984 project out from opposite ends of padded support 983, and are bent forwards at their ends to terminate in pivot sleeves 990 for connection to the exercise arms, as discussed in more detail below. Foot support plates 985 are secured on opposite sides of the user support by means of support bars 986 which depend downwardly from opposite sides of base strut 978. The user support is pivotally linked to the main frame by a floating link comprising a pair of pivot link plates 987 pivoted at one end to the main frame base strut 976 at a location spaced from rear end post 977, for rotation about a fixed pivot axis 988, and pivoted at the opposite end to the user support base strut 978 beneath a forward portion of seat pad 980 for rotation about a floating pivot axis 989.

Each independent exercise arm 974 is rotatably mounted at its end via a pivot pin 1010 which is rotatably engaged in a pivot sleeve 990 at the end of cross bar 984 on a respective side of the padded arm support 983 for rotation about pivot axis 991, as best illustrated in FIGS. 88, 89, 90 and 92A. A round earn or pulley 1024 is also secured on each pivot pin 1010 so as to rotate with the respective exercise arm. The exercise arms each have an inwardly bent end portion 992 (FIG. 90), and a handle or user engaging grip 993 is pivotally mounted on each end portion 992 via a pivot sleeve 994 secured transversely across the end of the respective handle. Pivot sleeve 994 is rotatably engaged on a pivot pin at the end of end portion 992 for rotation about pivot axis 995 (see FIG. 90). A post extending radially from the pivot pin engages in a slot 996 in the sleeve 994 to limit rotation of handles or grips 993 to a predetermined angular range.

Figure 87:
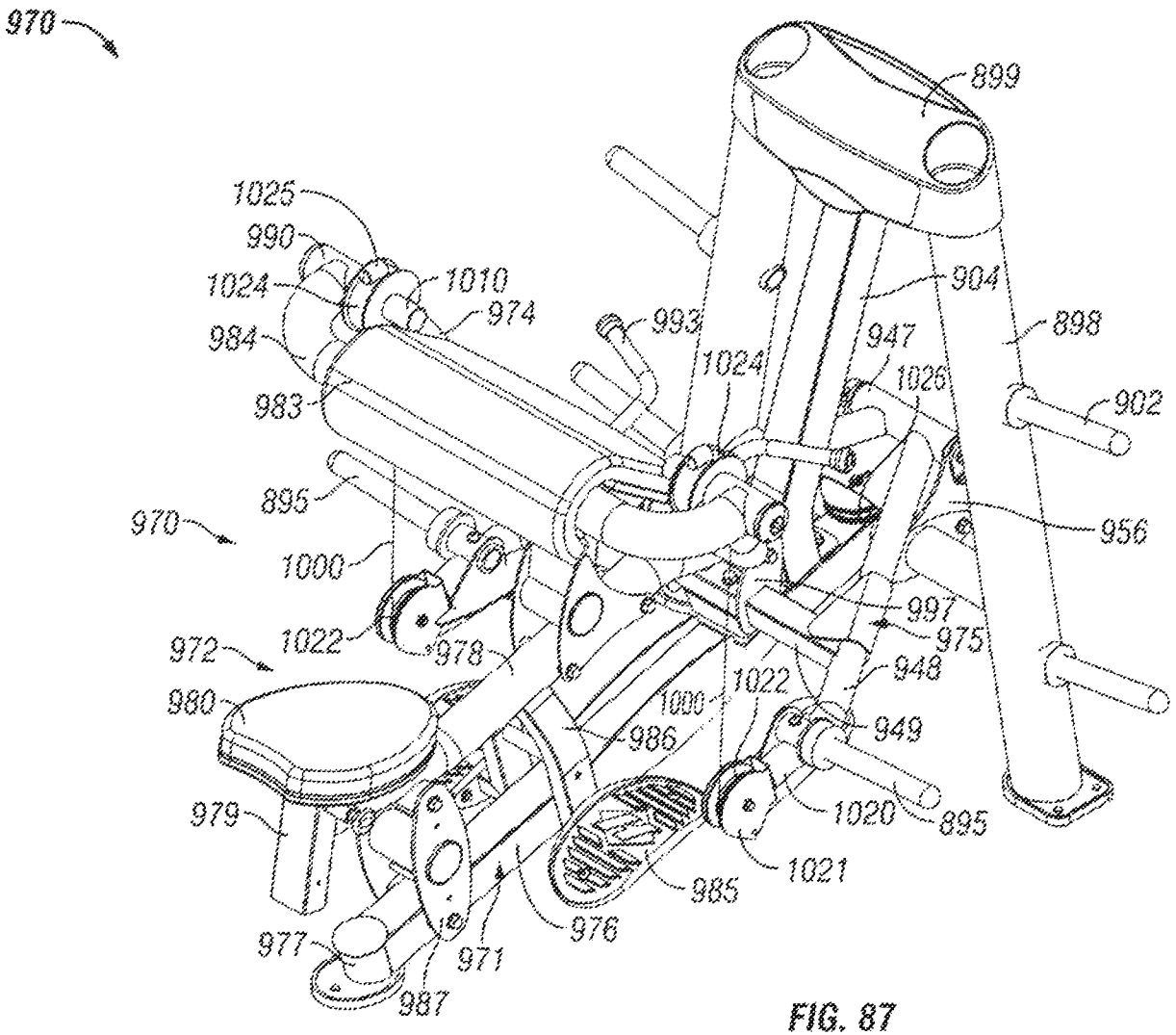
FIG. 87 is a front perspective view of a biceps curl exercise machine according to another embodiment, in the start position of a biceps curl exercise.
Figure 88:
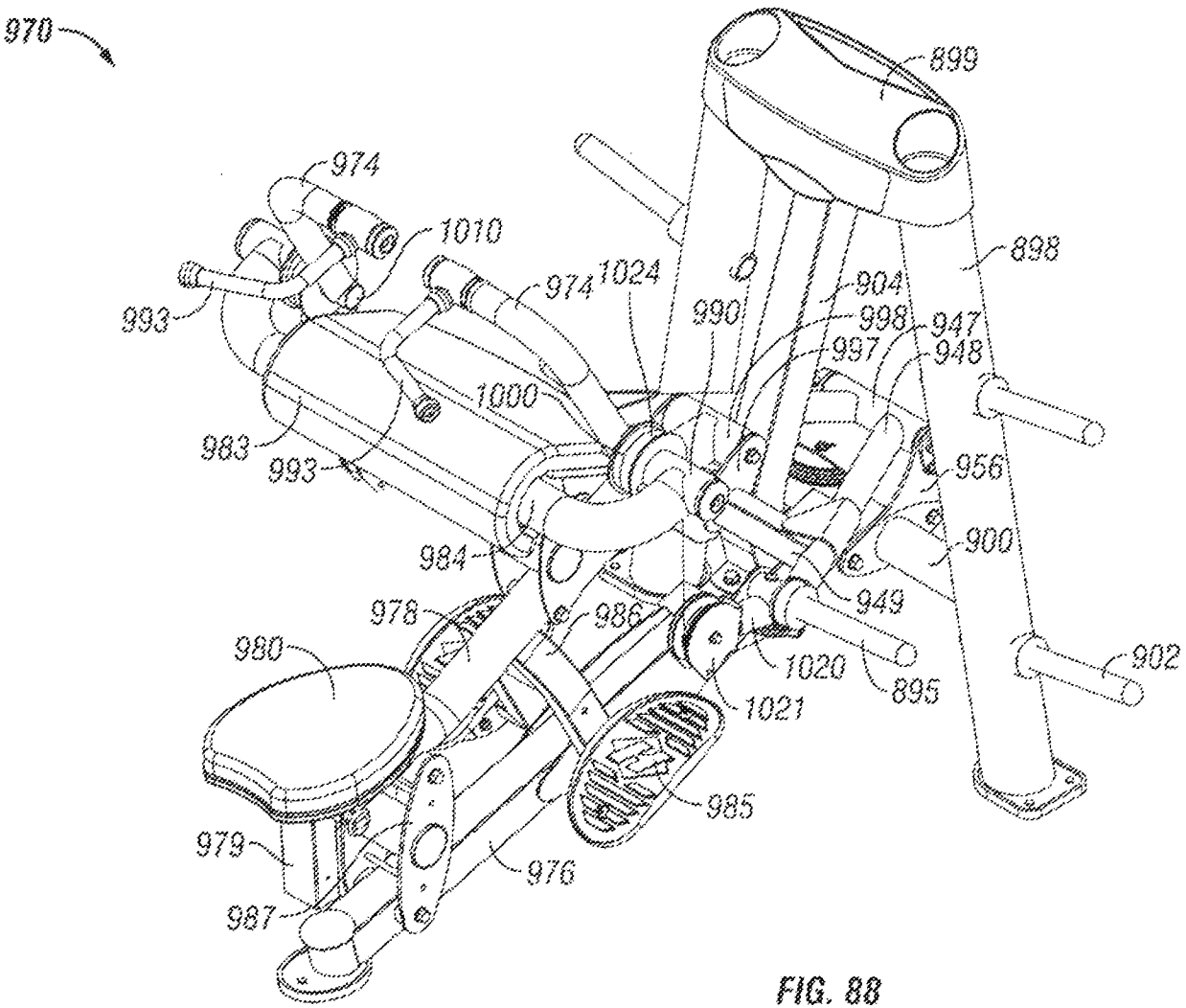
FIG. 88 is a front perspective view similar to FIG. 87, illustrating the end position of a biceps curl exercise.
Figure 89:
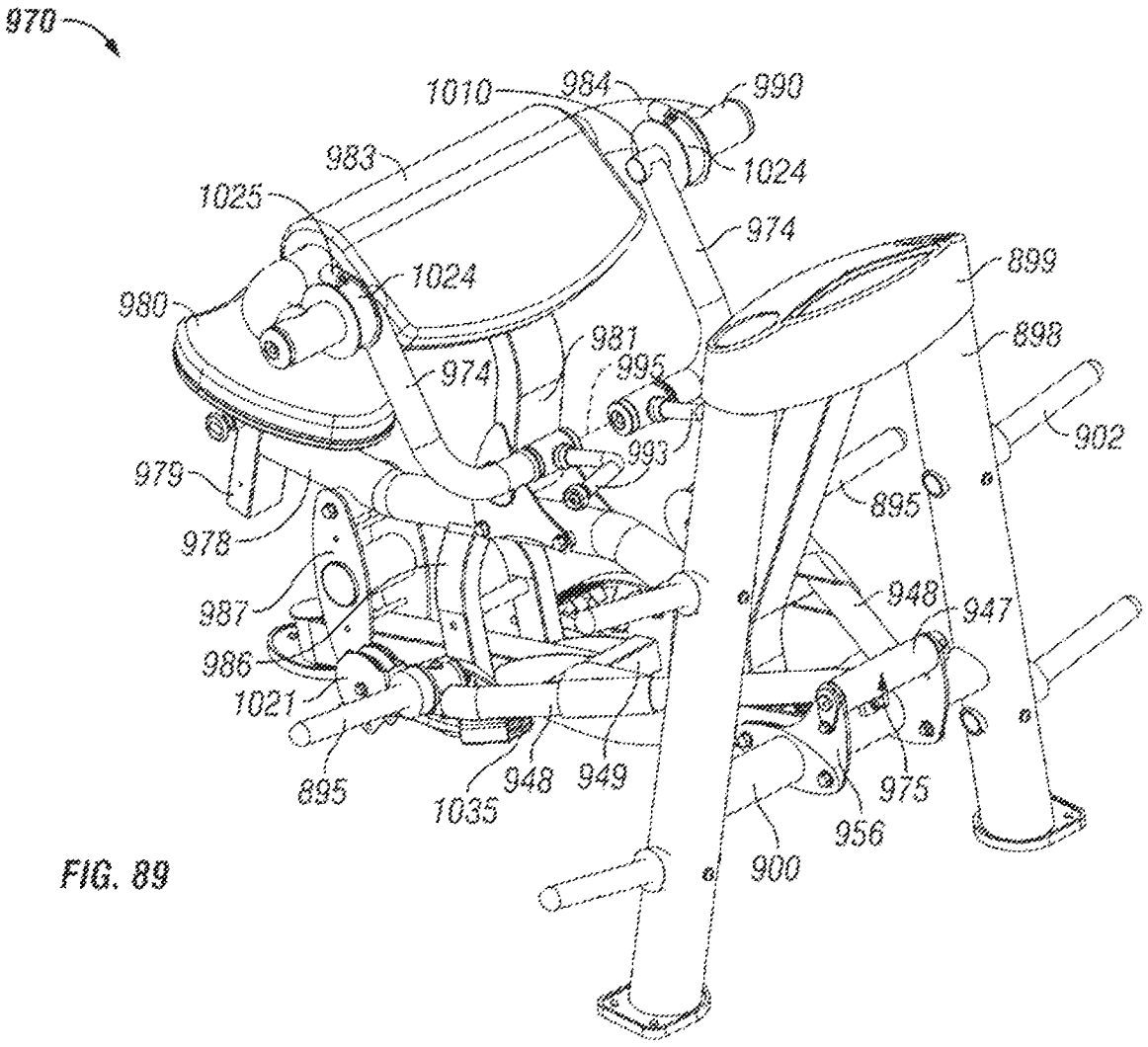
FIG. 89 is a rear perspective view of the machine of FIGS. 87 and 88 in an exercise start position.
Figure 90:
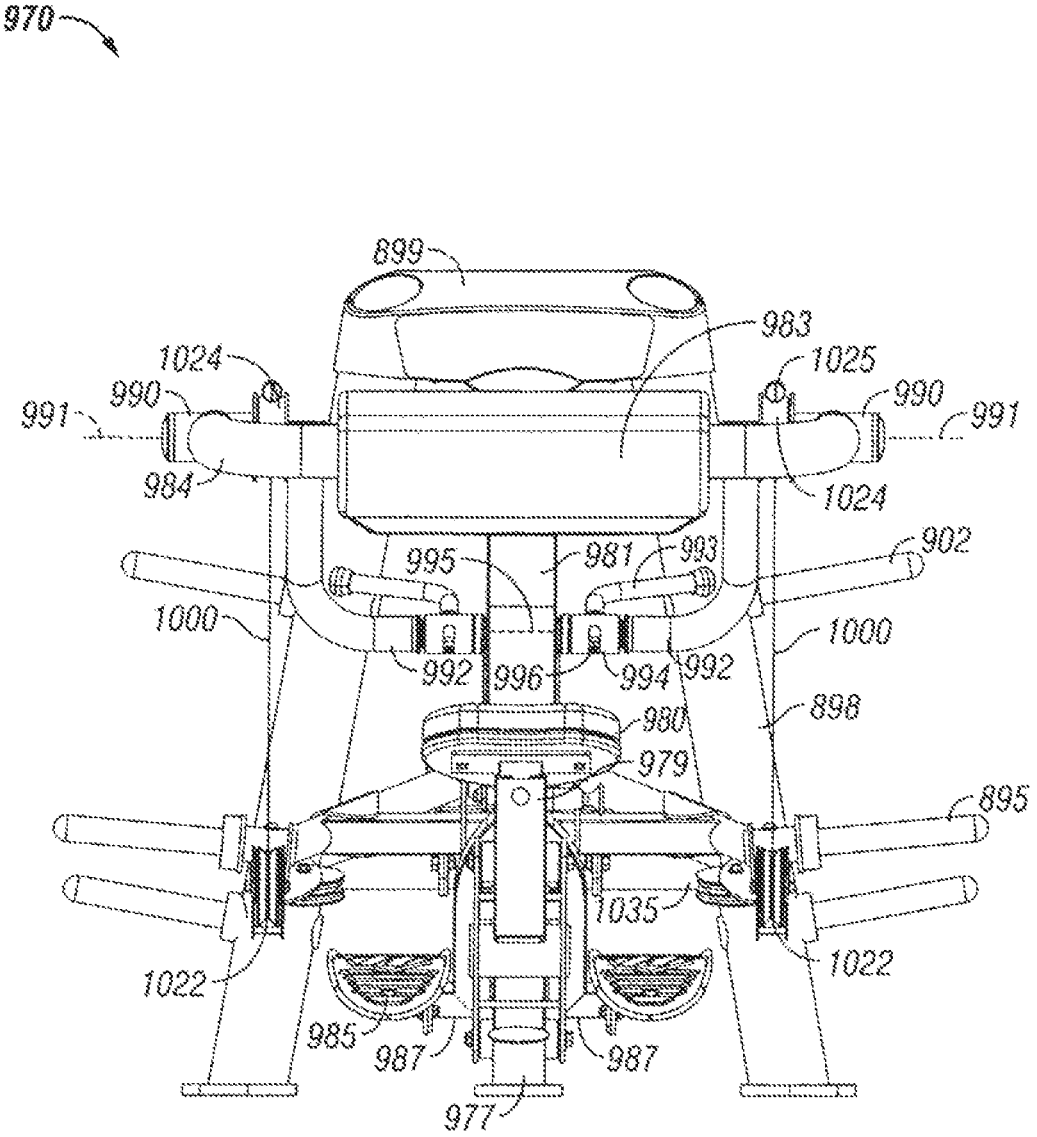
FIG. 90 is a front elevation view of the biceps curl exercise machine in the start position of FIGS. 87 and 89.
Figure 91:
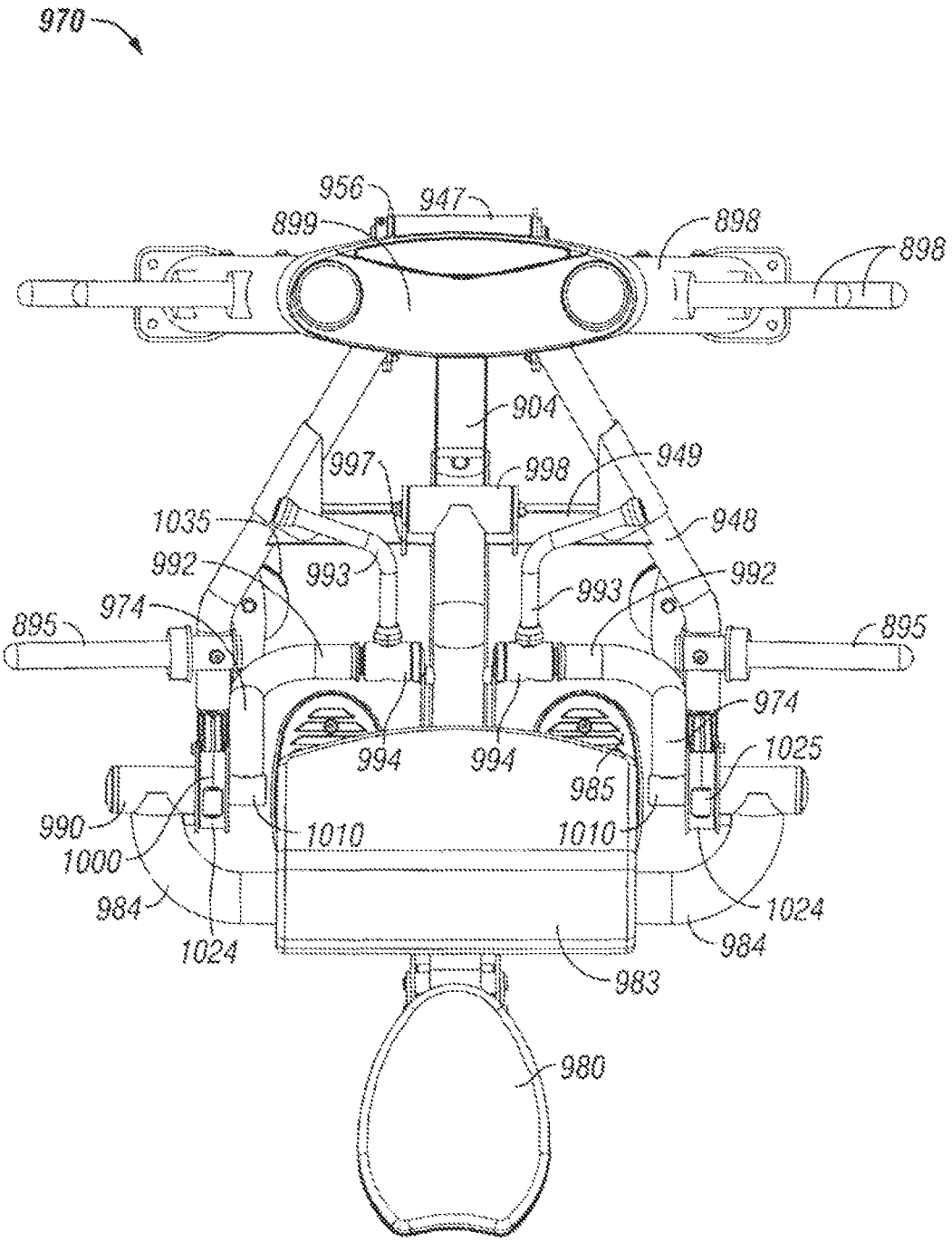
FIG. 91 is a top plan view of the machine in the start position of FIGS. 87, 89 and 90.

As in the previous embodiment, lifting arm 975 has a pivot sleeve 947 at one end and a pair of outwardly diverging rods or bars 948 extends from pivot sleeve 947 towards the user support, as best illustrated in FIGS. 87 to 89 and 91. The weight receiving pegs 895 are located the ends of rods 948, and the rods are secured together by a cross bar 949 at a location spaced rearward from weight receiving pins 895. Each rod 948 also has an extension 1020 at its end, and a pulley housing 1021 mounted at the end of extension 1020 supports a rotatably mounted pulley 1022. A pair of pivot brackets 997 are mounted on cross bar 949 and provide the pivot connection to the forward end of user support 972, via a pivot pin which extends between the brackets 997 and is rotatably engaged in pivot sleeve 998 secured to the forward end of the user support base strut 978, for rotation about pivot axis 999 (see FIGS. 88, 91, and 92A). The exercise arms 974 in this embodiment are each linked to the lifting arm 975 via a flexible line or cable 1000. Cable 1000 has a first end anchored to anchor 1025 on pulley 1024 secured to the respective pivot pin 1010 at the end of one of the exercise arms 974 so as to rotate with the exercise arm, and extends from pulley 1024 around pulley 1022 at the end of the associated lifting arm rod 948 positioned beneath pulley 1024, as best illustrated in FIGS. 87, 90, 91, 92A and 92B. The cable 1000 extends from pulley 1024 around a pulley 1035 (FIGS. 89, 90) secured under lifting arm rod 948, and around a pulley 1026 secured in the center of the lifting arm behind pivot sleeve 947 between the ends of the two lifting arm rods, as best illustrated in FIGS. 87 and 88. From pulley 1026, the cable extends around a second pulley 1035 under the second lifting arm rod 948, around the pulley 1022 at the end of the second rod 948 then upwardly to connect to anchor 1025 on the second pulley 1024 on the second exercise arm. Thus, pulling one or both exercise arms 974 from the start position of FIG. 92A to the end position of FIG. 92B rotates the cable 1000 onto the respective pulley or pulleys 1024, pulling the cable up and simultaneously raising the lifting arm 948 to rotate upwardly about pivot axis 957.

Figure 92A:
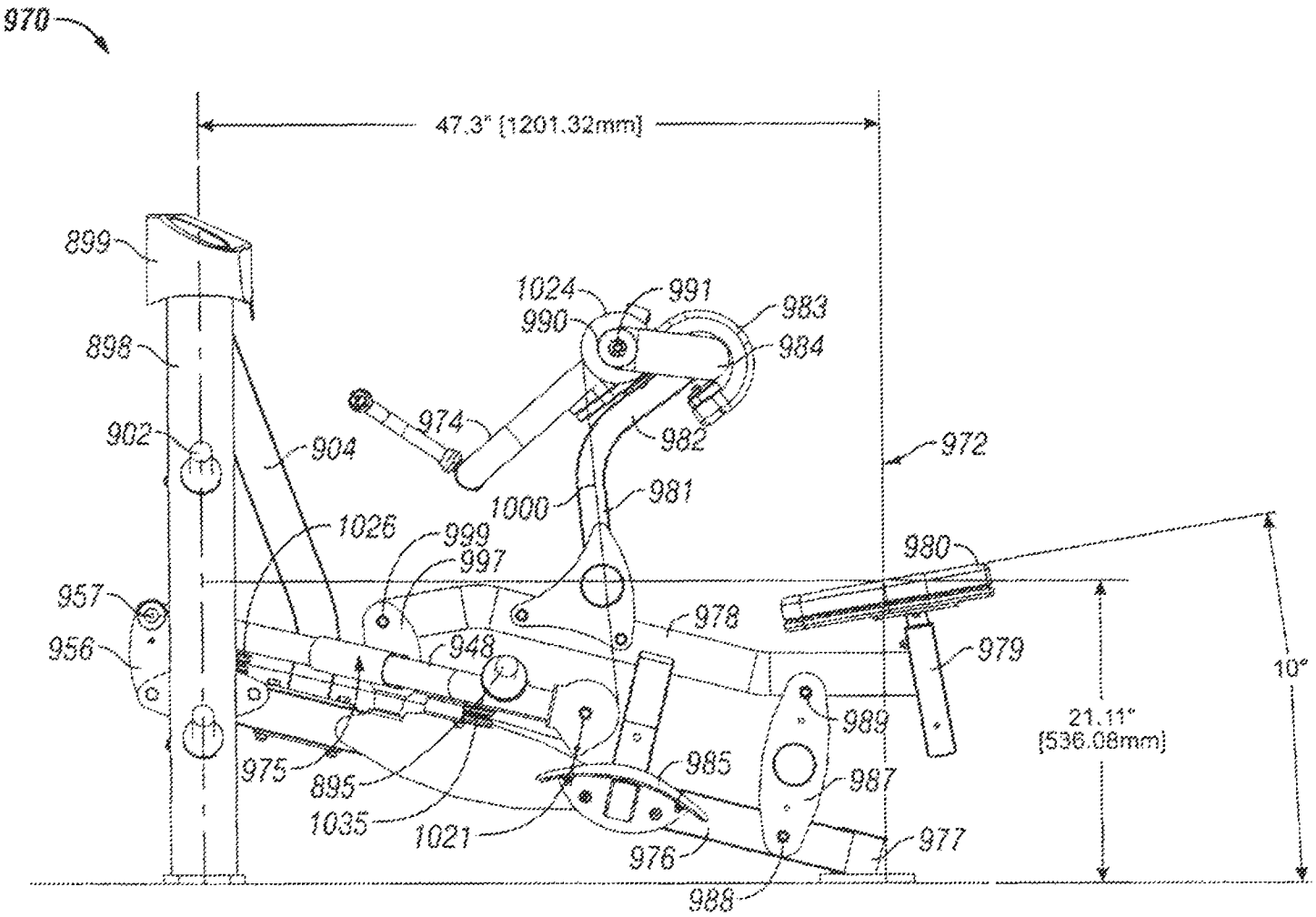
FIG. 92A is a side elevation view of the machine of FIGS. 87 to 91 in the start position for a biceps curl exercise.
Figure 93A:
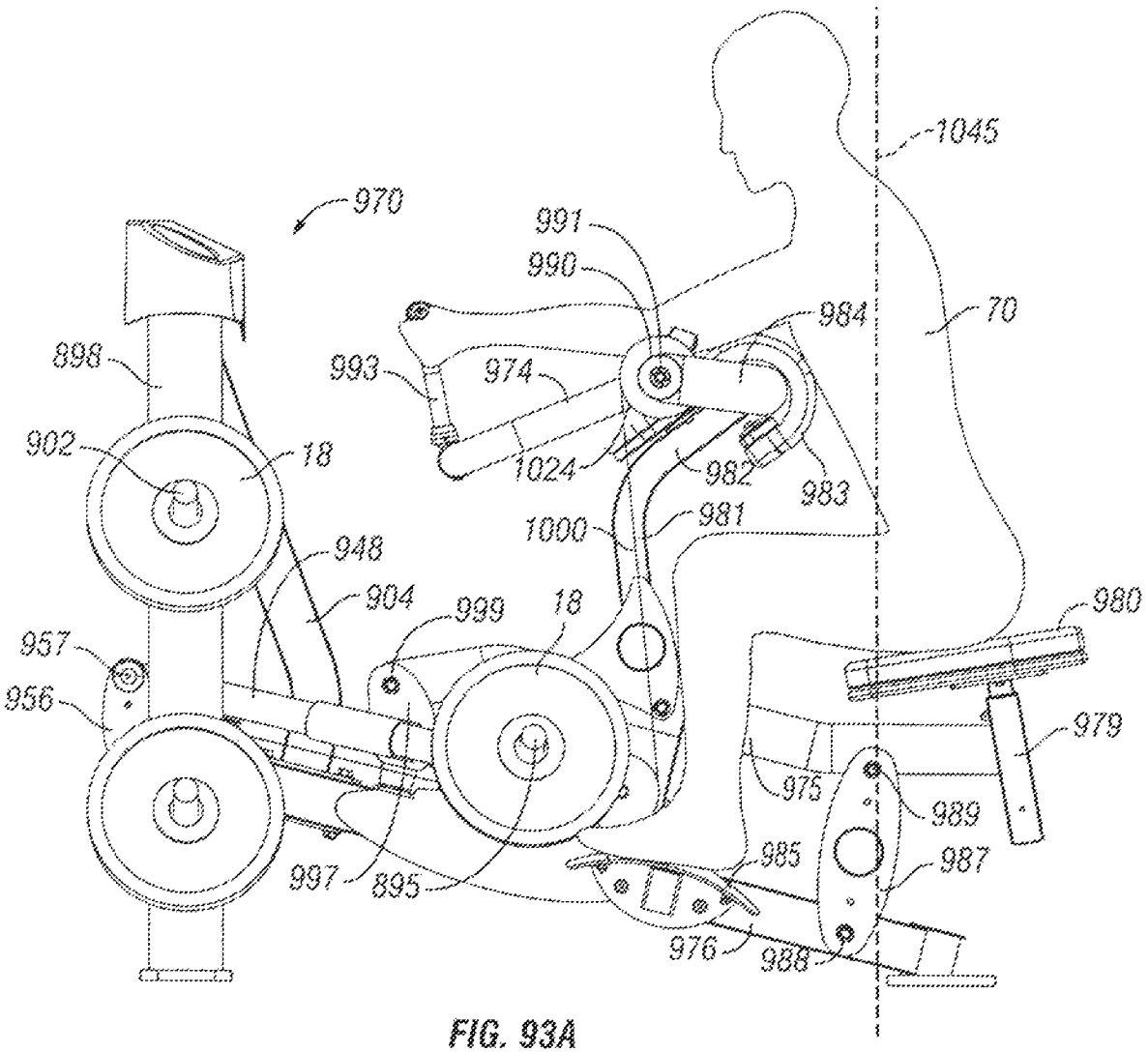
FIG. 93A is a side elevation view of the machine similar to FIG. 92A but illustrating a user seated on the user support in the start position for a biceps curl exercise.
Figure 93B:
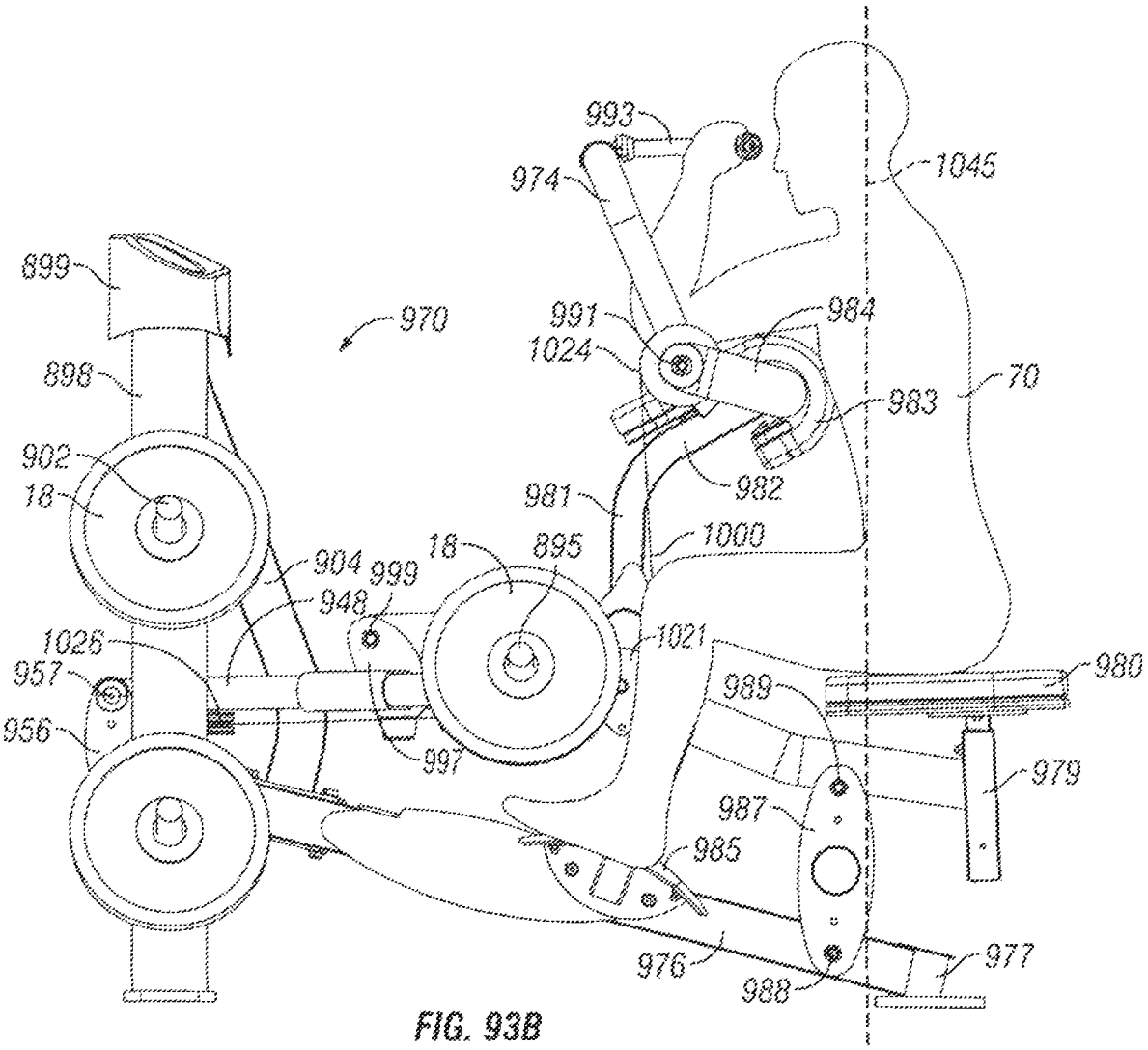
FIG. 93B is a side elevation view of the machine similar to FIG. 92B but illustrating the user seated on the machine at the end position of a biceps curl exercise.

FIGS. 87, 89 to 91, 92A and 93A illustrate the start position for a biceps curl exercise, with FIG. 93A illustrating the user seated on the seat pad 980 with their feet engaging foot plates 985. In the exercise start position, the seat pad 980 is at a slight forward inclination of around 10 degrees to horizontal. The user can opt to exercise both arms simultaneously, or alternating arms by pulling up only one of the exercise arms. Prior to starting an exercise, the user may place one or more weight plates 18 on the oppositely directed pegs 895 on the lifting arm 975. Once seated on the seat pad 980, the user leans forward to engage their chest against the padded support 983, and rests their upper arm and elbow on the upper portion of padded support 983, while extending their forearm forward and engaging one or both of the hand grips 993 with their palms facing upward, as illustrated in FIG. 93A. They then rotate their forearm upward about the elbow in a biceps curl movement, pulling the hand grips 993, along with the exercise arms 974, upwards and rearwards into the end position of FIG. 93B, ending with their arms bent upwards and their hands facing rearward. This in turn rotates the hand grips about pivot axis 995 and rotates each exercise arm 974 upward about pivot axis 991. This movement also rotates the pulleys 1024 to which the upper ends of cables 1000 are anchored, pulling up the cables and thus also pulling up the ends of lifting arm rods 948. This in turn rotates the lifting arm upward about pivot axis 957, lifting the weights mounted on the weight support pegs 895, and pushes up the forward end of the user support. The user support pivots about the multiple pivot linkage formed by the first pivot link 987 and the second pivot link formed by the lifting arm 975.

Figure 94:
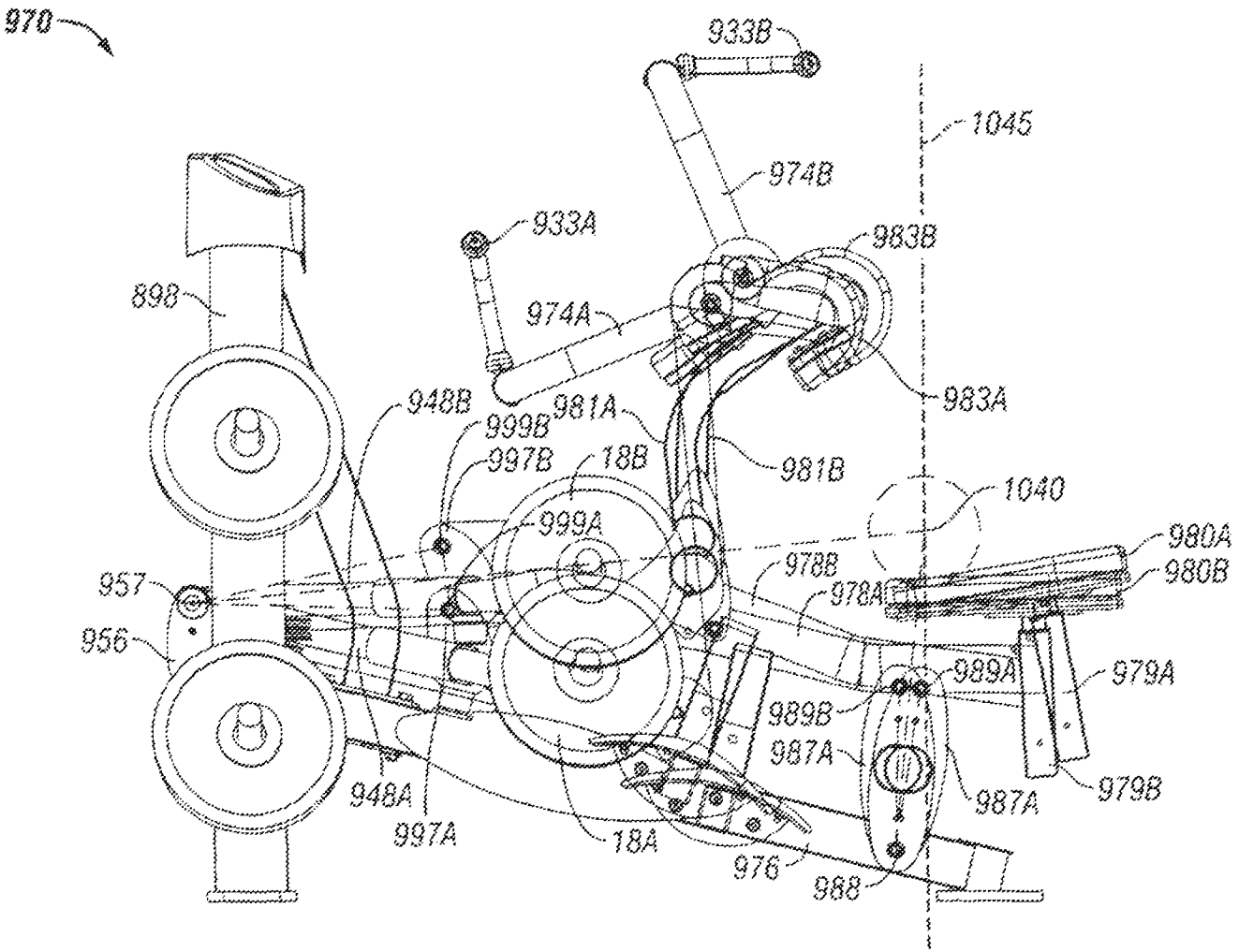
FIG. 94 illustrates the start and end positions of FIGS. 92A and 92B superimposed, showing the location of the theoretical pivot axis of the user support pivotal movement in the biceps curl machine of FIGS. 87 to 93.

In this embodiment, the user support 972 is pivotally mounted on the main frame via a multiple pivot linkage comprising the lifting arm 975 pivoted to the forward end of the user support at a first floating pivot axis 999 and the floating pivot link 987 between the base strut of the main frame and the base strut 978 of the user support, which is pivoted to the user support base strut at a second floating pivot axis 989. FIG. 94 superimposes the start and finish positions of the machine, with start positions of the various moving components indicated by the letter A following the reference number, and end positions indicated by the letter B following the reference number. FIG. 94 also illustrates the theoretical pivot axis 1040 of the user support's pivotal motion, calculated using the start and end positions of each of the moving or floating user support pivot axes 999 and 989. In this embodiment, the vertical gravitational center line 1045 of the pivotal motion extends through the user support (and part of a user's body when seated on the user support) in both the exercise start and finish positions. As in some previous embodiments, the amount of weight positioned on each side of centerline 1045 various only slightly from the start to the finish position. The combined weight of the user and user support has little effect on the amount of starting resistance because a substantially equal amount of weight is balanced rearward of the user support pivot. By the same token, because only a small portion of the user passes through the gravitational centerline during the exercise, there is no appreciable drop-off in resistance felt by the user.

Figure 92B:
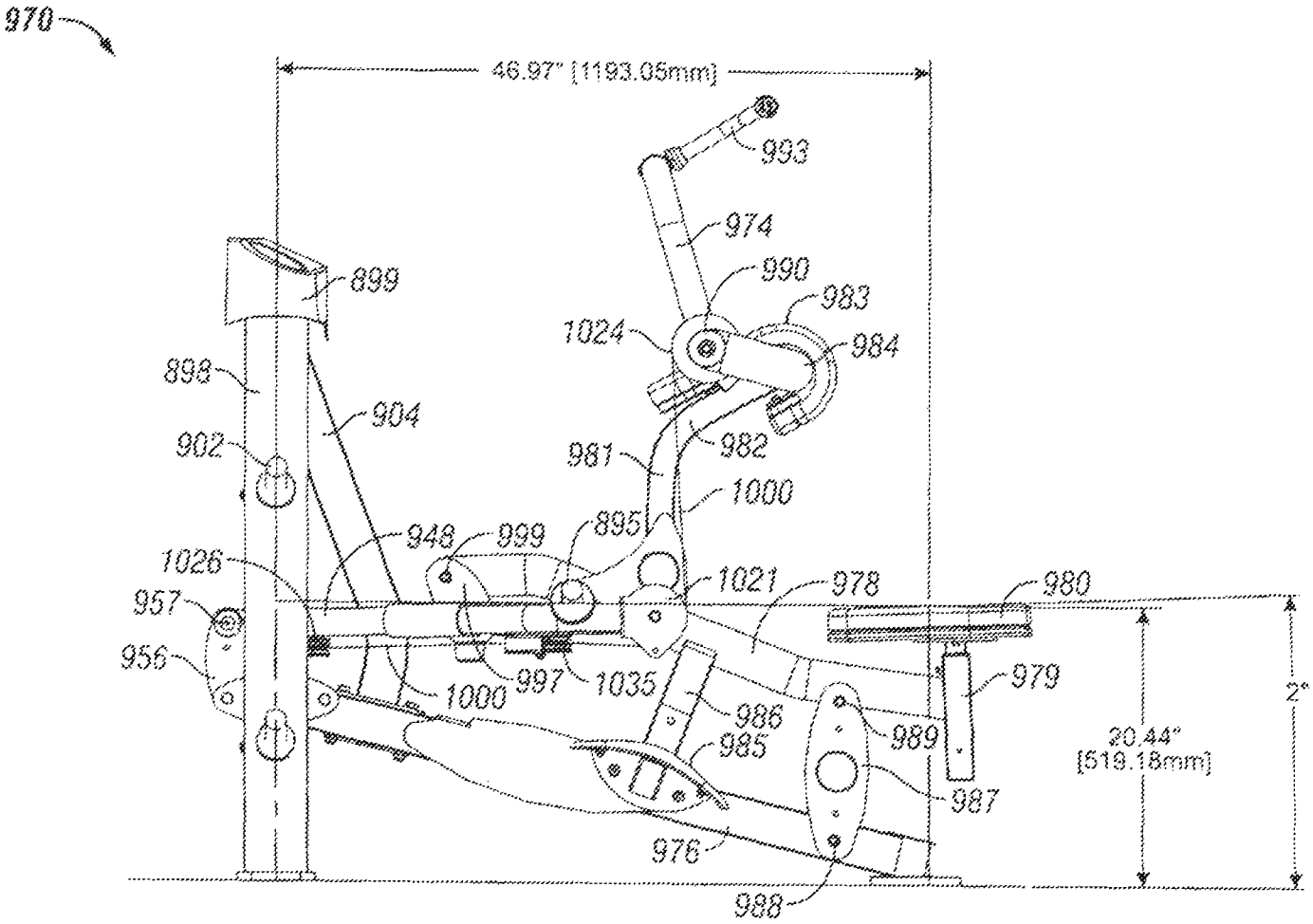
FIG. 92B is a side elevation view of the machine similar to FIG. 92A but illustrating the end position of a biceps curl exercise.

As illustrated by the dimensions marked in FIGS. 92A and 92B, the user support 972, and thus a user seated on the user support, move both downward and forward between the start and end positions of the exercise. The downward motion is around half an inch, and the forward motion is around 0.3 inches, as can be seen by comparing the start and end dimensions shown on these drawings. The downward movement of the user support during the exercise makes it easier for users of lower strength, such as women, to perform a biceps curl exercise. At the same time, seat pad 980 rotates through an angle of around eight degrees, starting at an inclination of ten degrees to the horizontal and ending at an inclination of around two degrees to the horizontal orientation in the illustrated embodiment.

In each of the above embodiments, the machine has a user support which is pivotally mounted for pivotal movement relative to a main frame, and a connecting linkage which translates movement of the exercise arm or user engagement device into movement of the user support. The exercises may be compound or isolation exercises. In each embodiment, a movable lifting arm is associated with at least one of the other moving parts so as to be moved during an exercise. The lifting arm is associated with a load providing exercise resistance. In some embodiments, the lifting arm is part of the connecting linkage which translates movement of the user engagement device into movement of the user support, while in others it is linked to the user support or user engagement device independent from the connecting linkage.

Exercise machines of the above embodiments all have a vertical gravitational center line extending through the pivot axis (where there is a single user support pivot) or theoretical pivot axis (where there is a multiple pivot assembly for the user support). In at least some embodiments, the gravitational centerline of the user support's pivotal movement is positioned so that the combined weight of the user support and user is distributed on both sides of the gravitational centerline in at least one of the exercise start and end positions. Because of this arrangement, the user support provides a counter-balancing effect on the exercise arm as it moves and its weight is re-distributed. This balanced weight distribution positions a portion of the user and user support on each side of the gravitational centerline in either the start or end position, or both the start and end position. As the exercise arm is moved, a portion of this combined weight passes through the gravitational centerline redistributing the weight. This redistribution is gradual and continuous throughout the exercise motion and is not noticed by the user.

The user support frame has a primary user support which supports the majority of the user's weight in at least one of the start and end positions of the exercise, as well as at least one secondary user support which stays in the same position relative to the primary user support throughout the exercise, and supports a spaced portion of the user's body. An additional user support which supports another part of the user's body may also be provided. The multiple user supports provide secure and safe positioning, placing the user in the proper exercise alignment from start to finish, without any adjustment required by the user. The primary and secondary supports may be a seat pad and back pad, a seat pad and chest pad, a seat pad and arm pad, a seat pad and foot support, a back pad and shoulder pads, or other combinations of supports. The primary and secondary support travel together in fixed alignment to keep the user in the same position throughout the exercise motion so that the user does not have to worry about balancing on a moving platform or pad. In some embodiments, more than two user support portions may be provided on the user support frame, and also travel together with the primary and secondary supports for increased stability. For example, in some embodiments a foot plate to provide a rest for the user's feet during travel of the user support may be provided in addition to a back pad, chest pad, or arm pad, or hand grips may be provided in addition to a back pad.

In each machine, the connecting linkage which translates the user engagement device movement into movement of the user support is associated with at least two of the user engagement device, user support, and main frame. In some embodiments, the connecting linkage is associated with all three of the user engagement device, user support, and main frame. The connecting linkage may have multiple parts or comprise a single rigid link, articulated links, a flexible link, and the like, and the connecting linkage may be made adjustable. Where the lifting arm is part of the connecting linkage, it may be directly pivoted to the user support and linked to the user engagement device by a rigid pivoted link or a flexible link, or may be linked to the user support by a rigid pivot link or flexible link, or may be linked to both the user support and user engagement device by respective flexible links or pivoted rigid links.

The exercise arm or user engagement device could be unidirectional or bi-directional, and may be in one piece (dependent) or two pieces for independent arm movement. The exercise arm may be mounted on the user support, main frame, or connecting linkage, and the exercise arm movement may be rotational, linear, converging, or diverging, and may be user-defined. The user engagement device may be partially flexible, completely flexible or articulated to allow user-defined movement of the user engagement device, or may be rigid exercise arms. In those stations where the exercise arm is engaged by the user's hands rather than their feet, the handles may be rigid or flexible, and may self-align during an exercise. The exercise arm may provide for two-dimensional or three-dimensional movement. The user engagement device or exercise arm may be bi-directional to perform different exercises and require adjustment by the user to convert from one exercise to another, or may require no adjustment.

The exercise machines in the above embodiments may be a stand-alone unit, part of a multi-station gym, or may be optional attachments to another machine. Each machine may have one user engagement device or exercise arm, or may have additional exercise arms which may be used to perform another exercise.

In the above embodiments, operation of the user engagement device causes a rocking movement of the user support. Due to the position of the user support pivot or the theoretical pivot in some embodiments, the movement of the user and user support has only a small effect on the exercise resistance felt by the user, and there is no high resistance to be overcome in starting the exercise, or large resistance drop-off. In all of the embodiments, the rocking movement of the user support recruits core stabilizing muscles and also makes the exercise enjoyable to perform, while the actuation of the lifting arm to lift the exercise resistance provides visual feedback of the effect of the exercise. Repetitious exercise movement can be tedious and boring. By adding motion to the user support, as well as a lifting arm, without any large increase or change in resistance felt during the exercise, performing the exercise is more enjoyable and the user's interest in their workout increases. This is a benefit both to the individual exerciser, who may be motivated to exercise more regularly, and the fitness facility, where retention of members is a primary objective.

It should be understood that all the different elements used in the various embodiments may be mixed and interchanged with one another, and different types and forms of components could be used without affecting the scope of the invention. Cables could be replaced with belts, ropes, chains, or the like, and pulleys could be replaced with sprockets. The seat and/or back pad could be fixed or made adjustable. Various different types of user engaging pads can be used.

The user support and user engagement device could be designed to travel in the same or opposite directions. The user support pivot mount may have a single pivot or multiple pivots, and in the latter case the user support pivots about a theoretical pivot mount of the combined pivotal motion. Any of the various embodiments could have the resistance associated with any of the moving parts (user support, user engagement device, or connecting linkage). The exercise resistance may be a weight stack linked to the lifting arm by a cable and pulley arrangement, weight plates directly loaded on weight pegs on the lifting arm, or may be hydraulic. Any other type of resistance known in the art may alternatively be used, such as weight plates, pneumatic, electromagnetic, or elastic bands, in place of the weight stack, weight plates, or hydraulic resistance.

In each machine, the user support is positioned relatively low to the ground in the start and end position, making the stations quicker, easier, and safer to enter and exit. The user does not have to climb up or down in order to get into, or out of, the exercise position. The low profile also makes the machines more economical to produce and less intimidating to the user. The user's position is continuously adjusted throughout the exercise. The combined exercise arm and user support movement produces an automatic and continuous self-aligning exercise motion.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

We claim:

1. An exercise machine comprising:

a stationary main frame;

a user support pivotally mounted relative to the mainframe and configured to move in a predetermined user support path during an exercise;

the user support having at least a primary support and a secondary support which are adapted to engage different parts of a user's body and which move together throughout an exercise movement, the primary support adapted to support the majority of the user's weight in the exercise start position;

at least one user engagement device movably mounted relative to the main frame which is adapted for engagement by the user in performing exercises;

a connecting linkage which translates movement of the user engagement device into movement of the user support;

at least one lifting arm movably mounted relative to the main frame and configured to move in a second path different from the user support path during an exercise, the lifting arm being associated with at least one of the user support, user engagement device, and connecting linkage, whereby the lifting arm moves in response to movement of at least one of the user support, user engagement device, and connecting linkage; and a load which resists movement of the lifting arm, wherein the lifting arm is associated with the user engagement device and movement of the user engagement device results in movement of the lifting arm, further comprising a connecting link between the user engagement device and the lifting arm, the connecting link having a pivotal connection to the user engagement device.

2. An exercise machine comprising:

a stationary main frame;

a user support pivotally mounted relative to the mainframe and configured to move in a predetermined user support path during an exercise;

the user support having at least a primary support and a secondary support which are adapted to engage different parts of a user's body and which move together throughout an exercise movement, the primary support adapted to support the majority of the user's weight in the exercise start position;

at least one user engagement device movably mounted relative to the main frame which is adapted for engagement by the user in performing exercises;

a connecting linkage which translates movement of the user engagement device into movement of the user support;

at least one lifting arm movably mounted relative to the main frame and configured to move in a second path different from the user support path during an exercise, the lifting arm being associated with at least one of the user support, user engagement device, and connecting linkage, whereby the lifting arm moves in response to movement of at least one of the user support, user engagement device, and connecting linkage; and a load which resists movement of the lifting arm, wherein the lifting arm is associated with the user engagement device and movement of the user engagement device results in movement of the lifting arm, further comprising a connecting link between the user engagement device and the lifting arm, the connecting link have a pivotal connection to the lifting arm.

3. An exercise machine comprising:

a stationary main frame;

a user support pivotally mounted relative to the mainframe and configured to move in a predetermined user support path during an exercise;

the user support having at least a primary support and a secondary support which are adapted to engage different parts of a user's body and which move together throughout an exercise movement, the primary support adapted to support the majority of the user's weight in the exercise start position;

at least one user engagement device movably mounted relative to the main frame which is adapted for engagement by the user in performing exercises;

a connecting linkage which translates movement of the user engagement device into movement of the user support;

at least one lifting arm movably mounted relative to the main frame and configured to move in a second path different from the user support path during an exercise, the lifting arm being associated with at least one of the user support, user engagement device, and connecting linkage, whereby the lifting arm moves in response to movement of at least one of the user support, user engagement device, and connecting linkage; and a load which resists movement of the lifting arm, wherein the lifting arm is associated with the user engagement device and movement of the user engagement device results in movement of the lifting arm, further comprising a connecting link having a first pivotal connection to the user engagement device and a second pivotal connection to the lifting arm.

4. An exercise machine comprising:

a stationary main frame;

a user support pivotally mounted relative to the mainframe and configured to move in a predetermined user support path during an exercise;

the user support having at least a primary support and a secondary support which are adapted to engage different parts of a user's body and which move together throughout an exercise movement, the primary support adapted to support the majority of the user's weight in the exercise start position;

at least one user engagement device movably mounted relative to the main frame which is adapted for engagement by the user in performing exercises;

a connecting linkage which translates movement of the user engagement device into movement of the user support;

at least one lifting arm movably mounted relative to the main frame and configured to move in a second path different from the user support path during an exercise, the lifting arm being associated with at least one of the user support, user engagement device, and connecting linkage, whereby the lifting arm moves in response to movement of at least one of the user support, user engagement device, and connecting linkage; and a load which resists movement of the lifting arm, wherein the lifting arm comprises one or more weight pegs for receiving one or more selected weights.

5. The exercise machine of claim 4, wherein the lifting arm further comprises one or more rods pivotally mounted on the main frame, each rod having an outwardly directed weight peg for receiving one or more selected weights.

6. An exercise machine comprising:

a stationary main frame;

a user support pivotally mounted relative to the mainframe and configured to move in a predetermined user support path during an exercise;

the user support having at least a primary support and a secondary support which are adapted to engage different parts of a user's body and which move together throughout an exercise movement, the primary support adapted to support the majority of the user's weight in the exercise start position;

at least one user engagement device movably mounted relative to the main frame which is adapted for engagement by the user in performing exercises;

a connecting linkage which translates movement of the user engagement device into movement of the user support;

at least one lifting arm movably mounted relative to the main frame and configured to move in a second path different from the user support path during an exercise, the lifting arm being associated with at least one of the user support, user engagement device, and connecting linkage, whereby the lifting arm moves in response to movement of at least one of the user support, user engagement device, and connecting linkage;

a load which resists movement of the lifting arm;

a pivot mount on the main frame which pivotally connects the lifting arm to the main frame, the lifting arm being linked to the load at a location spaced from the pivot mount; and a connecting link between the user engagement device and the lifting arm, the connecting link having a pivotal connection to the lifting arm at a location spaced from the pivot mount on the main frame.

7. An exercise machine comprising:

a stationary main frame;

a user support pivotally mounted relative to the mainframe and configured to move in a predetermined user support path during an exercise;

the user support having at least a primary support and a secondary support which are adapted to engage different parts of a user's body and which move together throughout an exercise movement, the primary support adapted to support the majority of the user's weight in the exercise start position;

at least one user engagement device movably mounted relative to the main frame which is adapted for engagement by the user in performing exercises;

a connecting linkage which translates movement of the user engagement device into movement of the user support;

at least one lifting arm movably mounted relative to the main frame and configured to move in a second path different from the user support path during an exercise, the lifting arm being associated with at least one of the user support, user engagement device, and connecting linkage, whereby the lifting arm moves in response to movement of at least one of the user support, user engagement device, and connecting linkage; and a load which resists movement of the lifting arm, wherein the user engagement device comprises one or more pivot brackets which are pivotally mounted on the main frame, and wherein the user engagement device further comprises one or more exercise arms secured to a forward end of any of the one or more pivot brackets, and wherein the connecting linkage comprises a connecting link between any one or more pivot brackets and the user support, wherein the connecting link is mounted on any one or more pivot brackets at a location forward of the pivot bracket's pivotal mounting location on the main frame.

8. The exercise machine of claim 7, wherein the connecting link is mounted on any one or more pivot brackets at a location rearward of the location where the one or more exercise arms are secured.

9. An exercise machine comprising:

a stationary main frame;

a user support pivotally mounted relative to the mainframe and configured to move in a predetermined user support path during an exercise;

the user support having at least a primary support and a secondary support which are adapted to engage different parts of a user's body and which move together throughout an exercise movement, the primary support adapted to support the majority of the user's weight in the exercise start position;

at least one user engagement device movably mounted relative to the main frame which is adapted for engagement by the user in performing exercises;

a connecting linkage which translates movement of the user engagement device into movement of the user support;

at least one lifting arm movably mounted relative to the main frame and configured to move in a second path different from the user support path during an exercise, the lifting arm being associated with at least one of the user support, user engagement device, and connecting linkage, whereby the lifting arm moves in response to movement of at least one of the user support, user engagement device, and connecting linkage;

a load which resists movement of the lifting arm, and wherein the user engagement device comprises one or more pivot brackets which are pivotally mounted on the main frame; and a connecting link between any one or more pivot brackets and the lifting arm.

10. The exercise machine of claim 9, wherein the connecting link is mounted on the one or more pivot brackets at a location rearward of the pivot bracket's pivotal mounting location on the main frame.

11. An exercise machine comprising:

a stationary main frame;

a user support pivotally mounted relative to the mainframe and configured to rotate in a predetermined user support path during an exercise;

the user support having at least a primary support and a secondary support which are adapted to engage different parts of a user's body and which move together throughout an exercise movement, the primary support adapted to support the majority of the user's weight in the exercise start position;

at least one user engagement device movably mounted relative to the main frame which is adapted for engagement by the user in performing exercises;

a first connecting link between the user engagement device and the user support which translates movement of the user engagement device into movement of the user support;

at least one lifting arm movably mounted relative to the main frame and configured to move in a second path different from the user support path during an exercise;

a second connecting link between the user engagement device and the lifting arm which translates movement of the user engagement device into movement of the user support; and a load which resists movement of the lifting arm, wherein the lifting arm comprises one or more rods pivotally mounted on the main frame, each rod having an outwardly directed weight peg for receiving one or more selected weights, and wherein the rods are secured together by a cross bar.

12. The exercise machine of claim 11, wherein a first stop is associated with the cross bar and rests on a second stop associated with the main frame when the exercise machine is in the exercise start position.

13. The exercise machine of claim 11, wherein a first stop is associated with the cross bar and engages a second stop associated with the main frame to limit upward movement of the lifting arm.

14. An exercise machine comprising:

a stationary main frame;

a user support pivotally mounted relative to the mainframe and configured to rotate in a predetermined user support path during an exercise;

the user support having at least a primary support and a secondary support which are adapted to engage different parts of a user's body and which move together throughout an exercise movement, the primary support adapted to support the majority of the user's weight in the exercise start position;

at least one user engagement device movably mounted relative to the main frame which is adapted for engagement by the user in performing exercises;

a first connecting link between the user engagement device and the user support which translates movement of the user engagement device into movement of the user support;

at least one lifting arm movably mounted relative to the main frame and configured to move in a second path different from the user support path during an exercise;

a second connecting link between the user engagement device and the lifting arm which translates movement of the user engagement device into movement of the user support; and a load which resists movement of the lifting arm wherein the second connecting link is rigid.

15. An exercise machine comprising:

a stationary main frame;

a user support pivotally mounted relative to the mainframe and configured to rotate in a predetermined user support path during an exercise;

at least one user engagement device adapted for engagement by the user in performing exercises;

the user engagement device comprising one or more pivot brackets which are pivotally mounted on the main frame;

a first connecting link between any of the one or more pivot brackets and the user support which translates movement of the user engagement device into movement of the user support;

at least one lifting arm movably mounted relative to the main frame and configured to move in a second path different from the user support path during an exercise;

a second connecting link between any of the one or more pivot brackets and the lifting arm which translates movement of the user engagement device into movement of the user support; and a load which resists movement of the lifting arm wherein the first connecting link is pivotally mounted to the one or more pivot brackets at a location forward of the pivot bracket's pivotal mounting location on the main frame.

16. An exercise machine comprising:

a stationary main frame;

a user support pivotally mounted relative to the mainframe and configured to rotate in a predetermined user support path during an exercise;

at least one user engagement device adapted for engagement by the user in performing exercises;

the user engagement device comprising one or more pivot brackets which are pivotally mounted on the main frame;

a first connecting link between any of the one or more pivot brackets and the user support which translates movement of the user engagement device into movement of the user support;

at least one lifting arm movably mounted relative to the main frame and configured to move in a second path different from the user support path during an exercise;

a second connecting link between any of the one or more pivot brackets and the lifting arm which translates movement of the user engagement device into movement of the user support; and a load which resists movement of the lifting arm wherein the second connecting link is pivotally mounted to the one or more pivot brackets at a location rearward of the pivot bracket's pivotal mounting location on the main frame.

17. An exercise machine comprising:

a stationary main frame;

a user support pivotally mounted relative to the mainframe and configured to rotate in a predetermined user support path during an exercise;

at least one user engagement device adapted for engagement by the user in performing exercises;

the user engagement device comprising one or more pivot brackets which are pivotally mounted on the main frame;

a first connecting link between any of the one or more pivot brackets and the user support which translates movement of the user engagement device into movement of the user support;

at least one lifting arm movably mounted relative to the main frame and configured to move in a second path different from the user support path during an exercise;

a second connecting link between any of the one or more pivot brackets and the lifting arm which translates movement of the user engagement device into movement of the user support; and a load which resists movement of the lifting arm wherein the user engagement device further comprises one or more exercise arms secured to a forward end of any of the one or more pivot brackets.

18. The exercise machine of claim 17, wherein the first connecting link is pivotally mounted to the one or more pivot brackets at a location forward of the pivot bracket's pivotal mounting location on the main frame and rearward of the location where the one or more exercise arms are secured.

19. The exercise machine of claim 17, wherein the first connecting link is pivotally mounted to the one or more pivot brackets at a location forward of both the pivot bracket's pivotal mounting location on the main frame and the location where the one or more exercise arms are secured.

* * * * *